US007220536B2

(12) United States Patent
Kuwano et al.

(10) Patent No.: US 7,220,536 B2
(45) Date of Patent: May 22, 2007

(54) SILVER SALT PHOTOTHERMOGRAPHIC DRY IMAGING MATERIAL, THERMAL DEVELOPMENT METHOD OF THE SAME, AND THERMAL DEVELOPMENT APPARATUS FOR THE SAME

(75) Inventors: Koji Kuwano, Hachioji (JP); Takayuki Sasaki, Hachioji (JP); Kazuhiro Kido, Hino (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 0 days.

(21) Appl. No.: 11/251,701

(22) Filed: Oct. 17, 2005

(65) Prior Publication Data

US 2006/0088785 A1 Apr. 27, 2006

(30) Foreign Application Priority Data

Oct. 22, 2004 (JP) ..... 2004-307905
Mar. 23, 2005 (JP) ..... 2005-083351

(51) Int. Cl.
*G03C 5/16* (2006.01)
*G03C 1/00* (2006.01)
*G03C 1/005* (2006.01)
*G03C 1/494* (2006.01)

(52) U.S. Cl. ..... 430/348; 430/349; 430/350; 430/617; 430/618; 430/619; 430/620; 430/570; 430/627; 430/631

(58) Field of Classification Search ..... 430/617–620, 430/567, 570, 627, 631, 348, 345, 350
See application file for complete search history.

(56) References Cited

U.S. PATENT DOCUMENTS

| | | | |
|---|---|---|---|
| 3,152,904 | A | 10/1964 | Sorensen et al. |
| 3,445,234 | A | 5/1969 | Cescon et al. |
| 3,457,075 | A | 7/1969 | Morgan et al. |
| 3,589,903 | A | 6/1971 | Birkeland |
| 3,593,863 | A | 7/1971 | Kintner |
| 3,672,904 | A | 6/1972 | de Mauriac |
| 3,770,448 | A | 11/1973 | Poot et al. |
| 3,773,512 | A | 11/1973 | Poot et al. |
| 3,801,321 | A | 4/1974 | Evans et al. |
| 3,846,136 | A | 11/1974 | Sullivan |
| 3,994,732 | A | 11/1976 | Winslow |
| 4,003,749 | A | 1/1977 | Masuda et al. |
| 4,009,039 | A | 2/1977 | Masuda et al. |
| 4,021,249 | A | 5/1977 | Noguchi et al. |
| 4,021,250 | A | 5/1977 | Sashihara et al. |
| 4,022,617 | A | 5/1977 | McGuckin |
| 4,123,282 | A | 10/1978 | Winslow |
| 4,368,247 | A | 1/1983 | Fletcher, Jr. et al. |
| 4,452,885 | A | 6/1984 | Nozawa et al. |
| 4,461,681 | A | 7/1984 | Barber |
| 4,515,888 | A | 5/1985 | Beretta et al. |
| 4,536,473 | A | 8/1985 | Mihara |
| 4,546,075 | A | 10/1985 | Kitaguchi et al. |
| 4,639,414 | A | 1/1987 | Sakaguchi |
| 4,740,455 | A | 4/1988 | Kubodera et al. |
| 4,741,966 | A | 5/1988 | Cavezzan |
| 4,751,175 | A | 6/1988 | Aotsuka et al. |
| 4,835,096 | A | 5/1989 | Lea |
| 4,959,294 | A | 9/1990 | Lea et al. |
| 5,244,773 | A | 9/1993 | Muramatsu et al. |
| 5,264,337 | A | 11/1993 | Maskasky |
| 5,314,798 | A | 5/1994 | Brust et al. |
| 5,320,958 | A | 6/1994 | Inouye et al. |
| 5,460,938 | A | 10/1995 | Kirk et al. |
| 5,464,738 | A | 11/1995 | Lynch et al. |
| 5,496,695 | A | 3/1996 | Simpson et al. |
| 6,350,561 | B1 | 2/2002 | Miller et al. |
| 6,352,819 | B1 | 3/2002 | Kenney et al. |
| 6,352,820 | B1 | 3/2002 | Bauer et al. |
| 2004/0058281 | A1 | 3/2004 | Yamane et al. |
| 2006/0029892 | A1 * | 2/2006 | Kuwano et al. ..... 430/619 |

FOREIGN PATENT DOCUMENTS

| | | | |
|---|---|---|---|
| JP | 10-500497 | A | 1/1998 |
| JP | 11-295844 | A | 10/1999 |
| JP | 11-352627 | A | 12/1999 |
| JP | 2001-209145 | A | 8/2001 |
| JP | 2002-06443 | A | 1/2002 |
| JP | 2002-162692 | A | 6/2002 |
| JP | 2003-066558 | A | 3/2003 |
| JP | 2003-270755 | A | 9/2003 |
| JP | 2003-287862 | A | 10/2003 |
| JP | 2004-004522 | A | 1/2004 |
| JP | 2004-085763 | A | 3/2004 |

* cited by examiner

*Primary Examiner*—Geraldina Visconti
(74) *Attorney, Agent, or Firm*—Frishauf, Holtz, Goodman & Chick, P.C.

(57) ABSTRACT

A photothermographic imaging material comprising a support having thereon, (a) a photosensitive layer containing an organic silver salt, photosensitive silver halide grains, a reducing agent and a binder, (b) a light-insensitive layer, and (c) a protective layer, wherein a weight reducing value from 25° C. to 100° C. by a heat drying weight measurement of the photographic imaging material is not more than 0.4% based on a weight value at 25° C.

29 Claims, 7 Drawing Sheets

FIG. 8 ( a )
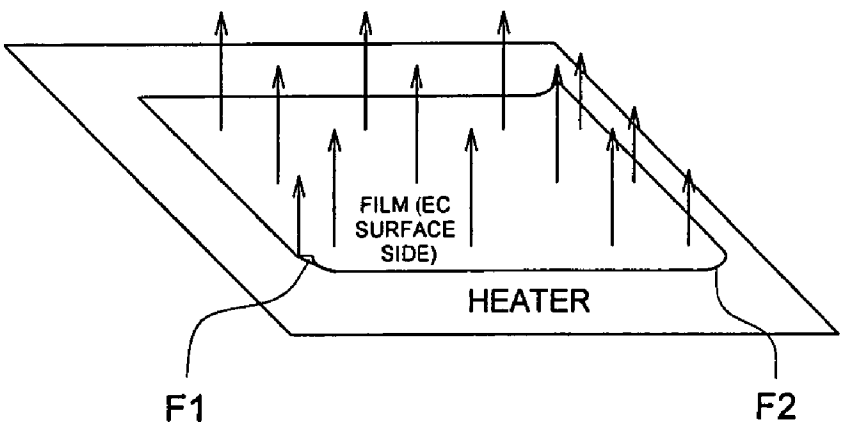
FIG. 8 ( b )
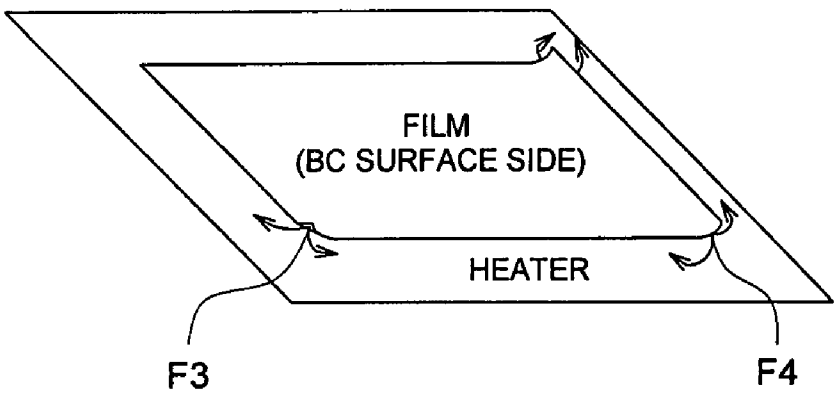

SILVER SALT PHOTOTHERMOGRAPHIC DRY IMAGING MATERIAL, THERMAL DEVELOPMENT METHOD OF THE SAME, AND THERMAL DEVELOPMENT APPARATUS FOR THE SAME

This application is based on Japanese Patent Application Nos. 2004-307905 filed on Oct. 22, 2004, 2005-083351 filed on Mar. 23, 2005.

FIELD OF THE INVENTION

The present invention relates to a silver salt photothermographic dry imaging material, a thermal developing method of the photothermographic material, and a thermal developing apparatus for the same.

BACKGROUND OF THE INVENTION

Heretofore, in the medical and printing plate making fields, effluent resulting from wet type processing for image forming materials became problematic in terms of workability, and in recent years, from the viewpoint of environmental protection as well as space saving, a decrease in processing effluent has been highly demanded. Accordingly, a silver salt photothermographic dry imaging material, which can perform image formation only by heating, has been brought into practical use and rapidly prevailing in the above fields.

A photothermographic dry imaging material itself has been proposed for a long time (for example, please refer to Patent Documents 1 and 2). This silver salt photothermographic dry imaging material is generally processed with a thermal development processor, which forms images by applying stable heat to said material and is called as a laser imager. As described above, a great number of laser imagers have been supplied on the market in accordance with rapid pervasion in recent years. Further, in recent years, improvements for more compact size and more rapid processing of laser imagers are required.

Therefore, improvement of characteristics of photothermographic dry imaging material is indispensable. To obtain sufficient density of a photographic image even with rapid processing, it is effective to increase covering power by increasing coloring points by use of silver halide grains having a small mean grain size (for example, refer to Patent Documents 3 and 4), to utilize a highly reactive reducing agent provided with a secondary or tertiary alkyl group (for example, refer to Patent Document 5), or to utilize a development accelerator such as phenol derivatives and naphthol derivatives (for example, refer to such as Patent Documents 6 and 7). Further, in a photothermographic dry imaging material utilizing photosensitive silver halide grains, there is a problem of deterioration of light irradiation image lasting quality (storage stability when an image obtained by thermal development is used in a daylight room for such as diagnosis or stored in a daylight room) because of remaining silver halide grains in a photosensitive layer even after thermal development, and it has been tried to solve this problem (for example, refer to Patent Documents 8 and 9).

Further, disclosed is a thermal development apparatus which develops a film, on which a latent image has been formed, by heating a silver salt photothermographic dry imaging material from the EC surface (the emulsion surface) while being slid between a heating drum and a plural number of opposing rollers (for example, refer to Patent Document 10). Disclosed is a thermal development apparatus in which a fixed heater divided into three parts is utilized instead of the foregoing heating drum, the BC surface side (the substrate surface side) of a film is heated while being slid on said heater (for example, refer to Patent Document 11). In conventional thermal development apparatuses, thermal development time was generally approximately 14 seconds (a length in the transportation direction of 17 inches), and further speed up of a thermal development process is required. However, in these Patent Documents, measures for rapid thermal development are neither indicated nor disclosed. As measures for rapid processing from the apparatus aspect, disclosed are techniques such as to perform thermal development while transporting a film at not less than 23 mm/sec, and to perform thermal development simultaneous with exposure (for example, refer to Patent Documents 12 and 13). However, since a distance between an exposure section and a development section is short, low molecular weight components in a thermally developable photosensitive material, which are generated from a film by thermal development, will influence to as far as the exposure section, which results in a problem of generating contamination of an exposure apparatus; and attempts have been tried to solve this problem (for example, refer to Patent Documents 14 and 15).

[Patent Document 1] U.S. Pat. No. 3,152,904
[Patent Document 2] U.S. Pat. No. 3,457,075
[Patent Document 3] JP-A 11-295844 (hereinafter, JP-A refers to Unexamined Japanese Patent Publication No.)
[Patent Document 4] JP-A 11-352627
[Patent Document 5] JP-A 2001-209145
[Patent Document 6] JP-A 2002-006443
[Patent Document 7] JP-A 2003-066558
[Patent Document 8] JP-A 2003-270755
[Patent Document 9] JP-A 2004-004522
[Patent Document 10] Japanese Translation of PCT International Application Publication No. 10-500497
[Patent Document 11] JP-A 2003-287862
[Patent Document 12] US Patent Application Publication No. 2004/58,281
[Patent Document 13] JP-A 2004-085763
[Patent Document 14] JP-A 2002-162692
[Patent Document 15] JP-A 2004-085763

SUMMARY OF THE INVENTION

This invention has been made in view of the above-described background, and an object is to provide a silver salt photothermographic dry imaging material, a thermal development method and a thermal development apparatus thereof, which exhibits minimum contamination of the interior of an imager, low level of odor as well as high abrasion resistance during performing a thermal development process, and also excellent image keeping stability after development.

BRIEF DESCRIPTION OF THE DRAWINGS

Embodiments will now be described, by way of example only, with reference to the accompanying drawings which are meant to be exemplary, not limiting and wherein like elements numbered alike in several Figures, in which:

FIG. 8(*a*) is a drawing to schematically show the state of emulsion surface side open (EC surface open) and opposing-to-emulsion surface side heated (BC surface heated) of a photothermographic imaging material, and FIG. 8(*b*) is a drawing to schematically show the state of opposing-to-emulsion surface side open (BC surface open) and emulsion surface side heated (EC surface heated) of a silver salt photothermographic dry imaging matrial, for comparison.

Figure 1:
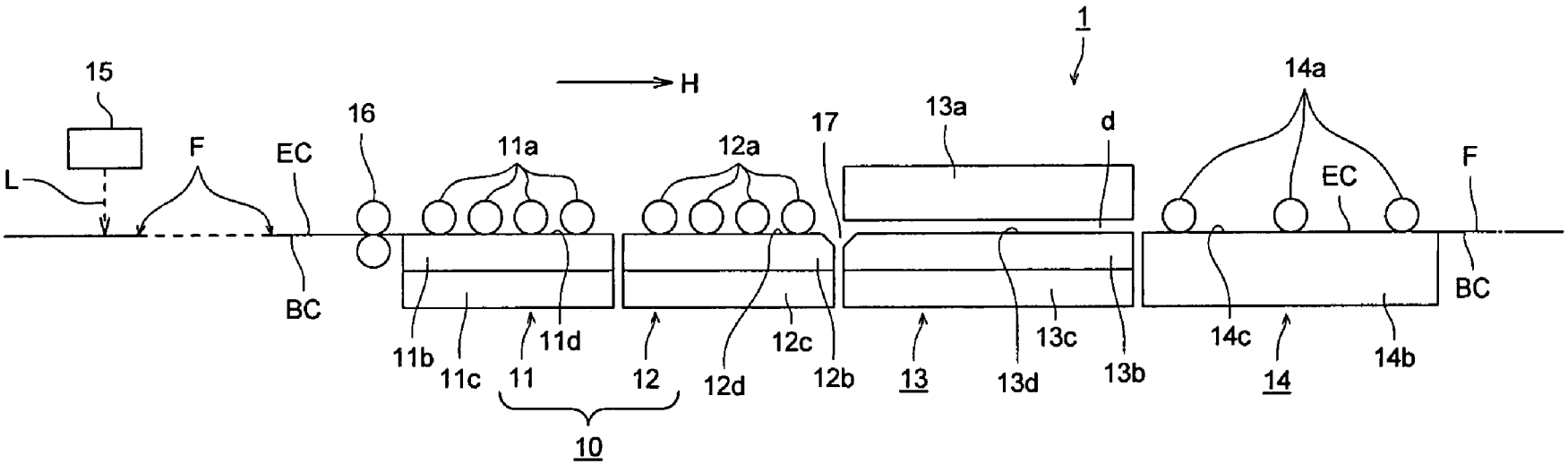
FIG. 1 is a side-view drawing to schematically show the primary portion of a thermal development apparatus according to this invention.

The above object of this invention can be achieved by the following constitutions.

Item 1. A photothermographic imaging material comprising a support having thereon:

(a) a photosensitive layer containing an organic silver salt, photosensitive silver halide grains, a reducing agent and a binder, (b) a light-insensitive layer, and (c) a protective layer, wherein a weight reducing value from 25° C. to 100° C. by a heat drying weight measurement of the photographic imaging material is not more than 0.4% based on a weight value at 25° C.

Item 2. The photothermographic imaging material of Item 1, wherein the weight reducing value from 100° C. to 120° C. by the heat drying weight measurement of the photographic imaging material is not more than 0.04% based on the weight value at 25° C.

Item 3. The photothermographic imaging material of Item 1 or 2, wherein the light-insensitive layer comprises a cross-linking agent.

Item 4. The photothermographic imaging material of any one of Items 1 to 3, wherein the protective layer comprises tabular grains.

Item 5. The photothermographic imaging material of any one of Items 1 to 4, wherein the photosensitive silver halide grains are silver halide grains convertible from internal latent-image type grains to surface latent-image type grains after the thermal development process.

Item 6. The photothermographic imaging material of any one of Items 1 to 5, exhibiting a total dry thickness of the photosensitive layer and the light-insensitive layer of not less than 10 μm and not more than 20 μm.

Item 7. The photothermographic imaging material of any one of Items 1 to 6 exhibiting the total dry thickness of the photosensitive layer of not less than 9 μm and not more than 16 μm.

Item 8. The photothermographic imaging material of any one of Items 1 to 7, wherein as silver halide grains, the photosensitive layer contains thermally convertible interior latent-image type silver halide grains surface sensitivity of which is reduced from that of before thermal development by conversion from the surface latent-image type to the interior latent-image type after the thermal development process.

Item 9. The photothermographic imaging material of any one of Items 1 to 8, exhibits a relative ratio ($S_2/S_1$) of not more than 1/10, wherein sensitivity $S_1$ is determined from characteristic curves which are obtained by thermal development with common thermal development conditions after exposure of the photothermographic material, exposure being conducted by white light or light of a specific spectral sensitized region through an optical wedge, or by laser light changing illumination intensity on the surface of the photosensitive layer in incremental steps; and sensitivity $S_2$ is determined from characteristic curves which are obtained by thermal development under the same conditions as above thermal development after exposure under the same exposure conditions as above exposure, except that exposure is conducted after heating of the photothermographic material under the same conditions as above thermal development.

Item 10. The photothermographic imaging material of any one of Items 1 to 9, wherein in the interior of the silver halide grains, contained are dopants which function as electron traps after thermal development.

Item 11. The photothermographic imaging material of any one of Items 1 to 10, wherein a compound represented by Formula (SE1) or Formula (SE2) is incorporated as a silver saving agent:

$$Q_1\text{-NHNH-}Q_2 \qquad \text{Formula (SE1)}$$

wherein $Q_1$ is an aromatic group bonding with —NHNH-Q2 at a carbon atom site or a heterocycle group; $Q_2$ is a carbamoyl group, an acyl group, an alkoxycarbonyl group, an aryloxycarbonyl group, a sulfonyl-group or a sulfamoyl group;

Formula (SE2)

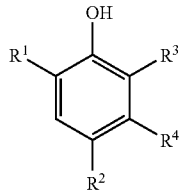

wherein $R^1$ is an alkyl group, an acyl group, an acylamino group, a sufonamide group, an alkoxycarbonyl group, or a carbamoyl group; $R^2$ is a hydrogen atom, a halogen atom, an alkyl group, an alkoxy group, an aryloxy group, an alkylthio group, an arylthio group, an acyloxy group, or ester carbonate; and $R^3$ and $R^4$ are each a substituent group capable of substituting to a benzene ring and may form a condensed ring combining each other.

Item 12. The photothermographic imaging material of any one of Items 1 to 11, wherein the photosensitive layer contains a binder exhibiting a glass-transition temperature (Tg) of 70 to 150° C.

Item 13. The photothermographic imaging material of any one of Items 1 to 12, wherein a compound represented by Formula (SF) is incorporated:

$$(R_f\text{-}(L_1)n_1\text{-})_p\text{-}(Y)m_1\text{-}(A)_q \qquad \text{Formula (SF)}$$

wherein $R_f$ is a substituent group containing a fluorine atom, $L_1$ is a divalent linking group not containing a fluorine atom, Y is a (p+Q) valent linking group containing no fluorine atom, A is an anion group or its salt, $n_1$ and $m_1$ are each an integer of 0 or 1, p and q are each an integer of 1 to 3, but when q is 1, $n_1$ and $m_1$ are not zero at the same time.

Item 14. The photothermographic imaging material of any one of Items 1 to 13, wherein an average grain diameter of the silver halide grains contained in the photosensitive layer is 10 to 50 nm.

Item 15. The photothermographic imaging material of Item 14, wherein the photosensitive layer further contains silver halide grains exhibiting an average grain diameter of 55 to 100 nm.

Item 16. The photothermographic imaging material of any one of Items 1 to 14, wherein a portion of the silver halide grains contained in the photosensitive layer is provided with chemical sensitization employing a chalcogen compound.

Item 17. A method of development of the photothermographic imaging material of any one of Items 1 to 16, comprising the steps of:

(a) exposing the photothermographic imaging material, and (b) developing the exposed photothermographic material using a thermal development apparatus having a distance from an exposure section to a development section of 0 to 20 cm.

Item 18. A method of thermal development of a photothermographic imaging material of any one of Items 1 to 16, further exhibiting a weight reducing value from 25° C. to 100° C. by a heat drying weight measurement of not more than 0.4% based on a weight value at 25° C., comprising the steps of:

(a) exposing the photothermographic material, (b) heating the exposed photothermographic material within a heating time of 0.5 to 10 seconds, and (c) cooling the heated material, wherein a side of the photothermographic material coated with the photosensitive layer is open to the air, and heating is conducted from the opposite side of the photosensitive layer.

Item 19. The method of thermal development of the photothermographic imaging material of any one of Items 1 to 16, further exhibiting a weight reducing value from 100 to 120° C. by the heat drying weight measurement of not more than 0.04% based on a weight value at 25° C., comprising the steps of:

(a) exposing the photothermographic material, (b) heating the exposed photothermographic material within a heating time of 0.5 to 10 seconds, and (c) cooling the heated material, wherein a side of the photothermographic material coated with the photosensitive layer is open to the air, and heating is conducted from the side opposite the photosensitive layer.

Item 20. The method of thermal development of the photothermographic imaging material of Item 18 or 19, wherein the heated photothermographic material is transferred to a cooling process while the photosensitive layer coated side of the photothermographic material is open to the air.

Item 21. The method of thermal development of the photothermographic imaging material of any one of Items 18 to 20, wherein the side opposite the photosensitive layer of the photothermographic material is cooled while the photosensitive layer coated side of the photothermographic material is open to the air.

Item 22. The method of thermal development of the photothermographic imaging material of any one of Items 18 to 21, wherein at least an entering portion of a thermal development apparatus, the photosensitive later coated side of the material is open to the air.

Item 23. A thermal development apparatus for the method of thermal development of any one of Items 18 to 22, comprising a temperature raising section which heats the photothermographic material to a thermal development temperature and a temperature maintaining section to prevent heat loss of the material, wherein different heating methods are employed in each of the temperature raising section and the temperature maintaining section.

Item 24. The thermal development apparatus of Item 23, wherein the temperature raising section heats the photothermographic material while in contact with a plate heater while pressed by opposed rollers, and the temperature maintaining section keeps the material warm in a slit formed by guides, at least one of which guides has a heater.

Item 25. The thermal development apparatus of Item 23 or 24, wherein a slit distance in the temperature maintaining section is 0.5 to 3.0 mm.

Item 26. The thermal development apparatus of any one of Items 23 to 25, wherein a slit distance in the temperature maintaining section is 1 to 3 mm.

The photothermographic imaging material of this invention exhibits the effects of high stability of in-plane density and excellent image keeping stability under light irradiation. According to a thermal development method of this invention, image formation which exhibits minimum contamination at the interior of an imager, low level of odor as well as high abrasion resistance, can be achieved.

DETAILED DESCRIPTION OF THE INVENTION

This invention will be further detailed. A thermal development method can achieve image formation which exhibits minimum contamination at the interior of an imager, low level of odor as well as high abrasion resistance, when a photothermographic imaging material utilized in a thermal development method of this invention satisfies either of the conditions of a weight reducing value from 25° C. to 100° C., determined by heat drying weight measurement, is not less than 0.0001% and not more than 0.4% based on a weight value at 25° C., or a weight reducing value from 100° C. to 120° C., determined by heat drying weight measurement, is not less than 0.0001% and not more than 0.04% based on a weight value at 25° C.

Heat drying weight measurement is performed by a conventional apparatus, and includes, for example, heating dry weight measuring apparatus TGAQ-1000, manufactured by T. A. Instruments Corp.

(Thermal Development Apparatus)

Next a thermal development apparatus which can be preferably utilized in this invention will be explained. In a thermal development apparatus preferably utilized in this invention, individual constitutions can be adopted with respect to a temperature raising section and a temperature maintaining section respectively, that is, a heating means, such as a heating member, and a photothermographic imaging material are brought into contact to depress generation of density unevenness in a temperature raising section, and such cross contact is not necessarily in a temperature maintaining section, and possible is a constitution enabling a rapid processing of thermal development process and a compact size of an apparatus as well as cost down while keeping high image quality without density unevenness, by utilizing different optimum heating means in a temperature raising section and a temperature maintaining section.

In the above thermal development apparatus, the foregoing temperature raising section may have a constitution to heat the foregoing photothermographic imaging material while being pressed to a plate heater by a counter roller, and the foregoing temperature maintaining section may have a constitution to heat the foregoing photothermographic imaging material in a slit which is formed between the guides at least one of which is provided with a heater. In a temperature raising section, a photothermographic imaging material can be cross contacted with a plate heater by pressing the photothermographic imaging material onto a plate heater by a counter roller, while in a temperature maintaining section, since the dry imaging material can be transported by a transportation force of a counter roller in a temperature raising section while being heated between a slit, no driving parts of a transportation system are required, nor strongly required precision of the slit dimension, resulting in a compact size and cost down of an apparatus.

According to this thermal development apparatus, temperature raise of a photothermographic imaging material is performed in the first zone while assuring cross contact between a heating means such as a heating member, and density unevenness is depressed, while in the second zone since there require such cross contact, temperature maintenance of a photothermographic imaging material can be performed between a gap of the guides, enabling a constitution to allow rapid processing of thermal development and minimization of an apparatus size while keeping high image quality without density unevenness. When the gap of the guides (the slit gap) is not more than 3 mm, there caused little influence on temperature maintaining capability irrespective to the transportation style of a photothermographic imaging material in the second zone, and further, great arrangement precision of a fixed guide and the other guide is not required to make a large allowance with respect to a curvature error and a attaching precision at the time of manufacturing of the both guides, resulting in significant increase of designing freedom which contributes cost down of an apparatus.

In the above-described thermal development apparatus, the foregoing slit gap in the second zone is preferably in a range of 1–3 mm. When the slit gap is not less than 1 mm, the surface coated with a thermal developable photosensitive material of a photothermographic imaging material barely touch the guide surface to minimize a fear to cause abrasion, which is preferable.

Further, the foregoing fixed guide and the foregoing guide in the second zone described above are preferably provided with almost the same curvature. It is because a guide having an approximately constant gap can be constituted when a guide in the second zone is provided with a curvature to decrease the size of an apparatus.

Further, possible is a constitution, in which a retention time of a photothermographic imaging material in the foregoing temperature raising section and in the temperature maintaining section is not more than 10 seconds to enable decreasing the period of temperature raising process and the temperature maintaining process, resulting in rapid processing of thermal development.

Further, a concave portion may be provided between the foregoing temperature raising section and the foregoing temperature maintaining section so that foreign materials from the foregoing temperature raising section are trapped in said concave portion, to prevent foreign materials which are accumulating transferred by the top of a film during the film is transported in the temperature raising section, from being brought in, resulting in prevention of generation of such as jamming, abrasion and density unevenness with a photothermographic imaging material.

Herein, the foregoing temperature raising section and the foregoing temperature maintaining section are preferably constituted so as to heat the foregoing photothermographic imaging material while leaving the surface, on which a photosensitive layer is provided, of the thermally developable photosensitive material open. Further, also in a cooling section, it is preferable to perform cooling while leaving the EC surface side of the thermally developable photosensitive material open.

In the following, the embodiment of a thermal development apparatus utilized in this invention will be explained with reference to the drawings. FIG. 1 is a side view to show the primary portion of a thermal development apparatus according to this invention.

In FIG. 1, thermal development apparatus 1, a latent image is formed on an EC surface by exposing photothermographic imaging material F, which is provided with an EC surface on one surface of a support substrate of a sheet form comprising such as PET, and the surface opposite to the EC surface (the surface opposite to a surface on which a photosensitive layer is coated) (hereinafter, referred to as a BC surface), by means of optical scanning of laser light L based on image data in optical scanning exposure section 15, while being transported for the vertical scan in direction H, followed by heating film F from the BC surface side to develop the latent image into a visible image.

Thermal development apparatus 1 of FIG. 1 is equipped with temperature raising section 10, which heats film F provided with a latent image up to a predetermined temperature by heating the film from the BC surface side, temperature maintaining section 13, which maintains heated film F at a predetermined temperature, and cooling section 14 which cools heated film F from the BC surface side. Temperature raising section 10 and temperature maintaining section 13 constitute a heating section and heat film F up to thermal development temperature and keep film F at the thermal development temperature.

Temperature raising section 10 is provided with first heating zone 11 to heat film F on the upper stream side and second heating zone to heat the film F on the down stream side.

First heating zone 11 is provided with planer heating guide 11*b* which is comprised of a metal material such as aluminum being fixed, planer heater 11*c* which is comprised of a silicone rubber heater adhered on the back surface of heating guide 11*b*, and a plural number of counter rollers 11*a* which is arranged so as to keep a gap narrower than the film thickness to enable to press a film onto fixed guide surface 11*d* of heating guide 11*b* and the surface of which is comprised of such as silicone rubber having a higher heat insulating property compared to such as a metal.

Second heating zone 12 is provided with planer heating guide 12*b* which is comprised of a metal material such as aluminum being fixed, planer heater 12*c* which is comprised of a silicone rubber heater adhered on the back surface of heating guide 12*b*, and a plural number of counter rollers 12*a* which are arranged so as to keep a gap narrower than the film thickness to enable to press a film onto fixed guide surface 12*d* of heating guide 12*b* and the surface of which is comprised of such as silicone rubber having a higher heat insulating property compared to such as a metal.

Temperature maintaining section 13 is provided with planer heating guide 13*b* which is comprised of a metal material such as aluminum being fixed, planer heater 13*c* which is comprised of a silicone rubber heater adhered on the back surface of heating guide 13*b*, and guide portion 13*a* which is comprised of such as a heat insulating material and arranged so as to keep a predetermined gap (slit) d against fixed guide plane 13*d* constituted on the surface of heating guide 13*b*.

In first heating zone 11 of temperature raising section 10, film F, which has been transported by such as transport roller pair 16 from the upper stream of temperature raising section 10, is transported in direction H while the BC surface being cross contacted onto fixed guide plane 11*d* and heated by being pressed on fixed guide plane 11*d* by each counter roller 11*a* which is rotationally driven.

Similarly in second heating zone 12, film F, which has been transported from first heating zone 11, is transported in direction H while the BC surface being cross contacted onto fixed guide plane 11*d* and heated by being pressed on fixed guide plane 12*d* by each counter roller 12*a* which is rotationally driven.

Concave portion 17, which is open upward in a V-letter shape, is arranged between second heating zone of temperature raising section 10 and temperature maintaining section 13, so as to provide a constitution which makes foreign materials from temperature raising section 10 to fall down in concave portion 17.

In temperature maintaining section 13, film F which has been transported from second heating zone 12 passes through gap d by a transporting force of counter roller 12*a* of the side of second heating zone 12 while being heated (keeping temperature) by heat from heating guide 13*b* in gap d between fixed guide plane 13*d* of heating guide 13*b* and guide 13*a*.

In cooling section 14, film F is further transported in direction H by counter roller 14*a* while being brought into contact with cooling guide plane 14*c* of cooling plate 14*b* comprising such as a metal material and cooled. Herein, cooling plate 14*b* may exhibit an increased cooling effect by being constituted of a heat sink structure equipped with fins. A cooling plate constituted of a heat sink structure equipped with fins may be further arranged in the down stream of cooling plate 14*b*.

As described above, in a thermal development apparatus 1 of FIG. 1, the BC surface of film F is facing toward fixed guide planes 11*d*, 12*d* and 13*d* in temperature raising section 10 and temperature maintaining section 13, and is transported in a state of the EC surface, on which a thermally developable photosensitive material having been coated, being left open. Further, in cooling section 14, film F is cooled by bringing the BC surface into contact with guide plane 14*c* and transported in a state of the EC surface, on which a thermally developable photosensitive material having been coated, being left open.

Further, film F is transported by counter rollers 11*a* and 12*a* so as to make a passing time at temperature raising section 10 and temperature maintaining section 13 of not more than 10 seconds. Therefore, heating time from temperature raise to temperature maintenance is also not more than 10 seconds.

As described above, according to thermal development apparatus 1 of FIG. 1, since film F is transported while assuring contact heat conduction by making film F adhere to fixed guide planes 11*d* and 12*d* by use of a plural number of counter rollers 11*a* and 12*a* which press film F onto heat guides 11*b* and 12*b*, the whole surface of a film is uniformly heated to uniformly raise the temperature, resulting in the finished film giving a high quality image with depressed density unevenness.

Further, after the film temperature is raised to thermal development temperature, the film is transported into a gap d between fixed guide 13*d* and guide portion 13*a* of heating guide 13*b*, and the film temperature is kept within a predetermined range (for example ±0.5° C.) against thermal development temperature (for example 123° C.) even when the film is heated in gap d particularly without adhering to fixed guide 13*d* (heat conduction by contact with the surrounding high temperature air). In this manner, since a film temperature difference is less than 0.5° C. to keep a uniform temperature maintenance state whether the film is transported along the wall of heating guide 13*b* or along the wall of guide 13*a*, in gap d, there barely generated density unevenness in a finished film. Therefore, there is no need to arrange driving parts such as a roller in temperature maintaining section 13, resulting in cut down of the number of parts.

Further, since the heating time of film F is not mopre than 10 seconds, rapid thermal development process can be realized; and since a film transport course, extending straight from temperature raising section 10 to cooling section 14, can be varied depending on the apparatus layout, it is possible to minimize installation area and to decrease the total size of the apparatus.

In a conventional large apparatus, since a portion requiring only a temperature maintaining function after heating a film to a development temperature was also provided with a heating and transporting constitution identical to a temperature raising section, unnecessary parts were utilized to induce increase of the number of parts and cost up, while in a conventional small apparatus, since it was difficult to assure heat conduction at the time of temperature raising to cause a problem of density unevenness, which resulted in difficulty of assuring high image quality; in an embodiment of this invention, it is possible to solve any of these problems by separately performing a thermal development process at temperature raising section 10 and at temperature maintaining section 13.

Further, since solvents (such as water content and an organic solvent), which are heated to be vaporized (evaporated), are dispersed in the shortest distance by leaving the EC surface side open at the time of performing a thermal development process in a rapid processing of not more than 10 seconds, by heating film F from the BC surface side while the EC surface side, on which a thermally developable photosensitive material has been coated, being left open in temperature raising section 10 and temperature maintaining section 13, there barely caused an influence of time reduction even with a reduced heating time (evaporation time) as well as a temperature difference is neutralized by a heat diffusion effect of a PET base at the BC surface even with partly presence of a poor contact portion between film F and fixed guide surfaces 11*d* and 12*d*, density difference is barely generated to stabilize density resulting in stable image quality. Herein, generally taking heating efficiency into consideration, heating from the EC surface side has been considered to be more preferable, however, the time lag is little in consideration of a thermal conductivity of PET of 0.17 W/m° C. and a thickness of a PET base of approximately 170 μm, in a support substrate of film F, and can be easily cancelled by such as increase of a heater capacity; that is, it is more preferable to expect an effect of neutralization of uneven contact described above.

Further, solvents (such as water content and an organic solvent) in film F are going to be vaporized (evaporate) due to high temperature during coming out from temperature maintaining section 13 and reaching cooling section 14 of film F, and since the EC surface of film F is left open also in cooling section 14, solvents (such as water content and an organic solvent) are not trapped to allow evaporation for longer time, resulting in a stabilized image (density). In this manner, cooling time is also important in the case of a rapid processing, and is specifically effective for a rapid processing having a heating time of not more than 10 seconds.

Figure 2:
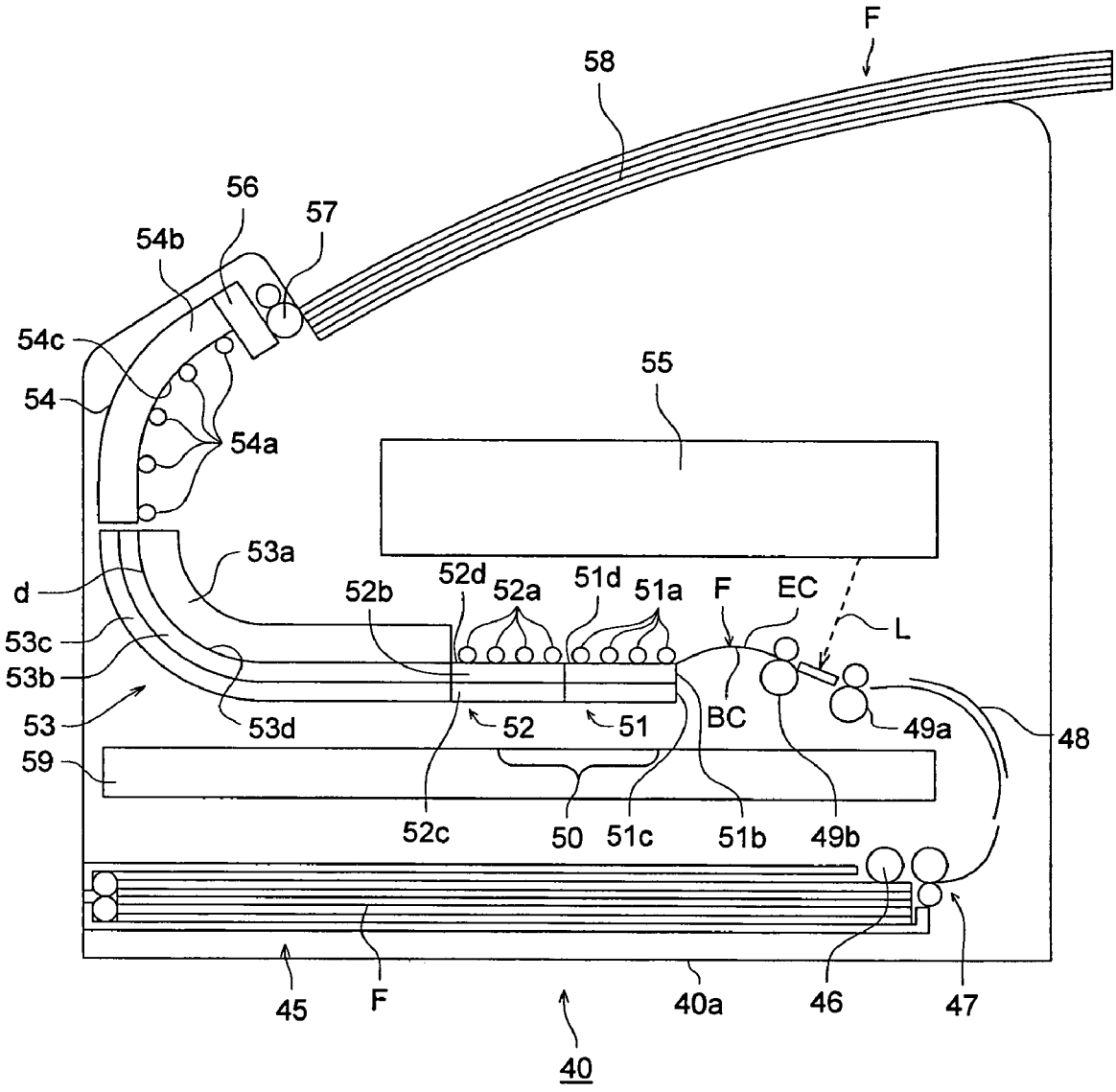
FIG. 2 is a side-view drawing to schematically show the primary portion of another thermal development apparatus according to this invention.

FIG. 2 is a side-view drawing to schematically show a primary portion of another thermal development apparatus according to this invention.

In FIG. 2, thermal development apparatus 40 forms a latent image on the EC surface by laser light L from optical scanning exposure section 55, while transporting film F, which is provided with an EC surface, in which a thermally developable photosensitive material has been coated on the one surface of a sheet form support substrate comprising such as PET similar to as described above, and a BC surface of a supporting substrate side opposite to the EC surface, in the vertical scanning direction; then develop the latent image into a visible image by heating film F from the BC surface side; and transport the film through a transport course, provided with a curvature, upward the apparatus and sends the film out.

Thermal development apparatus 40 of FIG. 2 is equipped with film stock section 45, which is arranged near the bottom portion of apparatus body 40*a* and stores many sheets of unused film F, pick up roller 46, which picks up and transports the upper most film F in film stock section 45, transport roller pair 47, which transports film F coming from pick up roller pair 46, curved surface guide 48, which is formed in a curved form so as to guides and transport film F coming from pick up roller pair 47 almost reversing the transport direction, transport roller pairs 49*a* and 49*b*, which perform transportation of film F from curved surface guide 48 for vertical scanning, and optical scanning exposure section 55 which forms a latent image on the EC surface by exposing film F by means of optically scanning of laser light based on image data.

Thermal development apparatus 40 is further equipped with temperature raising section 50 to heat film F, on which a latent image has been formed, from the BC surface side to heat the film up to a predetermined thermal development temperature, temperature maintaining section 53 to heat heated film F to maintain the temperature at the predetermined thermal development temperature, cooling section 54 to cool heated film F from the BC surface side, densitometer 56 which is arranged on the outlet side and measures density of film F, roller pair 57 to feed out film F coming from densitometer 56, and film mounting section 58 which is inclining arranged on the upper surface of apparatus body 40*a* so as to mount film F fed out by transport roller pair 57.

As shown in FIG. 2, in themal development apparatus 40, film stock section 45, substrate portion 59, transport roller pairs 49*a* and 49*b*, temperature raising section 50, temperature maintaining section 53 (on the upper stream side) are arranged in this order from the bottom of apparatus body 40*a* to upward, and film stock section 45, being arranged at the under most portion, as well as substrate portion 59 being arranged between temperature raising section 50 and temperature maintaining section 53, is hard to accept thermal influence.

Further, since the transport course, from transport roller pairs 49*a* and 49*b* to temperature raising section 50, of vertical scanning transportation is constituted to have a relatively short length, heating for thermal development is performed at the leading side of film F while film F is exposed by optical scanning section 55.

A heating system is constituted of temperature raising section 50 and temperature maintaining section 53 to heat film F up to a thermal development temperature and maintain the film at a thermal development temperature. Temperature raising section 50 is provided with first heating zone 51 to heat film F on the upper stream side and second heating zone 52 to heat the film on the down stream side.

First heating zone 51 is provided with planer heating guide 51*b* which is comprised of a metal material such as aluminum being fixed, planer heater 51*c* which is comprised of a silicone rubber heater adhered on the back surface of heating guide 51*b*, and a plural number of counter rollers 51*a*'s which are arranged so as to keep a gap narrower than the film thickness to enable to press a film onto fixed guide surface 51*d* of heating guide 51*b* and the surface of which is comprised of such as silicone rubber having a higher heat insulating property compared to such as a metal.

Second heating zone 52 is provided with planer heating guide 52*b* which is comprised of a metal material such as aluminum being fixed, planer heater 52*c* which is comprised of a silicone rubber heater adhered on the back surface of heating guide 52*b*, and a plural number of counter rollers 52*a*'s which are arranged so as to keep a gap narrower than the film thickness to enable to press a film onto fixed guide surface 52*d* of heating guide 52*b* and the surface of which is comprised of such as silicone rubber having a higher heat insulating property compared to such as a metal.

Temperature maintaining section 53 is provided with planer heating guide 13*b* which is comprised of a metal material such as aluminum being fixed, planer heater 13*c* which is comprised of a silicone rubber heater adhered on the back surface of heating guide 53*b*, and guide portion 53*a* which is comprised of such as a heat insulating material and arranged so as to keep a predetermined gap (slit) d against fixed guide plane 53*d* constituted on the surface of heating guide 53*b*. Temperature raising section 53 is constituted in a plain form to be continued to second heating zone 52 on the side of temperature raising section 50, and then in a curved plane form having a predetermined curvature upward the apparatus from the intermediate portion.

In first heating zone 51 of temperature raising section 50, film F, which has been transported from the upper stream side of temperature raising section 50 by transport roller pairs 49*a* and 49*b*, is transported while being heated by the BC surface being crossly contacted with fixed guide surface 51*d* by being pressed onto fixed guide surface 51*d* with each counter roller 51*a* which is rotationally driven.

Similarly also in second heating zone, film F which has been transported from first heating zone 51 is transported while being heated by the BC surface being crossly contacted with fixed guide surface 52*d* by being pressed onto fixed guide surface 52*d* with each counter roller 52*a* which is rotationally driven.

Herein, a concave portion which is open upward in a V-letter shape may be arranged between second heating zone 52 of temperature raising section 50 and temperature maintaining section 53, so that to enable to prevent foreign materials coming from temperature raising section 50 from being brought into temperature maintaining section 53.

In temperature maintaining section 53, film F, which has been transported from second heating zone 52, passes through gap d by a transporting force of counter roller 52*a* on the side of second heating zone 52 while being heated (maintaining a temperature) by heat from heating guide 53*b* in gap d between fixed guide surface 53*d* and guide portion 53*a* of heating guide 53*b*. At this time, film F is transported while gradually changing the direction from the horizontal direction to the vertical direction, and proceeds to cooling section 54.

In cooling section 54, film F, which has been transported from temperature maintaining section 53 in almost vertical direction, is transported toward film mounting section 58 by gradually changing the direction of film F from the vertical direction to the oblique direction, while being cooled by being brought in contact with cooling guide surface 54*c* of cooling plate 54*b* comprising such as a metal material by counter roller 54*a*. Herein, cooling plate 54*b* may have a heat sink structure attached with fins to increase the cooling effect. Also a part of cooling plate 54*b* may be provided with a structure attached with fins.

Film F having been cooled and coming out from cooling section 54 is subjected to density measurement by use of densitometer 56, and is transported by transport roller pair 57 to be fed out on film mounting section 58. Film mounting section 58 can temporally stock plural sheets of film F.

As described above, in thermal development apparatus 40 of FIG. 2, film F directs the BC surface toward fixed guide surfaces 51*d*, 52*d* and 53*d*, which are in a heated state, in temperature raising section 50 and temperature maintaining section 53, and is transported while leaving the EC surface, on which a thermally developable photosensitive material, open. Further, in cooling section 54, film F allows the BC surface to contact with cooling guide 54*c* to be cooled, and is transported while leaving the EC surface, on which a thermally developable photosensitive material, open.

Further, film F is transported by roller pairs 51*a* and 52*a* so as to make a passing time at temperature raising section 50 and temperature maintaining section 53 of not more than 10 seconds. Therefore, heating time from temperature raise to temperature maintenance is also not more than 10 seconds.

As described above, according to thermal development apparatus 40 of FIG. 2, since film F is transported while assuring contact heat conduction by adhering the film on fixed guide surfaces 51*d* and 52*d* by use of heating guides 51*b* and 52*b*, and a plural number of counter rollers 51*a* and 52*a*, which press the film on heating guide 51*b* and 52*b*, the whole film surface is uniformly heated to uniformly raise temperature, resulting in a high quality image with depressed density unevenness as a finished film.

Further, after heating the film to a thermal development temperature, film is transported into gap d between fixed guide surface 53*d* and guide portion 53*a* of heating guide 53*b* in temperature maintaining section 53, and film temperature can be kept in a predetermined range (for example, ±0.5° C.) against a development temperature (for example, 123° C.) even the film is heated in gap d without being adhered on fixed guide surface 53*d* (heat transfer by direct contact with fixed guide surface 53*d*, and/or heat transfer by contact with the surrounding high temperature air). In this manner, since a film temperature difference is less than 0.5° C. to keep a uniform temperature maintenance state whether the film is transported along the wall of heating guide 53*b* or along the wall of curved surface guide 53*a*, in gap d, there barely generated unfavorable density unevenness in a finished film. Therefore, there is no need to arrange driving parts such as a roller in temperature maintaining section 53, resulting in cut down of the number of parts.

Further, since the heating time of film F is not more than 10 seconds, rapid thermal development process can be realized; and since temperature maintaining section 53 extended in horizontal direction from temperature raising section 50 is constituted so as to direct toward vertical direction by forming curved surface on the way and film F is fed out on film mounting section 58 by almost reversing the direction of film F in cooling section 54, it is possible to minimize installation area and to decrease the total size of the apparatus by making cooling section 54 of a predetermined curvature depending on the apparatus layout.

In a conventional large apparatus, since a portion requiring only a temperature maintaining function after heating a film to a development temperature was also provided with a heating and transporting constitution identical to a temperature raising section, unnecessary parts were utilized to induce increase of the number of parts and cost up, while in a conventional small apparatus, since it was difficult to assure heat conduction at the time of temperature rising to cause a problem of density unevenness, which resulted in difficulty of assuring high image quality; in the second embodiment of this invention, it is possible to solve any of these problems by separately performing thermal development process at temperature raising section 50 and at temperature maintaining section 53.

Further, since solvents (such as water content and an organic solvent), which are heated to be vaporized (evaporated), are dispersed in the shortest distance by leaving the EC surface side open at the time of performing a thermal development process in a rapid processing of not more than 10 seconds, by heating film F from the BC surface side while the EC surface side, on which a thermally developable photosensitive material has been coated, being left open in temperature raising section 50 and temperature maintaining section 53, there barely caused an influence of time reduction even with a reduced heating time (evaporation time) as well as a temperature difference is neutralized by a heat diffusion effect of a PET base at the BC surface even with partial presence of a poor contact portion between film F and fixed guide surfaces 51*d* and 52*d*, and density difference is barely generated to stabilize density resulting in stable image quality. Herein, generally taking heating efficiency into consideration, heating from the EC surface side has been considered to be more preferable, however, the time lag is little in consideration of a thermal conductivity of PET of 0.17 W/m° C. and a thickness of a PET base of approximately 170 μm, in a support substrate of film F, and can be easily cancelled by such as increase of a heater capacity; that is, it is more preferable to expect an effect of neutralization of uneven contact described above.

Further, solvents (such as water content and an organic solvent) in film F are going to be vaporized (evaporate) due to high temperature during coming out from temperature maintaining section 13 and reaching cooling section 14 of film F, and since the EC surface of film F is left open also in cooling section 14, solvents (such as water content and an organic solvent) are not trapped to allow evaporation for longer time, resulting in a stabilized image (density). In this manner, cooling time is also important in the case of a rapid processing, and is specifically effective for a rapid processing having a heating time of not more than 10 seconds.

(Rapid Processing of Thermal Development Process)

Figure 3:
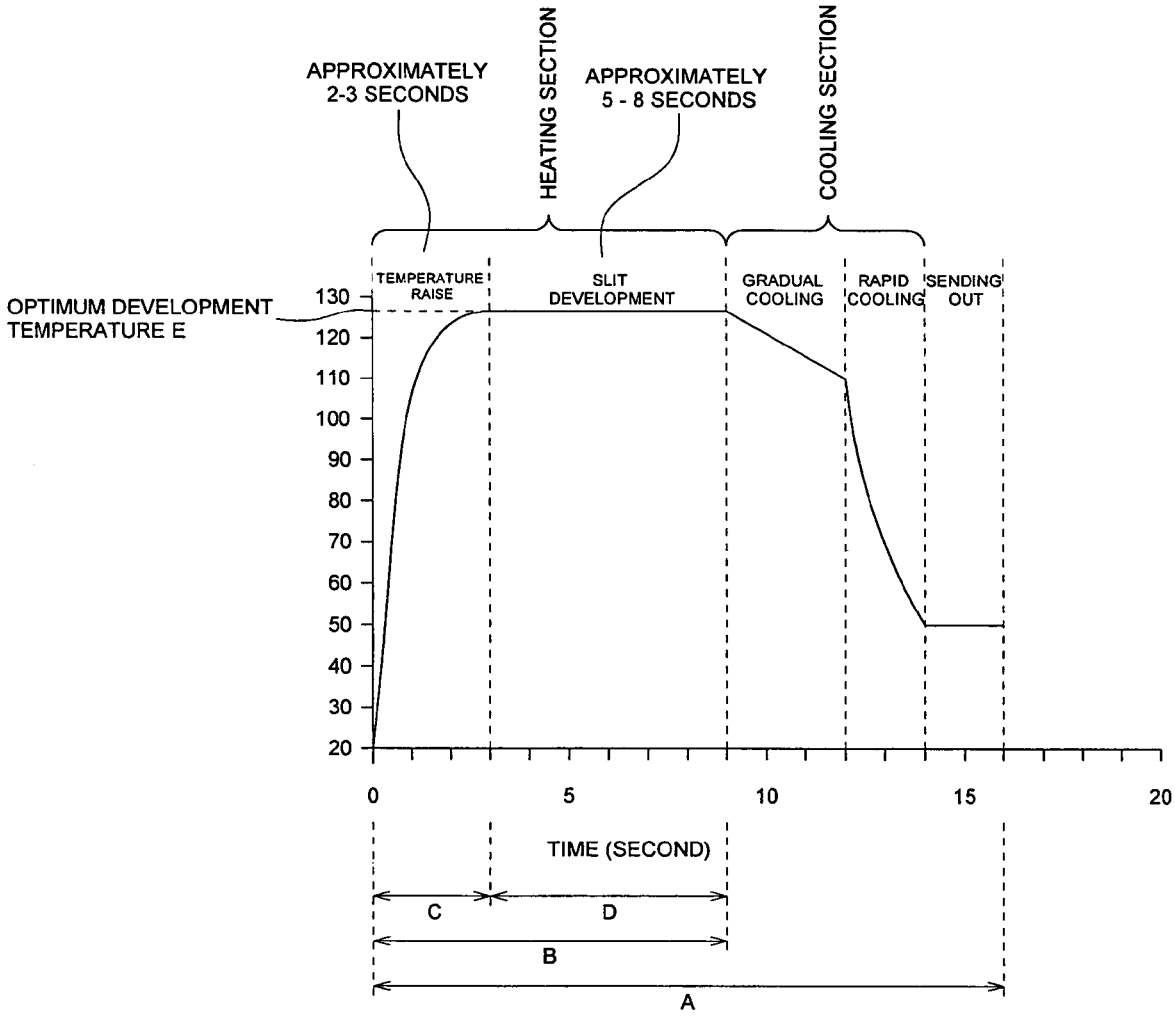
FIG. 3 is a graph to show a temperature profile at a rapid processing method of a thermal development process in thermal development apparatuses 1 and 40 of FIGS. 1 and 2.

Next, rapid processing of thermal development process will be explained referring to FIG. 3. FIG. 3 is a graph to show a temperature profile in a rapid processing method of thermal development process in thermal development apparatuses 1 or 40 of FIG. 1 or 2.

This rapid processing method makes heating time B shorter to shorten total processing time A of film in thermal development apparatuses 1 or 40 of FIG. 1 or 2. For this purpose, to further shorten temperature raise time C till optimum development temperature E, film F is forced by counter rollers 11*a* and 12*a*, or 51*a* and 52*a*, to be crossly contacted with fixed guide surfaces 11*d* and 12*d*, or 51*d* and 52*d*.

Then, after film F reaches a thermal development temperature E, film F is kept at the thermally developing temperature during temperature maintaining time D at temperature maintaining section 13 or 53. In temperature maintaining section 13 or 53, as described above, film F is transported while not being adhered to fixed guide 13*d* or 53*d* in gap d without a forcing means such as a counter roller. Herein, rapid cooling can be achieved by arranging such as a heat sink and a cooling fan in cooling section 14 or 54.

As described above, heating time B (temperature raise time C+ temperature maintaining time D) can be shortened from approximately 14 seconds, which are conventionally required, to not longer than 10 seconds, resulting in shortening of total processing time A.

(Effect of Gap (Slit) Heating in Temperature Maintaining Section)

Next, an effect of gap (slit) heating in a temperature maintaining section will be explained. In this example, a thermal development apparatus shown in FIG. 5 was utilized in the experiment. This thermal development apparatus was designed to make a film pass of a slit form to perform slit heating, by changing the heating system to the first heating plate on the upper stream side and to the second heating plate eliminating rubber rollers and being covered with heat insulating material on the down stream side, of FIG. 4. A gap between the second heating plate and the heat insulating material was set to 3 mm.

Figure 5:
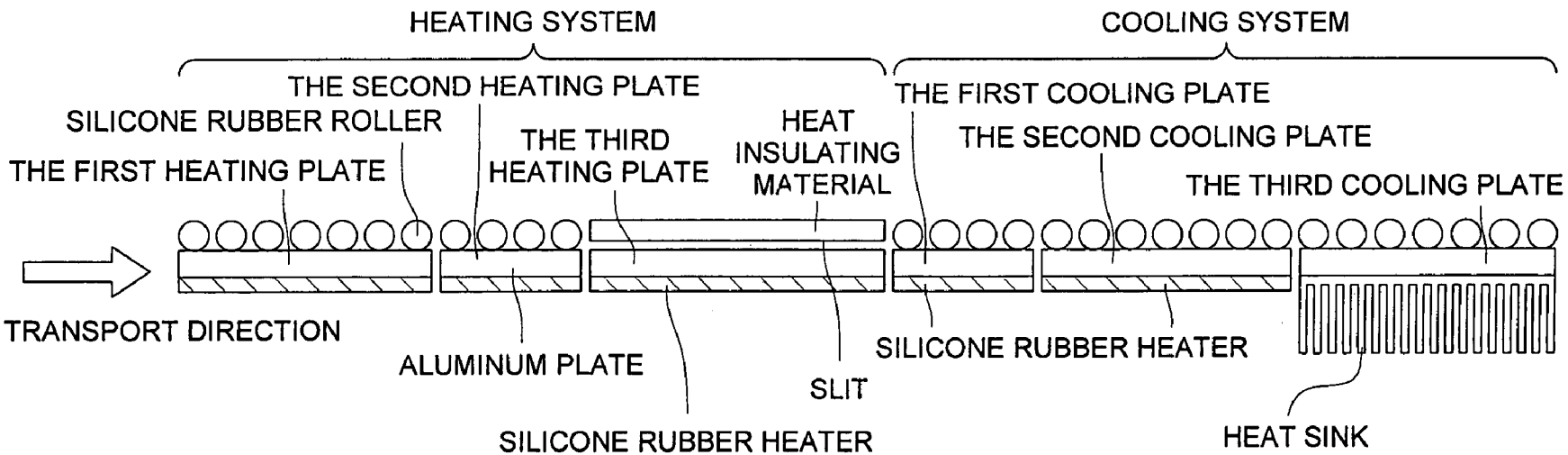
FIG. 5 is a side-view drawing to show a primary constitution of a thermal development apparatus having been utilized in examples which exhibit the effect of gap (slit) heating in a temperature maintaining section.
Figure 6:
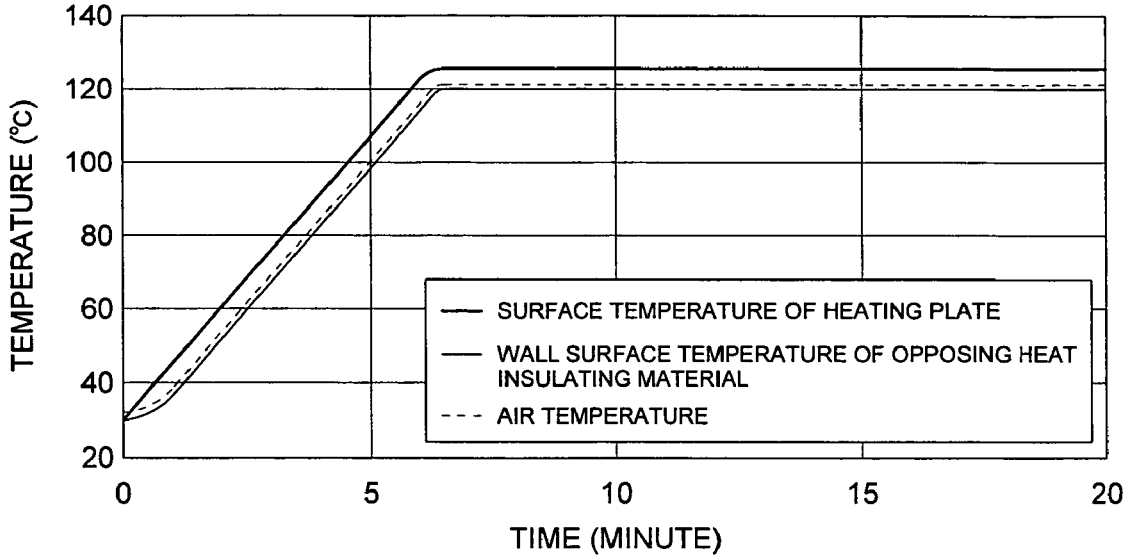
FIG. 6 is a graph to show the relationship between time and temperature, with respect to experimaetal examples which exhibit the effect of slit heating, when the surface temperature of a heating plate, the temperature of a heat insulation wall surface opposing to the heating plate surface and the air temperature in the slit, at the slit of FIG. 5, were measured from start of heating until reaching the thermal development temperature.

Surface temperature of a heating plate, wall surface temperature of the heat insulating material opposing to the heating plate surface, in a slit of FIG. 5, and air temperature in the slit, are measured from the start of temperature raise to reaching the thermal development temperature, and the relation between the time and temperature is shown in FIG. 6.

Figure 7:
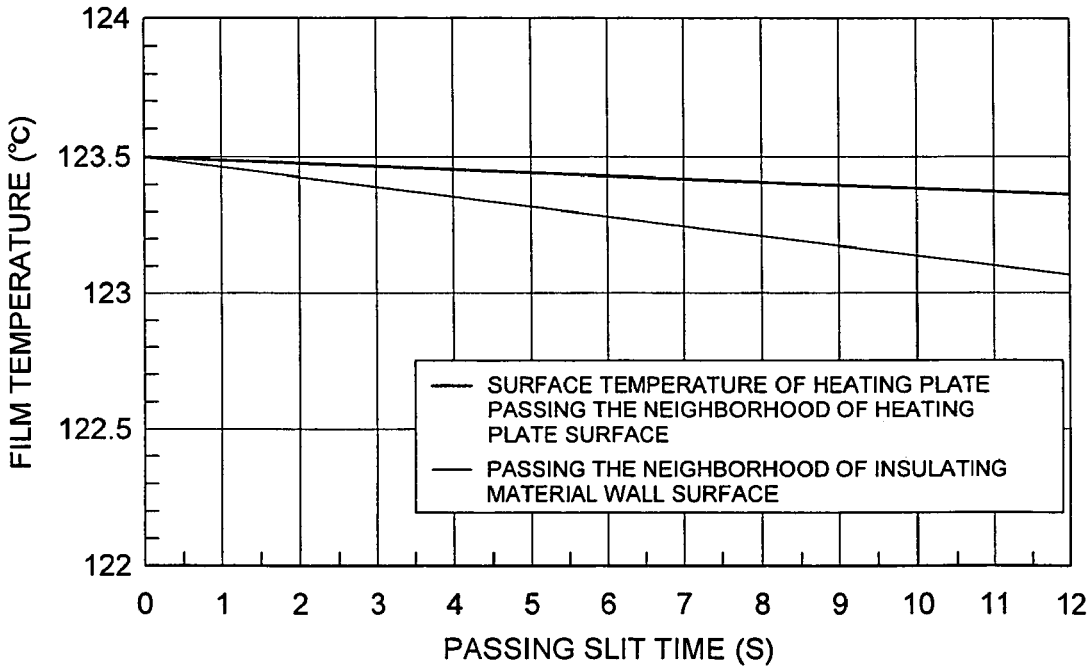
FIG. 7 is a graph to show film temperature changes, with respect to experimental examples to show the effect of slit heating, in the case of passing a film in the neighborhood of the heating plate surface in a slit, and in the case of passing a film in the neighborhood of the thermal insulating wall surface, respectively.

FIG. 7 shows changes of film temperatures in the case of film being passed in the neighborhood of the heating plate surface in a slit, and in the case of being passed the neighborhood of the insulating material wall surface, respectively.

It is clear from FIG. 6 that temperature of the insulating material wall surface and air temperature in the slit are nearly constant and almost identical after reaching the thermal development temperature, and are lower than temperature of the heating plate surface by approximately 3° C.

It is clear from FIG. 7 that, in a slit gap of not more than 3 mm and a temperature maintaining time of not longer than 8 seconds, film temperature is slightly lowered from thermal development temperature 123° C. when a film is passed in the neighborhood of the heating plate in a slit, while film temperature is lowered more than the case of film being passed in the neighborhood of a heating plate surface when a film is passed in the neighborhood of a heat insulating wall, however, either temperature lowering is less than 0.5° C. against the development temperature (123° C.), which is in a range of enabling to neglect an effect on density. Therefore, a slit gap of a temperature raising section can be made within 3 mm, and allowance against such as a curvature error and attaching accuracy at the manufacturing of the both guides becomes large, resulting in significant increase of the degree of freedom in design.

FIG. 8(*a*) is a schematic drawing to show the state of opening of the emulsion surface side (opening of the EC surface) and heating of the surface opposite to emulsion side (heating of the BC surface) of a photothermographic imaging material, and FIG. 8(*b*) is a schematic drawing to show the state of opening of the surface opposite to emulsion side (opening of the BC surface) and heating of the emulsion surface side (heating of the EC surface) of a photothermographic imaging material, for comparison. Arrow heads show the diffusing direction of solvents (such as water content and an organic solvent) contained in a photothermographic imaging material. In the case of EC surface opened/BC surface heated of FIG. 8(*a*), since the emulsion surface of a sheet film is left open, solvents (water, organic solvent) are evaporated to decrease density, however, evaporation amount becomes relatively small to depress density decrease, while temperature is relatively hard to rise to restrain development to proceed, resulting in density decrease in portions F1 and F2 where a film and a heater are in poor contact. There is barely caused density difference with portions in good contact by this cancellation. As a result, it is advantageous to provide uniformity in the plane with respect to density unevenness.

On the contrary, in the case of BC surface opened/EC surface heated of FIG. 8(*b*), solvent (water, organic solvent) is evaporated from portions F3 and F4 where a film and a heater are partly in bad contact to decrease density, while temperature is hard to rise in portions F3 and F4 where a film and a heating substance are partly in bad contact to restrain development proceeding resulting in density decrease. Density difference with the portion of good contact becomes significant by this synergism. As a result, it is disadvantageous to provide non-uniformity in the plane due to density unevenness.

Herein, transporting speed of a photothermographic imaging material at a thermal development section is generally 20–200 mm/sec, preferably 25–200 mm/sec and specifically preferably 30–150 mm/sec. By setting transporting speed in this range, it is possible to depress density unevenness at the time of thermal development as well as to shorten processing time, and as a result it is preferable also to meet diagnosis in emergency.

A development condition of a photothermographic imaging material may vary depending on equipment, apparatuses or means, however, is typically to perform development by heating the photothermographic imaging material, which has been image-wise exposed, at a suitable high temperature. A latent image obtained after exposure is developed at a moderately high temperature (approximately at 80–200° C., preferably at 100–140° C. and more preferably at 110–130° C.).

Sufficient image density cannot be obtained in a short time when heating temperature is less than 80° C., while a binder melts to badly influence not only to an image itself such as transfer on a roller but also to such as a transport property and a processor. A silver image is formed based on an oxidation reduction reaction between organic silver salt (which functions as an oxidant) and a reducing agent by heating. This reaction process proceeds without any supply of a processing solution such as water from outside.

As equipment, apparatuses or means for heating, for example, a hot plate, an iron, a hot roller and typical heating means as a heat generator utilizing such as carbon or white titanium may be employed. A photothermographic imaging material provided with a protective layer on a photosensitive layer is preferably heat processed by bringing the surface side having a protective layer in contact with a heating means with respect to uniform heating as well as such as a heat efficiency and workability, and is more preferably developed by being heat processed while the surface side having a protective layer is brought in contact with a heat roller. In this invention, an image which is obtained by heat development at a heating temperature of 123° C. and a development time of 10 seconds, preferably has a mean gradation of 2.0.–4.0 for optical diffuse density of 0.25–2.5, based on a characteristic curve shown on a right-angled coordinate having an identical unit length of diffuse density (Y-axis) and common logarithmic exposure quantity (X-axis). By setting the gradation in this range, it is possible to obtain an image having a high diagnostic recognition even with a small amount of silver.

In the following, a photothermographic imaging material preferably utilized in this invention will be explained.

<Protective Layer>

A protective layer preferably functions to prevent volatilization or adhesion of contaminants which are generated from the photothermographic material during thermal development.

Further, as a protective layer binder, cellulose acetate having an acetylation degree of not less than 50% and not more than 58%, and polymer comprising a vinylalcohol unit having a saponification degree of not more than 75% can be also utilized. A protective layer binder can be utilized by mixing with the following polymer. The mixing ratio is 0–90 volume % and more preferably 0–40 volume %.

For example, any polymer among those described in such as U.S. Pat. Nos. 6,352,819, 6,352,820, and 6,350,561.

Examples of this binder preferably include at least one polymer selected from cellulose derivatives, polyvinyl alcohol, polystyrene and copolymer thereof, copolymer of vinyl chloride and vinyl acetate, water-insoluble polyester, gelatin and derivatives thereof, and polyvinyl pyrolidone. Specifically preferable are cellulose derivatives and polymer provided with a vinylalcohol unit.

As polymer provided with a vinylalcohol unit, specifically preferable are vinylacetate polymer and polyvinyl alcohol. As polyvinyl alcohol, low crystallizing polyvinyl alcohol having a saponification degree of not more than 75% is preferred.

Cellulose acetate may be any of cellulose acetate provided having an acetylation degree of not less than 50% and not more than 58%. In this invention, cellulose acetate is utilized by being suitably mixed with a cellulose derivatve. The ratio is 0–90 volume % and more preferably 0–40 volume % against cellulose acetate.

An acetylation degree is an index to represent a degree of the substitution degree to represent a ratio of released acetic acid by saponification of cellulose acetate and is defined by the following equation.

$$\text{Sustitution degree} = \text{acetylation degree} \times 162/(6005 - \text{acetylation degree} \times 42)$$

Cellulose derivatives are such as cellulose acetate, cellulose acetate butyrate, cellulose propionate, hydroxypropyl cellulose, hydroxypropylmethyl cellulose, methyl cellulose, hydroxyethyl cellulose, carboxymethyl cellulose and mixtures thereof.

To achieve these functions, the thickness of the protective layer is preferably not less than 0.2 μm and not more than 10 μm, more preferably not less than 1 μm and mot more than 5 μm, and still more preferably not less than 1.5 μm and not more than 3.0 μm. The protective layer may be a single layer or multiple layers.

The protective layer may contain additives such as a surface active agent, a lubricant, a matting agent, a cross-linking agent, an image tone controlling agent for thermal development, and an anti-irradiation dye.

<Cross-linking Agent of Protective Layer>

Employed as cross-linking agents used in the present invention may be various conventional cross-linking ones, which have been employed for silver halide photosensitive photographic materials, such as aldehyde based, epoxy based, ethyleneimine based, vinylsulfone based sulfonic acid ester based, acryloyl based, carbodiimide based, and silane compound based cross-linking agents, which are described in Japanese Patent Application Open to Public Inspection No. 50-96216. Of these, preferred are isocyanate based compounds, silane compounds, epoxy compounds or acid anhydrides, as described below.

As one of the preferred cross-linking agents, isocyanate based and thioisocyanate based cross-linking agents represented by Formula (IC), shown below, will now be described.

$$X_1{=}C{=}N\text{-}L_1\text{-}(N{=}C{=}X_1)_v \qquad \text{Formula (IC)}$$

wherein v is an integer of 1 or 2; $L_1$ is an alkyl group, an aryl group, or an alkylaryl group which is a linking group having a valence of (v+1); and $X_1$ is an oxygen atom or a sulfur atom.

Incidentally, in the compounds represented by foregoing Formula (IC), the aryl ring of the aryl group may have a substituent. Preferred substituents are selected from the group consisting of a halogen atom (for example, a bromine atom or a chlorine atom), a hydroxyl group, an amino group, a carboxyl group, an alkyl group and an alkoxy group.

The foregoing isocyanate based cross-linking agents are isocyanates having at least two isocyanate groups and adducts thereof. More specifically, listed are aliphatic isocyanates, aliphatic isocyanates having a ring group, benzene diisocyanates, naphthalene diisocyanates, biphenyl isocyanates, diphenylmethane diisocyanates, triphenylmethane diisocyanates, triisocyanates, tetraisocyanates, and adducts of these isocyanates, as well as adducts of these isocyanates with dihydric or trihydric polyalcohols.

Employed as specific examples may be isocyanate compounds described on pp 10–12 of JP-A 56-5535.

It is more preferable that the above isocyanate cross-linking agent is an addition compound adducted with a blocking agent (being a blocked isocyanate).

As the above blocking agent, employable are a phenolic, an alcoholic, an active methylene, a mercaptan, an acid amide, an imide, an amide, an imidazole, a urea, a carbamic acid, an imine, an oxime, and a sulfite salt based blocking agent.

The above isocyanate blocking agents include, for example, Desmodule AP Stable, Desmodule CT Stable, Desmocap 11 (produced by Sumitomo Bayer Urethane Co., Ltd.), Burnock D-500 (produced by Dainippon Ink and Chemicals, Inc.), Duranate MF-B60X, Duranate MF-K60X (produced by Asahi Kasei Corp.), and JA925 (produced by Jujo Chemical Co., Ltd.).

Further, as thioisocyanate based cross-linking agents usable in this invention, also useful are compounds having a thioisocyanate structure corresponding to the isocyanates.

The amount of the cross-linking agents employed in this invention is preferably in the range of $1\times10^{-6}$–$1\times10^{-2}$ mol/m$^2$, and more preferably in the range of $1\times10^{-5}$–$1\times10^{-3}$ mol/m$^2$.

Isocyanate compounds as well as thioisocyanate compounds, which may be incorporated in this invention, are preferably those which function as the cross-linking agent. However, it is possible to obtain the desired results by employing compounds which have v of zero (0), namely compounds having only one functional group.

Listed as examples of silane compounds which can be employed as a cross-linking agent in this invention are compounds represented by Formal (1) or Formula (2), described in JP-A 2002-22203.

In these Formulas, at least one of the substituent groups is preferably a non-diffusive group or an absorptive group. Incidentally, the non-diffusive group, which is called a ballast group, is preferably an aliphatic group having at least 6 carbon atoms or an aryl group substituted with an alkyl group having at least 3 carbon atoms. Non-diffusive properties vary depending on binders as well as the used amount of cross-linking agents. By introducing the non-diffusive groups, migration distance in the molecule at room temperature is retarded, whereby it is possible to retard reactions during storage.

Compounds, which can be used as a cross-linking agent, may be those having at least one epoxy group. The number of epoxy groups and corresponding molecular weight are not limited. It is preferable that the epoxy group be incorporated in the molecule as a glycidyl group via an ether bond or an imino bond. Further, the epoxy compound may be a monomer, an oligomer, or a polymer. The number of epoxy groups in the molecule is commonly from about 1–about 10, and is preferably from 2–4. When the epoxy compound is a polymer, it may be either a homopolymer or a copolymer, and its number average molecular weight Mn is most preferably in the range of about 2,000 to about 20,000.

Preferred as epoxy compounds are those represented by Formula (EP) described below.

Formula (1)

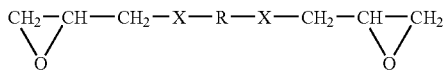

In Formula, the substituent of the alkylene group represented by $R_{10}$ is preferably a group selected from a halogen atom, a hydroxyl group, a hydroxyalkyl group, or an amino group. Further, the linking group represented by $R_{10}$ preferably has an amido linking portion, an ether linking portion, or a thioether linking portion. The divalent linking group, represented by X, is preferably —$SO_2$—, —$SO_2NH$—, —S—, —O—, or —$NR_1$—, wherein $R_1$ is a univalent group, which is preferably an electron attractive group.

These epoxy compounds may be employed individually or in combinations of at least two types. The added amount is not particularly limited but is preferably in the range of $1\times10^{-6}$–$1\times10^{-2}$ mol/m$^2$, and is more preferably in the range of $1\times10^{-5}$–$1\times10^{-3}$ mol/m$^2$.

The epoxy compounds may be incorporated in any of the optional layers on the photosensitive layer side of a support, such as a photosensitive layer, a surface protective layer, an interlayer, an antihalation layer, and a subbing layer, and may be incorporated in one or more than two layers. In addition, the epoxy compounds may be incorporated in the optional layers on the side opposite to the photosensitive layer on the support. Incidentally, when a photosensitive material has photosensitive layers on both sides of the support, the epoxy compounds may be incorporated in any layer.

Acid anhydrides are compounds which have at least one acid anhydride group having the structural formula described below.

—CO—O—CO—

The acid anhydrites may be one having at least one such acid anhydride group. The number of acid anhydride groups, and the molecular weight are not limited, but the compounds represented by Formula (SA) are preferred.

Formula (SA)

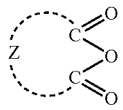

In Formula (SA), Z represents a group of atoms necessary for forming a single ring or a polycyclic system. These cyclic systems may be unsubstituted or substituted. Example of substituents include an alkyl group (for example, a methyl group, an ethyl group, or a hexyl group), an alkoxy group (for example, a methoxy group, an ethoxy group, or an octyloxy group), an aryl group (for example, a phenyl group, a naphthyl group, or a tolyl group), a hydroxyl group, an aryloxy group (for example, a phenoxy group), an alkylthio group (for example, a methylthio group or a butylthio group), an arylthio group (for example, a phenylthio group), an acyl group (for example, an acetyl group, a propionyl group, or a butyryl group), a sulfonyl group (for example, a methylsulfonyl group, or a phenylsulfonyl group), an acylamino group, a sulfonylamino group, an acyloxy group (for example, an acetoxy group or a benzoxy group), a carboxyl group, a cyano group, a sulfo group, and an amino group. Substituents are preferably those which do not contain a halogen atom.

These acid anhydrides may be employed individually or in combinations of at least two types. The added amount is not particularly limited, but is preferably in the range of $1\times10^{-6}$–$1\times10^{-2}$ mol/m$^2$, but is more preferably in the range of $1\times10^{-6}$–$1\times10^{-3}$ Mol/m$^2$.

In the present invention, the acid anhydrides may be incorporated in the optional layers on the photosensitive layer side on a support, such as a photosensitive layer, a surface protective layer, an interlayer, an antihalation layer, or a subbing layer, and may be incorporated in at least two layers. Further, the acid anhydrides may be incorporated in the layer(s) in which the epoxy compounds are incorporated.

In this invention, to prevent surface deposition of the fatty acid, it is preferable to employ a cross-linking agent having an acid radical capture function. The examples are compounds of isocyanate based ones represented by following Formula (X-1), an epoxy based one represented by following Formula (X-2), a phenolic one represented by following (X-3), an amine or diamine based one represented by following Formula (X-4), and a carbodiimide based one represented by following Formula (CI), which is described later.

R—NCO Formula (X-1)

Formula (X-2)

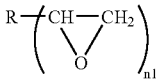

Formula (X-3)

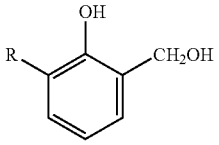

Formula (X-4)

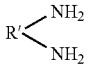

In Formulas, R is a substituent group, R' is a divalent linking group, and $_{n1}$ is an integer of 1–4.

Carbodiimide compounds include a compound having at least two carbodiimide groups and its adduct, but specifically aliphatic carbodiimides, aliphatic carbodiimides having a cyclic group, benzene dicarbodiimides, naphthalene dicarbodiimides, biphenylcarbodiimides, diphenylmethane dicarbodiimides, triphenylmethane dicarbodiimides, tricarbodiimides, and tetracarbodiimides, as well as adducts of these carbodiimides, and adducts of these carbodiimides and divalent or trivalent polyalcohols. These carbodiimides may be produced by reaction of corresponding isocyanates and primary amines under presence of a phosphorus catalyst such as a phospholene compound.

A multifunctional carbodiimide compound of this invention is a compound having more than two carbodiimide groups or carbothioimide groups in the molecular structure. Further, preferred are multifunctional aromatic carbodiimide compounds which have a carbodiimide group and an aromatic group in the molecule.

As a multifunctional carbodiimide compound, any compound having a bifunctional carbodiimide group may be preferably employed, and specifically preferable compounds are those having a structure of following Formula (CI).

$$R_1\text{-}J_1\text{-}N{=}C{=}N\text{-}J_2\text{-}(L)_n\text{-}(J_3\text{-}N{=}CN\text{-}J_4\text{-}R_2)_{v1} \qquad \text{Formula (CI)}$$

In Formula (CI), $R_1$ and $R_2$ are each an aryl group or an alkyl group, $J_1$ and $J_4$ are each a divalent linking group, $J_2$ and $J_3$ are each an arylene group or an alkylene group, L is a (v1+1)-valent alkyl, alkenyl, aryl, or heterocyclic group, or a group in which these groups are bonded with a linking group, v1 is an integer of not less than 1, and n is an integer of 0 or 1.

In Formula (CI), as an alkyl group or an aryl group represented by $R_1$ or $R_2$, for example, alkyl groups include a methyl group, ethyl group, propyl group, butyl group, or a pentyl group, while aryl groups include residual groups of benzene, naphthalene, toluene, and xylene, and heterocyclic groups include residual groups of furan, thiophene; dioxane, pyridine, piperazine, and morpholine, and further the groups in which these groups may be bonded with a linking group.

(v1+1)-valent alkyl groups represented by L include a methyl, ethyl, propyl, butyl, and pentyl group; (v1+1)-valent alkenyl groups include an ethenyl, propenyl, butadiene, and pentadiene group; (v1+1)-valent aryl groups include residual groups of benzene, naphthalene, toluene, and xylene; (v1+1)-valent heterocyclic groups include residual groups of furan, thiophene, dioxane, pyridine, piperazine, and morpholine, and the groups in which these groups may be bonded with a linking group. A linking group may be a simple bonding or a linking group which is formed by an oxygen atom, a nitrogen atom, a sulfur atom, and phosphorus atom, and which may contain a carbon atom, for example, O, S, NH, CO, SO, $SO_2$, NHCO, NHCONH, PO, and PS. An integer not less than 1 represented by v is preferably an integer of 1–6, and more preferably 1, 2 or 3.

Specific examples of the acid radical capture agents are listed below.

X-2-1

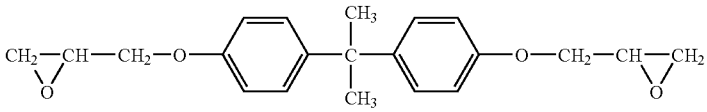

-continued
X-2-2
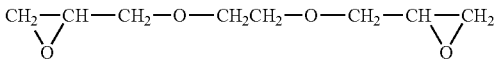
X-2-3
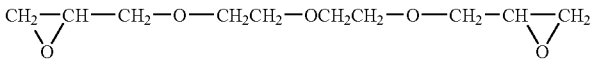
X-2-4
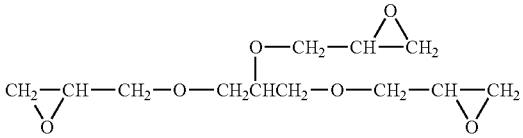
X-4-1
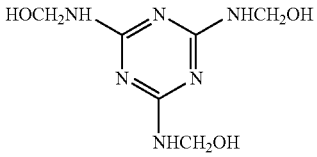
X-4-2
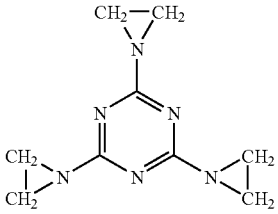
X-4-3
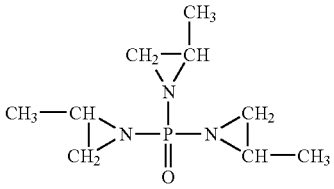
X-4-4
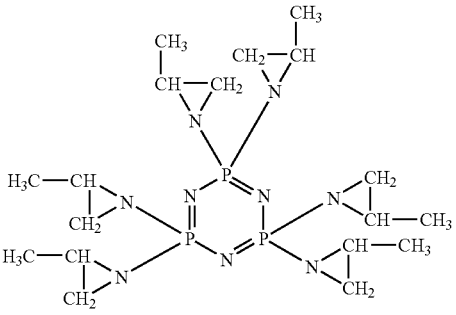
X-4-5
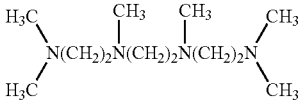
Cl-1
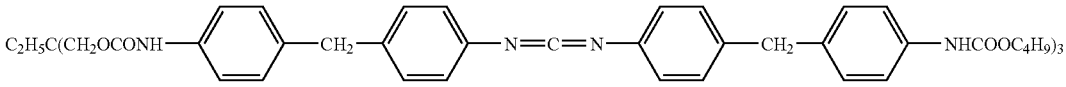
Cl-2
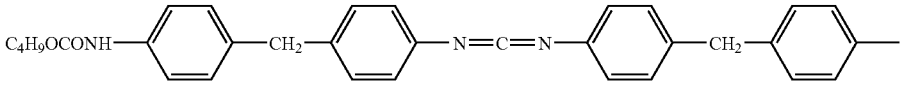

-continued
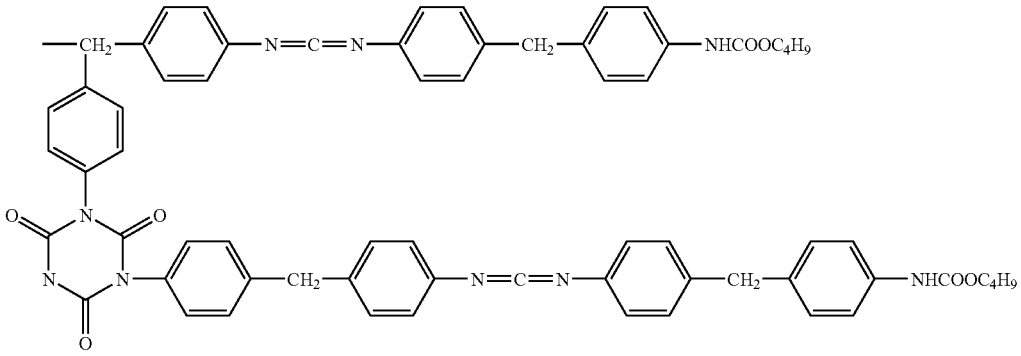
Cl-3
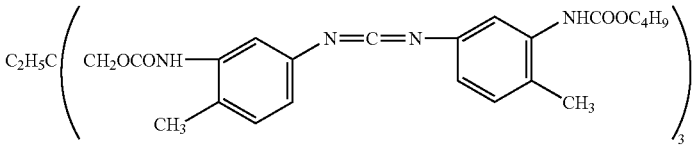
Cl-4
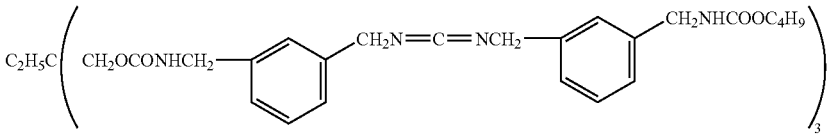
Cl-5
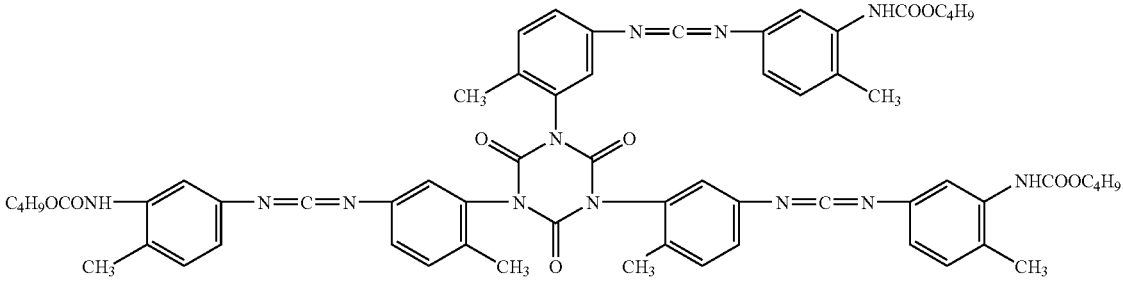
Cl-6
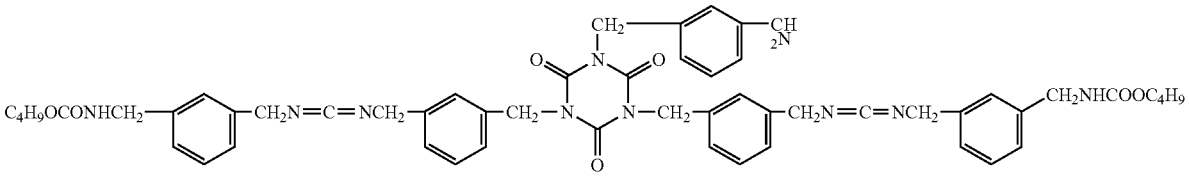
Cl-7
$C_2H_5C[CH_2OCONH(CH_2)_6N{=}C{=}N(CH_2)_6NHCOOC_4H_9]_3$
Cl-8
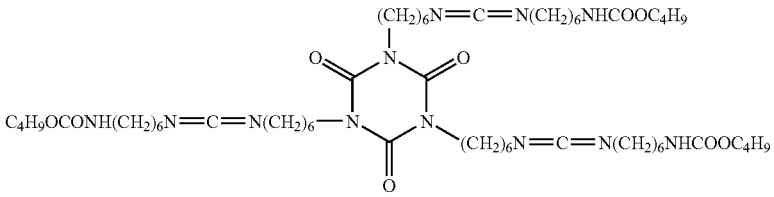
Cl-9
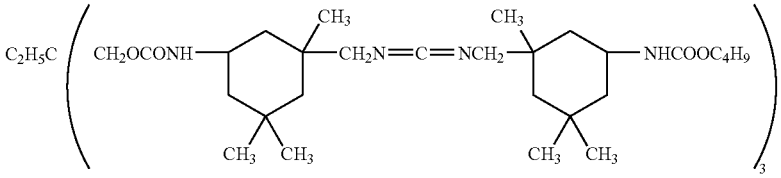

-continued
Cl-10
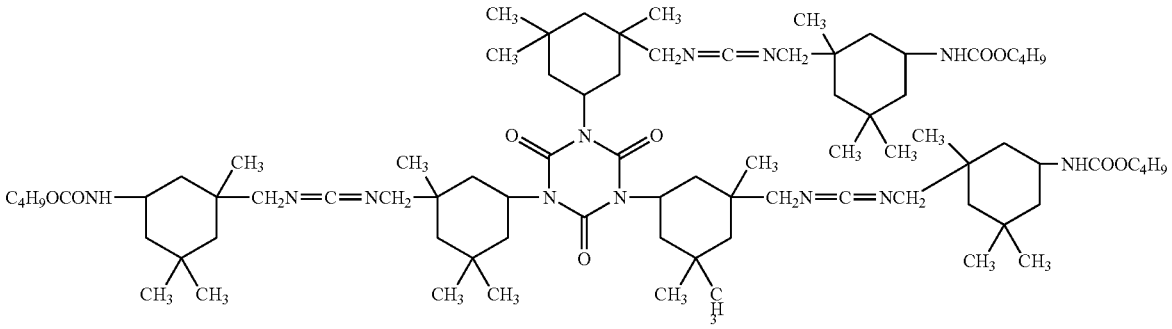
Cl-11
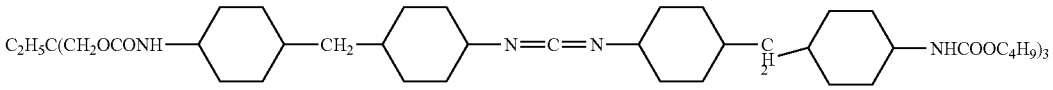
Cl-12
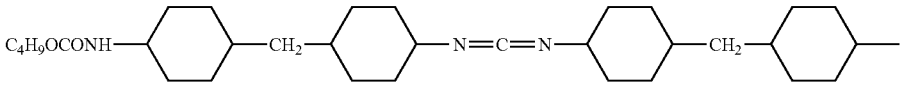
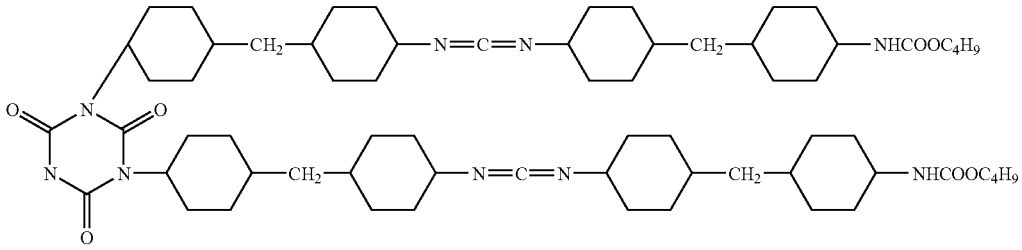
Cl-13
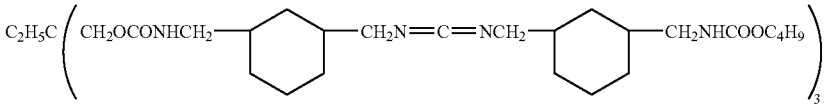
Cl-14
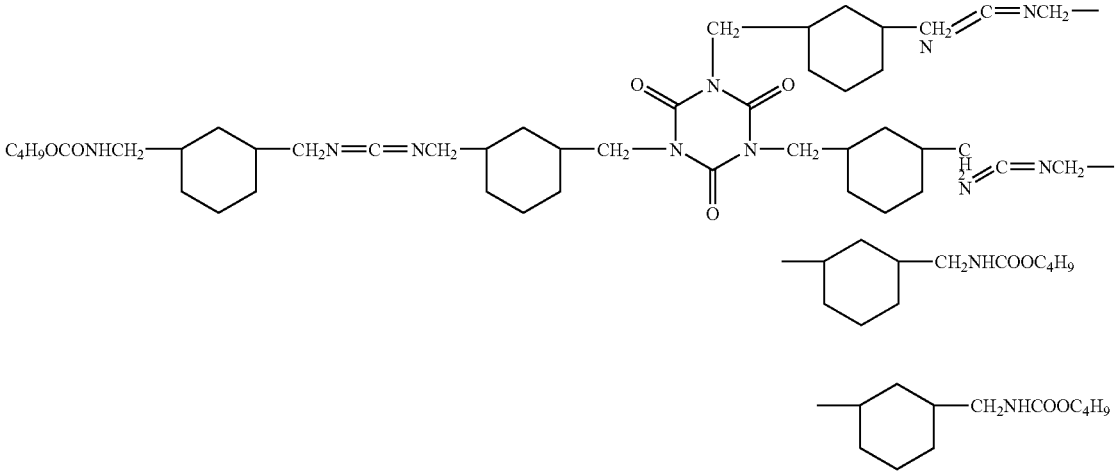

-continued
Cl-15
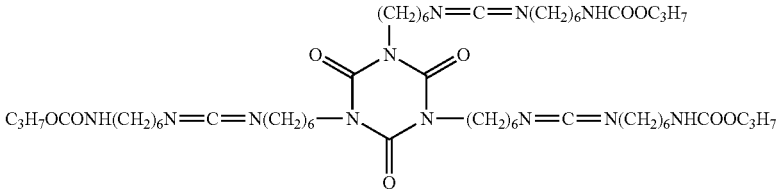
Cl-16
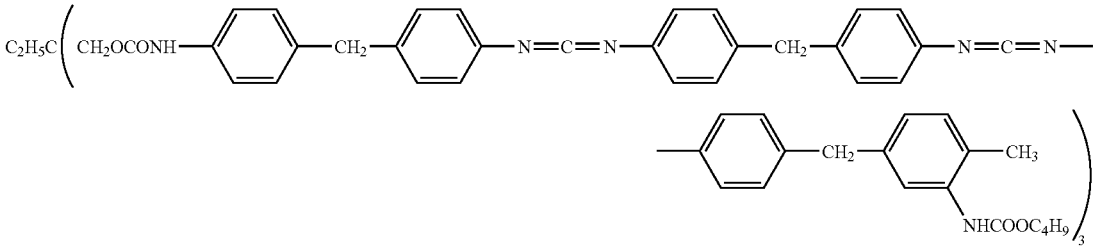
Cl-17
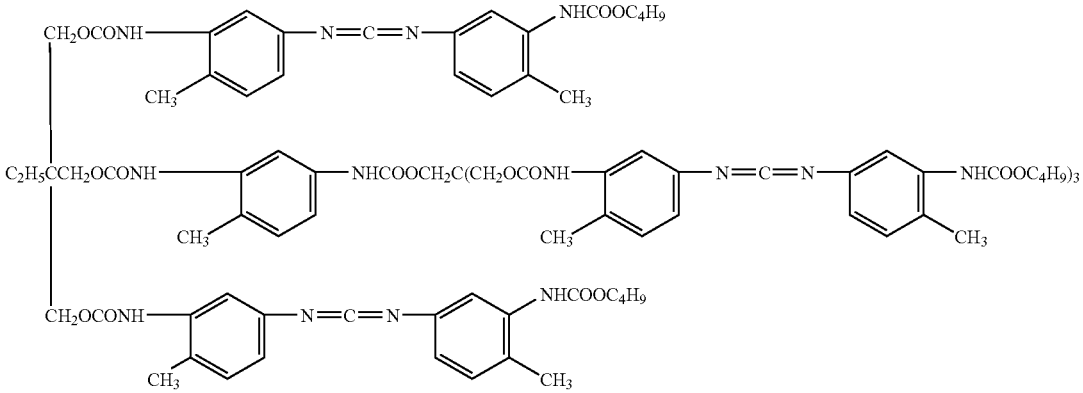
Cl-18
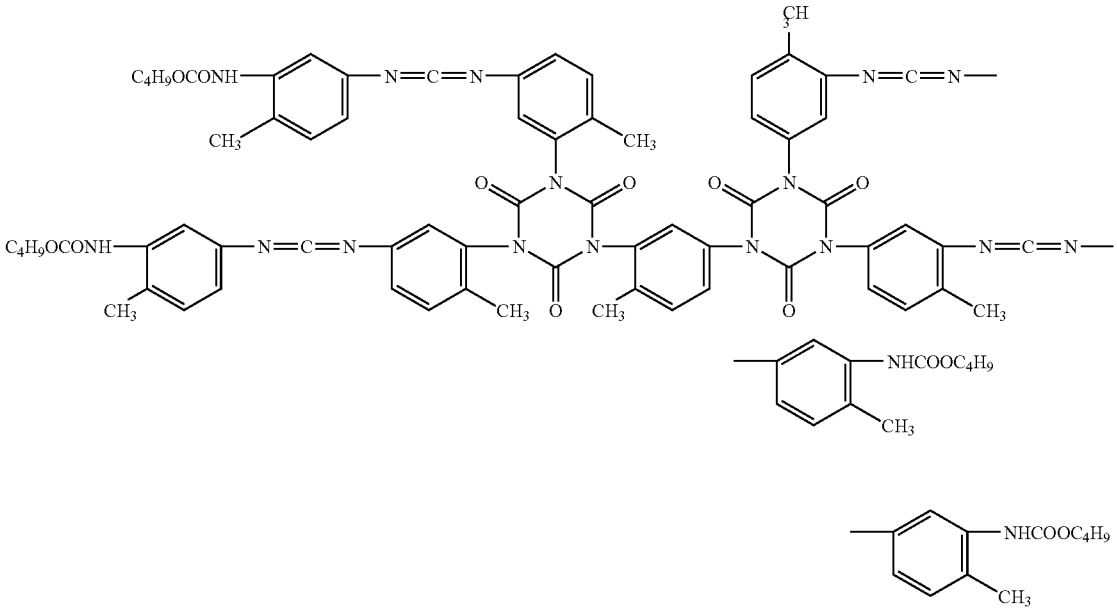

Of these specific examples described above, carbodiimide based compounds (CI-1)–(CI-18) are specifically preferable.

<Tabular Particles in Protective Layer>

In this invention, it is possible to reduce the quantity of the substances vaporized from film during development by employment of tabular particles in the protective layer.

As tabular particles, the aspect ratio of those is preferably not less than 10 and not more than 70, and more preferably not less than 20 and not more than 40.

Further, preferable tabular particles include Micromica ME-100, Micromica MK-100, MK-200, MK-300 (produced by Co-op Chemical Co., Ltd.) and B-82, B-92, B-102, and B-112 (produced by Yamaguchi Mica Co., Ltd.).

<Binder of Photosensitive Layer>

Suitable binders for the silver salt photothermographic material of this invention are to be transparent or translucent and commonly colorless, and include natural polymers, synthetic resin polymers and copolymers, as well as media to form films. The binders include, for example, gelatin, gum Arabic, casein, starch, poly(acrylic acid), poly(methacrylic acid), poly(vinyl chloride), poly(methacrylic acid), copoly (styrene-maleic anhydride), copoly(styrene-acrylonitrile), copoly(styrene-butadiene), poly(vinyl acetals) (for example, poly(vinyl formal) and poly(vinyl butyral)), poly(esters), poly(urethanes), phenoxy resins, poly(vinylidene chloride), poly(epoxides), poly(carbonates), poly(vinyl acetate), cellulose esters, and poly(amides).

Preferable binders for the photosensitive layer of the silver salt photothermographic dry imaging material of this invention are polyvinyl acetals, and a particularly preferable binder is polyvinyl butyral, which will be detailed hereunder. Polymers such as cellulose esters, especially polymers such as triacetyl cellulose, cellulose acetate butyrate, which exhibit higher softening temperature, are preferable for an overcoating layer as well as an undercoating layer, specifically for a light-insensitive layer such as a protective layer and a backing layer. Incidentally, if desired, the binders may be employed in combination of at least two types.

In this invention, it is preferable that thermal transition point temperature, after development is at higher or equal to 100° C., is from 46 to 200° C. and is more preferably from 70 to 105° C.

Thermal transition point temperature, as described in this invention, refers to the VICAT softening point or the value shown by the ring and ball method, and also refers to the endothermic peak which is obtained by measuring the individually peeled photosensitive layer which has been thermally developed, employing a differential scanning calorimeter (DSC), such as EXSTAR 6000 (manufactured by Seiko Denshi Co.), DSC220C (manufactured by Seiko Denshi Kogyo Co.), and DSC-7 (manufactured by Perkin-Elmer Co.).

The glass transition temperature (Tg) is determined employing the method, described in Brandlap, et al., "Polymer Handbook", pages from III-139–III-179, 1966 (published by Wiley and Son Co.). The Tg of the binder comprised of copolymer resins is obtained based on the following Formula.

Tg of the copolymer (in ° C.)$=v_1Tg_1+v_2Tg_2+\ldots+v_nTg_n$ wherein $v_1, v_2, \ldots v_n$ each represents the mass ratio of the monomer in the copolymer, and $Tg_1, Tg_2, \ldots Tg_n$ each represents Tg (in ° C.) of the homopolymer which is prepared employing each monomer in the copolymer. The accuracy of Tg, calculated based on the formula calculation, is ±5° C.

In the silver salt photothermographic dry imaging material of this invention, employed as binders, which are incorporated in the photosensitive layer, on the support, comprising aliphatic carboxylic acid silver salts, photosensitive silver halide grains and reducing agents, may be conventional polymers known in the art. The polymers have a Tg of 70–105° C., a number average molecular weight of 1,000–1,000,000, preferably 10,000–500,000, and a degree of polymerization of about 50–about 1,000. Examples of such polymers include polymers or copolymers comprised of constituent units of ethylenic unsaturated monomers such as vinyl chloride, vinyl acetate, vinyl alcohol, maleic acid, acrylic acid, acrylic acid esters, vinylidene chloride, acrylonitrile, methacrylic acid, methacrylic acid esters, styrene, butadiene, ethylene, vinyl butyral, and vinyl acetal, as well as vinyl ether, and polyurethane resins and various types of rubber based resins.

Further, listed are phenol resins, epoxy resins, polyurethane hardening type resins, urea resins, melamine resins, alkyd resins, formaldehyde resins, silicone resins, epoxy-polyamide resins, and polyester resins. Such resins are detailed in "Plastics Handbook", published by Asakura Shoten. These polymers are not particularly limited, and may be either homopolymers or copolymers as long as the resultant glass transition temperature, Tg is in the range of 70–105° C.

Listed as homopolymers or copolymers which comprise the ethylenic unsaturated monomers as constitution units are alkyl acrylates, aryl acrylates, alkyl methacrylates, aryl methacrylates, alkyl cyano acrylate, and aryl cyano acrylates, in which the alkyl group or aryl group may not be substituted. Specific alkyl groups and aryl groups include a methyl group, an ethyl group, an n-propyl group, an isopropyl group, an n-butyl group, an isobutyl group, a sec-butyl group, a tert-butyl group, an amyl group, a hexyl group, a cyclohexyl group, a benzyl group, a chlorophenyl group, an octyl group, a stearyl group, a sulfopropyl group, an N-ethyl-phenylaminoethyl group, a 2-(3-phenylpropyloxy) ethyl group, a dimethylaminophenoxyethyl group, a furfuryl group, a tetrahydrofurfuryl group, a phenyl group, a cresyl group, a naphthyl group, a 2-hydroxyethyl group, a 4-hydroxybutyl group, a triethylene glycol group, a dipropylene glycol group, a 2-methoxyethyl group, a 3-methoxybutyl group, a 2-actoxyethyl group, a 2-acetacttoxyethyl group, a 2-methoxyethyl group, a 2-iso-proxyethyl group, a 2-butoxyethyl group, a 2-(2-methoxyethoxy)ethyl group, a 2-(2-ethoxyetjoxy)ethyl group, a 2-(2-bitoxyethoxy)ethyl group, a 2-diphenylphsophorylethyl group, an ω-methoxypolyethylene glycol (the number of addition mol n=6), an ally group, and dimethylaminoethylmethyl chloride.

In addition, employed may be the monomers described below. Vinyl esters: specific examples include vinyl acetate, vinyl propionate, vinyl butyrate, vinyl isobutyrate, vinyl corporate, vinyl chloroacetate, vinyl methoxyacetate, vinyl phenyl-acetate, vinyl benzoate, and vinyl salicylate; N-substituted acrylamides, N-substituted methacrylamides and acrylamide and methacrylamide: N-substituents include a methyl group, an ethyl group, a propyl group, a butyl group, a tert-butyl group, a cyclohexyl group, a benzyl group, a hydroxymethyl group, a methoxyethyl group, a dimethylaminoethyl group, a phenyl group, a dimethyl group, a diethyl group, a β-cyanoethyl group, an N-(2-acetacetoxyethyl)group, a diacetone group; olefins: for example, dicyclopentadiene, ethylene, propylene, 1-butene, 1-pentane, vinyl chloride, vinylidene chloride, isoprene, chloroprene, butadiene, and 2,3-dimethylbutadiene; styrenes; for example, methylstyrene, dimethylstyrene, trimethylstyrene, ethylstyrene, isopropylstyrene, tert-butylstyrene, chloromethylstryene, methoxystyrene, acetoxystyrene, chlorostyrene, dichlorostyrene, bromostyrene, and vinyl methyl benzoate; vinyl ethers: for example, methyl vinyl ether, butyl vinyl ether, hexyl vinyl ether, methoxyethyl vinyl ether, and dimethylaminoethyl vinyl ether; N-substituted maleimides: N-substituents include a methyl group, an ethyl group, a propyl group, a butyl group, a tert-butyl group, a cyclohexyl group, a benzyl group, an n-dodecyl group, a phenyl group, a 2-methylphenyl group, a 2,6-diethylphenyl group, and a 2-chlorophenyl group; others include butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyl oxazolidone, N-vinyl pyrrolidone, acrylonitrile, metaacrylonitrile, methylene malonnitrile, vinylidene chloride.

Of these, listed as preferable examples are alkyl methacrylates, aryl methacrylates, and styrenes. Of such polymers, those having an acetal group are preferably employed because they exhibit excellent compatibility with the resultant aliphatic carboxylic acid, whereby an increase in flexibility of the resultant layer is effectively minimized.

Specifically preferred as polymers having an acetal group are the compounds represented by Formula (V) described below.

Formula (V)

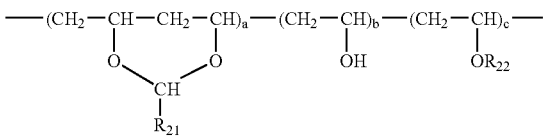

wherein $R_{21}$ is a substituted or unsubstituted alkyl group, and a substituted or unsubstituted aryl group, however, groups other than the aryl group are preferred; $R_{22}$ is a substituted or unsubstituted alkyl group, a substituted or unsubstituted aryl group, —$COR_3$ or —$CONHR_3$, wherein $R_{23}$ is the same as defined above for $R_{21}$.

Unsubstituted alkyl groups represented by $R_{21}$, $R_{22}$, and $R_{23}$ preferably have 1–20 carbon atoms and more preferably have 1–6 carbon atoms. The alkyl groups may have a straight or branched chain, but preferably have a straight chain. Listed as such unsubstituted alkyl groups are, for example, a methyl group, an ethyl group, an n-propyl group, an isopropyl group, an n-butyl group, an isobutyl group, a t-butyl group, an n-amyl group, a t-amyl group, an n-hexyl group, a cyclohexyl group, an n-heptyl group, an n-octyl group, a t-octyl group, a 2-ethylhexyl group, an n-nonyl group, an n-decyl group, an n-dodecyl group, and an n-octadecyl group. Of these, particularly preferred is a methyl group or a propyl group.

Unsubstituted aryl groups preferably have 6–20 carbon atoms and include, for example, a phenyl group and a naphthyl group. Listed as groups which can be substituted for the alkyl groups as well as the aryl groups are an alkyl group (for example, a methyl group, an n-propyl group, a t-amyl group, a t-octyl group, an n-nonyl group, and a dodecyl group), an aryl group (for example, a phenyl group), a nitro group, a hydroxyl group, a cyano group, a sulfo group, an alkoxy group (for example, a methoxy group), an aryloxy group (for example, a phenoxy group), an acyloxy group (for example, an acetoxy group), an acylamino group (for example, an acetylamino group), a sulfonamido group (for example, methanesulfonamido group), a sulfamoyl group (for example, a methylsulfamoyl group), a halogen atom (for example, a fluorine atom, a chlorine atom, and a bromine atom), a carboxyl group, a carbamoyl group (for example, a methylcarbamoyl group), an alkoxycarbonyl group (for example, a methoxycarbonyl group), and a sulfonyl group (for example, a methylsulfonyl group). When at least two of the substituents are employed, they may be the same or different. The number of total carbons of the substituted alkyl group is preferably 1–20, while the number of total carbons of the substituted aryl group is preferably 6–20.

$R_{22}$ is preferably —$COR_3$ (wherein $R_{23}$ is an alkyl group or an aryl group) and —$CONHR_{53}$ (wherein $R_{23}$ is an aryl group). "a", "b", and "c" are each the value in which the weight of repeated units is shown utilizing mol percent; "a" is in the range of 40–86 mol percents; "b" is in the range of 0–30 mol percents; "c" is in the range of 0–60 mol percents, so that a+b+c=100 is satisfied. Most preferably, "a" is in the range of 50–86 mol percents, "b" is in the range of 5–25 mol percents, and "c" is in the range of 0–40 mol percents. The repeated units having each composition ratio of "a", "b", and "c" may be the same or different.

Employed as polyurethane resins usable in the present invention may be those, known in the art, having a structure of polyester polyurethane, polyether polyurethane, polyether polyester polyurethane, polycarbonate polyurethane, polyester polycarbonate polyurethane, or polycaprolactone polyurethane. It is preferable that, if desired, all polyurethanes described herein are substituted, through copolymerization or addition reaction, with at least one polar group selected from the group consisting of —COOM, —$SO_3M$, —$OSO_3M$, —P═$O(OM)_2$, —O—P═$O(OM)_2$ (wherein M represents a hydrogen atom or an alkali metal salt group), —$N(R_4)_2$, —$N^+(R_4)_3$ (wherein $R_{54}$ represents a hydrocarbon group, and a plurality of $R_{54}$ may be the same or different), an epoxy group, —SH, and —CN. The amount of such polar groups is commonly $10^{-1}$–$10^{-8}$ mol/g, and is preferably $10^{-2}$–$10^{-6}$ mol/g. Other than the polar groups, it is preferable that the molecular terminal of the polyurethane molecule has at least one OH group and at least two OH groups in total. The OH group cross-links with polyisocyanate as a hardening agent so as to form a 3-dimensinal net structure. Therefore, the more OH groups which are incorporated in the molecule, the more preferred. It is particularly preferable that the OH group is positioned at the terminal of the molecule since thereby the reactivity with the hardening agent is enhanced. The polyurethane preferably has at least three OH groups at the terminal of the molecules, and more preferably has at least four OH groups. When polyurethane is employed, the polyurethane preferably has a glass transition temperature of 70–105° C., a breakage elongation of 100–2,000 percent, and a breakage stress of 0.5–100 $M/mm^2$.

Polymers represented by foregoing Formula (V) of the present invention can be synthesized employing common synthetic methods described in "Sakusan Binihru Jushi (Vinyl Acetate Resins)", edited by Ichiro Sakurada (Kohbunshi Kagaku Kankoh Kai, 1962).

Examples of representative synthetic methods will now be described. However, the present invention is not limited to these representative synthetic examples.

SYNTHETIC EXAMPLE 1

Synthesis of P-1

Charged into a reaction vessel were 20 g of polyvinyl alcohol (Gosenol GH18) manufactured by Nihon Gosei Co., Ltd. and 180 g of pure water, and the resulting mixture was dispersed in pure water so that 10 weight percent polyvinyl alcohol dispersion was obtained. Subsequently, the resultant dispersion was heated to 95° C. and polyvinyl alcohol was dissolved. Thereafter, the resultant solution was cooled to 75° C., whereby an aqueous polyvinyl alcohol solution was prepared. Subsequently, 1.6 g of 10 percent by weight hydrochloric acid, as an acid catalyst, was added to the solution. The resultant solution was designated as Dripping Solution A. Subsequently, 11.5 g of a mixture consisting of butylaldehyde and acetaldehyde in a mol ratio of 4:5 was prepared and was designated as Dripping Solution B. Added to a 1,000 ml four-necked flask fitted with a cooling pipe and a stirring device was 100 ml of pure water which was heated to 85° C. and stirred well. Subsequently, while stirring, Dripping Solution A and Dripping Solution B were simultaneously added dropwise into the pure water over 2 hours, employing a dripping funnel. During the addition, the reaction was conducted while minimizing coalescence of deposit particles by controlling the stirring rate. After the dropwise addition, 7 g of 10 weight percent hydrochloric acid, as an acid catalyst, was further added, and the resultant mixture was stirred for 2 hours at 85° C., whereby the reaction had sufficiently progressed. Thereafter, the reaction mixture was cooled to 40° C. and was neutralized employing sodium bicarbonate. The resultant product was washed with water 5 times, and the resultant polymer was collected through filtration and dried, whereby P-1 was prepared. The Tg of obtained P-1 was determined employing a DSC, resulting in 83° C.

Other polymers described in Table 1 were synthesized in the same manner as above.

These polymers may be employed individually or in combinations of at least two types as a binder. The polymers are employed as a main binder in the photosensitive silver salt containing layer (preferably in a photosensitive layer) of the present invention. The main binder, as described herein, refers to the binder in "the state in which the proportion of the foregoing binder is at least 50 percent by weight of the total binders of the photosensitive silver salt containing layer". Accordingly, other binders may be employed in the range of less than 50 weight percent of the total binders. The other polymers are not particularly limited as long as they are soluble in the solvents capable of dissolving the polymers of the present invention. More preferably listed as the polymers are poly(vinyl acetate), acrylic resins, and urethane resins.

Compositions of polymers, which are preferably employed in the present invention, are shown in Table 1. Incidentally, Tg in Table 1 is a value determined employing a differential scanning calorimeter (DSC), manufactured by Seiko Denshi Kogyo Co., Ltd.

TABLE 1

| Polymer Name | Acetoacetal mol % | Butyral mol % | Acetal mol % | Acetyl mol % | Hydroxyl Group mol % | Tg Value (° C.) |
|---|---|---|---|---|---|---|
| P-1 | 6 | 4 | 73.7 | 1.7 | 24.6 | 85 |
| P-2 | 3 | 7 | 75.0 | 1.6 | 23.4 | 75 |

TABLE 1-continued

| Polymer Name | Acetoacetal mol % | Butyral mol % | Acetal mol % | Acetyl mol % | Hydroxyl Group mol % | Tg Value (° C.) |
|---|---|---|---|---|---|---|
| P-3 | 10 | 0 | 73.6 | 1.9 | 24.5 | 110 |
| P-4 | 7 | 3 | 71.1 | 1.6 | 27.3 | 88 |
| P-5 | 10 | 0 | 73.3 | 1.9 | 24.8 | 104 |
| P-6 | 10 | 0 | 73.5 | 1.9 | 24.6 | 104 |
| P-7 | 3 | 7 | 74.4 | 1.6 | 24.0 | 75 |
| P-8 | 3 | 7 | 75.4 | 1.6 | 23.0 | 74 |
| P-9 | — | — | — | — | — | 60 |

Incidentally, in Table 1, P-9 is a polyvinyl butyral resin B-79, manufactured by Solutia Ltd.

In this invention, it is known that by employing cross-linking agents in the foregoing binders, uneven development is minimized due to improved adhesion of the layer to the support. In addition, a side effect is that fogging during storage is minimized and the creation of print-out silver after development is also minimized.

Described below will be non-aqueous dispersed particles (hereinafter, referred to as dispersed particles) which are insoluble in an organic solvent and feasible to add into the photothermographic imaging material of this invention.

As non-aqueous dispersed particles of this invention, employable without any limitation are, for example, an organic polymer particle (such a particle is known as a non-aqueous dispersed particle (NAD)), and an organic/inorganic composite particle. A polymerizable monomer having an unsaturated double bond and a cross-linking resin particle are preferably employed. Here, a non-aqueous particle means a particle which is suspended in a disperse medium containing water at more than 80%.

In cases when a binder and non-aqueous particles are employed in preparation of a coating composition of a photosensitive emulsion, dispersibility is enhanced, resulting in excellent stability of the coating composition. Also the composition is a particle coating composition exhibiting lower network aggregates compared to a coating composition prepared with only a binder, resulting in reduced staining with the photothermographic material obtained after coating, and lower temperature drying.

The polymerizable monomer having an unsaturated double bond, which monomer is preferably employed for preparation of dispersed particles in this invention, preferably contains a hydroxyl group, such as a hydroxyalkylacrylic acid, a hydroxyalkylmethacrylic acid, and modified compounds thereof. A hydroxyalkylacrylic acid includes one having an alkyl group of 1–6 carbon atoms, such as 2-hydroxyethylacrylic acid, and 2-hydroxypropylacrylic acid. A hydroxyalkylmethacrylic acid includes one having an alkyl group of 1–6 carbon atoms, such as 2-hydroxyethylmethacrylic acid, and 2-hydroxypropylmethacrylic acid.

Further, specific examples of the foregoing hydroxyalkylacrylic acid and hydroxyalkylmethacrylic acid include lactone modified 2-hydroxyethylacrylic acid, and lactone modified 2-hydroxyethylmethacrylic acid. The composition ratio of a polymerizable monomer having a hydroxyl group and an unsaturated double bond in a polymerizable monomer having an unsaturated double bond is preferably 0.5–35 weight %, but more preferably 1–30 weight %.

Further, the polymerizable monomers having a carboxyl group and an unsaturated double bond, which is employed to prepare dispersed particles used in this invention, include, for example, acrylic acid, methacrylic acid, maleic acid and fumaric acid. A carboxyl group may exist as an acid anhydride group, and maleic anhydride may be employed. The foregoing components may be employed alone or in combination of more than two kinds. The composition ratio of the polymerizable monomer having a carboxyl group and an unsaturated double bond in the polymerizable monomer having an unsaturated double bond is preferably 0.1–10 weight %, but more preferably 0.5–8 weight %. These polymerizable monomers having an unsaturated double bond may be employed alone or in combination of more than two kinds.

In this invention, a cross-linking resin particle is preferably employed. It is preferable to employ a copolymerized monomer of the cross-linking monomer having more than two unsaturated polymerizable groups (hereinafter, referred to as a cross-linking monomer). Other monomers are preferably selected so as to contain a functional group other than a polymerizable group, such as a carboxyl group, an epoxy group, an amino group, an isocyanate group, or a hydroxyl group.

Examples of the above cross-linking monomer include compounds containing plural polymerizable unsaturated groups, such as divinylbenzene, dially phthalate, ethylene diglycol di(meth)acrylate, trimethylolpropane tri(meth) acrylate, and pentaerythritol triacrylate.

Examples of the above "other monomers" include unsaturated nitrile compounds, such as butadiene, isoprene, dimethylbutadien, chloroprene, 1,3-pentadiene, (meth)acrylonitrile, α-chloroacrylonitrile, α-chloromethylacrylonitrile, α-methoxyacrylonitrile, α-ethoxyacrylonitrile, crotononitrile, cinnamoyl nitrile, itaconic acid dinitrile, maleic acid dinitrile, and fumaric acid dinitrile; unsaturated amides, such as (meth)acrylamide, N,N'-methylenebis(meth)acrylamide, N,N'-ethylenebis(meth)acrylamide, N,N'-hexamethylenebis (meth)acrylamide, N-hydroxymethyl(meth)acrylamide, N-(2-hydroxyethyl)(meth)acrylamide, N,N'-bis(2-hydroxyethyl)(meth)acrylamide, crotonic acid amide, and cinnamic acid amide; (meth)acrylic esters, such as methyl (meth) acrylate, ethyl (meth)acrylate, propyl (meth)acrylate, butyl (meth)acrylate, hexyl (meth)acrylate, lauryl (meth)acrylate, polyethylene glycol (meth)acrylate, and polypropylene glycol (meth)acrylate; aromatic vinyl compounds, such as styrene, α-methylstyrene, and o-methoxystyrene; epoxy(meth) acrylates, obtained by reaction of diglycidyl ether of bisphenol A or diglycidyl ether of glycol and (meth)acrylic acid or hydroxyalkyl(meth)acrylate, and urethane (meth) acrylate obtained by reaction of hydrohyalkyl(meth)acrylate and polyisocyanate; epoxy group containing unsaturated compounds, such as glycidyl(meth)acrylate, and (meth) acrylglycidyl ether; unsaturated acid compounds, such as (meth)acrylic acid, itaconic acid, β-(meth)acryloxyethyl succinate, β-(meth)acryloxyethyl maleate, β-(meth)acryloxyethyl phthalate, and β-(meth)acryloxyethyl hexahydrophthalate; amino group containing unsaturated compounds, such as dimethylamino(meth)acrylate, and diethylamino (meth)acrylate; anide group containing unsaturated compounds, such as (meth)acrylamide, and dimethyl(meth)acrylamide; hydroxyl group containing unsaturated compounds, such as hydroxyethyl(meth)acrylate, and hydroxypropyl (meth)acrylate.

As dispersed particles employable in this invention, urethane based cross-linking particles are preferred. Dispersion stabilizing agents being necessary to stabilize for dispersion of the urethane components into a dispersion medium include polyvinyl alcohol, hydroxyalkyl cellulose, carboxyalkyl cellulose, gum arabic, polyacrylate, polyacrylamide, polyvinyl pyrrolidone, ethylene maleic anhydride copolymer, and a nonionic, anionic or cationic surface active agent being well-known in the art, as well as various protective colloids. One or more than two kinds of the agents may be employed.

The dispersed particles employable in this invention exhibit an average particle diameter (φn) of the primary particle under dry conditions is commonly 0.05–2 μm, but preferably 0.05–0.5 μm. In cases when this average particle diameter is less than 0.05 μm, particles tend to aggregate to each other, resulting in difficulty of uniform dispersion in an organic solvent. On the other hand, when the average diameter (φn) exceeds 2 μm, haze of the coated film deteriorates.

Further, the above dispersed particles are characterized by being insoluble in organic solvents.

Specific examples employable in this invention are described below, but this invention is not limited to these examples.

PB-1: Stafiloid IM-101 (produced by Ganz Chemical Co., Ltd.)

PB-2: Stafiloid IM-203 (produced by Ganz Chemical Co., Ltd.)

PB-3: Stafiloid IM-4 01 (produced by Ganz Chemical Co., Ltd.)

PB-4: Stafiloid IM-601 (produced by Ganz Chemical Co., Ltd.)

PB-5: Stafiloid AC3355 (produced by Ganz Chemical Co., Ltd.)

PB-6: Stafiloid AC3364 (produced by Ganz Chemical Co., Ltd.)

PB-7: NarpowVP-101 (available from Sanyo Trading Co., Ltd.)

PB-8: NarpowVP-301 (available from Sanyo Trading Co., Ltd.)

PB-9: NarpowVP-401 (available from Sanyo Trading Co., Ltd.)

PB-10: NarpowVP-601 (available from Sanyo Trading Co., Ltd.)

PB-11: Aquabrid4735 (produced by Daisel Chemical Industries, Ltd.)

Further, the glass transition temperature (Tg) of a dispersed particle binder employable in this invention is preferably −40 to 105° C. When too low, the film exhibits reduced resistance to external stress, and when too high, the photothermographic material is inactive to thermal development.

The following binders containing dispersed particles are employed in the range of a proportion in which the binders function effectively. Skilled persons in the art can easily determine the effective range. For example, preferred as the index for maintaining aliphatic carboxylic acid silver salts in a photosensitive layer is the proportion range of binders to aliphatic carboxylic acid silver salts of 15:1 to 1:2 and most preferably of 8:1 to 1:1. Namely, the binder amount in the photosensitive layer is preferably from 1.5–6 g/m$^2$, and is more preferably from 1.7–5 g/m$^2$. When the binder amount is less than 1.5 g/m$^2$, density of the unexposed portion markedly increases, whereby it occasionally becomes impossible to use the resultant material.

<Cross-linking Agent in Photosensitive Layer>

Employed as cross-linking agents used in this invention may be various conventional cross-linking agents, which have been employed for silver halide photosensitive photographic materials, and preferably listed are the hardening agents preferably employed in the above protective layer.

The added amount of the compound represented by foregoing Formula (IC) in this invention is 0.001–2 mol per mol of silver, and preferably in the range of 0.005–0.5 mol.

The epoxy compounds represented by foregoing Formula (EP) may be employed individually or in combinations of at least two types. The added amount is not particularly limited but is preferably in the range of $1\times10^{-6}$–$1\times10^{-2}$ mol/m$^2$, and is more preferably in the range of $1\times10^{-5}$–$1\times10^{-3}$ mol/m$^2$.

The epoxy compounds may be incorporated in optional layers on the photosensitive layer side of a support, such as a photosensitive layer, a surface protective layer, an interlayer, an antihalation layer, and a subbing layer, and may be incorporated in at least two layers. In addition, the epoxy compounds may be incorporated in optional layers on the side opposite the photosensitive layer on the support. Incidentally, when a photosensitive material has photosensitive layers on both sides, the epoxy compounds may be incorporated in any layer.

The added amount of the acid anhydrides represented by foregoing Formula (SA) is preferably in the range of $1\times10^{-6}$–$1\times10^{-2}$ mol/m$^2$, and is more preferably in the range of $1\times10^{-5}$–$1\times10^{-3}$ mol/m$^2$.

The acid anhydrides employed in this may be incorporated in optional layers on the photosensitive layer side on a support, such as a photosensitive layer, a surface protective layer, an interlayer, an antihalation layer, or a subbing layer, and may be incorporated in at least two layers. Further, the acid anhydrides may be incorporated in the layer(s) in which the epoxy compounds are incorporated.

<Silver Halide Grains>

Photosensitive silver halide grains (hereinafter, simply referred to as silver halide grains) will be described which are employed in the silver salt photothermographic dry imaging material of the present invention (hereinafter, simply referred to as the photosensitive material of this invention).

The photosensitive silver halide grains, as described in this invention, refer to silver halide crystalline grains which can originally absorb light as an inherent quality of silver halide crystals, can absorb visible light or infrared radiation through artificial physicochemical methods and are treatment-produced so that physicochemical changes occur in the interior of the silver halide crystal and/or on the crystal surface, when the crystals absorb any radiation from ultraviolet to infrared.

Silver halide grains employed in the present invention can be prepared in the form of silver halide grain emulsions, employing methods described in P. Glafkides, "Chimie et Physique Photographiques" (published by Paul Montel Co., 1967), G. F. Duffin, "Photographic Emulsion Chemistry" (published by The Focal Press, 1955), and V. L. Zelikman et al., "Making and Coating Photographic Emulsion", published by The Focal Press, 1964). Namely, any of an acidic method, a neutral method, or an ammonia method may be employed. Further, employed as methods to allow water-soluble silver salts to react with water-soluble halides may be any of a single-jet precipitation method, a double-jet precipitation method, or combinations thereof. However, of these methods, the so-called controlled double-jet precipitation method is preferably employed in which silver halide grains are prepared while controlling formation conditions.

Halogen compositions are not particularly limited. Any of silver chloride, silver chlorobromide, silver chloroiodobromide, silver bromide, silver iodobromide, or silver iodide may be employed. Of these, silver bromide or silver iodobromide is particularly preferred.

The content ratio of iodine in silver iodobromide is preferably in the range of 0.02 to 16 mol percent per Ag mol. Iodine may be incorporated so that it is distributed into the entire silver halide grain. Alternatively, a core/shell structure may be formed in which, for example, the concentration of iodine in the central portion of the grain is increased, while the concentration near the grain surface is simply decreased or substantially decreased to zero.

Grain formation is commonly divided into two stages, that is, the formation of silver halide seed grains (being nuclei) and the growth of the grains. Either method may be employed in which two stages are continually carried out, or in which the formation of nuclei (seed grains) and the growth of grains are carried out separately. A controlled double-jet precipitation method, in which grains are formed while controlling the pAg and pH which are grain forming conditions, is preferred, since thereby it is possible to control grain shape as well as grain size. For example, when the method, in which nucleus formation and grain growth are separately carried out, is employed, initially, nuclei (being seed grains) are formed by uniformly and quickly mixing water-soluble silver salts with water-soluble halides in an aqueous gelatin solution. Subsequently, under the controlled pAg and pH, silver halide grains are prepared through a grain growing process which grows the grains while supplying water-soluble silver salts as well as water-soluble halides.

In order to minimize milkiness (or white turbidity) as well as coloration (yellowing) after image formation and to obtain excellent image quality, the average grain diameter of the silver halide grains, employed in the present invention, is preferably rather small. The average grain diameter, when grains having a grain diameter of less than 0.02 μm is beyond practical measurement, is preferably 0.030–0.055 μm.

Incidentally, grain diameter, as described herein, refers to the edge length of silver halide grains which are so-called regular crystals such as a cube or an octahedron. Further, when silver halide gains are planar, the grain diameter refers to the diameter of the circle which has the same area as the projection area of the main surface.

In this invention, silver halide grains are preferably in a state of monodispersion. Monodispersion, as described herein, means that the variation coefficient, obtained by the formula described below, is less than or equal to 30 percent. The foregoing variation coefficient is preferably less than or equal to 20 percent, and is more preferably less than or equal to 15 percent.

Variation coefficient (in percent) of grain diameter=standard deviation of grain diameter/average of grain diameter×100

Cited as shapes of silver halide grains may be cubic, octahedral and tetradecahedral grains, planar grains, spherical grains, rod-shaped grains, and roughly elliptical-shaped grains. Of these, cubic, octahedral, tetradecahedral, and planar silver halide grains are particularly preferred.

When the foregoing planar silver halide grains are employed, their average aspect ratio is preferably 1.5 to 100, and is more preferably 2 to 50. These are described in U.S. Pat. Nos. 5,264,337, 5,314,798, and 5,320,958, and incidentally it is possible to easily prepare the foregoing target planar grains. Further, it is possible to preferably employ silver halide grains having rounded corners.

The crystal habit of the external surface of silver halide grains is not particularly limited. However, when spectral sensitizing dyes, which exhibit crystal habit (surface) selectiveness are employed, it is preferable that silver halide grains are employed which have the crystal habit matching their selectiveness in a relatively high ratio. For example, when sensitizing dyes, which are selectively adsorbed onto a crystal plane having a Miller index of (100), it is preferable that the ratio of the (100) surface on the external surface of silver halide grains is high. The ratio is preferably at least 50 percent, is more preferably at least 70 percent, and is most preferably at least 80 percent. Incidentally, it is possible to obtain a ratio of the surface having a Miller index of (100), based on T. Tani, J. Imaging Sci., 29, 165 (1985), utilizing adsorption dependence of sensitizing dye in a (111) plane as well as a (100) surface.

The silver halide grains, employed in this invention, are preferably prepared employing low molecular weight gelatin, having an average molecular weight of less than or equal to 50,000 during the formation of the grains, which are preferably employed during formation of nuclei. The low molecular weight gelatin refers to gelatin having an average molecular weight of less than or equal to 50,000. The molecular weight is preferably from 2,000–40,000, and is more preferably from 5,000–25,000. It is possible to measure the molecular weight of gelatin employing gel filtration chromatography.

The concentration of dispersion media during the formation of nuclei is preferably less than or equal to 5 percent by weight. It is more effective to carry out the formation at a low concentration of 0.05–3.00 percent by weight.

During formation of the silver halide grains employed in this invention, it is possible to use polyethylene oxides represented by the formula described below.

$$YO(CH_2CH_2O)_{ma}(CH(CH_3)CH_2O)_{pa}(CH_2CH_2O)_{na}Y \qquad \text{Formula}$$

wherein Y is a hydrogen atom, —$SO_3M$, or —CO—B—COOM; M is a hydrogen atom, an alkali metal atom, an ammonium group, or an ammonium group substituted with an alkyl group having less than or equal to 5 carbon atoms; B is a chained or cyclic group which forms an organic dibasic acid; ma and na are each 0–50; and pa is 1–100.

When silver halide photosensitive photographic materials are produced, polyethylene oxides, represented by the above formula, have been preferably employed as anti-foaming agents to counter marked foaming which occurs while stirring and transporting emulsion raw materials in a process in which an aqueous gelatin solution is prepared, in the process in which water-soluble halides as well as water-soluble silver salts are added to the gelatin solution, and in a process in which the resultant emulsion is applied onto a support. Techniques to employ polyethylene oxides as an anti-foaming agent are disclosed in, for example, JP-A 44-9497. The polyethylene oxides represented by the above formula function as an anti-foaming agent during nuclei formation.

The content ratio of polyethylene oxides, represented by the above formula, is preferably less than or equal to 1 percent by weight with respect to silver, and is more preferably from 0.01–0.10 percent by weight.

It is desired that polyethylene oxides, represented by the above formula, are present during nuclei formation. It is preferable that they are previously added to the dispersion media prior to nuclei formation. However, they may also be added during nuclei formation, or they may be employed by adding them to an aqueous silver salt solution or an aqueous halide solution which is employed during nuclei formation. However, they are preferably employed by adding them to an aqueous halide solution, or to both aqueous solutions in an amount of 0.01–2.00 percent by weight. Further, it is preferable that they are present during at least 50 percent of the time of the nuclei formation process, and it is more preferable that they are present during at least 70 percent of the time of the same. The polyethylene oxides, represented by the above formula, may be added in the form of powder or they may be dissolved in a solvent such as methanol and then added.

Incidentally, temperature during nuclei formation is commonly at 5–60° C., and is preferably at 15–50° C. It is preferable that the temperature is controlled within the range, even when a constant temperature, a temperature increasing pattern (for example, a case in which temperature at the initiation of nuclei formation is 25° C., subsequently, temperature is gradually increased during nuclei formation and the temperature at the completion of nuclei formation is 40° C.), or a reverse sequence may be employed.

The concentration of an aqueous silver salt solution and an aqueous halide solution, employed for nuclei formation, is preferably less than or equal to 3.5 M/L, and is more preferably in the lower range of 0.01 to 2.50 M. The silver ion addition rate during nuclei formation is preferably at $1.5\times10^{-3}$–$3.0\times10^{-1}$ mol/minute per liter of the reaction solution, and is more preferably at $3.0\times10^{-3}$–$8.0\times10^{-2}$ mol/minute.

The pH during nuclei formation can be set in the range of 1.7 to 10.0. However, since the pH on the alkali side broadens the particle size distribution of the formed nuclei, the preferred pH is 2–6. Further, the pBr during nuclei formation is usually at about 0.05–about 3.00, is preferably at 1.0–0 2.5, and is more preferably at 1.5–2.0.

In this invention, a mean grain size of silver halide grains is generally 10–50 nm, preferably 10–40 nm and more preferably 10–35 nm. When the mean grain size is less than 10 nm, image density may be decreased or light irradiation image stability (storage stability in the case of an image obtained by thermal development is used in a day light room for such as diagnosis, or stored in a daylight room) may be deteriorated. While the mean grain size is over 50 nm, image density may be decreased.

Herein, the mean grain size refers to an edge length of a silver halide grain when silver halide grains contained in a silver halide grain emulsion are normal crystals such as cubic or octahedral crystal. Further, in the case of silver halide grains are tabular grains, the mean grain size is referred with respect to a diameter of circles having the same area as the projected area of the primary surface. In the case of those other than normal crystals, for example, such as spherical grains and rod-shaped grains, The mean grain size is calculated by defining the diameter of a supposed sphere having an equivalent volume to that of said silver halide grain. The measurement was performed by use of an electronmicroscope, and a mean grain size was determined by averaging the measured grain size values of 300 grains.

Further, in this invention, by utilizing silver halide grains having a mean grain size of 55–100 nm and silver halide grains having a mean grain size of 10–50 nm in combination, a gradation of image density can be improved as well as decrease of image density can be improved (minimized). The ratio (weight ratio) of silver halide grains having a mean grain size of 10–50 nm to silver halide grains having a mean grain size of 55–100 nm is preferably 95/5-50/50 and more preferably 90/10-60/40.

Herein, when two types of silver halide grain emulsions are utilized as described above, said two types of silver halide emulsions may be mixed to be contained in a photosensitive layer. Further, to adjust such as gradation, a photosensitive layer may be constituted of at least two layers in each of which said two types of silver halide grain emulsions having different mean grain size are preferably separately contained.

(Silver Halide Grins Having Iodide Content of 5–100 Mol %)

Silver halide grains according to this invention preferably contain silver iodide. The halogen composition is not less than 5 mol % and not more than 10 mol %, preferably not less than 40 mol % and not more than 100 mol %, more preferably not less than 70 mol % and not more than 100 mol % and specifically preferably not less than 90 mol % and not more than 100 mol %, based on silver iodide content. Provided that the iodide content is in this range, halogen composition distribution in the interior of silver halide may be uniform, stepwise varied or continuously varied. Silver halide grains provided with a core/shell structure having a high silver iodide content at the interior and/or the surface, can be preferably utilized. The core/shell structure is preferably a 2–5 folded structure and more preferably a 2–4 folded structure.

As a method to introduce silver iodide in silver halide grains according to this invention, preferable are a method in which an aqueous alkali iodide solution is added during the grain precipitation, a method in which at least one type of micro-particles among silver iodide micro-particles, silver bromoiodide micro-particles, silver chloroiodide micro-particles and silver bromochloroiodide micro-particles, and a method to utilize an iodide releasing agent as described in JP-A Nos. 5-323487 and 6-11780.

Silver halide grains according to this invention preferably exhibits direct transition absorption arising from a silver iodide crystal structure within wavelengths of 350–440 nm. Whether these silver halides have an optical absorption arising from a direct transition grains can be easily distinguished by an exciton absorption arising from a direct transition around 400–430 nm.

<Silver Halide Grains of Internal Latent Formation After Thermal Development>

Photosensitive silver halide grains according to this invention are preferably silver halide grains the surface sensitivity of which is decreased by conversion from a surface latent image type to an internal latent image type with thermal development.

That is, in the silver halide grains, a latent image, which functions as a catalyst of a development reaction ( ), is formed on the surface of said silver halide grains at exposure before thermal development, while since a latent image is formed in the interior more than on the surface, of said silver halide grains at exposure after thermal development process, latent image formation on the surface is restrained.

Generally, when photosensitive silver halide grains are exposed to light, silver halide grains themselves or spectral sensitizing dyes, which are adsorbed on the surface of photosensitive silver halide grains, are subjected to photo-excitation to generate free electrons. Generated electrons are competitively trapped by electron traps (sensitivity centers) on the surface or interior of silver halide grains.

Accordingly, when chemical sensitization centers (chemical sensitization specks) and dopants, which are useful as an electron trap, are much more located on the surface of the silver halide grains than the interior thereof and the number is appropriate, latent images are dominantly formed on the surface, whereby the resulting silver halide grains become developable. Contrary to this, when chemical sensitization centers (chemical sensitization specks) and dopants, which are useful as an electron trap, are much more located in the interior of the silver halide grains than the surface thereof and the number is appropriate, latent images are dominantly formed in the interior, whereby it becomes difficult to develop the resulting silver halide grains. In other words, in the former, the surface speed is higher than interior speed, while in the latter, the surface speed is lower than the interior speed. The former type of latent image is called "a surface latent image", and the latter is called "an internal latent image". Examples of the references are:

(1) T. H. James ed., "The Theory of the Photographic Process" $4^{th}$ edition, Macmillan Publishing Co., Ltd. 1977; and (2) Japan Photographic Society, "Shashin Kogaku no Kiso" (Basics of Photographic Engineering), Corona Publishing Co. Ltd., 1998.

The photosensitive silver halide grains of this invention are preferably provided with dopants which act as electron trapping in the interior of silver halide grains at least in a stage of exposure to light after thermal development. This is required so as to achieve high photographic speed grains as well as high image keeping stability.

It is especially preferred that the dopants act as a hole trap during an exposure step prior to thermal development, and the dopants change after a thermal development step resulting in functioning as an electron trap.

Electron trapping dopants, as described herein, refer to silver, elements except for halogen or compounds constituting silver halide, and the foregoing dopants themselves which exhibit properties capable of trapping free electron, or the foregoing dopants are incorporated in the interior of silver halide grains to generate electron trapping portions such as lattice defects. For example, listed are metal ions other than silver ions or salts or complexes thereof, chalcogen (such as elements of oxygen family) sulfur, selenium, or tellurium, inorganic or organic compounds comprising nitrogen atoms, and rare earth element ions or complexes thereof.

Listed as metal ions, or salts or complexes thereof may be lead ions, bismuth ions, and gold ions, or lead bromide, lead carbonate, lead sulfate, bismuth nitrate, bismuth chloride, bismuth trichloride, bismuth carbonate, sodium bismuthate, chloroauric acid, lead acetate, lead stearate, and bismuth acetate.

Employed as compounds comprising chalcogen such as sulfur, selenium, and tellurium may be various chalcogen releasing compounds which are generally known as chalcogen sensitizers in the photographic industry. Further, preferred as organic compounds comprising chalcogen or nitrogen are heterocyclic compounds which include, for example, imidazole, pyrazole, pyridine, pyrimidine, pyrazine, pyridazine, triazole, triazine, idole, indazole, purine, thiazole, oxadiazole, quinoline, phthalazine, naphthylizine, quinoxaline, quinazoline, cinnoline, pteridine, acrydine, phenanthroline, phenazine, tetrazole, thiazole, oxazole, benzimidazole, benzoxazole, benzthiazole, indolenine, and tetraazaindene. Of these, preferred are imidazole, pyrazine, pyrimidine, pyrazine, pyridazine, triazole, triazine, thiadiazole, oxadiazole, quinoline, phthalazine, naphthylizine, quinoxaline, quinazoline, cinnoline, tetrazole, thiazole, oxazole, benzimidazole, benzoxazole, benzthiazole, and tetraazaindene.

Incidentally, the foregoing heterocyclic compounds may have substituent(s). Preferable substituents include an alkyl group, an alkenyl group, an aryl group, an alkoxy group, an aryloxy group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, a ureido group, a phosphoric acid amide group, a halogen atom, a cyano group, a sulfo group, a carboxyl group, a nitro group, a heterocyclic group. Of these, more preferred are an alkyl group, an aryl group, an alkoxy group, an aryloxy group, an acyl group, an acylamino group, an alkoxycarbonylamino group, an aryloxycarbonylamino group, a sulfonylamino group, a sulfamoyl group, a carbamoyl group, a ureido group, a phosphoric acid amido group, a halogen atom, a cyano group, a nitro group, and a heterocyclic group. More preferred are an alkyl group, an aryl group, an alkoxy group, an aryloxy group, an acyl group, an acylamino group, a sulfonylamino group, a sulfamoyl group, a carbamoyl group, a halogen atom, a cyano group, a nitro group, and a heterocyclic group.

Incidentally, ions of transition metals which belong to Groups 6 through 11 in the Periodic Table may be chemically modified to form a complex employing ligands of the oxidation state of the ions and incorporated in silver halide grains employed in this invention so as to function as an electron trapping dopant, as described above, or as a hole trapping dopant. Preferred as foregoing transition metals are W, Fe, Co, Ni, Cu, Ru, Rh, Pd, Re, Os, Ir, and Pt.

In this invention, foregoing various types of dopants may be employed individually or in combination of at least two of the same or different types. It is required that at least one of the dopants act as an electron trapping dopant during an exposure time after being thermal developed. They may be incorporated in the interior of the silver halide grains in any forms of chemical states.

It is not recommended to use a complex or a salt of Ir or Cu as a single dopant without combining with other dopant.

The content ratio of dopants is preferably in the range of $1\times10^{-9}$–$1\times10$ mol per mol of silver, and is more preferably $1\times10^{-6}$–$1\times10^{-2}$ mol.

However, the optimal amount varies depending the types of dopants, the diameter and shape of silver halide grains, and ambient conditions. Accordingly, it is preferable that addition conditions are optimized taking into account these conditions.

In this invention, preferred as transition metal complexes or complex ions are those represented by the formula described below.

$$[ML_6]^m \qquad \text{Formula}$$

wherein M is a transition metal selected from the elements of Groups 6 through 11 in the Periodic Table; L is a ligand; and m is 0, -, 2-, 3-, or 4-. Listed as specific examples of ligands represented by L are a halogen ion (a fluoride ion, a chloride ion, a bromide ion, or an iodide ion), a cyanide, a cyanate, a thiocyanate, a selenocyanate, a tellurocyanate, an azide, and an aqua ligand, and nitrosyl and thionitrosyl. Of these, aqua, nitrosyl, and thionitrosyl are preferred. When the aqua ligand is present, one or two ligands are preferably occupied by the aqua ligand. L may be the same or different.

It is preferable that compounds, which provide ions of these metals or complex ions, are added during formation of silver halide grains so as to be incorporated in the silver halide grains. The compounds may be added at any stage of, prior to or after, silver halide grain preparation, namely nuclei formation, grain growth, physical ripening or chemical ripening. However, they are preferably added at the stage of nuclei formation, grain growth, physical ripening, are more preferably added at the stage of nuclei formation and growth, and are most preferably added at the stage of nuclei formation. They may be added over several times upon dividing them into several portions. Further, they may be uniformly incorporated in the interior of silver halide grains. Still further, as described in JP-A Nos. 63-29603, 2-306236, 3-167545, 4-76534, 6-110146, and 5-273683, they may be incorporated so as to result in a desired distribution in the interior of the grains.

These metal compounds may be dissolved in water or suitable organic solvents (for example, alcohols, ethers, glycols, ketones, esters, and amides) and then added. Further, addition methods include, for example, a method in which either an aqueous solution of metal compound powder or an aqueous solution prepared by dissolving metal compounds together with NaCl and KCl is added to a water-soluble halide solution, a method in which silver halide grains are formed by a silver salt solution, and a halide solution together with a the compound solution as a third aqueous solution employing a triple-jet precipitation method, a method in which, during grain formation, an aqueous metal compound solution in a necessary amount is charged into a reaction vessel, or a method in which, during preparation of silver halide, other silver halide grains which have been doped with metal ions or complex ions are added and dissolved. Specifically, a method is preferred in which either an aqueous solution of metal compound powder or an aqueous solution prepared by dissolving metal compounds together with NaCl and KCl is added to a water-soluble halide solution. When added onto the grain surface, an aqueous metal compound solution in a necessary amount may be added to a reaction vessel immediately after grain formation, during or after physical ripening, or during chemical ripening.

Incidentally, it is possible to introduce non-metallic dopants into the interior of silver halide employing the same method as the metallic dopants.

In the imaging materials in accordance with this invention, it is possible to evaluate whether the foregoing dopants exhibit electron trapping properties or not, while employing a method which has commonly employed in the photographic industry. Namely a silver halide emulsion comprised of silver halide grains, which have been doped with the foregoing dopant or decomposition product thereof so as to be introduced into the interior of grains, is subjected to photoconduction measurement, employing a microwave photoconduction measurement method. Subsequently, it is possible to evaluate the foregoing electron trapping properties by comparing the resulting decrease in photoconduction to that of the silver halide emulsion comprising no dopant as a standard. It is also possible to evaluate the same by performing experiments in which the internal speed of the foregoing silver halide grains is compared to the surface speed.

Further, a method follows which is applied to a finished photothermographic dry imaging material to evaluate the electron trapping dopant effect in accordance with the present invention. For example, prior to exposure, the foregoing imaging material is heated under the same conditions as the commonly employed thermal development conditions. Subsequently, the resulting material is exposed to white light or infrared radiation through an optical wedge for a definite time (for example, 30 seconds), and thermally developed under the same thermal development conations as above, whereby a characteristic curve (or a densitometry curve) is obtained. Then, it is possible to evaluate the foregoing electron trapping dopant effect by comparing the speed obtained based on the characteristic curve to that of the imaging material which is comprised of the silver halide emulsion which does not comprise the foregoing electron trapping dopant. Namely, it is necessary to confirm that the speed of the former sample comprised of the silver halide grain emulsion comprising the dopant in accordance with the present invention is lower than the latter sample which does not comprise the foregoing dopant.

Speed of the foregoing material is obtained based on the characteristic curve which is obtained by exposing the foregoing material to white light or infrared radiation through an optical wedge for a definite time (for example 30 seconds) followed by developing the resulting material under common thermal development conditions. Further, speed of the foregoing material is obtained based on the characteristic curve which is obtained by heating the foregoing material under common thermal development conditions prior to exposure and giving the same definite exposure as above to the resulting material for the same definite time as above followed by thermally developing the resulting material under common thermal development conditions. The ratio of the latter speed to the former speed is preferably at most 1/10, and is more preferably at most 1/20. When the silver halide emulsion is chemically sensitized, the preferred photographic speed ratio is as low as not more than 1/50.

Herein, ordinary thermal development conditions refer to conditions which are said to be suitably in a preferable range with respect to such as temperature, development time and environmental temperature, in the case that, in such as hospitals and medical organizations, a silver salt photothermographic dry imaging material is thermally developed by use of a laser imager available on the market to obtain an image suitable for applications such as diagnosis.

The silver halide grains of this invention may be incorporated in a photosensitive layer employing an optional method. In such a case, it is preferable that the foregoing silver halide grains are arranged so as to be adjacent to reducible silver sources (being aliphatic carboxylic silver salts) in order to get an imaging material having a high covering power.

The silver halide of this invention is previously prepared and the resulting silver halide is added to a solution which is employed to prepare aliphatic carboxylic acid silver salt particles. By so doing, since a silver halide preparation process and an aliphatic carboxylic acid silver salt particle preparation process are performed independently, production is preferably controlled. Further, as described in British Patent No. 1,447,454, when aliphatic carboxylic acid silver salt particles are formed, it is possible to almost simultaneously form aliphatic carboxylic acid silver salt particles by charging silver ions to a mixture consisting of halide components such as halide ions and aliphatic carboxylic acid silver salt particle forming components. Still further, it is possible to prepare silver halide grains utilizing conversion of aliphatic carboxylic acid silver salts by allowing halogen-containing components to act on aliphatic carboxylic acid silver salts. Namely, it is possible to convert some of aliphatic carboxylic acid silver salts to photosensitive silver halide by allowing silver halide forming components to act on the previously prepared aliphatic carboxylic acid silver salt solution or dispersion, or sheet materials comprising aliphatic carboxylic acid silver salts.

Silver halide grain forming components include inorganic halogen compounds, onium halides, halogenated hydrocarbons, N-halogen compounds, and other halogen containing compounds. Specific examples are disclosed in; U.S. Pat. Nos. 4,009,039, 3,4757,075, 4,003,749; G.B. Pat. No. 1,498,956; and JP-A Nos. 53-27027, 53-25420.

Further, silver halide grains may be employed in combination which are produced by converting some part of separately prepared aliphatic carboxylic acid silver salts.

The foregoing silver halide grains, which include separately prepared silver halide grains and silver halide grains prepared by partial conversion of aliphatic carboxylic acid silver salts, are employed commonly in an amount of 0.001–0.7 mol per mol of aliphatic carboxylic acid silver salts and preferably in an amount of 0.03–0.5 mol.

The separately prepared photosensitive silver halide particles are subjected to desalting employing desalting methods known in the photographic art, such as a noodle method, a flocculation method, an ultrafiltration method, and an electrophoresis method, while they may be employed without desalting.

<Light-insensitive Aliphatic Carboxylic Acid Silver Salt>

The light-insensitive aliphatic carboxylic acid silver salts according to this invention are reducible silver sources which are preferably silver salts of long chain aliphatic carboxylic acids, having 10–30 carbon atoms and preferably 15–25 carbon atoms. Listed as examples of appropriate silver salts are those described below.

For example, listed are silver salts of gallic acid, oxalic acid, behenic acid, stearic acid, arachidic acid, palmitic acid, and lauric acid. Of these, listed as preferable silver salts are silver behenate, silver arachidate, and silver stearate.

In this invention, among these silver aliphatic carboxylates, silver aliphatic carboxylate having a silver behenate content of not less than 50 mol %, more preferably 80–99.9 mol % and furthermore preferably 90–99.9 mol % is preferably utilized.

Further, in this invention, it is preferable that at least two types of aliphatic carboxylic acid silver salts are mixed since the resulting developing ability is enhanced and high contrast silver images are formed. Preparation is preferably carried out, for example, by mixing a mixture consisting of at least two types of aliphatic carboxylic acid with a silver ion solution.

On the other hand, from the viewpoint of enhancing retaining properties of images, the melting point of aliphatic carboxylic acids, which are employed as a raw material of aliphatic carboxylic acid silver, is commonly at least 50° C., and is preferably at least 60° C. The content ratio of aliphatic carboxylic acid silver salts is commonly at least 50 percent, is preferably at least 70 percent, and still more preferably at least 80 percent. From this viewpoint, specifically, it is preferable that the content ratio of silver behenate is higher.

Aliphatic carboxylic acid silver salts are prepared by mixing water-soluble silver compounds with compounds which form complexes with silver. When mixed, a normal precipitation method, a reverse precipitating method, a double-jet precipitation method, or a controlled double-jet precipitation method, described in JP-A No. 9-127643, are preferably employed. For example, after preparing a metal salt soap (for example, sodium behenate and sodium arachidate) by adding alkali metal salts (for example, sodium hydroxide and potassium hydroxide) to organic acids, crystals of aliphatic carboxylic acid silver salts are prepared by mixing the soap with silver nitrate. In such a case, silver halide grains may be mixed together with them.

The kinds of alkaline metal salts employed in this invention include sodium hydroxide, potassium hydroxide, and lithium hydroxide, and it is preferable to simultaneously use sodium hydroxide and potassium hydroxide. When simultaneously employed, the mol ratio of sodium hydroxide to potassium hydroxide is preferably in the range of 10:90–75:

25. When the alkali metal salt of aliphatic carboxylic acid is formed via a reaction with an aliphatic carboxylic acid, it is possible to control the viscosity of the resulting liquid reaction composition within the desired range.

Further, in the case in which aliphatic carboxylic acid silver is prepared in the presence of silver halide grains at an average grain diameter of at most 0.050 μm, it is preferable that the ratio of potassium among alkaline metals in alkaline metal salts is higher than the others, since dissolution of silver halide grains as well as Ostwald ripening is retarded. Further, as the ratio of potassium salts increases, it is possible to decrease the size of fatty acid silver salt particles. The ratio of potassium salts is preferably 50–100 percent with respect to the total alkaline metal salts, while the concentration of alkaline metal salts is preferably 0.1–0.3 mol/1,000 ml.

As organic silver other than those described above, organic silver salt having a core/shell structure (JP-A 2002-23303), silver salt of polybasic carboxylic acid (EP 1246001, JP-A 2004-061948) and polymer silver salt (JP-A Nos. 2000-292881 and 2003-295378-2003-295381) can be also utilized.

<Silver Salt Particles at a High Silver Ratio>

An emulsion containing aliphatic carboxylic acid silver salt particles according to the present invention is a mixture consisting of free aliphatic carboxylic acids which do not form silver salts, and aliphatic carboxylic acid silver salts. In view of storage stability of images, it is preferable that the ratio of the former is lower than the latter. Namely, the foregoing emulsion according to the present intention preferably contains aliphatic carboxylic acids in an amount of 3–10 mol percent with respect to the foregoing aliphatic carboxylic acid silver salt particles, and most preferably 4–8 mol percent.

Incidentally, in practice, each of the amount of total aliphatic carboxylic acids and the amount of free aliphatic carboxylic acids is determined employing the methods described below. Whereby, the amount of aliphatic carboxylic acid silver salts and free aliphatic carboxylic acids, and each ratio, or the ratio of free carboxylic acids to total aliphatic carboxylic acids, are calculated.

(Quantitative Analysis of the Amount of Total Aliphatic Carboxylic Acids (the Total Amount of these Being Due to Both of the Foregoing Aliphatic Carboxylic Acid Silver Salts and Free Acids))

(1) A sample in an amount (the weight when peeled from a photosensitive material) of approximately 10 mg is accurately weighed and placed in a 200 ml ovid flask.
(2) Subsequently, 15 ml of methanol and 3 ml of 4 mol/L hydrochloric acid are added and the resulting mixture is subjected to ultrasonic dispersion for one minute.
(3) Boiling stones made of Teflon (registered trade name) are placed and refluxing is performed for 60 minutes.
(4) After cooling, 5 ml of methanol is added from the upper part of the cooling pipe and those adhered to the cooling pipe are washed into the ovoid flask (this is repeated twice).
(5) The resulting liquid reaction composition is subjected to extraction employing ethyl acetate (separation extraction is performed twice by adding 100 ml of ethyl acetate and 70 ml of water).
(6) Vacuum drying is then performed at normal temperature for 30 minutes.
(7) Placed in a 10 ml measuring flask is 1 ml of a benzanthorone solution as an internal standard (approximately 100 mg of benzanthrone is dissolved in toluene and the total volume is made to 100 ml by the addition of toluene).
(8) The sample is dissolved in toluene and placed in the measuring flask described in (7) and the total volume is adjusted by the addition of toluene.
(9) Gas chromatography (GC) measurements are performed under the measurement conditions below.

Apparatus: HP-5890 +HP-Chemistation
Column: HP-1 30 m×0.32 mm×0.25 μm (manufactured by Hewlett-Packard)
Injection inlet: 250° C.
Detector: 280° C.
Oven: maintained at 250° C.
Carrier gas: He
Head pressure: 80 kPa (Quantitative Analysis of Free Aliphatic Carboxylic Acids)

(1) A sample in an amount of approximately 20 mg is accurately weighed and placed in a 200 ml ovoid flask. Subsequently, 100 ml of methanol was added and the resulting mixture is subjected to ultrasonic dispersion (free organic carboxylic acids are extracted).
(2) The resulting dispersion is filtered. The filtrate is placed in a 200 ml ovoid flask and then dried up (free organic carboxylic acids are separated).
(3) Subsequently, 15 ml of methanol and 3 ml of 4 mol/L hydrochloric acid are added and the resulting mixture is subjected to ultrasonic dispersion for one minute.
(4) Boiling stones made of Teflon (registered trade mark) were added, and refluxing is performed for 60 minutes.
(5) Added to the resulting liquid reaction composition are 60 ml of water and 60 ml of ethyl acetate, and a methyl-esterificated product of organic carboxylic acids is then extracted to an ethyl acetate phase. Ethyl acetate extraction is performed twice.
(6) The ethyl acetate phase is dried, followed by vacuum drying for 30 minutes.
(7) Placed in a 10 ml measuring flask is 1 ml of a benzanthorone solution (being an internal standard and prepared in such a manner that approximately 100 mg of benzanthrone is dissolved in toluene and the total volume is made to 100 ml by the addition of toluene).
(8) The product obtained in (6) is dissolved in toluene and placed in the measuring flask described in (7) and the total volume is adjusted by the addition of more toluene.
(9) Carried out GC measurement using the conditions described below.

Apparatus: HP-5890 +HP-Chemistation
Column: HP-1 30 m×0.32 mm×0.25 μm (manufactured by Hewlett-Packard)
Injection inlet: 250° C.
Detector: 280° C.
Oven: maintained at 250° C.
Carrier gas: He
Head pressure: 80 kPa <Morphology of Aliphatic carboxylic Acid Silver Salts>

Aliphatic carboxylic acid silver salts according to the present invention may be crystalline grains which have the core/shell structure disclosed in European Patent No. 1168069A1 and Japanese Patent Application Open to Public Inspection No. 2002-023303. Incidentally, when the core/shell structure is formed, organic silver salts, except for aliphatic carboxylic acid silver, such as silver salts of phthalic acid and benzimidazole may be employed wholly or partly in the core portion or the shell portion as a constitution component of the foregoing crystalline grains.

The shape of silver aliphatic carboxylate utilized in this invention is not specifically limited and may be any of a needle form, a bar form, a tabular and a flake form. In this invention, silver aliphatic carboxylate of a flake form, and silver aliphatic carboxylate of a short needle form or a lectangular solid form, having a length ratio of a long axis to a short axis of not more than 5, are preferably utilized.

In this invention, organic silver salt of a flake form is defined as follows. Organic silver salt is observed through an electronmicroscope, a form of an organic silver salt grain being approximated by a rectangular solid, and x is determined as follows employing the shorter values a and b when the edges of this rectangular solid are named as a, b and c from the shortest.

$$x=b/a$$

In this manner, x is determined with respect to approximately 200 grains, and those satisfies a relation of x (average)≧1.5, preferably 30≧x (average)≧1.5 and more preferably 20≧x (average)≧2.0 are defined as a flake form when the mean value is x (average). A needle form satisfies 1≦x (average)<1.5.

In flake form grains, "a" is interpreted as a thickness of a tabular grain when a plane having b and c as edges is a primary plane. Average of "a" is preferably not less than 0.01 μm and more preferably 0.1–0.20 μm. A mean value of c/b is preferably 1–6, more preferably 1.05–4, furthermore preferably 1.1–3 and specifically 1.1–2.

The grain size distribution of organic silver salt is preferably monodispersed. To be monodispersed means that a percentage of a value of a standard deviation of each length of a short axis or a long axis divided by a short axis and a long axis, respectively, is preferably not more than 100%, more preferably not more than 80% and furthermore preferably not more than 50%. As a measurement method of a shape of organic silver salt, the shape can be determined from a transmission electronphotographic image of an organic silver salt dispersion. Another method of measuring monodispersibility includes a method in which a standard deviation of a volume weighting average diameter of organic silver salt is determined, and a percentage divided by a volume weighting average diameter (a coefficient of variation) is preferably not more than 100%, more preferably not more than 80% and furthermore preferably not more than 50%. As a measurement method, for example, the standard deviation can be determined from a grain size (a volume weighting average diameter) which is obtained by irradiating laser light to organic silver salt dispersed in a solution to determine a self correlation function of swing of the scattered light against time elapse.

In the aliphatic carboxylic acid silver salts according to this invention, it is preferable that the average circle equivalent diameter is 0.05–0.80 μm, and the average thickness is 0.005–0.070 μm. It is still more preferable that the average circle equivalent diameter is 0.2–0.5 μm, and it is more preferable that the average circle equivalent diameter is 0.2–0.5 μm and the average thickness is 0.01–0.05 μm.

When the average circle equivalent diameter is less than or equal to 0.05 μm, excellent transparency is obtained, while image retention properties are degraded. On the other hand, when the average grain diameter is less than or equal to 0.8 μm, transparency is markedly degraded. When the average thickness is less than or equal to 0.005 μm, during development, silver ions are abruptly supplied due to the large surface area and are present in a large amount in the layer, since specifically in the low density section, the silver ions are not used to form silver images. As a result, the image retention properties are markedly degraded. On the other hand, when the average thickness is more than or equal to 0.07 μm, the surface area decreases, whereby image stability is enhanced. However, during development, the silver supply rate decreases and in the high density section, silver formed by development results in non-uniform shape, whereby the maximum density tends to decrease.

The average circle equivalent diameter can be determined as follows. Aliphatic carboxylic acid silver salts, which have been subjected to dispersion, are diluted, are dispersed onto a grid covered with a carbon supporting layer, and imaged at a direct magnification of 5,000, employing a transmission type electron microscope (Type 2000FX, manufactured by JEOL, Ltd.). The resultant negative image is converted to a digital image employing a scanner. Subsequently, by employing appropriate software, the grain diameter (being a circle equivalent diameter) of at least 300 grains is determined and an average grain diameter is calculated.

It is possible to determine the average thickness, employing a method utilizing a transmission electron microscope (hereinafter referred to as a TEM) as described below.

First, a photosensitive layer, which has been applied onto a support, is adhered onto a suitable holder, employing an adhesive, and subsequently, cut in the perpendicular direction with respect to the support plane, employing a diamond knife, whereby ultra-thin slices having a thickness of 0.1 to 0.2 μm are prepared. The ultra-thin slice is supported by a copper mesh and transferred onto a hydrophilic carbon layer, employing a glow discharge. Subsequently, while cooling the resultant slice at less than or equal to −130° C. employing liquid nitrogen, a bright field image is observed at a magnification of 5,000 to 40,000, employing TEM, and images are quickly recorded employing either film, imaging plates, or a CCD camera. During the operation, it is preferable that the portion of the slice in the visual field is suitably selected so that neither tears nor distortions are imaged.

The carbon layer, which is supported by an organic layer such as extremely thin collodion or Formvar, is preferably employed. The more preferred carbon layer is prepared as follows. The carbon layer is formed on a rock salt substrate which is removed through dissolution. Alternately, the organic layer is removed employing organic solvents and ion etching whereby the carbon layer itself is obtained. The acceleration voltage applied to the TEM is preferably from 80 to 400 kV, and is more preferably from 80 to 200 kV.

Other items such as electron microscopic observation techniques, as well as sample preparation techniques, may be obtained while referring to either "Igaku-Seibutsugaku Denshikenbikyo Kansatsu Gihoh (Medical-Biological Electron Microscopic Observation Techniques", edited by Nippon Denshikembikyo Gakkai Kanto Shibu (Maruzen) or "Denshikembikyo Seibutsu Shiryo Sakuseihoh (Preparation Methods of Electron Microscopic Biological Samples", edited by Nippon Denshikenbikyo Gakkai Kanto Shibu (Maruzen).

It is preferable that a TEM image, recorded in a suitable medium, is decomposed into preferably at least 1,024×1,024 pixels and subsequently subjected to image processing, utilizing a computer. In order to carry out the image processing, it is preferable that an analogue image, recorded on a film strip, is converted into a digital image, employing any appropriate means such as scanner, and if desired, the resulting digital image is subjected to shading correction as well as contrast-edge enhancement. Thereafter, a histogram is prepared, and portions, which correspond to aliphatic carboxylic acid silver salts, are extracted through a binarization processing.

At least 300 of the thickness of aliphatic carboxylic acid silver salt particles, extracted as above, are manually determined employing appropriate software, and an average value is then obtained.

Methods to prepare aliphatic carboxylic acid silver salt particles, having the shape as above, are not particularly limited. It is preferable to maintain a mixing state during formation of an organic acid alkali metal salt soap and/or a mixing state during addition of silver nitrate to the soap as desired, and to optimize the proportion of organic acid to the soap, and of silver nitrate which reacts with the soap.

It is preferable that, if desired, the planar aliphatic carboxylic acid silver salt particles (referring to aliphatic carboxylic acid silver salt particles, having an average circle equivalent diameter of 0.05–0.80 μm as well as an average thickness of 0.005–0.070 μm) are preliminarily dispersed together with binders as well as surface active agents, and thereafter, the resultant mixture is dispersed employing a media homogenizer or a high pressure homogenizer. The preliminary dispersion may be carried out employing a common anchor type or propeller type stirrer, a high speed rotation centrifugal radial type stirrer (being a dissolver), and a high speed rotation shearing type stirrer (being a homomixer).

Further, employed as the foregoing media homogenizers may be rotation mills such as a ball mill, a planet ball mill, and a vibration ball mill, media stirring mills such as a bead mill and an attritor, and still others such as a basket mill. Employed as high pressure homogenizers may be various types such as a type in which collision against walls and plugs occurs, a type in which a liquid is divided into a plurality of portions which are collided with each other at high speed, and a type in which a liquid is passed through narrow orifices.

Preferably employed as ceramics, which are used in ceramic beads employed during media dispersion are, for example, yttrium-stabilized zirconia, and zirconia-reinforced alumina (hereafter ceramics containing zirconia are abbreviated to as zirconia). The reason of the preference is that impurity formation due to friction with beads as well as the homogenizer during dispersion is minimized.

In apparatuses which are employed to disperse the planar aliphatic carboxylic acid silver salt particles of the present invention, preferably employed as materials of the members which come into contact with the aliphatic carboxylic acid silver salt particles are ceramics such as zirconia, alumina, silicon nitride, and boron nitride, or diamond. Of these, zirconia is preferably employed. During the dispersion, the concentration of added binders is preferably from 0.1 to 10.0 percent by weight with respect to the weight of aliphatic carboxylic acid silver salts. Further, temperature of the dispersion during the preliminary and main dispersion is preferably maintained at less than or equal to 45° C. The examples of the preferable operation conditions for the main dispersion are as follows. When a high pressure homogenizer is employed as a dispersion means, preferable operation conditions are from 29 to 100 MPa, and at least double operation frequency. Further, when the media homogenizer is employed as a dispersion means, the peripheral rate of 6 to 13 m/second is cited as the preferable condition.

As manufacturing of organic silver salt utilized in this invention and the dispersion method thereof, commonly known methods can be employed. For example, referred to can be such as above-described JP-A 10-62899, European Patent Application Publication Nos. 803,764 A1 and 962,812 A1, JP-A Nos. 2001-167022, 2000-7683, 2000-72711, 2001-163889, 2001-163890, 2001-163827, 2001-33907, 2001-188313, 2001-83652, 23301, 2002-6442, 2002-31870 and 2003-280135.

In the present invention, light-insensitive aliphatic carboxylic acid silver salt particles are preferably formed in the presence of compounds which function as a crystal growth retarding agent or a dispersing agent. Further, the compounds which function as a crystal growth retarding agent or a dispersing agent are preferably organic compounds having a hydroxyl group or a carboxyl group.

In the present invention, compounds, which are described herein as crystal growth retarding agents or dispersing agents for aliphatic carboxylic acid silver salt particles, refer to compounds which, in the production process of aliphatic carboxylic acid silver salts, exhibit more functions and greater effects to decrease the grain diameter, and to enhance monodispersibility when the aliphatic carboxylic acid silver salts are prepared in the presence of the compounds, compared to the case in which the compounds are not employed. Listed as examples are monohydric alcohols having 10 or fewer carbon atoms, such as preferably secondary alcohol and tertiary alcohol; glycols such as ethylene glycol and propylene glycol; polyethers such as polyethylene glycol; and glycerin. The preferable added amount is from 10 to 200 percent by weight with respect to aliphatic carboxylic acid silver salts.

On the other hands, preferred are branched aliphatic carboxylic acids, each containing an isomer, such as isoheptanic acid, isodecanoic acid, isotridecanoic acid, isomyristic acid, isopalmitic acid, isostearic acid, isoarachidinic acid, isobehenic acid, or isohexaconic acid. Listed as preferable side chains are an alkyl group or an alkenyl group having 4 or fewer carbon atoms. Further, listed are aliphatic unsaturated carboxylic acids such as palmitoleic acid, oleic acid, linoleic acid, linolenic acid, moroctic acid, eicosenoic acid, arachidonic acid, eicosapentaenoic acid, erucic acid, docosapentaenoic acid, and selacholeic acid. The preferable added amount is 0.5–10.0 mol % of aliphatic carboxylic acid silver salts.

Preferable compounds include glycosides such as glucoside, galactoside, and fructoside; trehalose type disaccharides such as trehalose and sucrose; polysaccharides such as glycogen, dextrin, dextran, and alginic acid; cellosolves such as methyl cellosolve and ethyl cellosolve; water-soluble organic solvents such as sorbitan, sorbitol, ethyl acetate, methyl acetate, and dimethylformamide; and water-soluble polymers such as polyvinyl alcohol, polyacrylic acid, acrylic acid copolymers, maleic acid copolymers, carboxymethyl cellulose, hydroxypropyl cellulose, hydroxypropyl methyl cellulose, polyvinylpyrrolidone, and gelatin. The preferable added amount is 0.1–20.0 percent by weight with respect to aliphatic carboxylic acid silver salts.

Alcohols having 10 or fewer carbon atoms, being preferably secondary alcohols and tertiary alcohols, increase the solubility of sodium aliphatic carboxylates in the emulsion preparation process, whereby the viscosity is lowered so as to enhance the stirring efficiency and to enhance monodispersibility as well as to decrease particle size. Branched aliphatic carboxylic acids, as well as aliphatic unsaturated carboxylic acids, result in higher steric hindrance than straight chain aliphatic carboxylic acid silver salts as a main component during crystallization of aliphatic carboxylic acid silver salts to increase the distortion of crystal lattices whereby the particle size decreases due to non-formation of over-sized crystals.

Herein, at the time of dispersing organic silver salt, photosensitive silver salt such as photosensitive silver halide grains may be incorporated. However, since fog increases and sensitivity significantly decreases when silver halide grains are incorporated at the time of dispersion of organic silver salt, it is more preferable that there contained essentially no silver halide grains at the time of dispersion. In this invention, the amount of silver halide grains in a water dispersion to be dispersed is preferably not more than 1 mol % against 1 mol of organic silver salt in the solution, more preferably not more than 0.1 mol % and furthermore preferable is not to positively add silver halide grains.

Photosensitive material can be manufactured by mixing an organic silver salt aqueous dispersion and a photosensitive silver halide grain dispersion, and a ratio of organic silver salt to photosensitive silver salt can be selected depending on the purposes, however, the ratio of photosensitive silve halide grains against organic silver salt is preferably in a range of 1–30 mol %, more preferably 2–20 mol % and specifically preferably 3–15 mol %. To mix at least two types of organic silver salts and at least two types of silver halide grain dispersions is a preferable method utilized to control photographic characteristics.

Organic silver salt of this invention can be utilized at desired amount, however, is preferably 0.1–5 g/m$^2$, more preferably 0.3–3 g/m$^2$ and furthermore preferably 0.5–2 g/m$^2$.

<Antifoggant and Image Stabilizer>

As mentioned above, being compared to conventional silver halide photosensitive photographic materials, the greatest different point in terms of the structure of silver salt photothermographic dry imaging materials is that in the latter materials, a large amount of photosensitive silver halide, organic silver salts and reducing agents is contained which are capable of becoming causes of generation of fogging and print-out silver, irrespective of prior and after photographic processing. Due to that, in order to maintain storage stability before development and even after development, it is important to apply highly effective fog minimizing and image stabilizing techniques to silver salt photothermographic dry imaging materials. Other than aromatic heterocyclic compounds which retard the growth and development of fog specks, heretofore, mercury compounds, such as mercury acetate, which exhibit functions to oxidize and eliminate fog specks, have been employed as a markedly effective storage stabilizing agents. However, the use of such mercury compounds may cause problems regarding safety as well as environmental protection.

The important points for achieving technologies for antifogging and image stabilizing are:

to prevent formation of metallic silver or silver atoms caused by reduction of silver ion during preserving the material prior to or after development; and to prevent the formed silver from effecting as a catalyst for oxidation (to oxidize silver into silver ions) or reduction (to reduce silver ions to silver).

Antifoggants as well as image stabilizing agents which are employed in the silver salt photothermographic dry imaging material of the present invention will now be described.

In the silver salt photothermographic dry imaging material of the present invention, one of the features is that bisphenols are mainly employed as a reducing agent, as described below. It is preferable that compounds are incorporated which are capable of deactivating reducing agents upon generating active species capable of extracting hydrogen atoms from the foregoing reducing agents. Preferred compounds are those which are capable of: preventing the reducing agent from forming a phenoxy radial; or trapping the formed phenoxy radial so as to stabilize the phenoxy radial in a deactivated form to be effective as a reducing agent for silver ions. Preferred compounds having the above-mentioned properties are non-reducible compounds having a functional group capable of forming a hydrogen bonding with a hydroxyl group in a bis-phenol compound. Examples are compounds having in the molecule such as, a phosphoryl group, a sulfoxide group, a sulfonyl group, a carbonyl group, an amido group, an ester group, a urethane group, a ureido group, a tertiary amino group, or a nitrogen containing aromatic group. More preferred are compounds having a sulfonyl group, a sulfoxide group or a phosphoryl group in the molecule.

Specific examples are disclosed in, JP-A Nos. 6-208192, 20001-215648, 3-50235, 2002-6444, 2002-18264. Another examples having a vinyl group are disclosed in, Japanese translated PCT Publication No. 2000-515995, JP-A Nos. 2002-207273, and 2003-140298.

Further, it is possible to simultaneously use compounds capable of oxidizing silver (metallic silver) such as compounds which release a halogen radical having oxidizing capability, or compounds which interact with silver to form a charge transfer complex. Specific examples of compounds which exhibit the foregoing function are disclosed in JP-A Nos. 50-120328, 59-57234, 4-232939, 6-208193, and 10-197989, as well as U.S. Pat. No. 5,460,938, and JP-A 7-2781. Specifically, in the imaging materials according to the present invention, specific examples of preferred compounds include halogen radical releasing compounds which are represented by Formula (OFI) below.

$$Q_{12}\text{-}Y_{11}\text{—}C(X_{11})(X_{13})(X_{12}) \qquad \text{Formula (OFI)}$$

In Formula (OFI), $Q_{12}$ is an aryl group or a heterocyclic group; $X_{11}$, $X_{12}$, and $X_{13}$ are each a hydrogen atom, a halogen atom, an acyl group, an alkoxycarbonyl group, an aryloxycarbonyl group, a sulfonyl group, or an aryl group, at least one of which is a halogen atom; and $Y_{11}$ is —C(═O)—, —SO— or —$SO_2$—.

The aryl group represented by $Q_{12}$ may be in the form of a single ring or a condensed ring, and is preferably a single ring or double ring aryl group having 6–30 carbon atoms (for example, phenyl and naphthyl) and is more preferably a phenyl group and a naphthyl group, and is still more preferably a phenyl group.

The heterocyclic group represented by $Q_{12}$ is a 3- to 10-membered saturated or unsaturated heterocyclic group containing at least one of N, O, or S, which may be a single ring or may form a condensed ring with another ring.

The heterocyclic group is preferably a 5- to 6-membered unsaturated heterocyclic group which may have a condensed ring, is more preferably a 5- to 6-membered aromatic heterocyclic group which may have a condensed ring, and is most preferably a 5- to 6-membered aromatic heterocyclic group which may have a condensed ring containing 1 to 4 nitrogen atoms. Heterocycles in such heterocyclic groups are preferably imidazole, pyrazole, pyridine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, benzthiazole, indolenine, and tetraazaindene; are more preferably imidazole, pyridine, pyrimidine, pyrazine, pyridazine, triazole, triazine, thiadiazole, oxadiazole, quinoline, phthalazine, naphthyridine, quinoxaline, quinazoline, cinnoline, tetrazole, thiazole, oxazole, benzimidazole, benzoxazole, benzthiazole, and tetraazaindene; are still more preferably imidazole, pyridine, pyrimidine, pyrazine, pyridazine, triazole, triazine, thiadiazole, quinoline, phthalazine, naphthyridine, quinoxaline, quinazoline, cinnoline, tetrazole, triazole, benzimidazole, and benzthiazole; and are most preferably pyridine, thiadiazole, quinoline, and benzthiazole.

The aryl group and heterocyclic group represented by $Q_{12}$ may have a substituent other than —YU—C($X_1$)($X_2$)($X_3$). Substituents are preferably an alkyl group, an alkenyl group, an aryl group, an alkoxy group, an aryloxy group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylimino group, a sulfamoyl group, a carbamoyl group, a sulfonyl group, a ureido group, a phosphoric acid amide group, a halogen atom, a cyano group, a sulfo group, a carboxyl group, a nitro group, and a heterocyclic group; are more preferably an alkyl group, an aryl group, an alkoxy group, an aryloxy group, an acyl group, an acylamino group, an alkoxycarbonylamino group, an aryloxycarbonylamino group, a sulfonylamino group, a sulfamoyl group, a carbamoyl group, a ureido group, a phosphoric acid amide group, a halogen atom, a cyano group, a nitro group, and a heterocyclic group; are more preferably an alkyl group, an aryl group, an alkoxy group, an aryloxy group, an acyl group, an acylamino group, a sulfonylimino group, a sulfamoyl group, a carbamoyl group, a halogen atom, a cyano group, a nitro group, and a heterocyclic group; and are most preferably an alkyl group, an aryl group, are a halogen atom.

Each of $X_{11}$, $X_{12}$ and $X_{13}$ is preferably a halogen atom, a haloalkyl group, an acyl group, an alkoxycarbonyl group, an aryloxycarbonyl group, a carbamoyl group, a sulfamoyl group, a sulfonyl group, or a heterocyclic group; is more preferably a halogen atom, a haloalkyl group, an acyl group, an alkoxycarbonyl group, an aryloxycarbonyl group, or a sulfonyl group; is still more preferably a halogen atom or a trihalomethyl group; and is most preferably a halogen atom. Of halogen atoms preferred are a chlorine atom, a bromine atom and an iodine atom. Of these, a chlorine atom and a bromine atom are more preferred and a bromine atom is particularly preferred.

Y is —C(═O)—, —SO— or —$SO_2$—, and is preferably —$SO_2$—.

The added amount of these compounds is commonly $1\times10^{-4}$–1 mol per mol of silver, and is preferably $1\times10^{-3}$–$5\times10^{-2}$ mol.

Incidentally, in the imaging materials according to the present invention, it is possible to use those disclosed in JP-A 2003-5041 in the manner as the compounds represented by foregoing Formula (OFI).

<Polymer PO Preventing Agent>

Further, in view of the capability of more stabilizing of silver images, as well as an increase in photographic speed and CP, it is preferable to use, in the photothermographic imaging materials according to this invention, as an image stabilizer, polymers which have at least one repeating unit of the monomer having a radical releasing group disclosed in JP-A 2003-91054. Specifically, in the photothermographic imaging materials according to the present invention, desired results are unexpectedly obtained.

Incidentally, other than the above-mentioned compounds, compounds which are conventionally known as an antifogging agent may be incorporated in the silver salt photothermographic dry imaging materials of the present invention. For example, listed are the compounds described in U.S. Pat. Nos. 3,589,903, 4,546,075, and 4,452,885, and JP-A Nos. 9-288328 and 9-90550. Listed as other antifogging agents are compounds disclosed in U.S. Pat. No. 5,028,523, and European Patent Nos. 600,587, 605,981 and 631,176.

<Polycarboxyl Compounds>

In the imaging materials according to this invention, it is preferable to use the compounds represented by the following Formula (PC) as an antifogging agent and a storage stabilizer.

$$R_{30}\text{—(CO—O-}M_{30})_{n3} \qquad \text{Formula (PC)}$$

wherein $R_{30}$ is a linkable atom, an aliphatic group, an aromatic group, a heterocyclic group, or a group of atoms capable of forming a ring as they combine with each other; $M_{30}$ is a hydrogen atom, a metal atom, a quaternary ammonium group, or a phosphonium group; and n3 is an integer of 2–20.

Listed as linkable atoms represented by $R_{30}$ in above Formula (PC) are those such as nitrogen, oxygen, sulfur or phosphor.

Listed as aliphatic groups represented by $R_{30}$ are straight or branched alkyl, alkenyl, alkynyl, and cycloalkyl groups having 1–30 and preferably 1–20 carbon atoms. Specific examples include methyl, ethyl, butyl, hexyl, decyl, dodecyl, isopropyl, t-butyl, 2-ethylhexyl, allyl, butenyl, 7-octenyl, propagyl, 2-butynyl, cyclopropyl, cyclopentyl, cyclohexyl, and cyclododecyl groups.

Listed as aromatic groups represented by $R_{30}$ are those having 6–20 carbon atoms, and specific examples include phenyl, naphthyl, and anthranyl groups.

Heterocyclic groups represented by $R_{30}$ may be in the form of a single ring or a condensed ring and include 5- to 6-membered heterocyclic groups which have at least one of O, S, or N atoms, or an amineoxido group. Listed as specific examples are pyrrolidine, piperidine, tetrahydrofuran, tetrahydropyran, oxirane, morpholine, thiomorpholine, thiopyran, tetrahydrothiophene, pyrrole, pyridine, furan, thiophene, imidazole, pyrazole, oxazole, thiazole, isoxazole, isothiazole, triazole, tetrazole, thiadiazole, and oxadiazole, and groups derived from these benzelogues.

In the case in which $R_{30}$ is formed employing $R_{31}$ and $R_{32}$, each $R_{31}$ or $R_{32}$ is defined as $R_{30}$, and $R_{31}$ and $R_{32}$ may be the same or different. Listed as rings which are formed employing $R_{31}$ and $R_{32}$ may be 4- to 7-membered rings. Of these, are preferred 5- to 7-membered rings. Preferred groups represented by $R_{31}$ and $R_{32}$ include aromatic groups as well as heterocyclic groups. Aliphatic groups, aromatic groups, or heterocyclic rigs may be further substituted with a substituent. Listed as the above substituents are a halogen atom (e.g., a chlorine atom or a bromine atom), an alkyl group (e.g., a methyl group, an ethyl group, an isopropyl group, a hydroxyethyl group, a methoxymethyl group, a trifluoromethyl group, or a t-butyl group), a cycloalkyl group (e.g., a cyclopentyl group or a cyclohexyl group), aralkyl group (e.g., a benzyl group or a 2-phenetyl group), an aryl group (e.g., phenyl group, a naphthyl group, a p-tolyl group, or a p-chlorophenyl group), an alkoxy group (e.g., a methoxy group, an ethoxy group, an isopropoxy group, or a butoxy group), an aryloxy group (e.g., a phenoxy group or a 4-methoxyphenoxy group), a cyano group, an acylamino group (e.g., an acetylamino group or a propionylamino group), an alkylthio group (e.g., a methylthio group, an ethylthio group, or a butylthio group), an arylthio group (e.g., a phenylthio group or a p-methylphenylthio group), a sulfonylamino group (e.g, a methanesulfonylamino group or a benzenesulfonylamino group), a ureido group (e.g., a 3-methylureido group, a 3,3-dimethylureido group, or a 1,3-dimethylureido group), a sulfamoylamino group (a dimethylsulfamoylamino group or a diethylsulfamoylamino group), a carbamoyl group (e.g., a methylcarbamoyl group, an ethylcarbmoyl group, or a dimerthylcarbamoyl group), a sulfamoyl group (e.g., an ethylsulfamoyl group or a dimethylsulfamoyl group), an alkoxycarbonyl group (e.g., a methoxycarbonyl group or an ethoxycarbonyl group), an aryloxycarbonyl group (e.g., a phenoxycarbonyl group or a p-chlorophenoxycarbonyl group), a sulfonyl-group (e.g., a methanesulfonyl group, a butanesulfonyl group, or a phenylsulfonyl group), an acyl group (e.g., an acetyl group, a propanoyl group, or a butyroyl group), an amino group (e.g., a methylamino group, an ethylamino group, and a dimethylamino group), a hydroxy group, a nitro group, a nitroso group, an amineoxide group (e.g., a pyridine-oxide group), an imido group (e.g., a phthalimido group), a disulfide group (e.g., a benzenedisulfide group or a benzthiazoryl-2-disulfide group), and a heterocyclic group (e.g., a pyridyl group, a benzimidazolyl group, a benzthiazoyl group, or a benzoxazolyl group). $R_{31}$ and $R_{32}$ may each have a single substituent or a plurality of substituents selected from the above. Further, each of the substituents maybe further substituted with the above substituents. Still further, $R_{31}$ and $R_{32}$ may be the same or different. Yet further, when Formula (PC-1) is an oligomer or a polymer $(R_{30}—(COOM_{30})_{n3})_{m3}$, desired effects are obtained, wherein n3 is preferably 2–20, and m3 is preferably 1–100, or the molecular weight is preferably at most 50,000.

Acid anhydrides of Formula (PC-1), as described in this invention, refer to compounds which are formed in such a manner that two carboxyl groups of the compound represented by Formula (PC-1) undergo dehydration reaction. Acid anhydrides are preferably prepared from compounds having 3–10 carboxyl groups and derivatives thereof.

Further preferably employed are simultaneously dicarboxylic acids described in JP-A Nos. 58-95338, 10-288824, 11-174621, 11-218877, 2000-10237, 2000-10236, and 2000-10231.

<Thiosulfonic Acid Restrainers>

It is preferable that imaging materials according to this invention contain the compounds represented by following Formula (ST).

$$Z_4\text{-}SO_2.S\text{-}M_4 \qquad \text{Formula (ST)}$$

In the compounds represented by Formula (ST), the alkyl group, aryl group, heterocyclic group, aromatic ring and heterocyclic ring, which are represented by $Z_4$ may be substituted. Listed as the substituents may be, for example, a lower alkyl group such as a methyl group or an ethyl group, an aryl group such as a phenyl group, an alkoxyl group having 1–8 carbon atoms, a halogen atom such as chlorine, a nitro group, an amino group, or a carboxyl group. Metal atoms represented by $M_4$ are alkaline metals such as a sodium ion or a potassium ion, while as the organic cation preferred are an ammonium ion or a guanidine group.

The compounds represented by Formula (ST) may be synthesized with the methods well-known in the art. For example, it is possible to synthesize them employing a method in which corresponding sulfonyl fluoride is allowed to react with sodium sulfide, or corresponding sodium sulfinate is allowed to react with sulfur. On the other hand, these compounds are also easily available on the market.

The compounds represented by Formula (ST) may be incorporated to the imaging material of this invention in any production process prior to the coating process, but it is preferable that the compounds are added to the coating composition just before coating.

The added amount of the compounds represented by Formula (ST) is not particularly limited, but is preferably in the range of $1\times10^{-6}$–1 g per mol of the total silver amount, including silver halides. Further, the similar compounds are disclosed in JP-A 8-314059.

<Electron Attractive Group Containing Vinyl Type Restrainers>

In this invention, it is preferable to simultaneously use the fog restrainers represented by following Formula (CV).

Formula (CV)

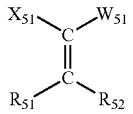

wherein, $X_{51}$ represents an electron withdrawing group; $W_{51}$ is a hydrogen atom, an alkyl group, an alkenyl group, an alkynyl group, an aryl group, a heterocyclic group, a halogen atom, a cyano group, an acyl group, a thioacyl group, an oxalyl group, an oxyoxalyl group, an —S-oxalyl group, an oxamoyl group, an oxycarbonyl group, an —S-carbonyl group, a carbamoyl group, a thiocarbamoyl group, a sulfonyl group, a sulfinyl group, an oxysulfonyl group, an —S-sulfonyl group, a sulfamoyl group, an oxysulfinyl group, an —S-sulfinyl group, a sulfinamoyl group, a phosphoryl group, a nitro group, an imino group, an N-carbonylimino group, an N-sulfonylimino group, an ammonium group, a sulfonium group, a phosphonium group, a pyrylium group or an immonium group; $R_{51}$ represents a hydroxyl group or a salt thereof; and $R_{52}$ represents an alkyl group, an alkenyl group, an alkynyl group, an aryl group or a heterocyclic group, provided that $X_{51}$ and W51 may form a ring structure by bonding to each other, $X_{51}$ and $R_{51}$ may be a cis-form or a trans-form.

In Formula (CV), an electron withdrawing group represented by $X_{51}$ is a substituent, Hammett's σp of which is positive. Specifically, listed are substituted alkyl groups (such as halogen-susbstituted alkyl), substituted alkenyl groups (such as cyanovinyl), substituted and non-substituted alkynyl groups (such as trifluoroacetylenyl, cyanoacetylenyl and formylacetylenyl), substituted aryl groups (such as cyanophenyl), substituted and non-substituted heterocyclic groups (pyridyl, triazinyl and benzooxazolyl), a halogen atom, a cyano group, acyl groups (such as acetyl, trifluoroacetyl and formyl), thioacyl groups (such as thioformyl and thioacetyl), oxalyl groups (such as methyloxalyl), oxyoxalyl groups (such as ethoxalyl), —S-oxalyl groups (such as ethylthiooxalyl), oxamoyl groups (such as methyloxamoyl), oxycarbonyl groups (such as ethoxycarbonyl and carboxyl), —S-carbonyl groups (such as ethylthiocarbonyl), a carbamoyl group, a thiocarbamoyl group, a sulfonyl group, a sulfinyl group, oxysulfonyl groups (such as ethoxysulfonyl), —S-sulfonyl groups (such as ethylthiosulfonyl), sulfamoyl groups, oxysulfinyl groups (such as methoxysulfinyl), —S-sulfinyl groups (such as methylthiosulfinyl), sulfinamoyl groups, phosphoryl groups, nitro groups, imino groups (such as an imino, N-methylimino, N-phenylimino, N-pyridylimino, N-cyanoimino and N-nitroimino group), N-carbonylimino groups (such as an N-acetylimino, N-ethoxycarbonylimino, N-ethoxalylimino, N-formylimino, N-trifluoroacetylimino and N-carbamoylimino group), N-sulfonylimino groups (such as a N-methanesulfonylimino, N-trifluoromethanesulfonylimino, N-methoxysulfonylimino and N-sulfamoylimino group), an ammonium group, a sulfonium group, a phosphonium group, a pyrilium group or an immonium group, and also listed are heterocyclic groups in which rings are formed by such as an ammonium group, a sulfonium group, a phosphonium group and an immonium group. The up value is preferably not less than 0.2 and more preferably not less than 0.3.

$W_{51}$ includes a hydrogen atom, alkyl groups (such as methyl, ethyl and trifluoromethyl), alkenyl groups (such as a vinyl, halogen substituted vinyl and cyano vinyl group), alkynyl groups (such as an acetylenyl and cyanoacetylenyl group), aryl groups (such as a phenyl, chlorophenyl, nitrophenyl, cyanophenyl and pentafluorophenyl group), heterocyclic groups (such as a pyridyl, pyrimidyl, pyrazinyl, quinoxalinyl, triazinyl, succineimido, tetrazonyl, triazolyl, imidazolyl and benzooxazolyl group), in addition to these, also include those explained in foregoing $X_{51}$ such as a halogen atom, a cyano group, an acyl group, a thioacyl group, an oxalyl group, an oxyoxalyl group, an —S-oxalyl group, an oxamoyl group, an oxycarbonyl group, an —S-carbonyl group, a carbamoyl group, a thiocarbamoyl group, a sulfonyl group, a sulfinyl group, an oxysulfonyl group, an —S-sulfonyl group, a sulfamoyl group, an oxysulfinyl group, a —S-sulfinyl group, a sulfinamoyl group, a phosphoryl group, a nitro group, an imino group, an N-carbonylimino group, an N-sulfonylimino group, an ammonium group, a sulfonium group, a phosphonium group, a pyrilium group and an immonium group.

Preferable as $W_{51}$ are also aryl groups and heterocyclic groups as described above, in addition to electron withdrawing groups having a positive Hammett's substituent constant σp.

$X_{51}$ and $W_{51}$ may form a ring structure by bonding to each other. Rings formed by $X_{51}$ and $W_{51}$ include a saturated or unsaturated carbon ring or heterocyclic ring, which may be provided with a condensed ring, and also a cyclic ketone. Heterocyclic rings are preferably those having at least one atom among N, O, and S and more preferably those containing one or two of said atoms.

$R_{51}$ includes a hydroxyl group or organic or inorganic salts of the hydroxyl group. Specific examples of alkyl groups, alkenyl groups, alkynyl groups, aryl groups and heterocyclic groups represented by $R_{52}$ include each example of alkyl groups, alkenyl groups, alkynyl groups, aryl groups and heterocyclic groups exemplified as $W_{51}$.

Further, in this invention, any of $X_{51}$, $W_{51}$ and $R_{52}$ may contain a ballast group. A ballast group means a so-called ballast group in such as a photographic coupler, which makes the added compound have a bulky molecular weight not to migrate in a coated film of a light-sensitive material.

Further, in this invention, $X_{51}$, $W_{51}$ and $R_{52}$ may contain a group enhancing adsorption to a silver salt. Groups enhancing adsorption to a silver salt include a thioamido group, an aliphatic mercapto group, an aromatic mercapto group, a heterocyclic mercapto group, and each group represented by 5- or 6-membered nitrogen-containing heterocyclic rings such as benzotriazole, triazole, tetrazole, indazole, benzimidazole, imidazole, benzothiazole, thiazole, benzoxazole, oxazole, thiadiazole, oxadiazole and triazine.

In this invention, it is preferred that at least one of $X_{51}$ and $W_{51}$ represents a cyano group, or $X_{51}$ and $W_{51}$ form a cyclic structure by bonding to each other.

Further, in this invention, preferable are compounds in which a thioether group (—S—) is contained in the substituents represented by $X_{51}$, $W_{51}$ and $R_{52}$.

Further, specifically preferable are those in which at least one of $X_{51}$ and $W_{51}$ is provided with an alkene group.

In this invention, alkene compounds represented by Formula (CV) include every isomers when they can take isomeric structures with respect to a double bond, where $X_{51}$, $W_{51}$, $R_{51}$ and $R_{52}$ substitute, and also include every isomers when they can take tautomeric structures such as a keto-enol form.

Specific examples of the compounds represented by Formula (CV) in clued, for example, the compounds of PR-01–PR-08, described in Japanese Translated PCT Patent Publication No. 2000-515995. Further, the compounds represented by Formula (CV) of this invention can be synthesized by various methods, and they can be synthesized by referring to, for example, a method described in Japanese Translated PCT Patent Publication No. 2000-515995.

The compound represented by Formula (CV) may be incorporated at least in one of a light-sensitive layer and light-insensitive layers on the light-sensitive layer side of a thermally developable light-sensitive material, and preferably at least in a light-sensitive layer. The added amount of the compounds represented by Formula (1) is preferably $1\times10^{-8}$–1 mol/Ag mol, more preferably $1\times10^{-6}$–$1\times10^{-1}$ mol/Ag mol and most preferably $1\times10^{-4}$–$1\times10^{-2}$ mol/Ag mol.

The compound represented by Formula (CV) can be added in a light-sensitive layer or a light-insensitive layer according to commonly known methods. That is, they can be added in light-sensitive layer or light-insensitive layer coating composition by being dissolved in alcohols such as methanol and ethanol, ketones such as methyl ethyl ketone and acetone, and polar solvents such as dimethylsulfoxide and dimethylformamide. Further, they can be added also by being made into micro-particles of not more than 1 μm followed by being dispersed in water or in an organic solvent. As for microparticle dispersion techniques, many techniques have been disclosed and the compound can be dispersed according to these techniques.

<Silver Ion Reducing Agents>

In this invention, employed as a silver ion reducing agent (hereinafter, occasionally referred simply to as a reducing agent) may be polyphenols described in U.S. Pat. Nos. 3,589,903 and 4,021,249, British Patent No. 1,486,148, JP-A Nos. 51-5193350-36110, 50-11,6023, and 52-84727, and Examined Japanese Patent Publication No. 51-35727; bisnaphthols such as 2,2'-dihydroxy-1,1'-binaphthyl and 6,6'-dibromo-2,2'-dihydroxy-1,1'-binaphthyl described in U.S. Pat. No. 3,672,904; sulfonamidophenols and sulfonamidonaphthols such as 4-benzenesulfonamidophenol, 2-benznesulfonamidophenol, 2,6-dichloro-4-benenesulfonamidophenol, and 4-benznesulfonamidonaphthol described in U.S. Pat. No. 3,801,321.

In this invention, preferred reducing agents for silver ions are compounds represented by following Formula (RED).

Formula (RED)

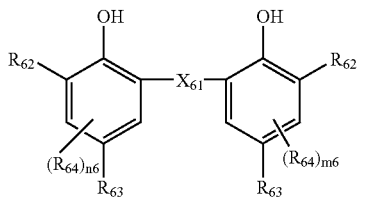

$X_{61}$ in Formula (RED) is a chalcogen atom or $CHR_{61}$. Specifically listed as chalcogen atoms are a sulfur atom, a selenium atom, and a tellurium atom. Of these, a sulfur atom is preferred. $R_{61}$ in $CHR_{61}$ is a hydrogen atom, a halogen atom, an alkyl group, an alkenyl group, an alkynyl group, an aryl group or a heterocyclic group. Listed as halogen atoms are, for example, a fluorine atom, a chlorine atom, and a bromine atom. Listed as alkyl groups are, alkyl groups having 1–20 carbon atoms, for example, a methyl group, an ethyl group, a propyl group, a butyl group, a hexyl group, a heptyl group and a cycloalkyl group. Examples of alkenyl groups are, a vinyl group, an allyl group, a butenyl group, a hexenyl group, a hexadienyl group, an ethenyl-2-propenyl group, a 3-butenyl group, a 1-methyl-3-propenyl group, a 3-pentenyl group, a 1-methyl-3-butenyl group and a cyclohexenyl group. Examples of aryl groups are, a phenyl group and a naphthyl group. Examples of heterocylic groups are, a thienyl group, a furyl group, an imidazolyl group, a pyrazolyl group and a pyrrolyl group. Of these, cyclic groups such as cycloalkyl groups and cycloalkenyl groups are preferred.

These groups may have a substituent. Listed as said substituents are a halogen atom (for example, a fluorine atom, a chlorine atom, or a bromine atom), a cycloalkyl group (for example, a cyclohexyl group or a cyclobutyl group), a cycloalkenyl group (for example, a 1-cycloalkenyl group or a 2-cycloalkenyl group), an alkoxy group (for example, a methoxy group, an ethoxy group, or a propoxy group), an alkylcarbonyloxy group (for example, an acetyloxy group), an alkylthio group (for example, a methylthio group or a trifluoromethylthio group), a carboxyl group, an alkylcarbonylamino group (for example, an acetylamino group), a ureido group (for example, a methylaminocarbonylamino group), an alkylsulfonylamino group (for example, a methanesulfonylamino group), an alkylsulfonyl group (for example, a methanesulfonyl group and a trifluoromethanesulfonyl group), a carbamoyl group (for example, a carbamoyl group, an N,N-dimethylcarbamoyl group, or an N-morpholinocarbonyl group), a sulfamoyl group (for example, a sulfamoyl group, an N,N-dimethylsulfamoyl group, or a morpholinosulfamoyl group), a trifluoromethyl group, a hydroxyl group, a nitro group, a cyano group, an alkylsulfonamido group (for example, a methanesulfonamido group or a butanesulfonamido group), an alkylamino group (for example, an amino group, an N,N-dimethylamino group, or an N,N-diethylamino group), a sulfo group, a phosphono group, a sulfite group, a sulfino group, an alkylsulfonylaminocarbonyl group (for example, a methanesulfonylaminocarbonyl group or an ethanesulfonylaminocarbonyl group), an alkylcarbonylaminosulfonyl group (for example, an acetamidosulfonyl group or a methoxyacetamidosulfonyl group), an alkynylaminocarbonyl group (for example, an acetamidocarbonyl group or a methoxyacetamidocarbonyl group), and an alkylsulfinylaminocarbonyl group (for example, a methanesulfinylaminocarbonyl group or an ethanesulfinylaminocarbonyl group). Further, when at least two substituents are present, they may be the same or different.

Most preferred substituent is an alkyl group.

$R_{62}$ is an alkyl group. Preferred as the alkyl groups are those, having 1–20 carbon atoms, which are substituted or unsubstituted. Specific examples include a methyl, ethyl, i-propyl, butyl, i-butyl, t-butyl, t-pentyl, t-octyl, cyclohexyl, 1-methylcyclohexyl, or 1-methylcyclopropyl group.

Substituents of the alkyl group are not particularly limited and include, for example, an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group, and a halogen atom. $R_{62}$s are each preferably a secondary or tertiary alkyl group and preferably has 2–20 carbon atoms. $R_{62}$ is more preferably a tertiary alkyl group, still more preferably a t-butyl group, a t-pentyl group, or a methylcyclohexyl group, and is most preferably a t-butyl group.

$R_{63}$ is a hydrogen atom or a group capable of being substituted to a benzene ring. Listed as groups capable of being substituted to a benzene ring are, for example, a halogen atom such as fluorine, chlorine, or bromine, an alkyl group, an aryl group, a cycloalkyl group, an alkenyl group, a cycloalkenyl group, an alkyny group, an amino group, an acyl group, an acyloxy group, an acylamino group, a sulfonylamino group, a sulfamoyl group, a carbamoyl group, an alkylthio group, a sulfonyl group, an alkylsulfonyl group, a sulfonyl group, a cyano group, and a heterocyclic group.

Preferably listed as $R_{63}$ are methyl, ethyl, i-propyl, t-butyl, cyclohexyl, 1-methylcyclohexyl, and 2-hydroxyethyl. Of these, more preferably listed is 2-hydroxyethyl.

These groups may further have a substituent. Employed as such substituents may be those listed in foregoing $R_{61}$.

Further, $R_{63}$ is more preferably an alkyl group having 1–10 carbon atoms. Specifically listed is the hydroxyl group disclosed in JP-A 2004-004767, or an alkyl group, such as a 2-hydroxyethyl group, which has as a substituent a group capable of forming a hydroxyl group while being deblocked.

$R_{63}$ is preferably a hydroxyl group, or an alkyl group having 1–20 carbon atoms, which alkyl group has a group (hereinafter, referred to also as a precursor group) capable of forming a hydroxyl group by deblocking, but more preferably an alkyl group having 2–15 carbon atoms, having a hydroxyl group. The carbon atoms are preferably 2–10, and more preferably 2–5. The groups capable of forming a hydroxyl group by deblocking are preferably the groups which form a hydroxyl group by deblocking with a function of an acid and/or heat.

Specifically, ether groups (such as a methoxy group, tert-buthoxy group, an allyloxy group, a benziloxy group, a triphenylmethoxy group, and a trimethylsilyloxy group); hemiacetal groups (such as a tetrahydropyranyloxy group); ester droups (such as an acetyloxy group, a benzoyloxy group, p-nitrobenzoyloxy group, a formyloxy group, a trifluotoacetyloxy group, and a pivalonyloxy group); carbonate groups (such as an ethoxycarbonyloxy group, a phenoxycarbonyloxy group, and tert-butyloxycarbonyloxy group); sulfonate groups (such as a p-toluenesulfonyloxy group, and a benzenesulfonyloxy group); carbamoyloxy groups (such as a phenylcarbamoyloxy group); thiocarbonyloxy groups (such as a benzylthiocarbonyloxy group); nitrate ester groups; and sulfenate groups (such as 2,4-dinitrobenzenesulfenyloxy group).

In order to achieve high maximum density (Dmax) at a definite silver coverage, namely to result in silver image density of high covering power (CP), sole use or use in combination with other kinds of reducing agents is preferred.

The most preferred combination of $R_{62}$ and $R_{63}$ is that $R_{62}$ is a tertiary alkyl group (t-butyl, or 1-methylcyclohexyl) and $R_{63}$ is an alkyl group, such as a 2-hydoxyethyl group, which has, as a substituent, a hydroxyl group or a group capable of forming a hydroxyl group while being deblocked. Incidentally, a plurality of $R_{62}$ and R63 may be the same or different.

$R_{64}$ is a group capable of being substituted to a benzene ring. Listed as specific examples may be an alkyl group having 1–25 carbon atoms (methyl, ethyl, propyl, i-propyl, t-butyl, pentyl, hexyl, or cyclohexyl), a halogenated alkyl group (trifluoromethyl or perfluorooctyl), a cycloalkyl group (cyclohexyl or cyclopentyl); an alkynyl group (propagyl), a glycidyl group, an acrylate group, a methacrylate group, an aryl group (phenyl), a heterocyclic group (pyridyl, thiazolyl, oxazolyl, imidazolyl, furyl, pyrrolyl, pyradinyl, pyrimidyl, pyridadinyl, selenazolyl, piperidinyl, sliforanyl, piperidinyl, pyrazolyl, or tetrazolyl), a halogen atom (chlorine, bromine, iodine or fluorine), an alkoxy group (methoxy, ethoxy, propyloxy, pentyloxy, cyclopentyloxy, hexyloxy, or cyclohexyloxy), an aryloxy group (phenoxy), an alkoxycarbonyl group (methyloxycarbonyl, ethyloxycarbonyl, or butyloxycarbonyl), an aryloxycarbonyl group (phenyloxycarbonyl), a sulfonamido group (methanesulfonamide, ethanesulfonamide, butanesulfonamide, hexanesulfonamide group, cyclohexabesulfonamide, benzenesulfonamide), sulfamoyl group (aminosulfonyl, methyaminosulfonyl, dimethylaminosulfonyl, butylaminosulfonyl, hexylaminosulfonyl, cyclohexylaminosufonyl, phenylaminosulfonyl, or 2-pyridylaminosulfonyl), a urethane group (methylureido, ethylureido, pentylureido, cyclopentylureido, phenylureido, or 2-pyridylureido), an acyl group (acetyl, propionyl, butanoyl, hexanoyl, cyclohexanoyl, benzoyl, or pyridinoyl), a carbamoyl group (aminocarbonyl, methylaminocarbonyl, dimethylaminocarbonyl, propylaminocarbonyl, a pentylaminocarbonyl group, cyclohexylaminocarbonyl, phenylaminocarbonyl, or 2-pyridylaminocarbonyl), an amido group (acetamide, propionamide, butaneamide, hexaneamide, or benzamide), a sulfonyl group (methylsulfonyl, ethylsulfonyl, butylsulfonyl, cyclohexylsulfonyl, phenylsulfonyl, or 2-pyridylsulfonyl), an amino group (amino, ethylamino, dimethylamino, butylamino, cyclopentylamino, anilino, or 2-pyridylamino), a cyano group, a nitro group, a sulfo group, a carboxyl group, a hydroxyl group, and an oxamoyl group. Further, these groups may further be substituted with these groups. Each of n6 and m6 is an integer of 0–2. However, the most preferred case is that both n6 and m6 are 0. A plurality of $R_{64}$s may be the same or different.

Specific examples of the compounds represented by Formula (RED) include compounds R-1–R-59 described in U.S. Pat. No. 6,800,431, columns 6–16, and the compounds satisfied Formulas (S) and (T) described in European Patent No. 1,278,101, specifically these are the compounds of (1-24), (1-28)–(1-54), and (1-56)–(1-75) on pp. 21–28.

Specific examples of the compounds represented by Formula (RED) are listed below. However, the present invention is not limited thereto.

(RED1-1)

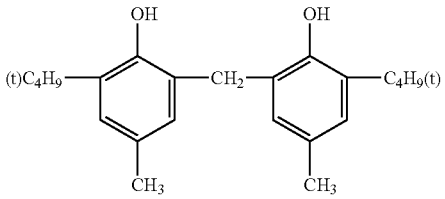

-continued (RED1-2)

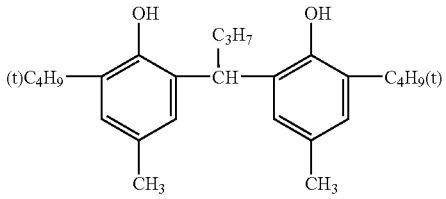

(RED1-3)

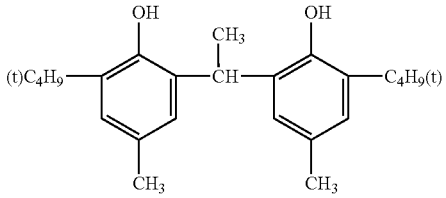

(RED1-4)

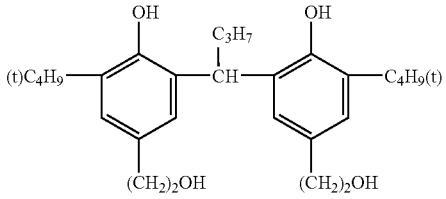

(RED1-5)

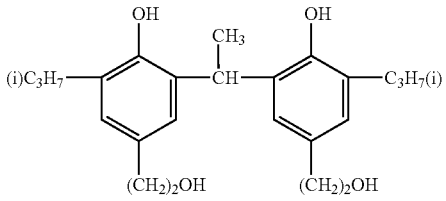

(RED1-6)

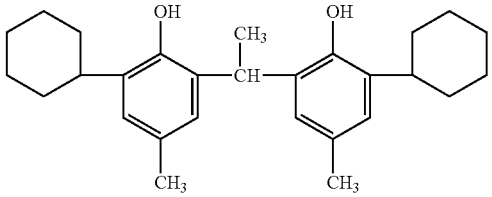

(RED1-7)

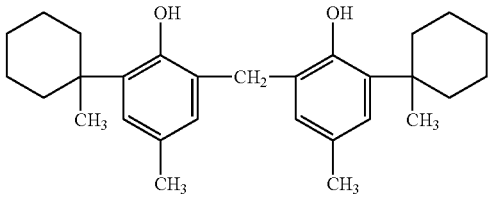

(RED1-8)

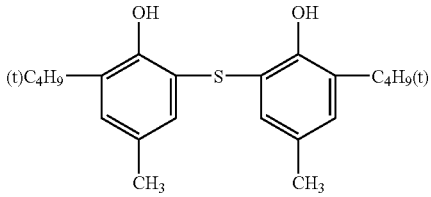

-continued
(RED1-9)
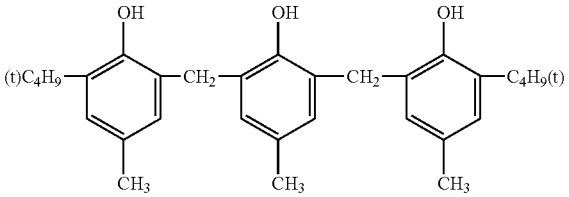
(RED1-10)
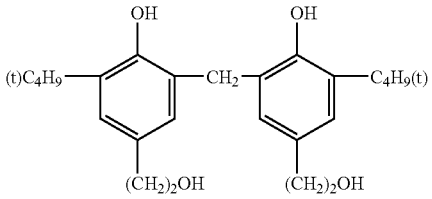
(RED1-11)
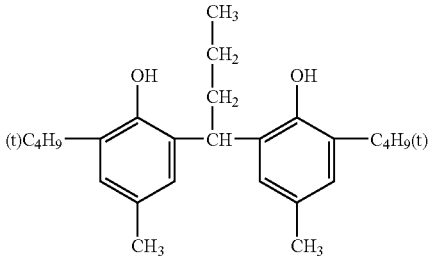
(RED1-12)
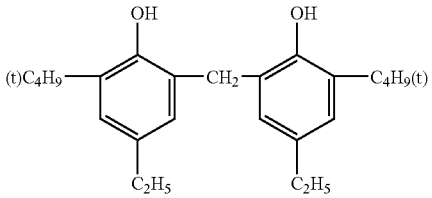
(RED1-13)
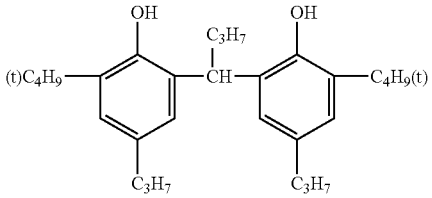
(RED1-14)
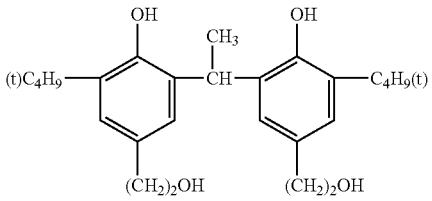
(RED1-15)
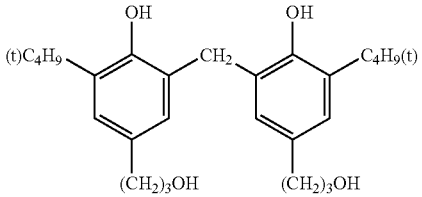
-continued
(RED1-16)
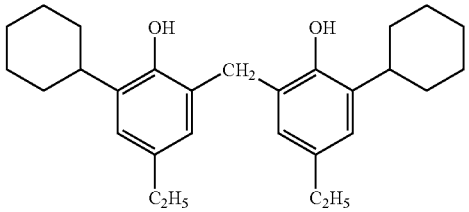
(RED1-17)
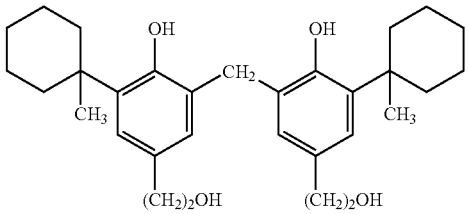
(RED1-18)
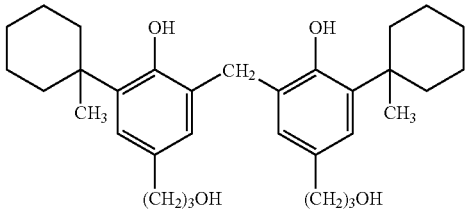
(RED1-19)
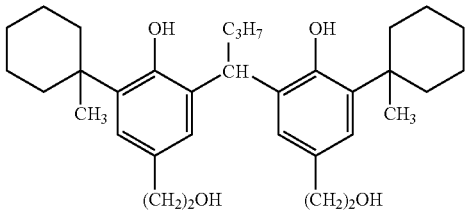
(RED1-20)
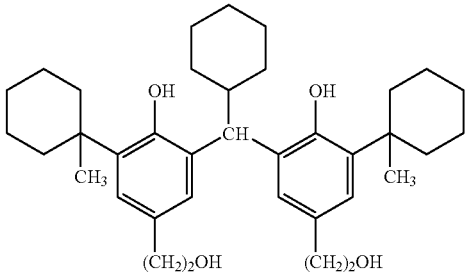
(RED1-21)
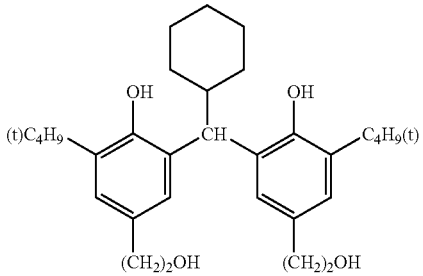

-continued
(RED1-22)
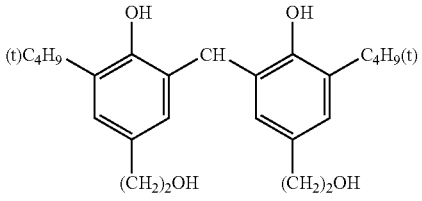
(RED1-23)
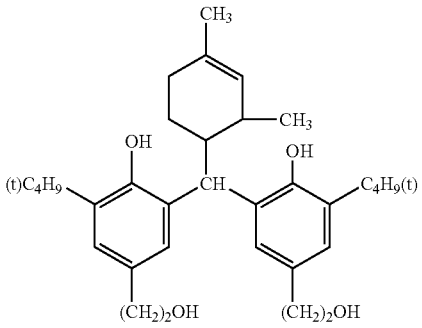
(RED1-24)
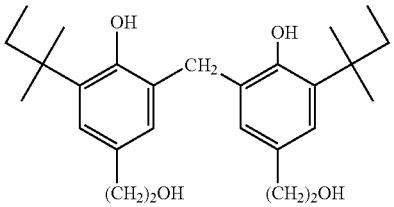
(RED1-25)
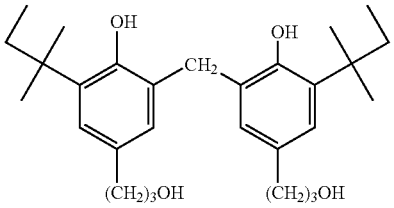
(RED1-26)
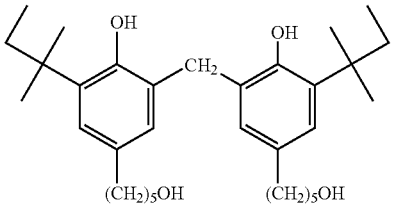
(RED2-1)
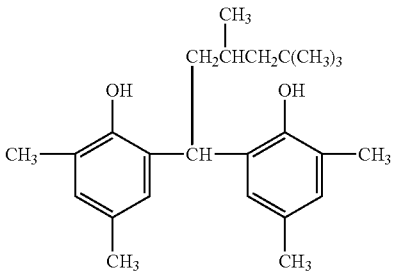
-continued
(RED2-2)
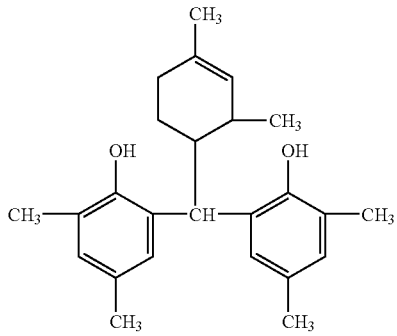
(RED2-3)
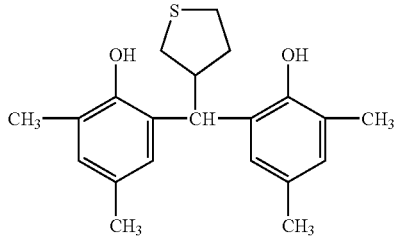
(RED2-4)
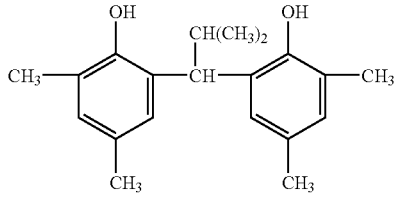
(RED2-5)
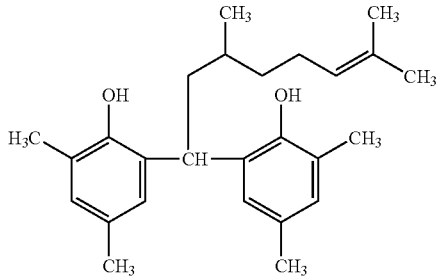
(RED2-6)
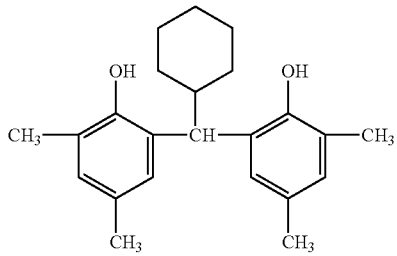
(RED2-7)
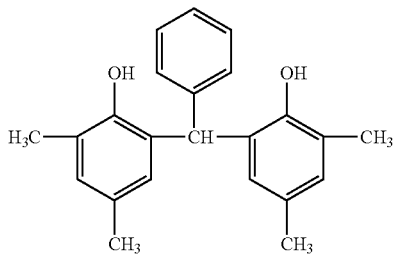

-continued (RED2-8)

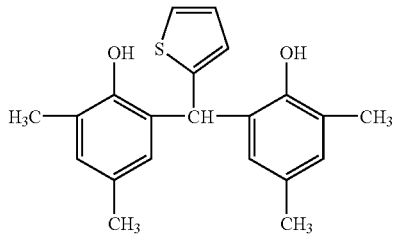

(RED2-9)

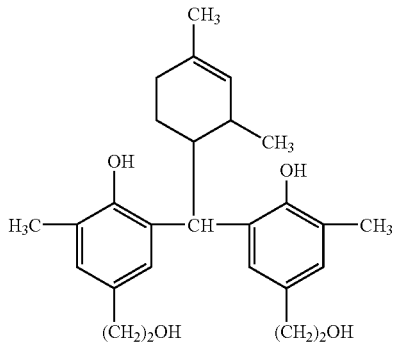

(RED2-10)

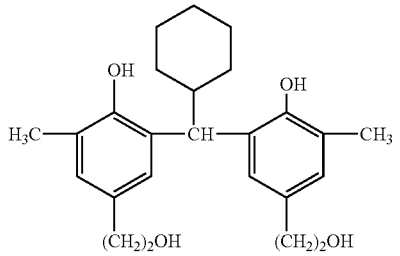

It is possible to synthesize these compounds (compounds) represented by Formula (RED) employing conventional methods known in the art.

The amount of silver ion reducing agents employed in the photothermographic dry imaging materials of this invention varies depending on the types of organic silver salts, reducing agents and other additives. However, the foregoing amount is customarily 0.05–10 mol per mol of organic silver salts, and is preferably 0.1–3 mol. Further, in the foregoing range, silver ion reducing agents of this invention may be employed in combinations of at least two types. Namely, in view of achieving images exhibiting excellent storage stability, high image quality and high CP, it is preferable to simultaneously use reducing agents which differ in reactivity, due to a different chemical structure.

In this invention, preferred cases occasionally occur in which the foregoing reducing agents are added, just prior to coating, to a photosensitive emulsion comprised of photosensitive silver halide, organic silver salt particles, and solvents and the resulting mixture is coated to minimize variations of photographic performance due to the standing time.

Further, hydrazine derivatives and phenol derivatives represented by Formulas (1)–(4) in JP-A 2003-43614, and Formulas (1)–(3) in JP-A 2003-66559 are preferably employed as a development accelerator which are simultaneously employed with the foregoing reducing agents.

Further employed as silver ion reducing agents according to this invention may be various types of reducing agents disclosed in European Patent No. 1,278,101 and JP-A 2003-15252.

Reducing agents which can be utilized in combination with reducing agents of this invention are described in such as U.S. Pat. Nos. 3,770,448, 3,773,512 and 3,593,863; RD Nos. 17029 and 29963; JP-A Nos. 11-119372 and 2002-62616.

The amount of silver ion reducing agents employed in the photothermographic imaging materials of this invention varies depending on the types of organic silver salts, reducing agents, and other additives. However, the foregoing amount is customarily 0.05–10 mol per mol of organic silver salts and is preferably 0.1–3 mol. Further, in this amount range, silver ion reducing agents of this invention may be employed in combinations of at least two types. Namely, in view of achieving images exhibiting excellent storage stability, high image quality, and high CP, it is preferable to simultaneously employ reducing agents which differ in reactivity due to different chemical structure.

In this invention, preferred cases occasionally occur in which when the foregoing reducing agents are added to and mixed with a photosensitive emulsion comprised of photosensitive silver halide, organic silver salt particles, and solvents just prior to coating, and then coated, variation of photographic performance during standing time is minimized.

<Chemical Sensitization>

The photosensitive silver halide of this invention may undergo chemical sensitization. For instance, it is possible to create chemical sensitization centers (being chemical sensitization nuclei) utilizing compounds which release chalcogen such as sulfur, as well as noble metal compounds which release noble metals ions, such as gold ions, while employing methods described in, for example, Japanese Patent Application Nos. 2000-057004 and 2000-061942. The chemical sensitization nuclei is capable of trapping an electron or a hole produced by a photo-excitation of a sensitizing dye. It is preferable that the foregoing silver halide is chemically sensitized employing organic sensitizers containing chalcogen atoms.

It is preferable that the foregoing organic sensitizers, comprising chalcogen atoms, have a group capable of being adsorbed onto silver halide grains as well as unstable chalcogen atom positions.

Employed as the foregoing organic sensitizers may be those having various structures, as disclosed in JP-A Nos. 60-150046, 4-109240, 11-218874, 11-218875, 11-218876, and 11-194447. Of these, the foregoing organic sensitizer is preferably at least one of compounds having a structure in which the chalcogen atom bonds to a carbon atom, or to a phosphorus atom, via a double bond. More specifically, a thiourea derivative having a heterocylic group and a triphenylphosphine derivative are preferred.

Chemical sensitization methods of this invention can be applied based on a variety of methods known in the field of wet type silver halide materials. Examples are disclosed in: (1) T. H. James ed., "The Theory of the Photographic Process" $4^{th}$ edition, Macmillan Publishing Co., Ltd. 1977; and (2) Japan Photographic Society, "Shashin Kogaku no Kiso" (Basics of Photographic Engineering), Corona Publishing, 1998. Specifically, when a silver halide emulsion is chemically sensitized, then mixed with a light-insensitive organic silver salt, the conventionally known chemical sensitizing methods ca be applied.

The employed amount of chalcogen compounds as an organic sensitizer varies depending on the types of employed chalcogen compounds, silver halide grains, and reaction environments during performing chemical sensitization, but is preferably from $10^{-8}$ to $10^{-2}$ mol per mol of silver halide, and is more preferably from $10^{-7}$ to $10^{-3}$ mol. The chemical sensitization environments are not particularly limited. However, it is preferable that in the presence of compounds which diminish chalcogenized silver or silver nuclei, or decrease their size, especially in the presence of oxidizing agents capable of oxidizing silver nuclei, chalcogen sensitization is performed employing organic sensitizers, containing chalcogen atoms. The sensitization conditions are that the pAg is preferably 6–11, but is more preferably 7–10, while the pH is preferably 4–10, but is more preferably 5–8. Further, the sensitization is preferably carried out at a temperature of lass than or equal to 30° C.

Further, it is preferable that chemical sensitization, employing the foregoing organic sensitizers, is carried out in the presence of either spectral sensitizing dyes or compounds containing heteroatoms, which exhibit the adsorption onto silver halide grains. By carrying out chemical sensitization in the presence of compounds which exhibit adsorption onto silver halide grains, it is possible to minimize the dispersion of chemical sensitization center nuclei, whereby it is possible to achieve higher speed as well as lower fogging. Though spectral sensitizing dyes will be described below, the compounds comprising heteroatoms, which result in adsorption onto silver halide grains, as descried herein, refer to, as preferable examples, nitrogen containing heterocyclic compounds described in JP-A 3-24537. Listed as heterocycles in nitrogen-containing heterocyclic compounds may be a pyrazole ring, a pyrimidine ring, a 1,2,4-triazine ring, a 1,2,3-triazole ring, a 1,3,4-thiazole ring, a 1,2,3-thiazole ring, a 1,2,4-thiadiazole ring, a 1,2,5-thiadiazole ring, 1,2,3,4-tetrazole ring, a pyridazine ring, and a 1,2,3-triazine ring, and a ring which is formed by combining 2 or 3 of the rings such as a triazolotriazole ring, a diazaindene ring, a triazaindene ring, and a pentaazaindenes ring. It is also possible to employ heterocyclic rings such as a phthalazine ring, a benzimidazole ring, an indazole ring and a benzthiazole ring, which are formed by condensing a single heterocyclic ring and an aromatic ring.

Of these, preferred is an azaindene ring. Further, preferred are azaindene compounds having a hydroxyl group, as a substituent, which include compounds such as hydroxytriazaindene, tetrahydroxyazaindene, and hydroxypentaazaindene.

The foregoing heterocyclic ring may have substituents other than a hydroxyl group. As substituents, the foregoing heterocyclic ring may have, for example, an alkyl group, a substituted alkyl group, an alkylthio group, an amino group, a hydroxyamino group, an alkylamino group, a dialkylamino group, an arylamino group, a carboxyl group, an alkoxycarbonyl group, a halogen atom, and a cyano group.

The added amount of these-heterocyclic compounds varies widely depending on the size and composition of silver halide grains, and other conditions. However, the amount is in the range of about $10^{-6}$–1 mol per mol of silver halide, and preferably in the range of $10^{-4}$–$10^{-1}$ mol.

The photosensitive silver halide of this invention may undergo noble metal sensitization utilizing compounds which release noble metal ions such as gold ions. For example, employed as gold sensitizers may be chloroaurates and organic gold compounds disclosed in JP-A 11-194447.

Further, other than the foregoing sensitization methods, it is possible to employ a reduction sensitization method. Employed as specific compounds for the reduction sensitization may be ascorbic acid, thiourea dioxide, stannous chloride, hydrazine derivatives, boron compounds, silane compounds, and polyamine compounds. Further, it is possible to perform reduction sensitization by ripening an emulsion while maintaining a pH higher than or equal to 7 or a pAg less than or equal to 8.3.

In this invention, silver halide which undergoes the chemical sensitization, includes one which has been formed in the presence of organic silver salts, another which has been formed in the absence of organic silver salts, or still another which has been formed by mixing those above.

In this invention, it is preferable that the surface of photosensitive silver halide grains undergoes chemical sensitization and the resulting chemical sensitizing effects are substantially lost after the thermal development process. "Chemical sensitization effects are substantially lost after the thermal development process", as described herein, means that the speed of the foregoing imaging material which has been achieved by the foregoing chemical sensitization techniques decreases to 1.1 times or less compared to the speed of foregoing material which does not undergo chemical sensitization. In order to decrease the effect of chemical sensitization after thermal development treatment, it is required to incorporate sufficient amount of an oxidizing agent capable to destroy the center of chemical sensitization by oxidation in an photosensitive emulsion layer or non-photosensitive layer of the imaging material. An example of such compound is a aforementioned compound which release a halogen radical. An amount of incorporated oxidizing agent is preferably adjusted by considering an oxidizing power of the oxidizing agent and the degree of the decrease the effect of chemical sensitization.

<Spectral Sensitization>

It is preferable that photosensitive silver halide in this invention is adsorbed by spectral sensitizing dyes so as to result in spectral sensitization. Employed as spectral sensitizing dyes may be cyanine dyes, merocyanine dyes, complex cyanine dyes, complex merocyanine dyes, homopolar cyanine dyes, styryl dyes, hemicyanine dyes, oxonol dyes, and hemioxonol dyes. For example, employed may be sensitizing dyes described in JP-A Nos. 63-159841, 60-140335, 63-231437, 63-259651, 63-304242, and 63-15245, and U.S. Pat. Nos. 4,639,414, 4,740,455, 4,741,966, 4,751,175, and 4,835,096.

Useful sensitizing dyes, employed in this invention, are described in, for example, Research Disclosure, Item 17645, Section IV-A (page 23, December 1978) and Item 18431, Section X (page 437, August 1978) and publications further cited therein. It is specifically preferable that those sensitizing dyes are used which exhibit spectral sensitivity suitable for spectral characteristics of light sources of various types of laser imagers, as well as of scanners. For example, preferably employed are compounds described in JP-A Nos. 9-34078, 9-54409, and 9-80679.

Useful cyanine dyes include, for example, cyanine dyes having basic nuclei such as a thiazoline nucleus, an oxazoline nucleus, a pyrroline nucleus, a pyridine nucleus, an oxazole nucleus, a thiazole nucleus, a selenazole nucleus, and an imidazole nucleus. Useful merocyanine dyes, which are preferred, comprise, in addition to the basic nuclei, acidic nuclei such as a thiohydantoin nucleus, a rhodanine nucleus, an oxazolizinedione nucleus, a thiazolinedione nucleus, a barbituric acid nucleus, a thiazolinone nucleus, a marononitryl nucleus, and a pyrazolone nucleus.

In this invention, it is possible to employ sensitizing dyes which exhibit spectral sensitivity, specifically in the infrared region. Listed as preferably employed infrared spectral sensitizing dyes are infrared spectral sensitizing dyes disclosed in U.S. Pat. Nos. 4,536,473, 4,515,888, and 4,959,294.

A photothermographic imaging material utilized in a thermal development method of this invention preferably contains at least one type selected from sensitizing dyes represented by formula (1) and sensitizing dyes represented by formula (2) and at least one type selected from sensitizing dyes represented by formula (5) and sensitizing dyes represented by formula (6), which are described in US Patent Publication Open to Public Inspection No. 2004-224266.

It is possible to easily synthesize the foregoing infrared sensitizing dyes, employing the method described in F. M. Harmer, "The Chemistry of Heterocyclic Compounds", Volume 18, The Cyanine Dyes and Related Compounds (A. Weissberger ed., published by Interscience, New York, 1964).

These infrared sensitizing dyes may be added at any time after preparing the silver halide. For example, the dyes may be added to solvents, or the dyes, in a so-called solid dispersion state in which the dyes are dispersed into minute particles, may be added to a photosensitive emulsion comprising silver halide grains or silver halide grains/aliphatic carboxylic acid silver salts. Further, in the same manner as the foregoing heteroatoms containing compounds which exhibit adsorption onto silver halide grains, the dyes are adsorbed onto silver halide grains prior to chemical sensitization, and subsequently, undergo chemical sensitization, whereby it is possible to minimize the dispersion of chemical sensitization center nuclei so at to enhance speed, as well as to decrease fogging.

In this invention, the foregoing spectral sensitizing dyes may be employed individually or in combination. Combinations of sensitizing dyes are frequently employed when specifically aiming for supersensitization, for expanding or adjusting a spectral sensitization range.

An emulsion comprising photosensitive silver halide as well as aliphatic carboxylic acid silver salts, which are employed in the photothermographic imaging material of this invention, may comprise sensitizing dyes together with compounds which are dyes having no spectral sensitization or have substantially no absorption of visible light and exhibit supersensitization, whereby the foregoing silver halide grains may be supersensitized.

Useful combinations of sensitizing dyes and dyes exhibiting supersensitization, as well as materials exhibiting supersensitization, are described in Research Disclosure 17643 (published December 1978), page 23, Section J of IV; JP-B 9-25500 and 43-4933; and JP-A Nos. 59-19032, 59-192242, and 5-431432. Preferred as supersensitizers are hetero-aromatic mercapto compounds or mercapto derivatives.

$$Ar—SM^4$$

wherein $M^4$ is a hydrogen atom or an alkali metal atom, and Ar is an aromatic ring or a condensed aromatic ring, having at least one of a nitrogen, sulfur, oxygen, selenium, or tellurium atom. Hetero-aromatic rings are preferably benzimidazole, naphthoimidazole, benzimidazole, naphthothiazole, benzoxazole, naphthooxazole, benzoselenazole, benztellurazole, imidazole, oxazole, pyrazole, triazole, triazine, pyrimidine, pyridazine, pyrazine, pyridine, purine, quinoline, or quinazoline. On the other hand, other hetero-aromatic rings are also included.

Incidentally, mercapto derivatives, when incorporated in the dispersion of aliphatic carboxylic acid silver salts and/or a silver halide grain emulsion, are also included which substantially prepare the mercapto compounds. Specifically, listed as preferred examples are the mercapto derivatives described below.

$$Ar—S—S—Ar$$

wherein Ar is the same as the mercapto compounds defined above.

The foregoing hetero-aromatic rings may have a substituent selected from the group consisting of, for example, a halogen atom (for example, Cl, Br, and I), a hydroxyl group, an amino group, a carboxyl group, an alkyl group (for example, an alkyl group having at least one carbon atom and preferably having from 1 to 4 carbon atoms), and an alkoxy group (for example, an alkoxy group having at least one carbon atom and preferably having from 1 to 4 carbon atoms).

Other than the foregoing supersensitizers, employed as supersensitizers may be compounds represented by Formula (5), shown below, which is disclosed in JP-A 2000-070296 and large ring compounds containing a hetero atom.

The amount of a supersensitizer of this invention used in a photosensitive layer containing an organic silver salt and silver halide grains and in this invention is in the range of 0.001–1.0 mol per mol of Ag. More preferably, it is 0.01–0.5 mol per mol of Ag.

In this invention, it is preferable that the surface of photosensitive silver halide grains undergoes chemical sensitization and the resulting chemical sensitizing effects are substantially lost after the thermal development process. "Chemical sensitization effects are substantially lost after the thermal development process", as described herein, means that the speed of the foregoing imaging material which has been achieved by the foregoing chemical sensitization techniques decreases to 1.1 times or less compared to the speed of foregoing material which does not undergo chemical sensitization. In order to decrease the effect of chemical sensitization after thermal development treatment, it is required to employ a spectral sensitizing dye which is easily desorpted from the silver halide grains during thermal development; or to incorporate sufficient amount of an oxidizing agent capable to destroy the spectral sensitizing dye by oxidation in an photosensitive emulsion layer or non-photosensitive layer of the imaging material. An example of such compound is a aforementioned compound which release a halogen radical. An amount of incorporated oxidizing agent is preferably adjusted by considering an oxidizing power of the oxidizing agent and the degree of the decrease the effect of chemical sensitization.

<Silver Saving Agent>

In this invention, either a photosensitive layer or a light-insensitive layer may comprise silver saving agents.

The silver saving agents, used in this invention, refer to compounds capable of reducing the silver amount to obtain a definite silver image density. Even though various mechanisms may be considered to explain functions regarding a decrease in the silver amount, compounds having functions to enhance covering power of developed silver are preferable. The covering power of developed silver, as described herein, refers to optical density per unit amount of silver.

These silver saving agents may be incorporated in either a photosensitive layer or a light-insensitive layer or in both such layers.

Preferable examples of a silver saving layer include hydrazine derivatives represented following Formula (H), vinyl compounds represented by following Formula (G), and quaternary onium compounds represented by following Formula (P), phenol derivatives, naphthol derivatives, and silane compounds.

Formula (H)

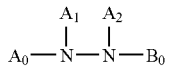

Formula (G)

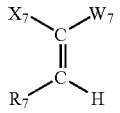

Formula (P)

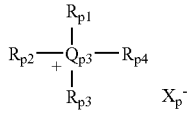

In Formula (H), $A_0$ is an aliphatic group, an aromatic group, a heterocyclic group, or a $-G_0-D_0$ group, each of which may have a substituent; $B_0$ is a blocking group; and $A_1$ and $A_2$ each is a hydrogen atom, or one is a hydrogen atom and the other is an acyl group, a sulfonyl group, or a oxalyl group. Herein, $G_0$ is a —CO— group, a —COCO— group, a —CS— group, a —C(═$NG_1D_1$)-group, a —SO— group, a —$SO_2$— group, or a —P(O) ($G_1D_1$)-group, wherein $G_1$ is a simple bonding atom or a group such as an —O— group, a —S— group, or an —N($D_1$)-group, wherein $D_1$ is an aliphatic group, an aromatic group, a heterocyclic group, or a hydrogen atom; when there is a plurality of $D_1$ in the molecule, those may be the same or different; and $D_0$ is a hydrogen atom, an aliphatic group, an aromatic group, a heterocyclic group, an amino group, an alkoxy group, an aryloxy group, an alkylthio group, or an arylthio group. Listed as preferred $D_0$ are a hydrogen atom, an alkyl group, an alkoxy group, and an amino group.

In Formula (H), the aliphatic group represented by $A_0$ is preferably a straight chain, branched, or cyclic alkyl group having from 1 to 30 carbon atoms and more preferably from 1 to 20 carbon atoms. Listed as the alkyl groups are, for example, a methyl group, an ethyl group, a t-butyl group, an octyl group, a cyclohexyl group, and a benzyl group. The groups may be substituted with a suitable substituent (for example, an aryl group, an alkoxy group, an aryloxy group, an alkylthio group, an arylthio group, a sulfoxyl group, a sulfonamido group, a sulfamoyl group, an acylamino group, and a ureido group).

In Formula (H), the aromatic group represented by $A_0$ is preferably a single ring or fused ring aryl group. Listed as examples are a benzene ring or a naphthalene ring. Preferably listed as heterocyclic groups represented by $A_0$ are those containing at least one heteroatom selected from nitrogen, sulfur and oxygen atoms. Listed as examples are a pyrrolidine ring, an imidazole ring, a tetrahydrofuran ring, a morpholine ring, a pyridine ring, a pyrimidine ring, a quinoline ring, a thiazole ring, a benzothiazole ring, a thiophene ring, and a furan ring. The aromatic ring, heterocyclic group, and $-G_0-D_0$ group may each have a substituent. Particularly preferred as $A_0$ are an aryl group and a $-G_0-D_0-$ group.

Further, in Formula (H), $A_0$ preferably contains at least one of non-diffusive groups or silver halide adsorbing groups. Preferred as the non-diffusive groups are ballast groups which are commonly employed for immobilized photographic additives such as couplers. Listed as ballast groups are an alkyl group, an alkenyl group, an alkynyl group, an alkoxy group, a phenyl group, a phenoxy group, and an alkylphenoxy group, which are photographically inactive. The total number of carbon atoms of the portion of the substituent is preferably at least 8.

In Formula (H), listed as silver halide adsorption enhancing groups are thiourea, a thiourethane group, a mercapto group, a thioether group, a thione group, a heterocyclic group, a thioamido heterocyclic group, a mercapto heterocyclic group, or the adsorption group described in JP-A 64-90439.

In Formula (H), $B_0$ is a blocking group, and preferably is $-G_0-D_0$ group, wherein $G_0$ is a —CO— group, a —COCO— group, a —CS— group, a —C(═$NG_1D_1$)-group, an —SO— group, an —$SO_2$— group, or a —P(O) ($G_1D_1$) group. Listed as preferred $G_0$ are a —CO— group and a —COCO— group. $G_1$ is a simple bonding atom or group such as an —O— atom, an —S— atom or an —N($D_1$)-group, wherein $D_1$ is an aliphatic group, an aromatic group, a heterocyclic group, or a hydrogen atom, and when there is a plurality of $D_1$ in a molecule, they may be the same or different. $D_0$ is a hydrogen atom, an aliphatic group, an aromatic group, a heterocyclic group, an amino group, an alkoxy group, an aryloxy group, an alkylthio group, and an arylthio group. Listed as preferred $D_0$ are a hydrogen atom, an alkyl group, an alkoxy group, or an amino group. $A_1$ and $A_2$ each is a hydrogen atom, or when one is a hydrogen atom, the other is an acyl group (such as an acetyl group, a trifluoroacetyl group, and a benzoyl group), a sulfonyl group (such as a methanesulfonyl group and a toluenesulfonyl group), or an oxalyl group (such as an ethoxalyl group).

The compounds represented by Formula (H) can be easily synthesized employing methods known in the art. They can be synthesized based on, for example, U.S. Pat. Nos. 5,464,738 and 5,496,695.

Other than those, preferably usable hydrazine derivatives include Compounds H-1 through H-29 described in columns 11–20 of U.S. Pat. No. 5,545,505, and Compounds 1–12 in columns 9–11 of U.S. Pat. No. 5,464,738. The hydrazine derivatives can be synthesized employing methods known in the art.

In Formula (G), $X_7$ as well as $R_7$ are illustrated utilizing a cis form, while $X_7$ and $R_7$ include a trans form. This is applied to the structure illustration of specific compounds.

In Formula (G), $X_7$ is an electron attractive group, while $W_7$ is a hydrogen atom, an alkyl group, an alkenyl group, an alkynyl group, an aryl group, a heterocyclic group, a halogen atom, an acyl group, a thioacyl group, an oxalyl group, an oxyoxalyl group, a thioxyalyl group, an oxamoyl group, an oxycarbonyl group, a thiocarbonyl group, a carbamoyl group, a thiocarbamoyl group, a sulfonyl group, a sulfinyl group, an oxysulfinyl group, a thiosulfinyl group, a sulfamoyl group, an oxysulfinyl group, a thiosulfinyl group, a sulfamoyl group, a phosphoryl group, a nitro group, an imino group, an N-carbonylimino group, an N-sulfonylimino group, a dicyanoethylene group, an ammonium group, a sulfonium group, a phosphonium group, a pyrylium group, and an immonium group.

$R_7$ is a halogen atom, a hydroxyl group, an alkoxy group, an aryloxy group, a heterocyclic oxy group, an alkenyloxy group, an acyloxy group, an alkoxycarbonyloxy group, an aminocarbonyloxy group, a mercapto group, an alkylthio group, an arylthio group, a heterocyclic thio group, an alkenylthio group, an acylthio group, an alkoxycarbonylthio group, an aminocarbonylthio group, a hydroxyl group, an organic or inorganic salt (for example, a sodium salt, a potassium salt, and a silver salt) of a mercapto group, an amino group, an alkylamino group, a cyclic amino group (for example, a pyrrolidino group), an acylamino group, an oxycarbonylamino group, a heterocyclic group (a nitrogen-containing 5- or 6-membered heterocyclic ring such as a benztriazolyl group, an imidazolyl group, a triazolyl group, and a tetrazolyl group), a ureido group, and a sulfonamido group. $X_7$ and $W_7$ may be joined together to form a ring structure, while $X_7$ and $R_7$ may also be joined together in the same manner. Listed as rings which are formed by $X_7$ and $W_7$ are, for example, pyrazolone, pyrazolidinone, cyclopentanedione, β-ketolactone, and β-ketolactum.

Formula (G) will be described further. The electron attractive group represented by $X_7$ refers to the substituent of which substituent constant σp is able to take a positive value. Specifically, included are a substituted alkyl group (such as a halogen-substituted alkyl group), a substituted alkenyl group (such as a cyanovinyl group), a substituted or unsubstituted alkynyl group (such as a trifluoromethylacetylenyl group and a cyanoacetylenyl group), a substituted aryl group (such as a cyanophenyl group), a substituted or unsubstituted heterocyclic group (such as a pyridyl group, a triazinyl group, or a benzoxazolyl group), a halogen atom, a cyano group, an acyl group (such as an acetyl group, a trifluoroacetyl group, and a formyl group), a thioacetyl group (such as a thioacetyl group and a thioformyl group), an oxalyl group (such as a methyloxalyl group), an oxyoxalyl group (such as an ethoxyoxalyl group), a thiooxyalyl group (such as an ethylthiooxyalyl group), an oxamoyl group (such as a methyloxamoyl group), an oxycarbonyl group (such as an ethoxycarbonyl group), a carboxyl group, a thiocarbonyl group (such as an ethylthiocarbonyl group), a carbamoyl group, a thiocarbamoyl group, a sulfonyl group, a sulfinyl group, an oxysulfonyl group (such as an ethoxysulfonyl group), a thiosulfonyl group (such as an ethylthiosulfonyl group), a sulfamoyl group, an oxysulfinyl group (such as a methoxysulfinyl group), a thiosulfinyl group (such as a methylthiosulfinyl group), a sulfinamoyl group, a phosphoryl group, a nitro group, an imino group, an N-carbonylimino group (such as an N-acetylimino group), an N-sulfonylimino group (such as an N-methanesulfonylimino group), a dicyanoethylene group, an ammonium group, a sulfonium group, a phosphonium group, a pyrylium group, and an immonium group. However, also included are heterocyclic rings which are formed employing an ammonium group, a sulfonium group, a phosphonium group, or an immonium group. Substituents having a σp value of at least 0.30 are particularly preferred.

Alkyl groups represented by $W_7$ include a methyl group, an ethyl group, and a trifluoromethyl group; alkenyl groups represented by W include a vinyl group, a halogen-substituted vinyl group, and a cyanovinyl group; aryl groups represented by W include a nitrophenol group, a cyanophenyl group, and a pentafluorophenyl group; heterocyclic groups represented by W include a pyridyl group, a triazinyl group, a succinimido group, a tetrazolyl group, an imidazolyl group, and a benzoxyazolyl group. Preferred as $W_7$ are electron attractive groups having a positive σp value, and more preferred are those having a σp value of at least 0.30.

Of the foregoing substituents of $R_7$, preferably listed are a hydroxyl group, a mercapto group, an alkoxy group, an alkylthio group, a halogen atom, an organic or inorganic salt of a hydroxyl group or a mercapto group, and a heterocyclic group, and of these, more preferably listed are a hydroxyl group, and an organic or inorganic salt of a hydroxyl group or a mercapto group.

Further, of the foregoing substituents of $X_7$ and $W_7$, preferred are those having an thioether bond in the substituent.

In Formula (P), $Q_{p3}$ is a nitrogen atom or a phosphorus atom; $R_{p1}$, $R_{p2}$, $R_{p3}$, and $R_{p4}$ are each a hydrogen atom or a substituents; and $X_p^-$ is an anion. Incidentally, $R_{p1}$–$R_{p4}$ may be joined together to form a ring.

Listed as substituents represented by $R_{p1}$–$R_{p4}$ are an alkyl group (such as a methyl group, an ethyl group, a propyl group, a butyl group, a hexyl group, and a cyclohexyl group), an alkenyl group (such as an allyl group and a butenyl group), an alkynyl group (such as a propargyl group and a butynyl group), an aryl group (such as a phenyl group and a naphthyl group), a heterocyclic group (such as a piperidinyl group, a piperazinyl group, a morpholinyl group, a pyridyl group, a furyl group, a thienyl group, a tetrahydrofuryl group, a tetrahydrothienyl group, and a sulforanyl group), and an amino group.

Listed as rings which are formed by joining $R_{p1}$–$R_{p4}$ are a piperidine ring, a morpholine ring, a piperazine ring, quinuclidine ring, a pyridine ring, a pyrrole ring, an imidazole ring, a triazole ring, and a tetrazole ring.

Groups represented by $R_{p1}$–$R_{p4}$ may have a substituent such as a hydroxyl group, an alkoxy group, an aryloxy group, a carboxyl group, a sulfo group, an alkyl group, and an aryl group. $R_{p1}$, $R_{p2}$, $R_{p3}$, and $R_{p4}$ are each preferably a hydrogen atom or an alkyl group.

Listed as anions represented by $X_p^-$ are inorganic or organic anions such as a halogen ion, a sulfate ion, a nitrate ion, an acetate ion, and a p-toluenesulfonate ion.

The foregoing quaternary onium compounds can easily be synthesized employing methods known in the art. For instance, the foregoing tetrazolium compounds can be synthesized based on the method described in Chemical Reviews Vol. 55. pp. 335–483. The added amount of the foregoing silver saving agents is commonly $10^{-5}$–1 mol per mol of aliphatic carboxylic acid silver salts, and is preferably $10^{-4}$–$5\times10^{-1}$ mol.

In this invention, it is preferable that at least one of silver saving agents is a silane compound. The silane compounds employed as a silver saving agent in present invention are preferably alkoxysilane compounds having at least two primary or secondary amino groups or salts thereof, as described in JP-A 2003-5324.

When alkoxysilane compounds or salts thereof or Schiff bases are incorporated in the image forming layer as a silver saving agent, the added amount of these compound is preferably in the range of 0.00001–0.05 mol per mol of silver. Further, both of alkoxysilane compounds or salt thereof and Schiff bases are added, the added amount is in the same range as above.

Specifically preferable silver saving agents of this invention are compounds represented by foregoing formulas (SE1) and (SE2).

In formula (SE1), an aromatic group or a heterocyclic group represented by Q, is preferably a 5–7 member unsaturated ring. Preferable examples include each ring of benzene, pyridine, pyrazine, pyrimidine, pyridazine, 1,2,4-triazine, 1,3,5-triazine, pyrrole, imidazole, pyrazole, 1,2,3-triazole, 1,2,4-triazole, tetrazole, 1,3,4-thiazole, 1,2,4-thiazole, 1,2,5-thiazole, 1,3,4-oxathiazole, 1,2,4-oxathiazole, 1,2,5-oxathiazole, thiazole, oxazole, isothiazole, isooxazole and thiophene; and further also preferable are condensed rings in which these rings are condensed each other.

These rings may be provided with a substituent and, in the case of having at least two substituents, the substituents may be either identical or different. Examples of the substituents include a halogen atom, an alkyl group, an aryl group, a carbonamido group, an alkylsulfonamido group, an arylsulfonamido group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group and an acyl group. When these substituents are capable of being substituted, they may be further provided with a substituent, and examples of the preferable substituents include a halogen atom, an alkyl group, an aryl group, a carbonamido group, an alkylsulfonamido group, an arylsulfonamido group, an alkoxy group, an aryloxy group, an alkylthio group, an arylthio group, an acyl group, an alkoxycarbonyl group, an aryloxycarbonyl group, a carbamoyl group, an cyano group, a sulfamoyl group, an alkylsulfonyl group, an arylsulfonyl group and an acyloxy group.

A carbamoyl group represented by $Q_2$ is a carbamoyl group having a carbon number of preferably 1–50 and more preferably 6–40, and include such as unsubstituted carbamoyl, methylcarbamoyl, N-ethylcarbamoyl, N-propylcarbamoyl, N-sec-butylcarbamoyl, N-octylcarbamoyl, N-cyclohexylcarbamoyl, N-t-butylcarbamoyl, N-dodecylcarbamoyl, N-(3-dodecyloxypropyl)carbamoyl, N-octadecylcarbamoyl, N-{3-(2,4-di-t-pentylphenoxy)propyl}carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphthylcarbamoyl, 3-pyridylcarbamoyl and N-benzylcarbamoyl.

An acyl group represented by $Q_2$ is an acyl group having a carbon number of preferably 1–50 and more preferably 6–40, and include such as formyl, acetyl, 2-methylpropanoyl, cyclohexylcarbonyl, octanoyl, 2-hexyldecanoyl, dodecanoyl, chloroacetyl, trifluoroactyl, benzoyl, 4-dodecyloxy benzoyl and 2-hydroxymethyl benzoyl. An alkoxycarbonyl group represented by $Q_2$ is an alkoxycarbonyl group having a carbon number of preferably 2–50 and more preferably 6–40, and include such as methoxycarbonyl, ethoxycarbonyl, i-butyloxycarbonyl, cyclohexyloxycarbonyl, dodecyloxycarbonyl and benzyloxycarbonyl.

An aryloxycarbonyl group represented by $Q_2$ is an aryloxycarbonyl group having a carbon number of preferably 7–50 and more preferably 7–40, and include such as phenoxycarbonyl, 4-octyloxyphenoxycarbonyl, 2-hydroxymethylphenoxycarbonyl and 4-dodecyloxyphenoxycarbonyl. A sulfonyl group represented by $Q_2$ is a sulfonyl group having a carbon number of preferably 1–50 and more preferably 6–40, and include such as methylsulfonyl, butylsulfonyl, octylsulfonyl, 2-hexadecylsulfonyl, 3-dodecyloxypropylsulfonyl, 2-octyloxy-5-t-octylphenylsulfonyl and 4-dodecyloxyphenylsulfonyl.

A sulfamoyl group represented by $Q_2$ is a sulfamoyl group having a carbon number of preferably 0–50 and more preferably 6–40, and include such as unsubstituted sulfamoyl, N-ethylsulfamoyl, N-(2-ethylhexyl)sulfamoyl, N-decylsulfamoyl, N-hexadecylsulfamoyl, N-3-(2-ethylhexyloxy)propylsulfamoyl, N-2-chloro-(5,-dodecyloxycarbonylphenyl)sulfamoyl and N-(2-tetradecyloxyphenyl)sulfamoyl. Groups represented by $Q_2$ may be provided with a group which was listed up as an example of substituents for the foregoing 5–7-member unsaturated rings represented by $Q_1$ at a position capable of being substituted, and, in the case of at least two substituents are provided, the substituents may be identical to or different from each other.

Next, the preferable range of compounds represented by formula (A-1) will be described. $Q_1$ is preferably a 5–6-member unsaturated ring, and more preferably each ring of benzene, pyrimidine, 1,2,3-triazole, 1,2,4-triazole, tetrazole, 1,3,4-thiazole, 1,2,4-thiazole, 1,3,4-oxazole, 1,2,4-oxadiazole, thiazole, oxazole, isothiazole and isooxazole, and rings, in which these rings condensed with a benzene ring or an unsaturated heterocyclic ring, are more preferable. Further, $Q_2$ is preferably a carbamoyl group and specifically preferably a carbamoyl group provided with a hydrogen atom on the nitrogen atom.

In formula (SE2), $R^1$ is preferably an alkyl group, an acyl group, a sulfonamide group, an alkoxycarbonyl group and a carbamoyl group. $R^2$ represents a hydrogen atom, a halogen atom, an alkyl group, an alkoxy group, an aryloxy group, an alkylthio group, an arylthio group, an acyloxy group and a carbonic acid ester group. $R^3$ and $R^4$ each represent groups capable of substituting to a benzene ring which are listed as substituent examples of formula (SE1). $R^3$ and $R^4$ may bond each other to form a condensed ring.

$R^1$ is preferably an alkyl group having a carbon number of 1–20 (such as methl, ethyl, i-propyl, butyl, t-octyl and cyclohexyl), an acylamino group (such as acetylamino, benzoylamino, methylureido and 4-cyanophenylureido) and a carbamoyl group (such as butylcarbamoyl, diethylcarbonyl, phenylcarbamoyl, 2-chlorophenylcarbamoyl and 2,4-dichlorophenylcarbamoyl); and more preferably an acyl amino group (including an ureido group and a urethane group). $R^2$ is preferably a halogen atom (more preferably a chlorine atom or a bromine atom), an alkoxy group (such as methoxy, butoxy, hexyloxy, decyloxy, cyclohexyloxy and benzyloxy) or an aryloxy group (such as phenoxy and naphthoxy).

$R^3$ is preferably a hydrogen atom, a halogen atom or an alkyl group having a carbon number of 1–20 and most preferably a halogen atom. $R^4$ is preferably a hydrogen atom, an alkyl group or an acylamino group, and preferably an alkyl group or an acylamino group. Examples of these preferable groups are identical to $R^1$. In the case of $R^4$ being an acylamino group, $R^4$ also preferably form a carbostyryl ring by connecting with $R^3$.

In formula (SE2), when $R^3$ and $R^4$ connect to each other to form a condensed ring, the condensed ring is specifically preferably a naphthalene ring. The naphthalene ring may be provided with a substituent identical to a substituent example listed in formula (SE1). When formula (SE2) is a naphthol type compound, $R^1$ is preferably a carbamoyl group. Among them, a benzoyl group is specifically preferable. $R^2$ is preferably an alkoxy group or an aryloxy group, and specifically preferably an alkoxy group.

In the following, specific examples of preferable development accelerators of this invention will be listed; however, this invention is not limited thereto.

(SE1-1)

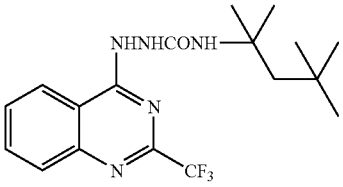

(SE1-2)

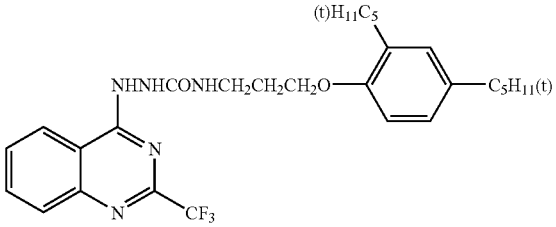

(SE1-3)

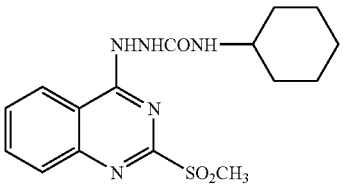

(SE1-4)

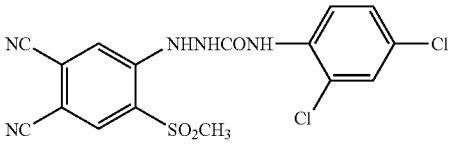

(SE1-5)

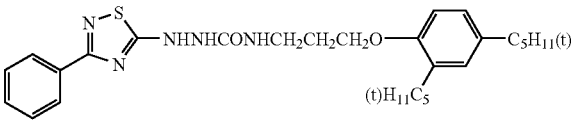

(SE2-1)

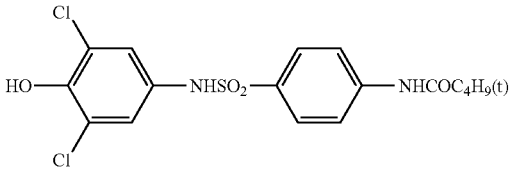

(SE2-2)

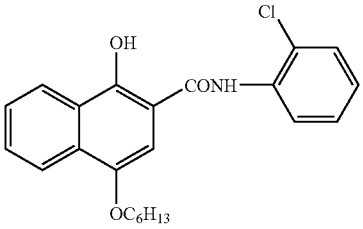

-continued (SE2-3)

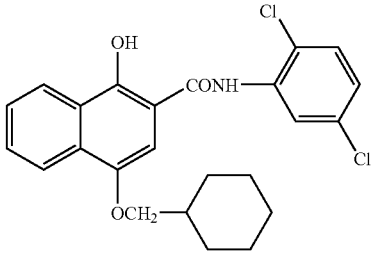

(SE2-4)

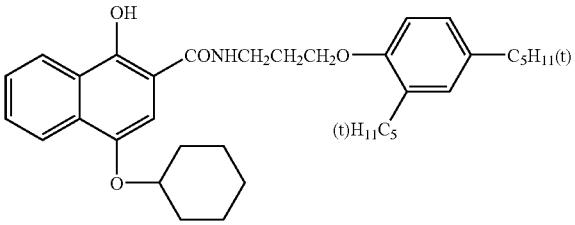

(SE2-5)

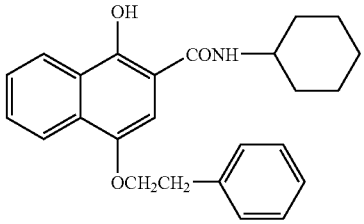

(SE2-6)

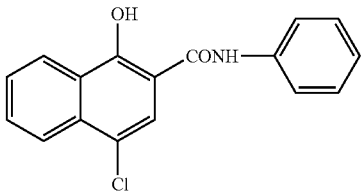

(SE2-7)

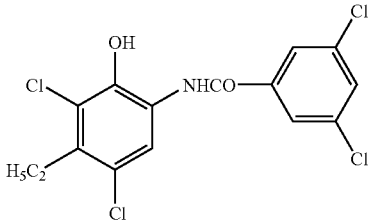

<Tone Controlling Agent>

The tone of images obtained by thermal development of the imaging material is described.

It has been pointed out that in regard to the output image tone for medical diagnosis, cold image tone tends to result in more accurate diagnostic observation of radiographs. The cold image tone, as described herein, refers to pure black tone or blue black tone in which black images are tinted to blue. On the other hand, warm image tone refers to warm black tone in which black images are tinted to brown. The tone is more described below based on an expression defined by a method recommended by the Commission Internationale de l'Eclairage (CIE) in order to define more quantitatively.

"Colder tone" as well as "warmer tone", which is terminology of image tone, is expressed, employing minimum density $D_{min}$ and hue angle $h_{ab}$ at an optical density D of 1.0. The hue angle $h_{ab}$ is obtained by the following formula, utilizing color specifications a* and b* of L*a*b* Color Space which is a color space perceptively having approximately a uniform rate, recommended by Commission Internationale de l'Eclairage (CIE) in 1976.

$$h_{ab}=\tan^{-1}(b^*/a^*)$$

In this invention, $h_{ab}$ is preferably in the range of 180 degrees<$h_{ab}$<270 degrees, is more preferably in the range of 200 degrees<$h_{ab}$<270 degrees, and is most preferably in the range of 220 degrees<$h_{ab}$<260 degrees.

This finding is also disclosed in JP-A 2002-6463.

Incidentally, as described, for example, in JP-A 2000-29164, it is conventionally known that diagnostic images with visually preferred color tone are obtained by adjusting, to the specified values, u* and v* or a* and b* in CIE 1976 (L*u*v*) color space or (L*a*b*) color space near an optical density of 1.0.

Diligent investigation was performed for the silver salt photothermographic imaging material according to this invention. As a result, it was discovered that when a linear regression line was formed on a graph in which in the CIE 1976 (L*u*v*) color space or the (L*a*b*) color space, u* or a* was used as the abscissa and v* or b* was used as the ordinate, the foregoing materiel exhibited diagnostic properties which were equal to or better than conventional wet type silver salt photosensitive materials by regulating the resulting linear regression line to the specified range. The condition ranges of this invention will now be described.

(1) It is preferable that the coefficient of determination value $R^2$ of the linear regression line, which is made by arranging u* and v* in terms of each of the optical densities of 0.5, 1.0, and 1.5 and the minimum optical density, is also 0.998–1.000.

The value v* of the intersection point of the foregoing linear regression line with the ordinate is −5 to +5, and gradient (v*/u*) is 0.7–2.5.

(2) The coefficient of determination value $R^2$ of the linear regression line is 0.998–1.000, which is formed in such a manner that each of optical density of 0.5, 1.0, and 1.5 and the minimum optical density of the foregoing imaging material is measured, and a* and b* in terms of each of the above optical densities are arranged in two-dimensional coordinates in which a* is used as the abscissa of the CIE 1976 (L*a*b*) color space, while b* is used as the ordinate of the same.

In addition, value b* of the intersection point of the foregoing linear regression line with the ordinate is −5–+5, while gradient (b*/a*) is 0.7–2.5.

A method for making the above-mentioned linear regression line, namely one example of a method for determining u* and v* as well as a* and b* in the CIE 1976 color space, will now be described.

By employing a thermal development apparatus, a 4-step wedge sample including an unexposed portion and optical densities of 0.5, 1.0, and 1.5 is prepared. Each of the wedge density portions prepared as above is determined employing a spectral chronometer (for example, CM-3600d, manufactured by Minolta Co., Ltd.) and either u* and v* or a* and b* are calculated. Measurement conditions are such that an F7 light source is used as a light source, the visual field angle is 10 degrees, and the transmission measurement mode is used. Subsequently, either measured u* and v* or measured a* and b* are plotted on the graph in which u* or a* is used as the abscissa, while v* or b* is used as the ordinate, and a linear regression line is formed, whereby the coefficient of determination value $R^2$ as well as intersection points and gradients are determined.

The specific method enabling to obtain a linear regression line having the above-described characteristics will be described below.

In this invention, by regulating the added amount of the foregoing toning agents, developing agents, silver halide grains, and aliphatic carboxylic acid silver, which are directly or indirectly involved in the development reaction process, it is possible to optimize the shape of developed silver so as to result in the desired tone. For example, when the developed silver is shaped to dendrite, the resulting image tends to be bluish, while when shaped to filament, the resulting imager tends to be yellowish. Namely, it is possible to adjust the image tone taking into account the properties of shape of developed silver.

Usually, toning agents such as phthalazinones or a combinations of phthalazine with phthalic acids, or phthalic anhydride are employed. Examples of suitable image toning agents are disclosed in Research Disclosure, Item 17029, and U.S. Pat. Nos. 4,123,282, 3,994,732, 3,846,136, and 4,021,249.

Listed are imides (such as succinimide, phthalimide, naphthalimide, N-hydroxy-1,8-naphthalimide), mercaptanes (such as 3-mercapto-1,2-triazole), phthalazine derivatives or metal salts thereof (such as phthalazinone, 4-(1-naphthyl) phthalazinone, 6-chlorophthalazinone, 5,7-dimethyloxyphthalazinone and 2,3-dihydro-1,4-phthalazinedione), combinations of phthalazine and phthalic acids (such as phthalic acid, 4-methylphthalic acid, 4-nitrophthalic acid and tetrachlorophthalic acid), combinations of phthalazine and at least one conmpound selected from maleic acid abhydride, an phthalic acid, 2,3-naphthalene dicarboxylic acid or o-phenylene acid derivatives and anhydrides thereof (such as phthalic acid, 4-methyl phthalic acid, 4-nitrophtahlic acid and tetrachloro phthalic acid anhydride). Specifically preferable toner is a combination of phthalazinone or phtahlazine and phthalic acids or phthalic acid anhydrides.

Other than such toners, it is preferable to control color tone employing couplers disclosed in JP-A 11-288057 and EP 1134611A2 as well as leuco dyes detailed below.

Further, it is possible to unexpectedly minimize variation of tone during storage of silver images by simultaneously employing silver halide grains which are converted into an internal latent image-forming type after the thermal development according to this invention.

<Leuco Dyes>

Leuco dyes are employed in the photothermographic imaging materials of this invention.

Employed as leuco dyes may be any of the colorless or slightly tinted compounds which are oxidized to form a colored state when heated at temperatures of about 80–about 200° C. for about 0.5–about 30 seconds. It is possible to use any of the leuco dyes which are oxidized by silver ions to form dyes. Compounds are useful which are sensitive to pH and oxidizable to a colored state.

Representative leuco dyes suitable for the use in this invention are not particularly limited. Examples include biphenol leuco dyes, phenol leuco dyes, indoaniline leuco dyes, acrylated azine leuco dyes, phenoxazine leuco dyes, phenodiazine leuco dyes, and phenothiazine leuco dyes. Further, other useful leuco dyes are those disclosed in U.S. Pat. Nos. 3,445,234, 3,846,136, 3,994,732, 4,021,249, 4,021,250, 4,022,617, 4,123,282, 4,368,247, and 4,461,681, as well as JP-A Nos. 50-36110, 59-206831, 5-204087, 11-231460, 2002-169249, and 2002-236334.

In order to control images to specified color tones, it is preferable that various color leuco dyes are employed individually or in combinations of a plurality of types. In this invention, for minimizing excessive yellowish color tone due to the use of highly active reducing agents, as well as excessive reddish images especially at a density of at least 2.0 due to the use of minute silver halide grains, it is preferable to employ leuco dyes which change to cyan. Further, in order to achieve precise adjustment of color tone, it is further preferable to simultaneously use yellow leuco dyes as well as other leuco dyes which change to cyan.

It is preferable to appropriately control the density of the resulting color while taking into account the relationship with the color tone of developed silver itself. In this invention, color formation is performed so that the sum of maximum densities at the maximum adsorption wavelengths of dye images formed by leuco dyes is customarily 0.01–0.30, is preferably 0.02.–0.20, and is most preferably 0.02–0.10. Further, it is preferable that images be controlled within the preferred color tone range described below.

(Yellow Forming Leuco Dyes)

In this invention, particularly preferably employed as yellow forming leuco dyes are color image forming agents represented by following Formula (YL) which increase absorbance between 360 and 450 nm via oxidation.

Formula (YL)

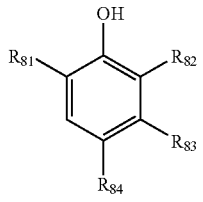

In foregoing Formula (YL), preferably as the alkyl groups represented by $R_{81}$ are those having 1–30 carbon atoms, which may have a substituent. Specifically preferred is methyl, ethyl, butyl, octyl, i-propyl, t-butyl, t-octyl, t-pentyl, sec-butyl, cyclohexyl, or 1-methyl-cyclohexyl. Groups (i-propyl, i-nonyl, t-butyl, t-amyl, t-octyl, cyclohexyl, 1-methyl-cyclohexyl or adamantyl) which are three-dimensionally larger than i-propyl are preferred. Of these, preferred are secondary or tertiary alkyl groups and t-butyl, t-octyl, and t-pentyl, which are tertiary alkyl groups, are particularly preferred. Listed as substituents which $R_1$ may have are a halogen atom, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, and a phosphoryl group.

$R_{82}$ is a hydrogen atom, a substituted or unsubstituted alkyl group, or an acylamino group. The alkyl group represented by $R_{82}$ is preferably one having 1–30 carbon atoms, while the acylamino group is preferably one having 1–30 carbon atoms. Of these, description for the alkyl group is the same as for foregoing $R_{81}$.

The acylamino group represented by $R_{82}$ may be unsubstituted or have a substituent. Specifically listed are an acetylamino group, an alkoxyacetylamino group, and an aryloxyacetylamino group. $R_{82}$ is preferably a hydrogen atom or an unsubstituted group having 1–24 carbon atoms, and specifically listed are methyl, i-propyl, and t-butyl. Further, neither $R_{81}$ nor $R_{82}$ is a 2-hydroxyphenylmethyl group.

$R_{83}$ is a hydrogen atom, and a substituted or unsubstituted alkyl group. Preferred as alkyl groups are those having 1–30 carbon atoms. Description for the above alkyl groups is the same as for $R_{81}$. Preferred as $R_{83}$ are a hydrogen atom and an unsubstituted alkyl group having 1–24 carbon atoms, and specifically listed are methyl, i-propyl and t-butyl. It is preferable that either $R_{81}$ or $R_{83}$ is a hydrogen atom.

$R_{84}$ is a group capable of being substituted to a benzene ring. $R_{84}$ is preferably a substituted or unsubstituted alkyl group having 1–30 carbon atoms, as well as an oxycarbonyl group having 2–30 carbon atoms. The alkyl group having 1–24 carbon atoms is more preferred. Listed as substituents of the alkyl group are an aryl group, an amino group, an alkoxy group, an oxycarbonyl group, an acylamino group, an acyloxy group, an imide group, and a ureido group. Of these, more preferred are an aryl group, an amino group, an oxycarbonyl group, and an alkoxy group. The substituent of these alkyl group may be substituted with any of the above alkyl groups.

Among the compounds represented by Formula (YL), preferred compounds are bis-phenol compounds represented by the following Formula.

Formula (YL')

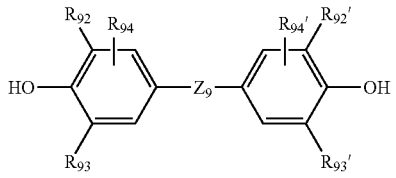

wherein, $Z_9$ is a —S— or —C($R_{91}$) ($R_{91}$')— group. $R_{91}$ and $R_{91}$' each represent a hydrogen atom or a substituent. The substituents represented by $R_{91}$ and $R_{91}$' are the same substituents listed for $R_{91}$ in the aforementioned Formula (RED). $R_{91}$ and $R_{91}$' are preferably a hydrogen atom or an alkyl group.

$R_{92}$, $R_{93}$, $R_{92}$' and $R_{93}$' each represent a substituent. The substituents represented by $R_{92}$, $R_{93}$, $R_{92}$' and $R_{93}$' are the same substituents listed for $R_{62}$ and $R_{63}$ in the aforementioned Formula (RED).

$R_{92}$, $R_{93}$, $R_{92}$' and $R_{93}$' are preferably, an alkyl group, an alkenyl group, an alkynyl group, an aryl group, a heterocyclic group, and more preferably, an alkyl group. Substituents on the alkyl group are the same substituents listed for the substituents in the aforementioned Formula (RED).

$R_{92}$, $R_{93}$, $R_{92}$' and $R_{93}$' are more preferably tertiary alkyl groups such as t-butyl, t-amino, t-octyl and 1-methyl-cyclohexyl.

$R_{94}$ and $R_{94}$' each represent a hydrogen atom or a substituent, and the substituents are the same substituents listed for $R_{64}$ in the aforementioned Formula (RED).

Examples of the bis-phenol compounds represented by Formula (YL) are, the compounds disclosed in JP-A 2002-169249, Compounds (II-1) to (II-40), paragraph Nos. [0032]–[0038]; and EP 1211093, Compounds (ITS-1) to (ITS-12), paragraph No. [0026].

In the following paragrapfs, specific examples of bisphenol compounds represented by Formulas (YA) and (YB) will be shown; however, this invention is not limited thereto.

(YA-1)

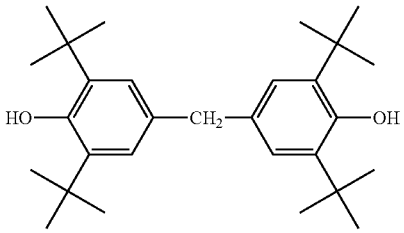

(YA-2)

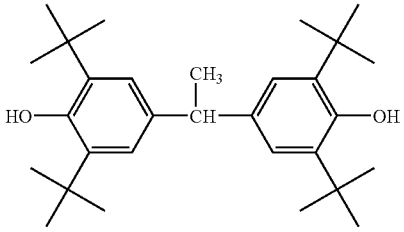

(YA-3)

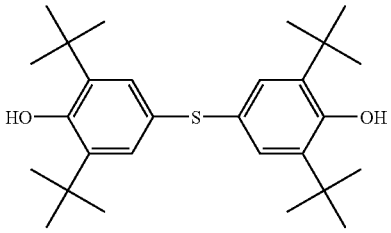

(YA-4)

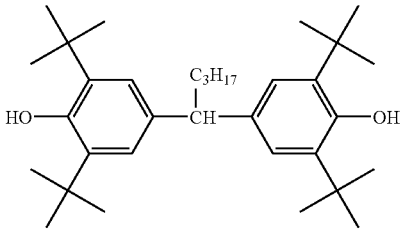

(YA-5)

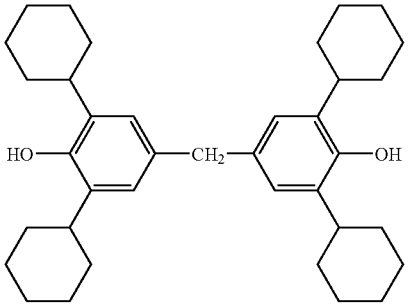

(YA-6)

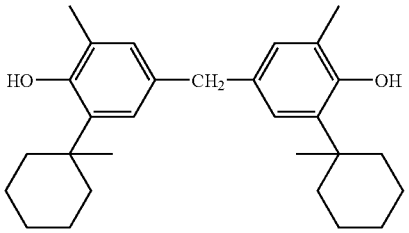

-continued (YA-7)

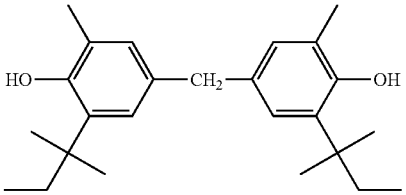

(YA-8)

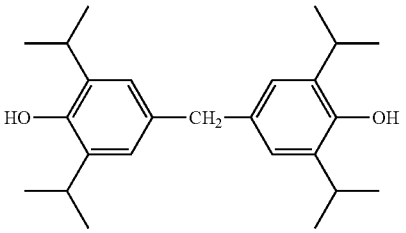

(YA-9)

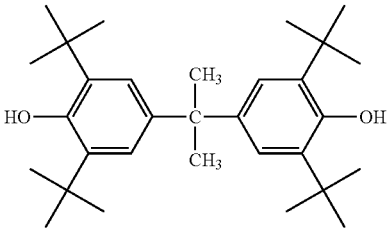

(YA-10)

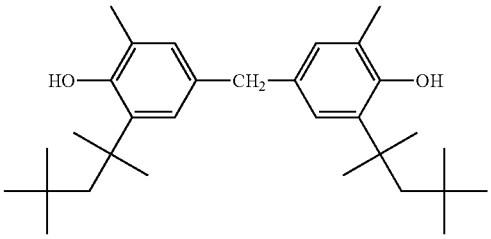

The added amount of the compounds represented by Formula (YL) is usually 0.00001–0.01 mol per mol of silver, preferably 0.0005–0.01 mol, and more preferably 0.001–0.008 mol.

Further, the addition ratio of a yellow coloring leuco dye against the total of reducing agents is preferably 0.001–0.2 and more preferably 0.005–0.1, based on a mol ratio.

(Cyan Forming Leuco Dyes)

In a silver salt photothermographic dry imaging material of this invention, the tone can be adjusted also by use of a cyan coloring leuco dye other than a yellow coloring leuco dye described above.

A leuco dye is preferably any compound which is colorless or slightly colored and is oxidized to be a colored state when being heated at a temperature of approximately 80–200° C. for approximately 0.5–30 seconds, and any leuco dye, and any leuco dyes which is oxidized by an oxidized substance of a reducing agent to form a dye, can be also utilized. A compound which is provided with pH sensibility and can be oxidized into a colored state is useful.

Cyan forming leuco dyes will now be described. In this invention, particularly preferably employed as cyan forming leuco dyes are color image forming agents which increase absorbance between 600 and 700 nm via oxidation, and include the compounds described in JP-A 59-206831 (particularly, compounds of λmax in the range of 600–700 nm), compounds represented by Formulas (I)–(IV) of JP-A 5-204087 (specifically, compounds (1)–(18) described in paragraphs [0032]–[0037]), and compounds represented by Formulas 4–7 (specifically, compound Nos. 1–79 described in paragraph [0105]) of JP-A 11-231460.

Cyan forming leuco dyes which are particularly preferably employed in this invention are represented by following Formula (CL).

Formula (CL)

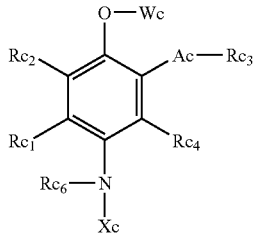

wherein $R_{c1}$ and $R_{c2}$ are each a hydrogen atom; a halogen atom; a substituted or unsubstituted alkyl group, an alkenyl group, or an alkoxyl group; an NHCO—$R_{c10}$ group wherein $R_{c10}$ is an alkyl group, an aryl group, or a heterocyclic group; while $R_{c1}$ and $R_{c2}$ may bond to each other to form an aliphatic hydrocarbon ring, an aromatic hydrocarbon ring, or a heterocyclic ring; $A_c$ is an —NHCO— group, a —CONH— group, or an —NHCONH— group; $R_{c3}$ is a substituted or unsubstituted alkyl group, an aryl group, or a heterocyclic group; or -$A_c$-$R_{c3}$ is a hydrogen atom; $W_c$ is a hydrogen atom or a —CONH$R_{c5}$— group, —CO$R_{c5}$ or a —CO—O—$R_{c5}$ group wherein $R_{c5}$ is a substituted or unsubstituted alkyl group, an aryl group, or a heterocyclic group; $R_{c4}$ is a hydrogen atom, a halogen atom, a substituted or unsubstituted alkyl group, an alkoxy group, a carbamoyl group, or a nitrile group; $R_{c6}$ is a —CONH—$R_{c7}$ group, a —CO—$R_{c7}$ group, or a —CO—O—$R_{c7}$ group wherein $R_{c7}$ is a substituted or unsubstituted alkyl group, an aryl group, or a heterocyclic group; and $X_c$ is a substituted or unsubstituted aryl group or a heterocyclic group.

In Formula (CL), halogen atoms include fluorine, bromine, and chlorine; alkyl groups include those having at most 20 carbon atoms (methyl, ethyl, butyl, or dodecyl); alkenyl groups include those having at most 20 carbon atoms (vinyl, allyl, butenyl, hexenyl, hexadienyl, ethenyl-2-propenyl, 3-butenyl, 1-methyl-3-propenyl, 3-pentenyl, or 1-methyl-3-butenyl); alkoxy groups include those having at most 20 carbon atoms (methoxy or ethoxy); aryl groups include those having 6–20 carbon atoms such as a phenyl group, a naphthyl group, or a thienyl group; heterocyclic groups include each of thiophene, furan, imidazole, pyrazole, and pyrrole groups. $A_c$ is a —NHCO— group, a —CONH— group, or a —NHCONH— group; $R_{c3}$ is a substituted or unsubstituted alkyl group (preferably having at most 20 carbon atoms such as methyl, ethyl, butyl, or dodecyl), an aryl group (preferably having 6–20 carbon atoms, such as phenyl, naphthyl, or thienyl), or a heterocyclic group (thiophene, furan, imidazole, pyrazole, or pyrrole); -$A_c$-$R_{c3}$ is a hydrogen atom; $W_c$ is a hydrogen atom or a —CONH$R_{c5}$ group, a —CO—$R_{c5}$ group or a —CO—O$R_{c5}$ group wherein $R_{c5}$ is a substituted or unsubstituted alkyl group (preferably having at most 20 carbon atoms, such as methyl, ethyl, butyl, or dodecyl), an aryl group (preferably having 6–20 carbon atoms, such as phenyl, naphthyl, or thienyl), or a heterocyclic group (such as thiophene, furan, imidazole, pyrazole, or pyrrole); $R_{c4}$ is preferably a hydrogen atom, a halogen atom (e.g., fluorine, chlorine, bromine, iodine), a chain or cyclic alkyl group (e.g., a methyl group, a butyl group, a dodecyl group, or a cyclohexyl group), an alkoxy group (e.g., a methoxy group, a butoxy group, or a tetradecyloxy group), a carbamoyl group (e.g., a diethylcarbamoyl group or a phenylcarbamoyl group), and a nitrile group and of these, a hydrogen atom and an alkyl group are more preferred. Foregoing $R_{c1}$ and $R_{c2}$, and $R_{c3}$ and $R_{c4}$ bond to each other to form a ring structure. The foregoing groups may have a single substituent or a plurality of substituents. For example, typical substituents which may be introduced into aryl groups include a halogen atom (fluorine, chlorine, or bromine), an alkyl group (methyl, ethyl, propyl, butyl, or dodecyl), a hydroxyl group, a cyan group, a nitro group, an alkoxy group (methoxy or ethoxy), an alkylsulfonamide group (methylsulfonamido or octylsulfonamido), an arylsulfonamide group (phenylsulfonamido or naphthylsulfonamido), an alkylsulfamoyl group (butylsulfamoyl), an arylsulfamoyl group (phenylsulfamoyl), an alkyloxycarbonyl group (methoxycarbonyl), an aryloxycarbonyl group (phenyloxycarbonyl), an aminosulfonamide group, an acylamino group, a carbamoyl group, a sulfonyl group, a sulfinyl group, a sulfoxy group, a sulfo group, an aryloxy group, an alkoxy group, an alkylcarbonyl group, an arylcarbonyl group, or an aminocarbonyl group. It is possible to introduce two different groups of these groups into an aryl group. Either $R_{c10}$ or $R_{c5}$ is preferably a phenyl group, and is more preferably a phenyl group having a plurality of substituents containing a halogen atom or a cyano group.

$R_{c6}$ is a —CONH—$R_{c7}$ group, a —CO—$R_{c7}$ group, or —CO—O—$R_{c7}$ group, wherein $R_{c7}$ is a substituted or unsubstituted alkyl group (preferably having at most 20 carbon atoms, such as methyl, ethyl, butyl, or dodecyl), an aryl group (preferably having 6–20 carbon atoms, such as phenyl, naphthol, or thienyl), or a heterocyclic group (thiophene, furan, imidazole, pyrazole, or pyrrole). Employed as substituents of the alkyl group represented by $R_{c7}$ may be the same ones as substituents in $R_{c1}$–$R_{c4}$. $X_c$ is a substituted or unsubstituted aryl group or a heterocyclic group. These aryl groups include groups having 6–20 carbon atoms such as phenyl, naphthyl, or thienyl, while the heterocyclic groups include any of the groups such as thiophene, furan, imidazole, pyrazole, or pyrrole. Employed as substituents which may be substituted to the group represented by $X_c$ may be the same ones as the substituents in $R_{c1}$–$R_{c4}$. As the groups represented by $X_c$, preferred are an aryl group, which is substituted with an alkylamino group (a diethylamino group) at the para position, or a heterocyclic group. These may contain other photographically useful groups.

In the following paragraphs, specific examples of a cyan coloring leuco-dye (LC) will be shown, however, a cyan coloring leuco dye utilized in this invention is not limited thereto.

(CA-1)

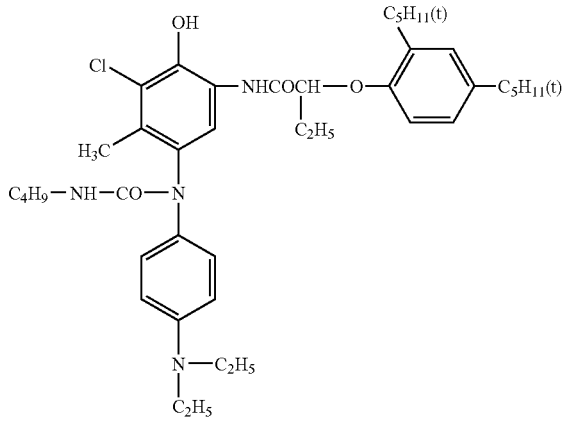

-continued
(CA-2)
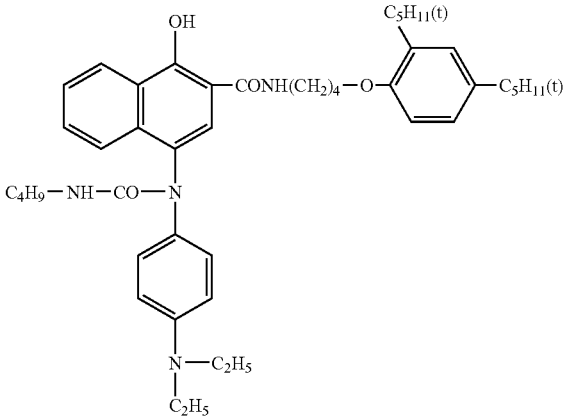
(CA-3)
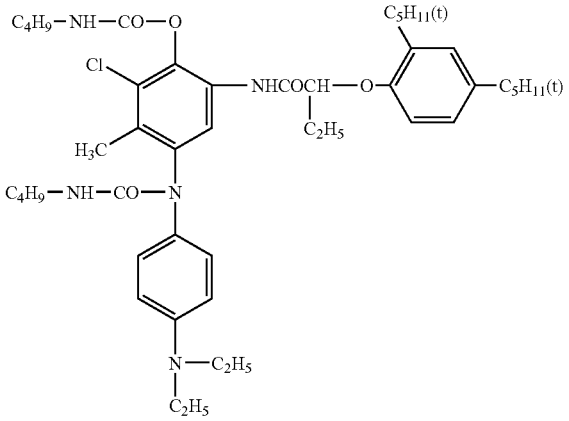
(CA-4)
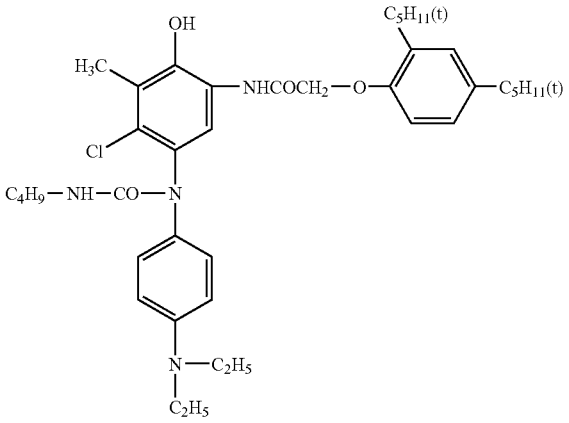
-continued
(CA-5)
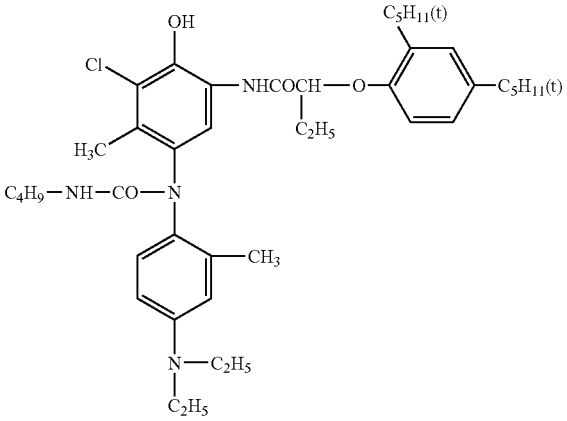
(CA-6)
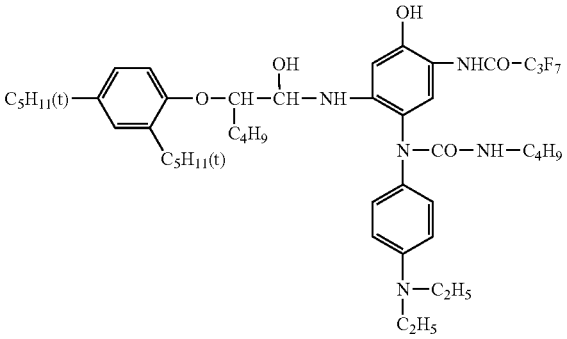
(CA-7)
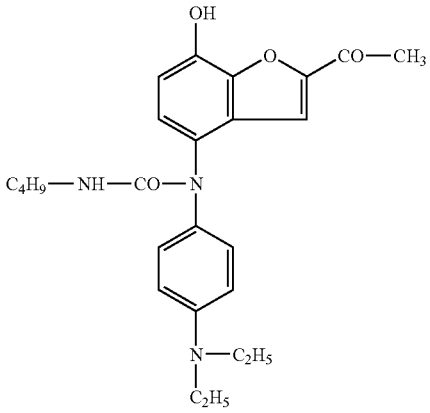
(CA-8)
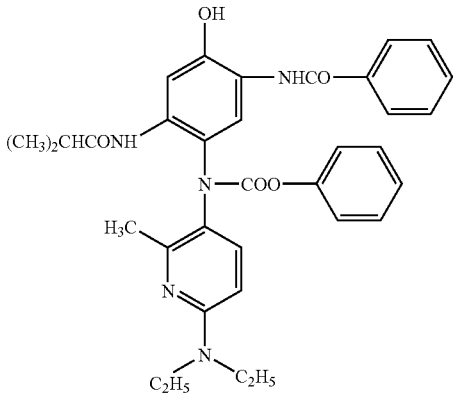

-continued (CA-10)

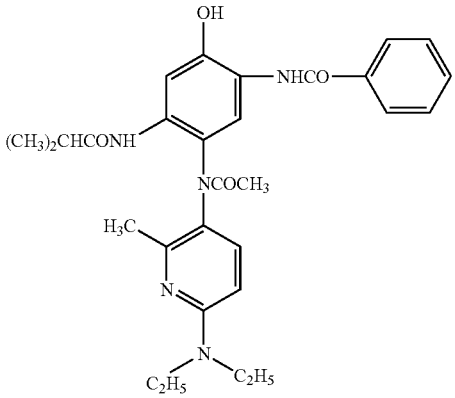

(CA-11)

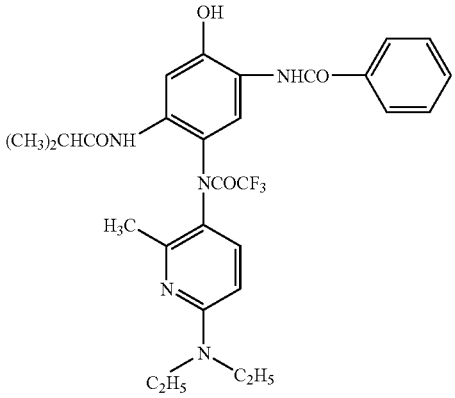

(CA-12)

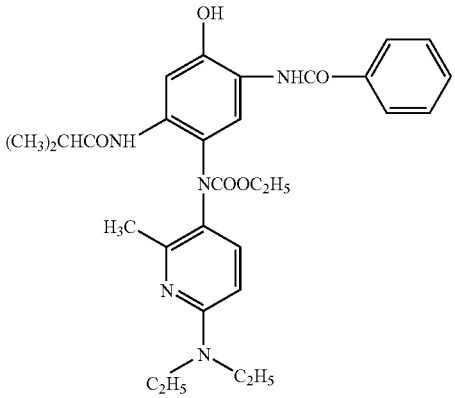

The added amount of cyan forming leuco dyes is customarily 0.00001–0.05 mol/mol of Ag, is preferably 0.0005–0.02 mol/mol, and is more preferably 0.001–0.01 mol.

In the photothermographic imaging material, the total of the maximum density at the maximum absorption wavelength of a dye image formed by a cyan leuco dye is preferably 0.01–0.50, more preferably 0.02–0.30 and specifically preferably 0.03–0.10.

It is possible to control further delicate tone by incorporating a magenta coloring leuco dye or a yellow coloring leuco dye in addition to the above-described cyan coloring leuco dye in combination.

The compounds represented by Formula (YL) and cyan forming leuco dyes may be added employing the same method as for the reducing agents represented by formula (RED). They may be incorporated in liquid coating compositions employing an optional method to result in a solution form, an emulsified dispersion form, or a minute solid particle dispersion form, and then incorporated in a photosensitive material.

It is preferable to incorporate the compounds represented by Formula (YL) and cyan forming leuco dyes into an image forming layer containing organic silver salts. On the other hand, the former may be incorporated in the image forming layer, while the latter may be incorporated in a non-image forming layer adjacent to the foregoing image forming layer. Alternatively, both may be incorporated in the non-image forming layer. Further, when the image forming layer is comprised of a plurality of layers, incorporation may be performed for each of the layers.

(Surface Layer)

Ten-point mean roughness (Rz), the maximum roughness (Rt) and center-line mean roughness (Ra) in this invention are defined based on following JIS surface roughness (B0601). Ten-point mean roughness refers to a difference expressed by micrometer (μm) between an average of a height of peaks from the highest to the fifth highest and an average of a height of bottoms from the deepest to the fifth deepest, which are measured at the standard length portion extracted from the cross sectional curve and in the longitudinal magnification direction from the straight line which is parallel to an average line and not cross the cross sectional curve. The maximum roughness (Rt) refers to the value expressed by micrometer (μm) which is an interval between the two straight lines measured in the longitudinal magnification direction, when a standard length L is extracted from the roughness curve and which is sandwiched with two straight lines parallel to the center line. Center-line mean roughness (Ra) refers to the value expressed by micrometer (μm) which is determined by the following equation, when measurement length L in the center-line direction is extracted from the roughness curve, and the center-line of this extracted portion is set to X axis, the longitudinal magnification direction is set to Y axis and the roughness curve is set to y=f(x).

$$Ra = \frac{1}{L}\int_0^L |f(x)|\,dx$$

As a measurement method of Rz, Rt and Ra, the samples for measurement were rehumidified under an environment of 25° C.·65% RH for 24 hours without being overlapped and measurement was carried out under said environment. Herein, condition of without being overlapped refers to any one of a method in which a film is wound up by making the film edge portions higher, a method in which film is superimposed by. sandwiching paper between the films, or a method in which a frame is formed with such as thick paper and the four corners are fixed. Measurement apparatus utilized include such as RSTPLUS, a non-contacting three-dimensional micro surface shape measurement system, manufactured by WYKO Co., Ltd.

To make Rz, Rt and Ra of the front surface and the back surface of a photosensitive material be in a range of this invention, they are easily adjustable by utilizing the technological means described below being suitably combined.

(1) A type, a mean particle diameter, an added amount and a surface treatment method of a matting agent (inorganic or organic powder), which is contained in a layer of the photosensitive layer side and in a layer opposite to the photosensitive layer, (2) Dispersion Conditions of a matting agent (a type of a homogenizer employed, homogenizing time, a type and a mean particle size of beads utilized in homogenization, a type and an amount of a dispersant employed at homogenization, a type and a content of a polar group of a binder), (3) Drying conditions at the time of coating (a coating speed, a distance between a hot wind nozzle and the coating surface, an amount of drying wind), a residual solvent amount, (4) A type of a filter utilized for filtration of a coating composition, a filtering time, (5) In case of performing a calendaring treatment after coating, conditions thereof (for example, a calendaring temperature of 40–80° C., a pressure of 50–300 kg/cm, a line speed of 20–100 m/min and a nip number of 2–6)

In this invention, a value of Rz (E)/Rz (B) is preferably 0.1–0.7, more preferably 0.2–0.6 and most preferably 0.3–0.55. By setting the value in this range, particularly among the effects of this invention, a film transport property can be made excellent and generation of uneven density at thermal development can be significantly minimized. Herein, (E) represents the outermost surface of the photosensitive layer side and (B) represents the outermost surface of the back coat layer side which is opposite to the photosensitive layer.

Further, in this invention, a value of Ra (E)/Ra (B) is preferably 0.6–1.5, more preferably 0.6–1.3 and most preferably 0.7–1.1. By setting the value in this range, particularly among the effects of this invention, fog increase by aging can be made small, a film transport property can be made excellent and generation of uneven density at thermal development can be further decreased.

A silver salt phtothermographic dry imaging material of this invention is preferably provided with a layer constitution including plural types of matting agents on the both sides of a support. When a mean particle diameter of a matting agent having the maximum mean particle diameter among matting agents contained in the layer to contain a matting agent of the photosensitive layer side is Le (μm), and a mean particle diameter of a matting agent having the maximum mean particle diameter among matting agents contained in the layer to contain a matting agent opposite to the photosensitive layer sandwiching a support, that is, the back-coat layer side is Lb (μm), Lb/Le is preferably 2.0–10 and more preferably 3.0–4.5.

By setting Lb/Le in this range, particularly among the effects of this invention, uneven density at thermal development can be depressed. Further, in an image forming method of this invention, Rz(E)/Ra(E) is preferably 12–60 and more preferably 14–50. By setting Rz(E)/Ra(E) in this range, particularly among the effects of this invention, uneven density at thermal development can be depressed and aging stability can be improved.

Further, in an image forming method of this invention, Rz(B)/Ra(B) is preferably 25–65 and more preferably 30–60. By setting Rz(B)/Ra(B) in this range, particularly among the effects of this invention, uneven density at thermal development can be depressed and aging stability can be improved.

In this invention, the case of the layer containing a matting agent being the outermost layer is one of preferable embodiments.

That is, organic or inorganic powder is preferably incorporated in the outermost layer of the photosensitive layer side of a silver salt photothermographic dry imaging material, as well as of the photo-insensitive layer side opposite to the photosensitive layer sandwiching a support, as a matting agent for the purpose of such as controlling the surface roughness.

As powder utilized in this invention, preferable is powder provided with a Mohs' hardness of not less than 5. Commonly known inorganic powder or organic powder can be utilized by being suitably selected, as powder. Inorganic powder includes such as titanium oxide, boron nitride, $SnO_2$, $SiO_2$, $Cr_2O_3$, $\alpha$-$Al_2O_3$, $\alpha$-$Fe_2O_3$, $\alpha$-FeOOH, SiC, cerium oxide, corundum, artificial diamond, a garnet-group, garnet, mica, silica, silicon nitride and silicon carbide. Organic powder includes such as powder of polymethyl methacrylate, polystyrene and Teflon (a trade mark). Among them, inorganic powder of $SiO_2$, titanium oxide, barium sulfate, $\alpha$-$Al_2O_3$, $\alpha$-$Fe_2O_3$, $\alpha$-FeOOH, $Cr_2O_3$ and mica are preferable; $SiO_2$ and $\alpha$-$Al_2O_3$ are more preferable and $SiO_2$ is most preferable.

In this invention, the foregoing powder preferably has been subjected to such as a surface processing. To form a surface processed layer, after an inorganic powder material is dry ground, water and a dispersant are added thereto and the resulting solution is subjected to coarse grain classification by means of wet grinding and centrifugal separation. Thereafter, micro-grain slurry is transferred into a surface processing vessel, where surface covering by metal hydroxide is performed. First, a predetermined amount of an aqueous salts solution of such as Al, Si, Ti, Zr, Sb, Sn and Zn is added, then acid or alkali to neutralize this is added resulting in covering the surface of inorganic powder grains by a formed hydrated hydroxide. By-produced water-soluble salts are removed by decantation, filtration and washing, and finally the slurry, of which pH is adjusted, is filtered and washed with pure water. The washed cake is dried by a spray dryer or a hand dryer. Finally, this dried substance is ground by a jet mill to be a product. Further, in addition to water based processing, it is also possible that vapor of $AlCl_3$ or $SiCl_4$ is passed through a non-magnetic inorganic powder followed by water vapor being introduced, resulting in surface processing of Al or Si. Other surface processing methods can be referred to "Characterization of Powder Surfaces", published by Academic Press.

In this invention, the surface processing is preferably performed by a Si compound or an Al compound. Utilizing powder having been subjected with such a surface processing can make an excellent dispersed state at the time of dispersion of a matting agent. The content of the foregoing Si or Al is preferably 0.1–10 weight % for Si and 0.1–10 weight % for Al, more preferably 0.1–5 weight % for Si and 0.1–5 weight % for Al, and specifically preferably 0.1–2 weight % for Si and 0.1–2 weight % for Al, against the foregoing powder. Further, the weight ratio of Si and Al is preferably Si<Al. The surface processing can be performed by a method described in JP-A No. 2-83219. Herein, a mean particle diameter of powder in this invention means a mean diameter in the case of spherical powder, a mean longer axis length in the case of needle form powder, and an average of the maximum diagonal line length of the plate form surface in the case of plate form powder, respectively, and can be easily determined by measurement using an electronmicroscope.

A mean particle diameter of the above-described organic or inorganic powder is preferably 0.5–10 μm and more preferably 1.0–8.0 μm.

A mean particle diameter of organic or inorganic powder contained in the outermost layer of the photosensitive layer side is generally 0.5–8.0 μm, preferably 1.0–6.0 μm and more preferably 2.0–5.0 μm.

The added amount is generally 1.0–20 weight %, preferably 2.0–15 weight % and more preferably 3.0–10 weight %, against the binder amount utilized in the outermost layer (a cross-linking agent is included in the binder amount).

A mean particle diameter of organic or inorganic powder contained in the outermost layer of the opposite side to a photosensitive layer side sandwiching a support is generally 2.0–15.0 μm, preferably 3.0–12.0 μm and more preferably 4.0–10.0 μm. The added amount is generally 0.2–10 weight %, preferably 0.4–7 weight % and more preferably 0.6–5 weight %, against the binder amount utilized in the outermost layer (a cross-linking agent is included in the binder amount).

Further, a coefficient of variation of particle size distribution is preferably not more than 50%, more preferably not more than 40%, and most preferably not more than 30%. Herein, a coefficient of variation of the particle size distribution is a value represented by the following equation.

{(Standard deviation of particle diameter)/(mean particle diameter)}×100

The addition method of organic or inorganic powder is either a method in which the powder is dispersed in a coating composition in advance, or a method in which organic or inorganic powder is sprayed after a coating composition is coated but before finish of drying. Further, in the case of adding plural types of powder, the both methods may be utilized in combination.

(Fluorine-Type Surfactant)

In this invention, to improve film transport characteristics in a laser imager (thermal development apparatus) and environmental adaptability (minimum accumulation in a humane body), a fluorine-type surfactant represented by foregoing formula (SF) is preferably utilized.

In formula (SF), $R_f$ is a substituent containing a fluorine atom, and said substituent containing a fluorine atom includes a fluoroalkyl group having a carbon number of 1–25 (such as a trifluorometyl group, a trifluoroethyl group, a perfluoroethyl group, a perfluorobutyl group, a perfluorooctyl group, a perfluorododecyl group and a perfluorooctadecyl group), or a fluoroalkenyl group (such as a perfluoropropenyl group, a perfluorobutenyl group, a perfluorononenyl group and a perfluorododecenyl group). $R_f$ is preferably provided with a carbon number of 2–8 and more preferably of 2–6. Further, $R_f$ is preferably provided with a fluorine atom number of 2–12 and more preferably of 3–12.

$L_1$ is a divalent connecting group having no fluorine atom, and said divalent connecting group having no fluorine atom includes, for example, an alkylene group (such as a methylene group, an ethylene group and a butylene group), an alkyleneoxy group (such as a methyleneoxy group, an ethyleneoxy group and a butylenesoxy group), an oxyalkylene group (such as an oxymethylene group, an oxyethylene group and an oxybutylene group), an oxyalkyleneoxy group (such as an oxymethyleneoxy group, an oxyethyleneoxy group and an oxyehtyleneoxyethyleneoxy group), a phenylene group, an oxyphenylene group, a phenyleneoxy group, an oxyphenyloxy group or combination groups thereof.

A is an anionic group or a salt thereof and includes carboxylic acid or a salt thereof (sodium salt, potassium salt and lithium salt), sulfonic caid or salt thereof (sodium salt, potassium salt and lithium salt), sulfonic acid half ester or salt thereof (sodium salt, potassium salt and lithium salt) and phosphoric acid or salt thereof (such as sodium salt and potassium salt).

Y is a (p+q) valent connecting group containing no fluorine atom, and, for example, 3- or 4-valent connecting group containing no fluorine atom includes atomic groups constituted of a nitrogen atom or a carbon atom as a center atom. n1 is 0 or 1 and is preferably 1.

Fluorine-type surfactants represented by formula (SF) can be prepared by further introducing an anionic group (A) into a compound prepared by an addition reaction or condensation reaction of an alkyl compound having a carbon number of 1–12 introduced with a fluorine atom (a compound provided with such as a trifluoromethyl group, a pentafluoroethyl group, a perfluorobutyl group and a perfluorooctadecyl group), an alkenyl compound (a compound provided with such as a perfluorohexenyl group and a perfluorononenyl group), an alkanol compound having a 3–6 valency without being introduced with a fluorine atom and an aromatic compound or hetero compound having 3–4 hydroxyl groups, by such as sulfuric acid esterification.

The above-described alkanol compounds having 3–6 valency include such as glycerin, pentaerithritol, 2-methl-2-hydroxymethyl-1,3-propanediol, 2,4-dihydroxy-3-hydroxymethylpentene, 1,2,6-hexatriol, 1,1,1-tris(hydroxymethyl)propane, 2,2-bis(butanol)-3-aliphatic triol, tetramethirolmethane, D-sorbitol, xylitol and D-mannitol.

The above aromatic compounds and hetero compounds, which are provided with 3–4 hydroxyl groups, include such as 1,3,5-trihydroxybenzene and 2,4,6-trihydroxypyridine. Preferable specific examples of fluorine-type surfactants represented by grneral formula (SF) are shown below.

SF-1

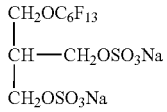

SF-2

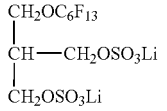

SF-3

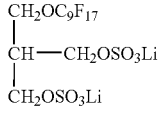

SF-4

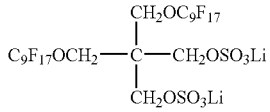

SF-5

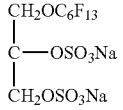

-continued

SF-6

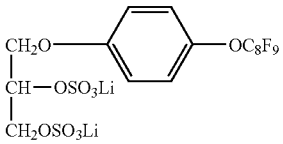

SF-7

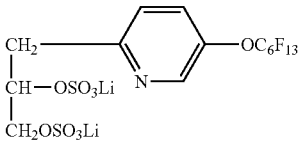

SF-8

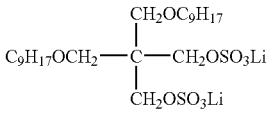

SF-9

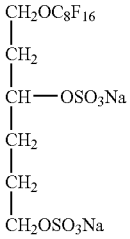

SF-10

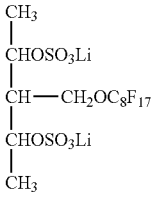

SF-11

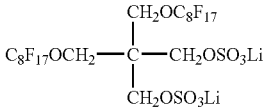

SF-12

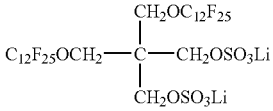

SF-13

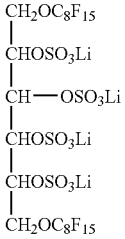

SF-14

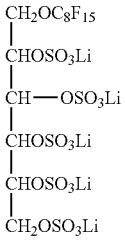

-continued

SF-15

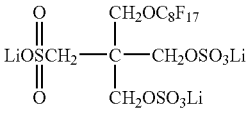

SF-16

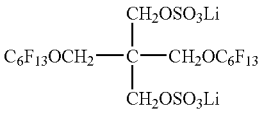

SF-17

SF-18

SF-19

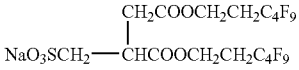

SF-20

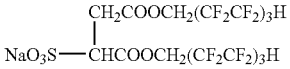

SF-21

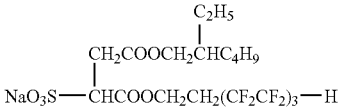

A fluorine-type surfactant represented by formula (SF) of this invention can be added into a coating composition according to a method well known in the art. That is, it can be added by dissolving in such as a polar solvent like alcohols such as methanol and ethanol, ketones such as methyl ethyl ketone and acetone, dimethylsulfoxide, and dimethylfolmamide. Further, it can be added also by being dispersed as micro-particles having a particle size of not more than 1 μm in water or an organic solvent by means of sand mill dispersion, jet mill dispersion, ultrasonic dispersion and homogenizer dispersion. Many technologies have been disclosed with respect to micro-particle dispersion, and dispersion can be carried out according to these technologies. A fluorine-type surfactant represented by formula (SF) is preferably incorporated in the outermost protective layer.

The added amount of a fluorine-type surfactant represented by formula (SF) of this invention is preferably $1\times10^{-8}$–$1\times10^{-1}$ mol and more preferably $1\times10^{-5}$–$1\times10^{-2}$ mol, per 1 $m^2$. When it is less than the foregoing range, an antistatic property may not be obtained, while when over the foregoing range, temperature dependence may become large resulting in deterioration of storage stability under high humidity.

Listed as materials of the support employed in the silver salt photothermographic dry imaging material of this invention are various kinds of polymers, glass, wool fabric, cotton fabric, paper, and metal (for example, aluminum). From the viewpoint of handling as information recording materials, flexible materials, which can be employed as a sheet or can be wound in a roll, are suitable. Accordingly, preferred as supports in the silver salt photothermographic dry imaging material of this invention are plastic films (for example, cellulose acetate film, polyester film, polyethylene terephthalate film, polyethylene naphthalate film, polyamide film, polyimide film, cellulose triacetate film or polycarbonate film). Of these, in this invention, biaxially stretched polyethylene terephthalate film is particularly preferred. The thickness of the supports is commonly from about 50 to about 300 μm, and is preferably from 70 to 180 μm.

In this invention, in order to minimize static-charge buildup, electrically conductive compounds such as metal oxides and/or electrically conductive polymers may be incorporated in composition layers. The compounds may be incorporated in any layer, but are preferably incorporated in a subbing layer, a backing layer, and an interlayer between the photosensitive layer and the subbing layer. In this invention, preferably employed are electrically conductive compounds described in columns 14 through 20 of U.S. Pat. No. 5,244,773.

Herein, a conductive metal oxide is crystalline metal oxide particles and such as those containing oxygen defects and a small amount of a hetero atom which forms a donor against utilized metal oxide are specifically preferable, generally speaking, because of high conductivity, and the latter is specifically preferable because it provides no fog to silver halide emulsion. Examples of a metal oxide is preferably such as ZnO, $TiO_2$, $SnO_2$, $AL_2O_3$, $In_2O_3$, $SiO_2$, MgO, BaO, $MoO_3$ and $V_2O_5$ and complex oxides thereof, and specifically preferably ZnO, $TiO_2$ and $SnO_2$. As examples containing a hetero atom, addition of such as Al and In to ZnO, addition of such as Sb, Nb, P and a halogen element to $SnO_2$, and addition of such Nb and Ta to $TiO_2$ are effective. The added amount of these hetero atoms is in a range of preferably 0.01–30 mol % and specifically preferably 0.1–10 mol %. Further, a silicon compound may be added at the time of micro-particle preparation to improve micro-particle dispersibility and transparency.

Metal oxide micro-particles utilized in this invention are provided with conductivity, and the volume specific resistance is preferably not more than $10^7$ Ω·cm and specifically preferably not more than $10^5$ Ω·cm. These oxides are described in such as JP-A Nos. 56-143431, 56-120519 and 58-62647. In addition to these, utilized may be conductive materials, in which the above-described metal oxide adheres to other crystalline metal oxide particles or fiber form substances (such as titanium oxide), as described in Examined Japanese Patent Application Publication No. 59-6235.

The particle size utilized is preferably not more than 1 μm; however, the stability after dispersion is excellent to be easily handled when it is not more than 0.5 μm. Further, when conductive particles of not more than 0.3 μm are utilized to minimize light scattering, it is specifically preferable because a transparent photosensitive material can be prepared. Further, when the conductive metal oxide is a needle-form or a fiber-form, a length of not more than 30 μm and a diameter of not more than 1 μm are preferable, and a length of not more than 10 μm, a diameter of not more than 0.3 μm and a length/diameter ratio of not less than 3 are specifically preferable. Herein, $SnO_2$ is available on the market from Ishihara Sangyo Kaisha, Ltd., and utilized can be such as SNS-10M, SN-100P, SN-100D and FSS-10M.

The silver salt photothermographic dry imaging material of this invention comprises a support having thereon at least one photosensitive layer. The photosensitive layer may only be formed on the support. However, it is preferable that at least one light-insensitive layer is formed on the photosensitive layer. For example, it is preferable that for the purpose of protecting a photosensitive layer, a protective layer is formed on the photosensitive layer, and in order to minimize adhesion between photosensitive materials as well as adhesion in a wound roll, a backing layer is provided on the opposite side of the support. As binders employed in the protective layer as well as the backing layer, polymers such as cellulose acetate, cellulose acetate butyrate, which has a higher glass transition point from the thermal development layer and exhibit abrasion resistance as well as distortion resistance are selected from the foregoing binders. Incidentally, for the purpose of increasing latitude, one of the preferred embodiments of this invention is that at least two photosensitive layers are provided on the one side of the support or at least one photosensitive layer is provided on both sides of the support.

In the silver salt photothermographic dry imaging material of this invention, in order to control the light amount as well as the wavelength distribution of light which transmits the photosensitive layer, it is preferable that a filter layer is formed on the photosensitive layer side or on the opposite side, or dyes or pigments are incorporated in the photosensitive layer.

Employed as dyes may be compounds, known in the art, which absorb various wavelength regions according to the spectral sensitivity of photosensitive materials.

For example, when the silver salt photothermographic dry imaging material of this invention is used as an image recording material utilizing infrared radiation, it is preferable to employ squarylium dyes having a thiopyrylium nucleus (hereinafter referred to as thiopyriliumsquarylium dyes) and squarylium dyes having a pyrylium nucleus (hereinafter referred to as pyryliumsquarylium dyes), as described in Japanese Patent Application No. 11-255557, and thiopyryliumcroconium dyes or pyryliumcroconium dyes which are analogous to the squarylium dyes.

Incidentally, the compounds having a squarylium nucleus, as described herein, refers to ones having 1-cyclobutene-2-hydroxy-4-one in their molecular structure. Herein, the hydroxyl group may be dissociated. Hereinafter, all of these dyes are referred to as squarylium dyes.

Incidentally, preferably employed as the dyes are compounds described in JP-A No. 8-201959.

(Thermal Solvent)

A thermal solvent is preferably contained in a silver salt photothermographic dry imaging material of this invention. Herein, a thermal solvent is defined as a material which can lower the thermal development temperature of a silver salt photothermographic dry imaging material containing a thermal solvent by not less than 1° C. compared to a silver salt photothermographic dry imaging material containing no thermal solvent. More preferably it is a material being able to lower the thermal development temperature by not less than 2° C. and specifically preferably by not less than 3° C. For example, when a photothermographic dry imaging material containing a thermal solvent is A and a photothermographic dry imaging material containing no thermal solvent is B, a thermal solvent is defined with respect to the case, in which the thermal development temperature to obtain the density, which is obtained by exposing B and processing B at a thermal development temperature of 120° C. and a thermal development time of 20 seconds, by photothermographic dry imaging material A with the same exposure amount and the same thermal development time becomes not higher than 119° C.

A thermal solvent is provided with a polar group as a substituent and is preferably represented by formula (TS), however, is not limited thereto.

$$(Y^{11})_{n11}Z^{11} \qquad \text{Formula (TS)}$$

In Formula (TS), $Y^{11}$ is an alkyl group, an alkenyl group, an alkynyl group, an aryl group, or a heterocyclic group. $Z^{11}$ is a group selected from a hydroxyl group, a carboxy group, an amino group, an amido group, a sulfonamide group, a phosphoric acid amide group, a cyano group, imido, urido, sulfoxide, suphon, sulphine, phosphinoxide or a nitrogen-containing heterocyclic group. n11 is an integer of 1–3, and is 1 when $Z^{11}$ is monovalent, is identical to the valence of $Z^{11}$ when $Z^{11}$ is a group of two or more valence. Plural number of Y11 may be same opr different when n11 is not less than 2.

$Y^{11}$ is further provided with a substituent, which may be a group represented by $Z^{11}$. $Y^{11}$ will be further detailed. In formula (TS), $Y^{11}$ is a straight chain, branched chain or cyclic alkyl group (having a carbon number of preferably 1–40, more preferably 1–30 and specifically preferably 1–25, and includes methyl, ethyl, n-propyl, iso-propyl, sec-butyl, t-butyl, t-octyl, n-amyl, t-amyl, n-dodecyl, n-tridecyl, octadecyl, icocyl, cyclopentyl and cyclohexyl), an alkenyl group (preferably having a carbon number of preferably 2–40, more preferably 2–30 and specifically preferably 2–25, and includes such as vinyl allyl, 2-butenyl and 3-pentenyl), an aryl group (preferably having a carbon number of preferably 6–40, more preferably 6–30 and specifically preferably 6–25, and includes such as phenyl, P-methylphenyl and naphthyl), a heterocyclic group (preferably having a carbon number of preferably 2–20, more preferably 2–16 and specifically preferably 2–12, and includes such as pyridyl, pyradyl, imidazoyl and pyrrolidyl). These substituents may be further substituted by other substituent. Further, these substituents may form a ring by bonding to each other.

$Y^{11}$ may be further provided with a substituent, and examples of the substituent include the substituents described in "0015" of JP-A No. 2004-21068. The reason why development becomes active by utilizing a thermal solvent is considered that a thermal solvent is fused at near development temperature to become compatible with substances related to development, which enables a reaction at a lower temperature compared to the case without a thermal solvent. Since thermal development is a reducing reaction in which carboxylic acid and a silver ion transporting substance, having a relatively high polarity, participate, it is preferable to form a reaction field provided with a suitable polarity by a thermal solvent having a polarity.

A melting point of a thermal solvent preferably utilized in this invention is not lower than 50° C. and not more than 200° C., and more preferably is not lower than 60° C. and not more than 150° C. Such as the purpose of this invention, in a thermally developable photosensitive material which regards stability against outer environment such as image storage stability as important, preferred is a thermal solvent having a melting point of not lower than 100° C. and not higher than 150° C.

Specific examples of a thermal solvent include compounds described in "0017" of JP-A 2004-21068 and compounds described in "0027" of US Patent Application Publication No. 2002/0025498; that is, compounds MF-1–MF-3, MF-6, MF-7, MF-9–MF-12 and MF-15–MF-22.

The added amount of α-thermal solvent in this invention is preferably 0.01–5.0 g/m$^2$, more preferably 0.05–2.5 g/m$^2$ and furthermore preferably 0.1–1.5 g/m$^2$. A thermal solvent is preferably incorporated in a photosensitive layer. Further, the above-described thermal solvents may be utilized alone or in combination of at least two types. In this invention, a thermal solvent may be incorporated in a coating composition by any method such as a solution form, a emulsified dispersion form and a solid micro-particle dispersion form, to be contained in a photosensitive material.

Emulsifying dispersion methods well known include a method to mechanically prepare an emulsified dispersion by dissolution utilizing an auxiliary solvent such as dibutylphthalate, tricresylphosphate, glycryltriacetate or diethylphthalate.

Further, a solid micro-particle dispersion method includes a method in which a powder of a thermal solvent is dispersed in an appropriate solvent such as water by use of a ball mill, a vibration ball mill, a sand mill, a jet mill, a roller mill or ultrasonic wave to prepare a solid dispersion. Herein, at that time, a protective colloid (such as polyvinyl alcohol) and a surfactant (anionic surfactant such as sodium triisopropylnaphthalenesulfonate (a mixture of three compounds isopropyl groups of which substitute at different positions)) may be utilized. In the above-described mills, beads such as zirconia are generally utilized, and such as Zr dissolved from these beads may be mixed in the dispersion. The concentration depends on a dispersion conditions, however, is generally in a range of 1–1000 ppm. It is not practically problematic, when a content of Zr in a photosensitive material is not more than 0.5 mg per 1 g of silver. An antiseptic agent (such as benzoisothiazolinone sodium salt) is preferably incorporated in a water dispersion.

In this invention, a solvent is preferably contained at a range of 5–1,000 mg/m$^2$ in a silver salt phothtermographic dry imaging material at the time of thermal development. It is more preferably adjusted to 10–150 mg/m$^2$. Thereby, it is possible to prepare a thermally developable photosensitive material which exhibits high sensitivity, low fog and high density. The solvent includes those described in paragraph "0030" of JP-A 2001-264930. However, this invention is not limited thereto. Further, these solvents can be utilized alone or in combination of a few types.

The content of the above-described solvent in a thermally developable photosensitive material can be adjusted by changing the conditions of such as temperature in such as a drying process after a coating process. Further, the content of said solvent can be measured by means of gas chromatography under conditions suitable to detect the containing solvent.

(Packaging)

In the case of a silver salt photothermographic dry imaging material of this invention being stored, to prevent density variation and fog generation due to aging or to improve such as curling and core set property, a packaging material having a low oxygen permeability and/or moisture permeability is utilized for the packaging. The oxygen permeability at 25° C. is preferably not more than 50 ml/atm·m$^2$·day (herein, 1 atm is $1.01325\times10^5$ Pa), more preferably not more than 10 ml/atm·m$^2$·day and most preferably not more than 1.0 ml/atm·m$^2$·day. The moisture permeability is preferably not more than 0.01 g/m$^2$·40° C.·90% RH·day (According to cup method of JIS Z0208), more preferably not more than 0.005 g/m$^2$·40° C.·90% RH·day and most preferably not more than 0.001 g/m$^2$·40° C.·90% RH·day.

Specific examples of a packaging material for a thermally developable photosensitive material are those described in such as JP-A Nos. 8-254793, 2000-206653, 2000-235241, 2002-062625, 2003-015261, 2003-057790, 2003-084397, 2003-098648, 2003-098635, 2003-107635, 2003-131337, 2003-146330, 2003-226439 and 2003-228152. Further, the vacancy ratio of the inside of a package is 0.01–10% and preferably 0.02–5%, and a nitrogen partial pressure of the inside of a package is set at not less than 80% and preferably at not less than 90% by nitrogen sealing. Further, a relative humidity of the inside of a package is set at 10–60% and preferably not less than 40–55%.

In a cutting process and a packaging process, to prevent image defects such as abrasion and white spot, it is preferable to perform the work under an environment having an air cleanliness class of not more than US federal standard 209d class 10,000 as described in JP-A No. 2004-341145.

<Layer Structures and Coating Conditions>

It is preferable to prepare the silver salt photothermographic dry imaging material of this invention as follows. Materials of each constitution layer as above are dissolved or dispersed in solvents to prepare coating compositions. Resultant coating compositions are subjected to simultaneous multilayer coating and subsequently, the resultant coating is subjected to a thermal treatment. "Simultaneous multilayer coating", as described herein, refers to the following. The coating composition of each constitution layer (for example, a photosensitive layer and a protective layer) is prepared. When the resultant coating compositions are applied onto a support, the coating compositions are not applied onto a support in such a manner that they are individually applied and subsequently dried, and the operation is repeated, but are simultaneously applied onto a support and subsequently dried. Namely, before the residual amount of the total solvents of the lower layer reaches 70 percent by weight, the upper layer is applied.

Simultaneous multilayer coating methods, which are applied to each constitution layer, are not particularly limited. For example, are employed methods, known in the art, such as a bar coater method, a curtain coating method, a dipping method, an air knife method, a hopper coating method, and an extrusion method. Of these, more preferred is the pre-weighing type coating system called an extrusion coating method. The foregoing extrusion coating method is suitable for accurate coating as well as organic solvent coating because volatilization on a slide surface, which occurs in a slide coating system, does not occur. Coating methods have been described for coating layers on the photosensitive layer side. However, the backing layer and the subbing layer are applied onto a support in the same manner as above.

In this invention, silver coverage is preferably from 0.1 to 2.5 g/m$^2$, and is more preferably from 0.5 to 1.5 g/m$^2$.

Further, in this invention, it is preferable that in the silver halide grain emulsion, the content ratio of silver halide grains, having a grain diameter of 0.030 to 0.055 μm in term of the silver weight, is from 3 to 15 percent in the range of a silver coverage of 0.5 to 1.5 g/m$^2$.

The ratio of the silver coverage which is resulted from silver halide is preferably from 2 to 18 percent with respect to the total silver, and is more preferably from 3 to 15 percent.

Further, in this invention, the number of coated silver halide grains, having a grain diameter (being a sphere equivalent grain diameter) of at least 0.01 μm, is preferably from $1\times10^{14}$ to $1\times10^{18}$ grains/m$^2$, and is more preferably from $1\times10^{15}$ to $1\times10^{17}$.

Further, the coated weight of aliphatic carboxylic acid silver salts of this invention is from $10^{-17}$ to $10^{-15}$ g per silver halide grain having a diameter (being a sphere equivalent grain diameter) of at least 0.01 μm, and is more preferably from $10^{-16}$ to $10^{-14}$ g.

When coating is carried out under conditions within the foregoing range, from the viewpoint of maximum optical silver image density per definite silver coverage, namely covering power as well as silver image tone, desired results are obtained.

<Exposure Conditions>

When the silver salt photothermographic dry imaging material of this invention is exposed, it is preferable to employ an optimal light source for the spectral sensitivity provided to the foregoing photosensitive material. For example, when the foregoing photosensitive material is sensitive to infrared radiation, it is possible to use any radiation source which emits radiation in the infrared region. However, infrared semiconductor lasers (at 780 nm and 820 nm) are preferably employed due to their high power, as well as ability to make photosensitive materials transparent.

Further, a photothermographic dry imaging material of this invention exhibits the characteristics by being exposed with a light preferably having a high illuminance of not less than 1 mW/mm$^2$ in a short time. Herein, the illuminance refers to an illuminance at which a photosensitive material provides an optical density of 3.0. When an exposure is performed at such a high illuminance, a light amount (=illuminance×exposure time) necessary to obtain a required density can be made small, resulting in enabling a design of a high sensitive system. It is more preferably 2 mW/mm$^2$–50 W/mm$^2$ and is most preferably 10 mW–50 W/mm$^2$.

Provided being such a light sourceas described above, any light source can be employed; however, laser light can achieve an excellent result. As a laser light preferably utilized, a gas laser (Ar ion, Kr ion, He—Ne), a YAG laser, a dye laser and a semiconductor laser are preferable. Further, a semiconductor laser in combination with a second-harmonic generating element may be also utilized. Further, a semiconductor laser of blue-violet emitting light (such as having the peak strength at a wavelength in 350–440 nm) can be utilized. A blue-violet emitting high output power laser includes NLHV 3000E semiconductor laser, manufactured by Nichia Chemicals Co., Ltd.

In this invention, it is preferable that exposure is carried out utilizing laser scanning. Employed as the exposure methods are various ones. For example, listed as a firstly preferable method is the method utilizing a laser scanning exposure apparatus in which the angle between the scanning surface of a photosensitive material and the scanning laser beam does not substantially become vertical.

"Does not substantially become vertical", as described herein, means that during laser scanning, the nearest vertical angle is preferably from 55 to 88 degrees, is more preferably from 60 to 86 degrees, and is most preferably from 70 to 82 degrees.

When the laser beam scans photosensitive materials, the beam spot diameter on the exposed surface of the photosensitive material is preferably at most 200 μm, and is more preferably at most 100 mm, and is more preferably at most 100 μm. It is preferable to decrease the spot diameter due to the fact that it is possible to decrease the deviated angle from the verticality of laser beam incident angle. Incidentally, the lower limit of the laser beam spot diameter is 10 μm. By performing the laser beam scanning exposure, it is possible to minimize degradation of image quality according to reflection light such as generation of unevenness analogous to interference fringes.

Further, as the second method, exposure in this invention is also preferably carried out employing a laser scanning exposure apparatus which generates a scanning laser beam in a longitudinal multiple mode, which minimizes degradation of image quality such as generation of unevenness analogous to interference fringes, compared to the scanning laser beam in a longitudinal single mode.

The longitudinal multiple mode is achieved utilizing methods in which return light due to integrated wave is employed, or high frequency superposition is applied. The longitudinal multiple mode, as described herein, means that the wavelength of radiation employed for exposure is not single. The wavelength distribution of the radiation is commonly at least 5 nm, and is preferably at least 10 nm. The upper limit of the wavelength of the radiation is not particularly limited, but is commonly about 60 nm.

Further, as the third embodiment, it is also preferable to form an image by scanning exposure employing at least two sets of laser light. Such an image recording method employing plural sets of laser light is a technique utilized as an image writing means in a laser printer and a digital copier to write plural lines per each at one time scanning, with respect to requirement of high resolution and high speed, and disclosed in such as JP-A No. 60-166916. This is a method in which laser light emitted from a light source unit is inclination scanned by use of a polygon mirror and focused on a photosensitive unit through such as an fθ lens, which is a laser scanning exposure apparatus principally same as a laser imager.

In focusing of laser light on a photosensitive element in an image writing means of a laser printer and a digital copier, the next laser light is focused at the position being shifted by one line from the focused position of one laser light for the purpose of writing plural lines of an image per one time scanning. Specifically, two light beams are adjacent to each other in a vertical scanning direction at an interval of a few 10 μm order on an image surface, and the vertical scanning direction pitch of 2 beams is 63.5 μm when the printing density is 400 dpi (dpi is a dot number per 1 inch=2.54 cm), and is 42.3 μm when the printing density is 600 dpi. Different from such a method in which laser light is shifted by an amount of one resolution in the vertical scanning direction, in this invention, an image is preferably formed by condensing at least two sets of laser on the same place of the exposure surface at different incident angles. At this time, it is preferable to set the condition to satisfy $0.9\times E \leqq En\times N \leqq 1.1\times E$, when an exposure energy in the case that writing is generally performed with one set of laser light (wavelength of λ (nm)) is E, and N sets of laser light utilized for exposure have the same wavelength (wavelength of λ (nm)) and same exposure energy (En). By setting such a condition, the energy on the exposure surface is assured while reflection of each laser light on an image forming layer is decreased due to lower exposure energy of the laser resulting in depression of generation of interference fringes.

Herein, in the above description, the plural sets of laser light, wavelengths of which are identical, are utilized; however, those provided with different wavelengths can be also utilized. In the latter case, with respect to λ nm, it is preferable to set the condition to satisfy $(\lambda-30)<\lambda 1, \lambda 2, \ldots \lambda n \leqq (\lambda+30)$.

Incidentally, in the recording methods of the foregoing first and second embodiments, it is possible to suitably select any of the following lasers employed for scanning exposure, which are generally well known, while matching the use. The foregoing lasers include solid lasers such as a ruby laser, a YAG laser, and a glass laser; gas lasers such as a HeNe laser, an Ar ion laser, a Kr ion laser, a $CO_2$ laser a CO laser, a HeCd laser, an $N_2$ laser, and an excimer laser; semiconductor lasers such as an InGaP laser, an AlGaAs laser, a GaASP laser, an InGaAs laser, an InAsP laser, a $CdSnP_2$ laser, and a GaSb laser; chemical lasers; and dye lasers. Of these, from the viewpoint of maintenance as well as the size of light sources, it is preferable to employ any of the semiconductor lasers having a wavelength of 600 to 1,200 nm.

The beam spot diameter of lasers employed in laser imagers, as well as laser image setters, is commonly in the range of 5 to 75 μm in terms of a short axis diameter and in the range of 5 to 100 μm in terms of a long axis diameter. Further, it is possible to set a laser beam scanning rate at the optimal value for each photosensitive material depending on the inherent speed of the silver salt photothermographic dry imaging material at laser transmitting wavelength and the laser power.

<Development Conditions>In this invention, development conditions vary depending on employed devices and apparatuses, or means. Typically, an imagewise exposed silver salt photothermographic dry imaging material is heated at optimal high temperature. It is possible to develop a latent image formed by exposure by heating the material at relatively high temperature (for example, from about 100 to about 200° C.) for a sufficient period (commonly from about 1 second to about 2 minutes). When heating temperature is less than or equal to 100° C., it is difficult to obtain sufficient image density within a relatively short period. On the other hand, at more than or equal to 200° C., binders melt so as to be transferred to rollers, and adverse effects result not only for images but also for transportability as well as processing devices. Upon heating the material, silver images are formed through an oxidation-reduction reaction between aliphatic carboxylic acid silver salts (which function as an oxidizing agent) and reducing agents. This reaction proceeds without any supply of processing solutions such as water from the exterior.

Heating may be carried out employing typical heating means such as hot plates, irons, hot rollers and heat generators employing carbon and white titanium. When the protective layer-provided silver salt photothermographic dry imaging material of this invention is heated, from the viewpoint of uniform heating, heating efficiency, and workability, it is preferable that heating is carried out while the surface of the side provided with the protective layer comes into contact with a heating means, and thermal development is carried out during the transport of the material while the surface comes into contact with the heating rollers.

EXAMPLE

This invention will now be detailed with reference to examples. However, this invention is not limited to these examples. "Percent (or %)" in the examples is "% by weight (or wt %)", if not otherwise specified.

Example 1

<<Preparation of Subbed Photographic Supports>>

A photographic support comprised of a 175 μm thick biaxially oriented polyethylene terephthalate film with blue tinted at an optical density of 0.170 (determined by Densitometer PDA-65, manufactured by Konica Corp.), which had been subjected to corona discharge treatment of 8 W·minute/$m^2$ on both sides, was subjected to subbing. Namely, subbing liquid coating composition a-1 was applied onto one side of the above photographic support at 22° C. and 100 m/minute to result in a dried layer thickness of 0.2 μm and dried at 140° C., whereby a subbing layer on the image forming layer side (designated as Subbing Layer A-1) was formed. Further, subbing liquid coating composition b-1 described below was applied, as a backing layer subbing layer, onto the opposite side at 22° C. and 100 m/minute to result in a dried layer thickness of 0.12 μm and dried at 140°

C. An electrically conductive subbing layer (designated as Subbing Lower Layer B-1), which exhibited an antistatic function, was applied onto the backing layer side. The surface of Subbing Lower Layer A-1 and Subbing Lower Layer B-1 was subjected to corona discharge treatment of 8 W·minute/$m^2$. Subsequently, subbing liquid coating composition a-2 was applied onto Subbing Lower Layer A-1 was applied at 33° C. and 100 m/minute to result in a dried layer thickness of 0.03 μm and dried at 140° C. The resulting layer was designated as Subbing Upper Layer A-2. Subbing liquid coating composition b-2 described below was applied onto Subbing Lower Layer B-1 at 33° C. and 100 m/minute to results in a dried layer thickness of 0.2 μm and dried at 140° C. The resulting layer was designated as Subbing Upper Layer B-2. Thereafter, the resulting support was subjected to heat treatment at 123° C. for two minutes and wound up under the conditions of 25° C. and 50 percent relative humidity, whereby a subbed sample was prepared.

(Preparation of Water-based Polyester A-1)

A mixture consisting of 35.4 parts by weight of dimethyl terephthalate, 33.63 parts by weight of dimethyl isophthalate, 17.92 parts by weight of sodium salt of dimethyl 5-sulfoisophthalate, 62 parts by weight of ethylene glycol, 0.065 part by weight of calcium acetate monohydrate, and 0.022 part by weight of manganese acetate tetrahydrate underwent transesterification at 170–220° C. under a flow of nitrogen while distilling out methanol. Thereafter, 0.04 part by weight of trimethyl phosphate, 0.04 part by weight of antimony trioxide, and 6.8 parts by weight of 4-cyclohexanedicarboxylic acid were added. The resulting mixture underwent esterification at a reaction temperature of 220–235° C. while distilling out a nearly theoretical amount of water.

Thereafter, the reaction system was subjected to pressure reduction and heating over a period of one hour and was subjected to polycondensation at a final temperature of 280° C. and a maximum pressure of 133 Pa for one hour, whereby Water-soluble Polyester A-1 was synthesized. The intrinsic viscosity of the resulting Water-soluble Polyester A-1 was 0.33, the average particle diameters was 40 nm, and Mw was 80,000–100,000.

Subsequently, 850 ml of pure water was placed in a 2-liter three-necked flask fitted with stirring blades, a refluxing cooling pipe, and a thermometer, and while rotating the stirring blades, 150 g of Water-soluble Polyester A-1 was gradually added. The resulting mixture was stirred at room temperature for 30 minutes without any modification. Thereafter, the interior temperature was raised to 98° C. over a period of 1.5 hours and at that resulting temperature, dissolution was performed. Thereafter, the temperature was lowered to room temperature over a period of one hour and the resulting product was allowed to stand overnight, whereby Water-based Polyester A-1 Solution was prepared.

(Preparation of Modified Water-based Polyester B-1 and B-2 Solutions)

Placed in a 3-liter four-necked flask fitted with stirring blades, a reflux cooling pipe, a thermometer, and a dripping funnel was 1,900 ml of the foregoing 15% by weight Water-based Polyester A-1 Solution, and the interior temperature was raised to 80° C., while rotating the stirring blades. Into this added was 6.52 ml of a 24 percent aqueous ammonium peroxide solution, and a monomer mixed liquid composition (consisting of 28.5 g of glycidyl methacrylate, 21.4 g of ethyl acrylate, and 21.4 g of methyl methacrylate) was dripped over a period of 30 minutes, and reaction was allowed for an additional 3 hours. Thereafter, the resulting product was cooled to at most 30° C., and filtrated, whereby Modified Water-based Polyesters B-1 Solution (vinyl based component modification ratio of 20% by weight) at a solid concentration of 18 percent by weight was obtained.

Modified Water-based Polyester B-2 at a solid concentration of 18 percent by weight (a vinyl based component modification ratio of 20 percent by weight) was prepared in the same manner as above except that the vinyl modification ratio was changed to 36 percent by weight and the modified component was changed to styrene:glycidyl methacrylate: acetacetoxyethyl methacrylate n-butyl, acrylate=39.5:40:20:0.5.

(Preparation of Acryl Based Polymer Latexes C-1–C-3)

Acryl Based Polymer Latexes C-1–C-3 having the monomer compositions shown in the following table were synthesized employing emulsion polymerization. All the solid concentrations were adjusted to 30 percent by weight.

TABLE 2

| Latex No. | Monomer composition (weight ratio) | Tg(° C.) |
|---|---|---|
| C-1 | Styrene/glycidyl methacrylate/n-butylacrylate = 20/40/40 | 20 |
| C-2 | Styrene/n-butylacrylate/t-butylacrylate/hydroxyethyl methacrylate = 27/10/35/28 | 55 |
| C-3 | Styrene/glycidyl methacrylate/acetoacetoxyethyl methacrylate = 40/40/20 | 50 |

[Photosensitive Layer Side Subbing Lower Layer Coating Composition a-1]

| | |
|---|---|
| Acryl-type Polymer Latex C-3 (solid content of 30%) | 70.0 g |
| Water dispersion of ethoxylated alcohol and ethylene homopolymer (solid content of 10%) | 5.0 g |
| Surfactant(A) | 0.1 g |

Distilled water to make up to 1000 ml; resulting in preparation of a coating composition.

[Photosensitive Layer Side Subbing Upper Layer Coating Composition a-2]

| | |
|---|---|
| Modified water-based polyester B-2 (18 weight %) | 30.0 g |
| Surfactant(A) | 0.1 g |
| True-spherical silica matting agent (Seahoster KE-P50 manufactured by Nippon Shokubai Co., Ltd.) | 0.04 g |

Distilled water to make up to 1000 ml; resulting in preparation of a coating composition.

[Backing Layer Side Subbing Lower Layer Coating Composition b-1]

| | |
|---|---|
| Acryl-type Polymer Latex C-1 (solid content of 30%) | 30.0 g |
| Acryl-type Polymer Latex C-2 (solid content of 30%) | 7.6 g |

-continued

| [Backing Layer Side Subbing Lower Layer Coating Composition b-1] | |
|---|---|
| $SnO_2$ sol ($SnO_2$ sol, synthesized by a method described in example 1 of JP-B 35-6616, was concentrated by heating to make a solid concentration of 10 weight %, pH of which was adjusted to 10 by ammonia water.) | 180 g |
| Surfactant (A) | 0.5 g |
| PVA-613 (PVA manufactured by Kuraray Corp.) | 0.4 g |

Distilled water to make up to 1000 ml; resulting in preparation of a coating composition.

On the above Subbing Layer A-2 of the support supplied with the subbing layer, applied were the back coat layer and the back coat layer protective layer having the following compositions.

<Preparation of Back Coat Layer Coating Composition>

Into methyl ethyl ketone (MEK) of 830 g, while stirring, 84.2 g of cellulose acetate propionate (CAP 482-20, manufactured by Eastman Chemical Corp.) and 4.5 g of polyester resin (Vitel PE2200B, manufactured by Bostic Corp.) were added and dissolved. Next into the dissolved solution, 0.30 g of following infrared dye 1 and further 4.5 g of a fluorine-type surfactant (Surflon KH40, manufactured by Asahi Glass Co., Ltd.) and a fluorine-type surfactant (Megafag F120K, manufactured by Dainippon Ink and Chemicals Co., Ltd.) which were dissolved in 43.2 g of methanol were added and the resulting solution was sufficiently stirred until complete dissolution. Then the system was added with 2.5 g of oleyloleate and stirred resulting in preparation of a Back Coat Layer Coating Composition.

Surfactant (A)

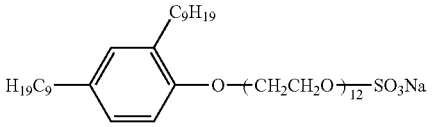

Infrared dye 1

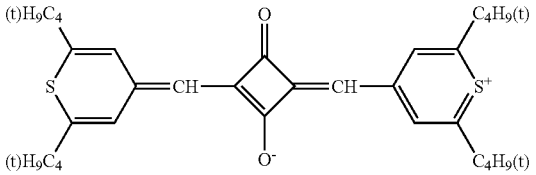

<Preparation of Back Coat Layer Protective Layer (Surface Protective Layer) Coating Composition>

Also with respect to Back Coat Layer protective layer, a Coating Composition was prepared in a similar manner to a back-coat Coating Composition employing the following component ratio. Silica was dispersed at a concentration of 1% in MEK by use of a dissolver-type homogenizer and added at the end.

| | |
|---|---|
| Cellulose acetate propionate (10% MEK solution) (CAP 482-20, produced by Eastman Chemical Corp.) | 15 g |
| Silica having a monodispersibility of 15% (mean particle size: 10 μm) (Surface treated with aluminum at 1% against the total weight of silica) | 0.03 g |
| $C_8F_{17}(CH_2CH_2O)C_8F_{17}$ | 0.075 g |
| Fluorine-type surfactant (SF-17) | 0.01 g |
| Fluorine-type polymer (FM-1) | 0.05 g |
| Stearic acid | 0.1 g |
| Butyl stearate | 0.1 g |
| α-alumina (Mohs' hrdness of 9) | 0.1 g |

(Preparation of Photosensitive Silver Halide Grain Emulsion A1)

| | |
|---|---|
| **Composition of Solution (A1)** | |
| Phenylcarbamoyl gelatin | 88.3 g |
| 10% methanol aqueous solution of Compound A (*1) | 10 ml |
| Potassium bromide | 0.32 g |
| Water to make | 5429 ml |
| **Composition of Solution (B1)** | |
| 0.67 mol/L aqueous silver nitrate solution | 2635 ml |
| **Composition of Solution (C1)** | |
| Potassium bromide | 51.55 g |
| Potassium iodide | 1.47 g |
| Water to make | 660 ml |
| **Composition of Solution (D1)** | |
| Potassium bromide | 154.9 g |
| Potassium iodide | 4.41 g |
| $K_2(IrCl_6)$ (corresponding to $4 \times 10^{-5}$ mol/Ag) | 50.0 ml |
| Water to make | 1.982 ml |
| **Composition of Solution (E1)** | |
| 0.4 mol/L aqueous potassium bromide solution an amount for controlling silver potential | |
| **Composition of Solution (F1)** | |
| Potassium hydroxide | 0.71 g |
| Water to make | 20 ml |
| **Composition of Solution (G1)** | |
| 56% aqueous acetic acid solution | 18.0 ml |
| **Composition of Solution (H1)** | |
| Sodium carbonate anhydride | 1.72 g |
| Water to make | 151 ml |

(*1) Compound A: $HO(CH_2CH_2O)_n[CH(CH_3)CH_2O]_{17}(CH_2CH_2O)_mH$ (m + n = 5 − 7)

Employing a mixing stirrer described in Examined Japanese Patent Publication No. 58-58288, added to solution (A1) were ¼ solution (B1) and total solution (C1) over 4 minutes 45 seconds utilizing a double-jet method, while adjusting the temperature to 45° C. and the pAg to 8.09, whereby nuclei were formed. After 1 minute all of solution (F1) was added. Meanwhile pAg was appropriately adjusted by employing (E1). After 6 minutes, added to the resulting mixture were the residual solution (B1) and all of solution (D1) over 14 minutes 15 seconds employing a double-jet method, while adjusting the temperature to 20° C., and the pAg to 8.09. After said solution was stirred for 5 minutes, it was cooled to 40° C. Subsequently, added to the resulting solution was all of solution (G1), whereby a silver halide emulsion was prepared. The resulting supernatant was then removed while leaving 2,000 ml of the resulting precipitation to which 10 L of water was added. After stirring, silver halide was precipitated again. Subsequently, the resulting supernatant was removed while leaving 1,500 ml of the precipitate. Thereafter, Solution (H1) was added and the resulting mixture was heated to 60° C. and stirred for further 120 minutes. Finally, the pH was adjusted to 5.8 and water was added so as to make a total weight of 1,161 g per mol of silver, whereby photosensitive silver halide grain emulsion A1 was prepared.

Said emulsion A1 was comprised of monodispersed cubic silver iodobromide grains having an average grain size of 0.040 μm, a variation coefficient of grain size of 12%, and [100] plane ratio of 92%.

[Preparation of Photosensitive Silver Halide Emulsion 2]

Photosensitive silver halide emulsion 2 was prepared in a similar manner to the preparation of photosensitive silver halide emulsion 1 described above, except that 4 ml of 0.1% ethanol solution of the following compound (being ETTU) was added after addition of the total amount of solution F1 after nucleation.

This emulsion was comprised of monodispersed cubic silver iodobromide grains having an average grain size of 0.042 μm, a variation coefficient of grain size of 10%, and [100] plane ratio of 94%.

<<Preparation of Photosensitive Layer Coating Composition>>

(Preparation of Powder Aliphatic Carboxylic Acid Silver Salt A)

Dissolved in 4,720 ml of pure water were 117.7 g of behenic acid, 60.9 g of arachidic acid, 39.2 g of stearic acid, and 2.1 g of palmitic acid at 80° C. Subsequently, 486.2 ml of a 1.5 M aqueous sodium hydroxide solution was added, and further, 6.2 ml of concentrated nitric acid was added. Thereafter, the resultant mixture was cooled to 55° C., whereby an aliphatic acid sodium salt solution was prepared. After 347 ml of t-butyl alcohol was added and stirred for 20 min, the above-described Photosensitive Silver Halide Emulsion 1 as well as 450 ml of pure water was added and stirred for 5 minutes.

Subsequently, 702.6 ml of one mol silver nitrate solution was added over two minutes and stirred for 10 minutes, whereby an aliphatic carboxylic acid silver salt dispersion was prepared. Thereafter, the resultant aliphatic carboxylic acid silver salt dispersion was transferred to a water washing machine, and deionized water was added. After stirring, the resultant dispersion was allowed to stand, whereby a flocculated aliphatic carboxylic acid silver salt was allowed to float and was separated, and the lower portion, containing water-soluble salts, were removed. Thereafter, washing was repeated employing deionized water until electric conductivity of the resultant effluent reached 50 μS/cm. After centrifugal dehydration, the resultant cake-shaped aliphatic carboxylic acid silver salt was dried employing an gas flow type dryer Flush Jet Dryer (manufactured by Seishin Kikaku Co., Ltd.), while setting the drying conditions such as nitrogen gas as well as heating flow temperature at the inlet of the dryer, until its water content ratio reached 0.1 percent, whereby Powder Aliphatic Carboxylic Acid Silver Salt A was prepared. The water content ratio of aliphatic carboxylic acid silver salt compositions was determined employing an infrared moisture meter. A silver salt conversion ratio of the aliphatic carboxylic acid was confirmed to be about 95%, measured by the above method.

<<Preparation of Preliminary Dispersion A>>

Dissolved in 1457 g of methyl ethyl ketone (hereinafter referred to as MEK) was 14.57 g of poly(vinyl butyral) resin P-9. While stirring, employing Dissolver DISPERMAT Type CA-40M, manufactured by VMA-Getzmann Co., 500 g of foregoing Powder Aliphatic Carboxylic Acid Silver Salt A was gradually added and sufficiently mixed, whereby Preliminary Dispersion A was prepared.

(Preparation of Photosensitive Emulsion A)

Preliminary Dispersion A, prepared as above, was charged into a media type homogenizer DISPERMAT Type SL-C12EX (manufactured by VMA-Getzmann Co.), filled with 0.5 mm diameter zirconia beads so as to occupy 80 percent of the interior volume so that the retention time in the mill reached 1.5 minutes and was dispersed at a peripheral rate of the mill of 8 m/second, whereby Photosensitive Emulsion A was prepared.

(Preparation of Stabilizer Solution)

Stabilizer Solution was prepared by dissolving 1.0 g of Stabilizer 1 and 0.31 g of potassium acetate in 4.97 g of methanol.

(Preparation of Infrared Sensitizing Dye A Solution)

Infrared Sensitizing Dye A Solution was prepared by dissolving 19.2 mg of Infrared Sensitizing Dye 1, 10 mg of Infrared Sensitizing Dye 2, 1.48 g of 2-chloro-benzoic acid, 2.78 g of Stabilizer 2, and 365 mg of 5-methyl-2-mercaptobenzimidazole in 31.3 ml of MEK in a light-shielded room.

(Preparation of Additive Solution "a")

Additive Solution "a" was prepared by dissolving 27.98 g of 1,1-bis(2-hydroxy-3,5-dimethylphenyl)-3,5,5-trimethylhexane (Developing Agent A) and 1.54 g of 4-methylphthalic acid, and 0.20 g of foregoing Infrared Dye 1 in 110 g of MEK.

(Preparation of Additive Solution "b")

Additive Solution "b" was prepared by dissolving 3.56 g of Antifoggant 2 and 3.43 g of phthalazine in 40.9 g of MEK.

(Preparation of Photosensitive Layer Coating Composition A)

While stirring, 50 g of foregoing Photosensitive Emulsion A and 15.11 g of MEK were mixed and the resultant mixture was maintained at 21° C. Subsequently, 390 μl of Antifoggant 1 (being a 10 percent methanol solution) was added and stirred for one hour. Further, 494 μl of calcium bromide (being a 10 percent methanol solution) was added and stirred for 20 minutes. Subsequently, 167 ml of foregoing Stabilizer Solution was added and stirred for 10 minutes. Thereafter, 1.32 g of foregoing Infrared Sensitizing Dye A was added and the resulting mixture was stirred for one hour. Subsequently, the resulting mixture was cooled to 13° C. and stirred for an additional 30 minutes. While maintaining at 13° C., 13.31 g of poly(vinyl acetal) Resin P-1 and Stafiloid IM-601 (produced by Ganz Chemical Co., Ltd.), mixed together in the volume ratio of 1:1, as a binder was added and stirred for 30 minutes. Thereafter, 1.084 g of tetrachlorophthalic acid (being a 9.4 weight percent MEK solution) was added and stirred for 15 minutes. Further, while stirring, 12.43 g of Additive Solution "a", 1.6 ml of Desmodur N300/aliphatic isocyanate, produced by Mobay Chemical Co. (being a 10 percent MEK solution), and 4.27 g of Additive Solution "b" were successively added, whereby Photosensitive Layer Coating Composition A1 was prepared.

Stabilizer 1

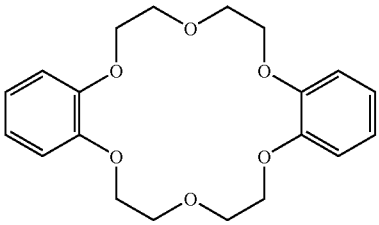

Antifoggant 1

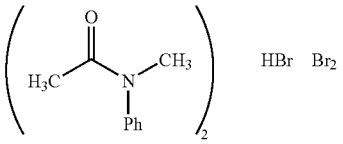

ETTU

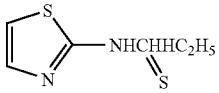

Stabilizer 2

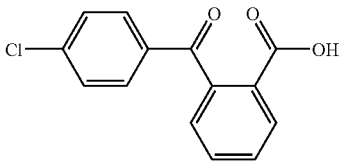

Antifoggant2

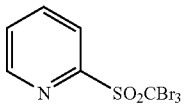

Infrared Sensitizing Dye 1

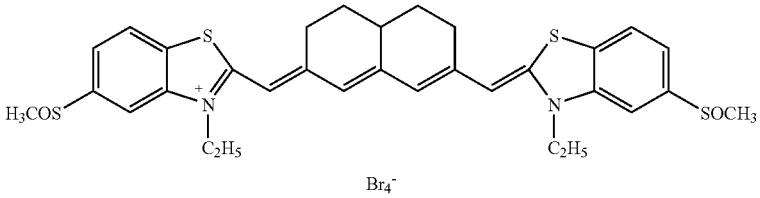

Infrared Sensitizing Dye 2

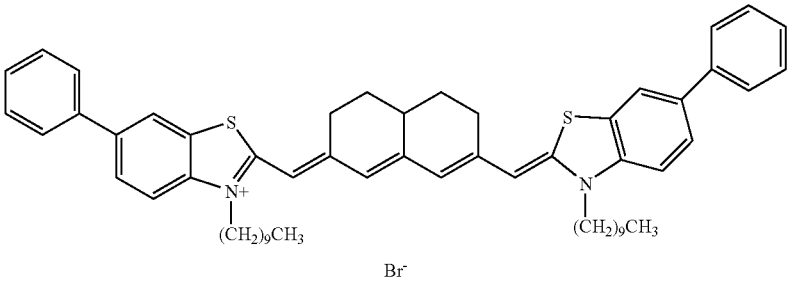

<<Surface Protective Layer>>

| <Lower Layer of Image Forming Layer Protective Layer (Lower Surface Protective Layer)> | |
|---|---|
| Acetone | 5 g |
| MEK | 21 g |
| Cellulose acetate propyonate (CAP-141-20, having a glass transition temperature, Tg, of 190° C., produced by Eastman Chemical Co.) | 2.3 g |
| Palaroide A-21 (Rhom & Haas Corp.) | 0.07 g |
| Benzotriazole | 0.03 g |
| Methanol | 7 g |
| Phthalazin | 0.25 g |
| $CH_2{=}CHSO_2CH_2CH_2OCH_2CH_2SO_2CH{=}CH_2$ | 0.035 g |
| $C_{12}F_{25}(CH_2CH_2O)_{10}C_{12}F_{25}$ | 0.01 g |
| Fluorine-type surfactant ($LiO_3S{-}C_3F_6{-}SO_3Li$) | 0.01 g |
| Stearic acid | 0.1 g |
| Butyl Stearate | 0.1 g |
| α-alumina (Mohs' hardness of 9) | 0.1 g |
| <Upper Layer of Image Forming Layer Protective Layer (Upper | |

-continued

| Surface Protective Layer)> | |
|---|---|
| Acetone | 5 g |
| MEK | 21 g |
| Binder (described in table 2) | 2.3 g |
| Palaroide A-21 (produced by Rhom & Haas Corp.) | 0.07 g |
| Benzotriazole | 0.03 g |
| Methanol | 7 g |
| Phthalazin | 0.25 g |
| Cross-lonking agent (kind and weight are described in Table 3) | |
| Tabular particles (kind and weight are described in Table 3) | |
| $C_{12}F_{25}(CH_2CH_2O)_{10}C_{12}F_{25}$ | 0.01 g |
| Fluorine-type surfactant ($LiO_3S{-}C_3F_6{-}SO_3Li$) | 0.01 g |
| Stearic acid | 0.1 g |
| Butyl Stearate | 0.1 g |
| α-alumina (Mohs' hardness of 9) | 0.1 g |
| S400 N5 (produced by Diamond Shamrock Corp.) | 0.1 g |

Herein, with respect to the upper and lower image forming layer protective layers, the coating compositions were prepared in a similar manner to preparation of a back coat layer protective layer coating composition, employing the composition ratio described above. Silica was dispersed by use of a dissolver type homogenizer at 1 weight % concentration in MEK, and being added at the end, resulting in preparation of the upper and lower photosensitive layer protective layers.

<Preparation of Photothermographic Imaging Material>

The back coat layer coating composition and back coat layer protective layer coating composition, prepared in the above-manner, were coated on Subbing Upper Layer B-2 by use of an extrusion coater at a coating rate of 50 m/min, so as to make a dry layer thickness of 3.5 μm each. Herein, drying was performed for 5 minutes employing wind having a drying temperature of 100° C. and a dew point of 10° C.

Sample Nos. 101–130 were prepared by changing kids of silver halide emulsions and protective layer binders and adding a cross-linking agents and an acid scabemger as shown in Table 3, while simultaneously coating the foregoing photosensitive layer coating composition and photosensitive layer protective layer coating composition on Subbing Upper Layer A-2 by use of an extrusion coater at a coating rate of 50 m/min.

Coating was conducted to achieve that the silver coverage of the image forming layer was 1.2 g/m$^2$ and the dry layer thicknesses of the image forming layer protective layer (the surface protective layer) was 3.0 μm (being Upper Surface Protective Layer was 1.5 μm and Lower Surface Protective Layer was 1.5 μm), followed by drying for 10 minutes employing wind having a drying temperature of 75° C. and a dew point of 10° C.

Prepared phtothermographic imaging materials (Sample No. 101) was provided with a surface pH 5.3 and a Beck's smoothness of 6,000 sec., for the image forming layer layer side, and a surface pH 5.5 and a Beck's smoothness of 9,000 sec., for the back coat layer side.

<<Evaluation of Each Characteristic Value>>

(Heat Drying Weight Measurement)

Heat drying weight measurement of the samples prepared as above was conducted employing TGA $Q_{500}$ (manufactured by TA Instrument Japan, Co.). The samples were cut in a circular pattern of a 5 mm diameter, and placed on a measuring pan, and measurement was conducted at a temperature raising rate of 5° C./min. under nitrogen gas stream.

(Exposure and Development Process)

Exposure was given onto the emulsion side surface of each sample prepared as above, employing an exposure apparatus in which a semiconductor laser, which was subjected to longitudinal multi mode of a wavelength of 800 to 820 nm, employing high frequency superposition, was employed as a laser beam source. In such a case, images were formed while adjusting the angle between the exposed surface of the sample and the exposure laser beam to 75 degrees. By employing such a method, compared to the case in which the angle was adjusted to 90 degrees, images were obtained which minimized unevenness and surprisingly exhibited excellent sharpness.

Thereafter, while employing an automatic processor having a heating drum, the protective layer of each sample was brought into contact with the surface of the drum and thermal development was carried out at 123° C. for 15 seconds. In such a case, exposure as well as development was carried out in the room which was conditioned at 23° C. and 50% RH.

(Evaluation of Image Stability)

Density of each formed image of prepared samples above was determined. The center portion of the sample width was set to 3.0 with a calibration function, and then density of the edge portion (being 15 mm from a slitted edge) was determined.

(Image Keeping Stability Under Light Irradiation)

After exposure and development of each photothermographic imaging material in the manner similar to above, density in fogged areas was determined. After that, the samples were placed on a viewing box of 5,000 lux at 45° C. and 55% RH for 10 hours. Density of the fogged areas was determined, after which density changes in the fogged areas (ΔDmin) were evaluated.

(Measurement of Equivalent Value of Odor Index)

A black color image sample exhibiting a density of 3.0 was prepared by a method similar to the foregoing exposure and development. A sample of 10 g was put in a sample bag and an odor gas in the interior of the sample bag at 120° C. was gathered by use of odor detector FF-2A (manufactured by Shimazu Seisakusho Co., Ltd., with a temperature-raising thermal eliminating concentration method, employing 9 oxide semiconductor sensors) and an equivalent value of odor index was measured. Herein, an equivalent value of odor index is a value to express odor strength and is a dilution ratio, at which the odor can no longer be smelled, expressed a a common logarithm multiplied by 10.

(Evaluation of Staining Level)

Prepared samples of 3,000 sheets were continuously developed according to the above exposure and development, and contamination of a heat development drum and the neighborhood in the processor were visually evaluated. The evaluation was performed in 5 ranks based on the following criteria.

A: No contamination was observed.

B: Negligible contamination was observed.

C: Slight contamination was observed.

D: Definite contamination wass observed.

E: Considerably strong contamination was observed.

TABLE 3-1

| | Upper Protective Layer | | Tabular Particles | | Cross-linking Agent | | | | | |
|---|---|---|---|---|---|---|---|---|---|---|
| Example 1 | Binder of Upper Protective Layer | Saponification degree or Acetylation degree | Kind | Added Particle Ratio: (particle weight/ binder weight) | Koid | Added Weight Ratio: (cross-linking agent weight/ binder weidht) | weight reducing value from 25° C. to 100° C./ weight value at 25° C. | weight reducing value from 100° C. to 125° C./ weight value at 25° C. | *5 | *6 |
| 101 | CAP | — | None | — | None | — | 0.55 | 0.061 | 1 | 5 |
| 102 | PVA-403 | 78.5–81.5 | ME-100 | 0.40 | Epoxy (X-2-4) | 0.03 | 0.36 | 0.057 | 2 | 5 |
| 103 | PVA-505 | 72.5–74.5 | ME-100 | 0.40 | Epoxy (X-2-4) | 0.03 | 0.36 | 0.055 | 2 | 5 |
| 104 | PVA-505 | 72.5–74.5 | MK-300 | 0.40 | Epoxy (X-2-4) | 0.03 | 0.35 | 0.038 | 2 | 5 |
| 105 | PVA-505 | 72.5–74.5 | MK-300 | 0.40 | Epoxy (X-2-4) | 0.10 | 0.35 | 0.035 | 2 | 5 |
| 106 | PVA-505 | 72.5–74.5 | MK-200 | 0.30 | Burnock D-500 | 0.03 | 0.30 | 0.035 | 2 | 5 |
| 107 | PVA-505 | 72.5–74.5 | MK-200 | 0.40 | Burnock D-500 | 0.03 | 0.29 | 0.030 | 2 | 5 |
| 108 | PVA-505 | 72.5–74.5 | MK-100 | 0.40 | Burnock D-500 | 0.10 | 0.25 | 0.028 | 2 | 5 |
| 109 | PVA-505 | 72.5–74.5 | MK-100 | 0.30 | Duranate MF60X | 0.03 | 0.24 | 0.280 | 1 | 5 |
| 110 | PVA-505 | 72.5–74.5 | MK-100 | 0.40 | Duranate MF60X | 0.10 | 0.24 | 0.275 | 1 | 5 |
| 111 | PVA-505 | 72.5–74.5 | MK-100 | 0.30 | Duranate MF60X | 0.03 | 0.24 | 0.275 | 2 | 25 |
| 112 | PVA-505 | 72.5–74.5 | MK-300 | 0.40 | Duranate MF60X | 0.03 | 0.22 | 0.025 | 2 | 5 |
| 113 | PVA-505 | 72.5–74.5 | MK-100 | 0.30 | Duranate MF60X | 0.03 | 0.20 | 0.022 | 2 | 5 |
| 114 | PVA-505 | 72.5–74.5 | MK-100 | 0.40 | Duranate MF60X | 0.10 | 0.18 | 0.020 | 2 | 5 |

*5: Siver Halide Emulsion in Photosensitive Layer
*6: Distance (cm) from exposure section to development section

TABLE 3-2

| | Upper Protective Layer | | Tabular Particles | | Cross-linking Agent | | | | | |
|---|---|---|---|---|---|---|---|---|---|---|
| Example 1 | Binder of Upper Protective Layer | Saponification degree or Acetylation degree | Kind | Added Particle Ratio: (particle weight/ binder weight) | Koid | Added Weight Ratio: (cross-linking agent weight/ binder weidht) | weight reducing value from 25° C. to 100° C./ weight value at 25° C. | weight reducing value from 100° C. to 125° C./ weight value at 25° C. | *5 | *6 |
| 116 | LL-10 | 43–45% | MK-100 | 0.15 | None | — | 0.51 | 0.061 | 2 | 5 |
| 117 | LL-10 | 43–45% | MK-100 | 0.40 | Duranate MF60X | 0.10 | 0.39 | 0.048 | 2 | 5 |
| 118 | L-30 | 55% | ME-100 | 0.40 | Epoxy (X-2-4) | 0.03 | 0.36 | 0.055 | 2 | 5 |
| 119 | L-30 | 55% | MK-300 | 0.40 | Epoxy (X-2-4) | 0.03 | 0.35 | 0.038 | 2 | 5 |
| 120 | L-30 | 55% | MK-300 | 0.40 | Epoxy (X-2-4) | 0.10 | 0.35 | 0.035 | 2 | 5 |
| 121 | L-30 | 55% | MK-200 | 0.30 | Burnock D-500 | 0.03 | 0.30 | 0.035 | 2 | 5 |
| 122 | L-30 | 55% | MK-200 | 0.40 | Burnock D-500 | 0.03 | 0.29 | 0.030 | 2 | 5 |
| 123 | L-30 | 55% | MK-100 | 0.40 | Burnock D-500 | 0.10 | 0.25 | 0.028 | 2 | 5 |
| 124 | L-30 | 55% | MK-100 | 0.30 | Duranate MF60X | 0.03 | 0.24 | 0.280 | 1 | 5 |
| 125 | L-30 | 55% | MK-100 | 0.40 | Duranate MF60X | 0.10 | 0.24 | 0.275 | 1 | 5 |
| 126 | L-30 | 55% | MK-100 | 0.30 | Duranate MF60X | 0.03 | 0.24 | 0.275 | 2 | 25 |
| 127 | L-30 | 55% | MK-300 | 0.40 | Duranate MF60X | 0.03 | 0.22 | 0.025 | 2 | 5 |
| 128 | L-30 | 55% | MK-100 | 0.30 | Duranate MF60X | 0.03 | 0.20 | 0.022 | 2 | 5 |
| 129 | L-30 | 55% | MK-100 | 0.40 | Duranate MF60X | 0.10 | 0.18 | 0.020 | 2 | 5 |
| 130 | L-35 | 61.60% | MK-100 | 0.40 | Duranate MF60X | 0.10 | 0.4 | 0.051 | 2 | 5 |

*5: Siver Halide Emulsion in Photosensitive Layer
*6: Distance (cm) from exposure section to development section

TABLE 3-3

| Example 1 | Staining Level | Image keeping stability under light irradiation (ΔDmin: at 45° C., 5,000 lx for 10 hr.) | Density in Center Portion | Density in Edge Portion | Equivalent Value of Odor Index | |
|---|---|---|---|---|---|---|
| 101 | E | 0.140 | 3.00 | 2.93 | 45.3 | Comp. |
| 102 | E | 0.139 | 3.00 | 2.94 | 43.9 | Comp. |
| 103 | D | 0.139 | 3.00 | 2.94 | 43.0 | Comp. |

TABLE 3-3-continued

| Example 1 | Staining Level | Image keeping stability under light irradiation (ΔDmin: at 45° C., 5,000 lx for 10 hr.) | Density in Center Portion | Density in Edge Portion | Equivalent Value of Odor Index | |
|---|---|---|---|---|---|---|
| 104 | D | 0.135 | 3.00 | 2.96 | 38.9 | Inv. |
| 105 | C | 0.135 | 3.00 | 2.98 | 36.7 | Inv. |
| 106 | C | 0.132 | 3.00 | 2.97 | 36.3 | Inv. |
| 107 | B | 0.132 | 3.00 | 2.99 | 36.3 | Inv. |
| 108 | B | 0.131 | 3.00 | 3.00 | 36.0 | Inv. |
| 109 | B | 0.132 | 3.00 | 2.97 | 35.5 | Inv. |
| 110 | A | 0.131 | 3.00 | 2.98 | 35.3 | Inv. |
| 111 | A | 0.131 | 3.00 | 2.89 | 35.2 | Inv. |
| 112 | B | 0.131 | 3.00 | 3.00 | 36.0 | Inv. |
| 113 | A | 0.129 | 3.00 | 2.98 | 35.2 | Inv. |
| 114 | A | 0.128 | 3.00 | 2.99 | 35.0 | Inv. |
| 116 | E | 0.137 | 3.00 | 2.93 | 45.7 | Comp. |
| 117 | E | 0.138 | 3.00 | 2.94 | 44.1 | Comp. |
| 118 | D | 0.139 | 3.00 | 2.94 | 43.8 | Comp. |
| 119 | D | 0.135 | 3.00 | 2.96 | 39.9 | Inv. |
| 120 | C | 0.135 | 3.00 | 2.98 | 39.0 | Inv. |
| 121 | C | 0.132 | 3.00 | 2.97 | 38.5 | Inv. |
| 122 | B | 0.132 | 3.00 | 2.99 | 38.4 | Inv. |
| 123 | B | 0.131 | 3.00 | 3.00 | 37.9 | Inv. |
| 124 | B | 0.132 | 3.00 | 2.97 | 36.5 | Inv. |
| 125 | A | 0.131 | 3.00 | 2.98 | 36.4 | Inv. |
| 126 | A | 0.131 | 3.00 | 2.89 | 36.4 | Inv. |
| 127 | B | 0.131 | 3.00 | 3.00 | 37.0 | Inv. |
| 128 | A | 0.129 | 3.00 | 2.96 | 36.4 | Inv. |
| 129 | A | 0.128 | 3.00 | 2.97 | 36.0 | Inv. |
| 130 | E | 0.138 | 3.00 | 2.92 | 41.2 | Comp. |

Comp.: Comparative example,
Inv.: This invention

CAP-141-20 (cellulose acetate propyonate: produced by Eastman Chemical Co., having a glass transition temperature Tg of 190° C.)

PVA-403 and -505 (polyvinyl alcohol, produced by Kuraray Co., Ltd.)

L-30, -35, and LL-10 (cellulose acetate, produced by Daicel Chemical Industries, Ltd.)

Burnock D-500 (brocked isocyanate cross-linking agent, produced by Dainippon Ink And Chemicals, Inc.)

Duranate MF-K60X blocked isocyanate cross-linking agent, produced by Asahi Chemical Industry Co., Ltd.)

It is apparent from Table 3 that compared to the comparative examples, the photothermographic imaging material of this invention exhibits improved density differences in the film, and excellent density stability in plain after development, and also reduced staining, because staining of the thermal development drum in the developing apparatus and its surrounding areas is improved.

Example 2

<Preparation of Phoptographic Support Provided with Under Coating>

Under coating was performed on a photographic support in which the both surfaces of polyethylene terephthalate film, having been colored with the following blue dye, biaxially stretched and thermally fixed, and having a thickness of 175 μm, had been subjected to a corona discharge treatment of 8 W·min/m$^2$. That is, under-coat layer coating composition a-1 was coated at 22° C., 100 m/min, on the one surface of the photographic support so as to make a dry thickness of 0.2 μm, followed by being dried at 140° C. to form a photosensitive layer (an image forming layer) side under-coat layer (referred to as under-coat layer A-2). Further, under-coat layer coating composition b-1 was coated at 22° C., 100 m/min, as a backing layer side under-coat layer, on the opposite surface so as to make a dry thickness of 0.2 μm, followed by being dried at 140° C. to form a under-coat conductive layer (referred to as under-coat layer B-2) provided with a antistatic function on a backing layer side. Corona discharge treatment was provided on the surfaces of under-coat layer A-2 and under-coat layer B-2 at 8 W·min/m2, then following under-coat coating composition a-2 was coated at 33° C., 100 m/min on lower under-coat layer A-2 so as to make a dry layer thickness of 0.03 μm, followed by being dried at 140° C. to form upper under-coat layer A-3, as well as following under-coat coating composition b-2 was coated at 33° C., 100 m/min on lower under-coat layer B-2 so as to make a dry layer thickness of 0.2 μm, followed by being dried at 140° C. to form upper under-coat layer B-3, and the support was further heat treated at 123° C. for 2 minutes followed by being wound up under a condition of 25° C., 50% RH, resulting in preparation of an under-coated sample.

Blue Dye

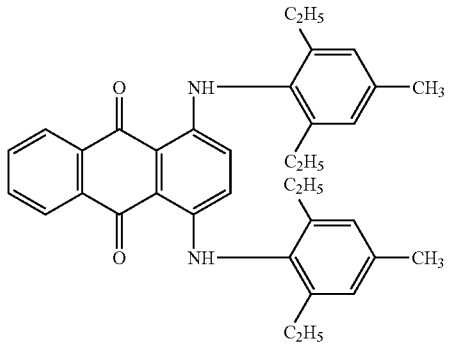

[Preparation of Water-based Polyester A-2 Solution]

After dimethyl terephthalate of 35.4 weight parts, 33.63 weight parts of dimethyl isophthalate, 17.92 weight parts of sodium dimethyl sulfoisophthalate, 62 weight parts of ethylene glycol, 0.065 weight parts of calcium acetate monohydrate and 0.022 weight parts of manganese acetate tetrahydrate were subjected to an ester exchange reaction while distillation eliminating alcohol at 170–220° C. under nitrogen gas flow; 0.04 weight parts of trimethyl phosphate, 0.04 weight parts of antimony trioxide and 6.8 weight parts of 1,4-dicyclohexane dicarboxylate, as polymerization catalysts, were added to the system, and approximately theoretical amount of water was distillation eliminated at a reaction temperature of 220–235° C. resulting in esterification.

Thereafter, the interior of the reaction system was further evacuated and heated to finally perform polycondensation for approximately 1 hour at 280° C., not higher than 133 Pa, resulting in synthesis of water-based polyester A-2. Water based polyester A-2 obtained above had an intrinsic viscosity of 0.33, a mean particle size of 40 nm, and Mw=80,000–100,000.

Next, 150 g of water-based polyester A-2 were gradually added into a three-necked 2 L flask equipped with a stirring fan, a reflux condenser and a thermometer, while rotating the stirring fan. After the system was stirred at room temperature for 30 minutes as it is, being heated to make the interior temperature of 98° C. over 1.5 hours, and was dissolved by heating at this temperature for 3 hours. After finish of heating, the system was cooled down to room temperature by taking 1 hour and kept for one night, resulting in preparation of 15 weight % water based polyester A-2 solution.

[Preparation of Modified Water-based Polyester B-2–B-3 Solutions]

Foregoing 15 weight % water-based polyester A-2 solution of 1900 ml were charged in a 3 L 4-necked flask equipped with a stirring fan, a reflux condenser, a thermometer and a titration funnel, and the interior temperature was heated up to 80° C. while rotating the stirring fan. Into this system, 6.52 ml of 24 weight % aqueous solution of ammonium peroxide was added and monomer mixed solution (28.5 g of glycidyl methacrylate, 21.4 g of ethylacrylate and 21.4 g of methylacrylate) was titrated over 30 minutes, followed by further 3 hours of reaction. Thereafter, the system was cooled down to not higher than 30° C. and filtered, resulting in preparation of modified water-based polyester B-2 solution (vinyl type component ratio of 20 weight %) having a solid concentration of 18 weight %.

Modified water-based polyester B-3 solution (vinyl type component ratio of 20 weight %) having a solid concentration of 18 weight % was prepared in a similar manner to B-2 solution except that the vinyl modification ratio was set to 36 weight % and modification components were set to styrene/glycidyl methacrylate/acetoacetoxy ethylmethacrylate/n-butylacrylate=39.5/40/20/0.5.

[Preparation of Acryl Type Polymer Latexes C-2–C-4]

Acryl type polymer latexes having monomer compositions shown in Table 4 were synthesized by means of emulsion polymerization. All the solid contents were set to 30 weight %.

TABLE 4

| Latex No. | Monomer composition (weight ratio) | Tg (° C.) |
|---|---|---|
| C-2 | Styrene/glycidyl methacrylate/n-butylacrylate = 20/40/40 | 20 |
| C-3 | Styrene/n-butylacrylate/t-butylacrylate/hydroxyethyl methacrylate = 27/10/35/28 | 55 |
| C-4 | Styrene/glycidyl methacrylate/acetoacetoxyethyl methacrylate-butylacrylate = 40/40/20 | 50 |

| [Photosensitive Layer Side Lower Under-coat Layer Coating composition a-1] | |
|---|---|
| Acryl-type Polymer Latex C-3 (solid content of 30%) | 70.0 g |
| Water dispersion of ethoxylated alcohol and ethylene homopolymer (solid content of 10%) | 5.0 g |
| Surfactant(A) | 0.1 g |
| Distilled water to make up to 1000 ml; resulting in preparation of a coating composition. | |

| [Photosensitive Layer Side Upper Under-coat Layer Coating composition a-2] | |
|---|---|
| Modified water-based polyester B-2 (18 weight %) | 30.0 g |
| Surfactant(A) | 0.1 g |
| True-spherical silica matting agent (Seahoster KE-P50 manufactured by Nippon Shokubai Co., Ltd.) | 0.04 g |
| Distilled water to make up to 1000 ml; resulting in preparation of a coating composition. | |

| [Backing Layer Side Lower Under-coat Layer Coating composition b-1] | |
|---|---|
| Acryl-type Polymer Latex C-2 (solid content of 30%) | 30.0 g |
| Acryl-type Polymer Latex C-3 (solid content of 30%) | 7.6 g |
| $SnO_2$ sol | 180 g |
| ($SnO_2$ sol, synthesized by a method described in example 1 of Examined Japanese Patent Application Publication No. 35-6616, was concentrated by heating to make a solid concentration of 10 weight %, pH of which was adjusted to 10 by ammonia water.) | |
| Surfactant (A) | 0.5 g |
| PVA-613 (PVA manufactured by Kuraray Corp.) | 0.4 g |
| Distilled water to make up to 1000 ml; resulting in preparation of a coating composition. | |

| [Backing Layer Side Upper Under-coat Layer Coating composition b-2] | |
|---|---|
| Modified water-based polyester B-2 (18 weight %) | 145.0 g |
| True-spherical silica matting agent (Seahoster KE-P50 manufactured by Nippon Shokubai Co., Ltd.) | 0.2 g |
| Surfactant(A) | 0.1 g |
| Distilled water to make up to 1000 ml; resulting in preparation of a coating composition. | |
| Herein, the back-coat layer and back-coat layer protective layer, having the following compositions, were coated on under-coat layer B-2 of the support provided with the foregoing under-coat layers. | |

Herein, the back-coat layer and back-coat layer protective layer, having the following compositions, were coated on under-coat layer B-2 of the support provided with the foregoing under-coat layers.

Surfactant (A)

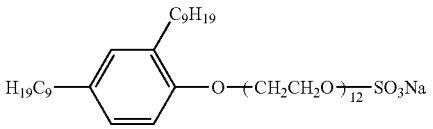

<Preparation of Back-coat Layer Coating Composition>

Into methyl ethyl ketone (MEK) of 830 g, while stirring, 84.2 g of cellulose acetate propionate (CAP 482-20, manufactured by Eastman Chemical Corp.) and 4.5 g of polyester resin (Vitel PE2200B, manufactured by Bostic Corp.) were added and dissolved. Next into the dissolved solution, 0.30 g of following infrared dye 1 and further 4.5 g of a fluorine-type surfactant (Surflon KH40, manufactured by Asahi Glass Co., Ltd.) and a fluorine-type surfactant (Megafag F120K, manufactured by Dainippon Ink and Chemicals Co., Ltd.) which were dissolved in 43.2 g of methanol were added and the resulting solution was sufficiently stirred until complete dissolution. Then the system was added with 2.5 g of oleyloleate and stirred resulting in preparation of a back-coat layer coating composition.

Infrared dye 1

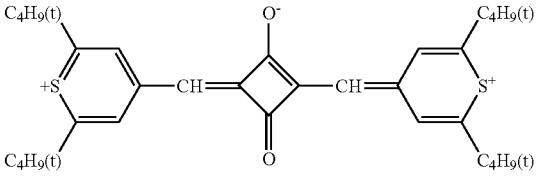

<Preparation of Back-coat Layer Protective Layer (Surface Protective Layer) Coating Composition>

Also with respect to back-coat layer protective layer, a coating composition was prepared in a similar manner to a back-coat coating composition employing the following component ratio. Silica was dispersed at a concentration of 1% in MEK by use of a dissolver-type homogenizer and added at the end.

| | |
|---|---|
| Cellulose acetate propionate (10% MEK solution) (CAP 482-20, manufactured by Eastman Chemical Corp.) | 15 g |
| Silica having a monodispersibility of 15% (mean particle size: 10 μm) (Surface treated with aluminum at 1% against the total weight of silica) | 0.03 g |
| $C_8F_{17}(CH_2CH_2O)C_8F_{17}$ | 0.075 g |
| Fluorine-type surfactant (SF-17) | 0.01 g |
| Fluorine-type polymer (FM-1) | 0.05 g |
| Stearic acid | 0.1 g |
| Butyl stearate | 0.1 g |
| α-alumina (Mohs' hrdness of 9) | 0.1 g |

-continued

| (Preparation of Photosensitive Silver Halide Grain Emulsion A1) | |
|---|---|
| Composition of Solution (A1) | |
| Phenylcarbamoyl gelatin | 88.3 g |
| 10% methanol aqueous solution of Compound (AO-1) | 10 ml |
| Potassium bromide | 0.32 g |
| Water to make | 5.429 ml |
| Composition of Solution (B1) | |
| 0.67 mol/L aqueous silver nitrate solution | 2.635 ml |
| Composition of Solution (C1) | |
| Potassium bromide | 50.69 g |
| Potassium iodide | 2.66 g |
| Water to make | 660 ml. |
| Composition of Solution (D-1) | |
| Potassium bromide | 151.6 g |
| Potassium iodide | 7.67 g |
| Potassium hexachloro iridate (IV) (1% aqueous solution) $K_2(IrCl_6)$ | 0.93 ml |
| Potassium hexacyano ferrate (II) | 0.004 g |
| Ptassium hexachloro osmate (IV) | 0.004 g |
| Water to make | 1982 ml |
| Composition of Solution (E1) | |
| 0.4 mol/L aqueous potassium bromide solution an amount for controlling silver potential | |
| Composition of Solution (F1) | |
| Potassium hydroxide | 0.71 g |
| Water to make | 20 ml |
| Composition of Solution (G1) | |
| 56% aqueous acetic acid solution | 18.0 ml |
| Composition of Solution (H1) | |
| Sodium carbonate anhydride | 1.72 g |
| Water to make | 151 ml |

Compound AO-1: $HO(CH_2CH_2O)_n[CH(CH_3)CH_2O]_{17}(CH_2CH_2O)_mH$ (m + n = 5 − 7)

Employing a mixing stirrer described in JP-B 58-58288, added to solution (A1) were ¼ solution (B1) and total solution (C1) over 4 minutes 45 seconds utilizing a double-jet method, while adjusting the temperature to 45° C. and the pAg to 8.09, whereby nuclei were formed. After 1 minute all of solution (F1) was added. Meanwhile pAg was appropriately adjusted by employing (E1). After 6 minutes, added to the resulting mixture were the residual solution (B1) and all of solution (D1) over 14 minutes 15 seconds employing a double-jet method, while adjusting the temperature to 20° C., and the pAg to 8.09. After said solution was stirred for 5 minutes, it was cooled to 40° C. Subsequently, added to the resulting solution was all of solution (G1), whereby a silver halide emulsion was prepared. The resulting supernatant was then removed while leaving 2,000 ml of the resulting precipitation to which 10 L of water was added. After stirring, silver halide was precipitated again. Subsequently, the resulting supernatant was removed while leaving 1,500 ml of the precipitate. Thereafter, Solution (H1) was added and the resulting mixture was heated to 60° C. and stirred for further 120 minutes. Finally, the pH was adjusted to 5.8 and water was added so as to make a total weight of 1,161 g per mol of silver, whereby photosensitive silver halide grain emulsion A1 was prepared.

Said emulsion A1 was comprised of monodispersed cubic silver iodobromide grains (AgI content was 3.5 mol %)

having an average grain size of 25 nm, a variation coefficient of grain size of 12%, and [100] plane ratio of 92% (AgI content of 3.5 mol %).

[Preparation of Photosensitive Silver Halide Grain Emulsion A2]

Photosensitive silver halide emulsion A2 was prepared in a similar manner to the preparation of photosensitive silver halide emulsion A1 described above, except that 5% aqueous solution of 4-hydroxy-6-methyl-1,3,3a,7-tetrazaindene was added after addition of the total amount of solution F1 after nucleation.

Herein, this emulsion is comprised of monodispersed cubic silver iodobromide grains having a mean grain size of 25 nm, a variation coefficient of grain size of 12% and [100] surface ratio of 92% (AgI content of 3.5 mol %).

[Preparation of Photosensitive Silver Halide Grain Emulsion A3]

Photosensitive silver halide emulsion A3 was prepared in a similar manner to the preparation of photosensitive silver halide emulsion A1 described above, except that 4 ml of 0.1% ethanol solution of following compound (TPPS) was added after addition of the total amount of solution F1 after nucleation.

Herein, this emulsion is comprised of monodispersed cubic silver iodobromide grains having a mean grain size of 25 nm, a variation coefficient of grain size of 12% and [100] surface ratio of 92% (AgI content of 3.5 mol %).

TPPS

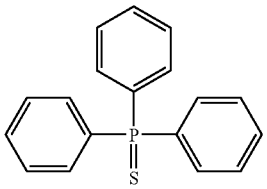

[Preparation of Photosensitive Silver Halide Grain Emulsion B1]

Photosensitive silver halide emulsion B1 was prepared in a similar manner to the preparation of photosensitive silver halide emulsion A1 described above, except that the temperature at the time of addition was changed to 45° C. This emulsion is comprised of monodispersed cubic silver iodobromide grains having a mean grain size of 55 nm, a variation coefficient of grain size of 12% and [100] surface ratio of 92% (AgI content of 3.5 mol %).

[Preparation of Photosensitive Silver Halide Grain Emulsion B2]

Photosensitive silver halide emulsion B2 was prepared in a similar manner to the preparation of photosensitive silver halide emulsion B1 described above, except that 4 ml of 0.1% ethanol solution of following compound (TPPS) was added after addition of the total amount of solution F1 after nucleation. This emulsion is comprised of monodispersed cubic silver iodobromide grains having a mean grain size of 55 nm, a variation coefficient of grain size of 12% and [100] surface ratio of 92% (AgI content of 3.5 mol %).

<Preparation of Powder Organic Silver Salt A>

Dissolved in 4720 ml of pure water were 130.8 g of behenic acid, 67.7 g of arachidinic acid, 43.6 g of stearic acid and 2.3 g of palmitic acid at 80° C. Subsequently, added to the resulting mixture were 540.2 ml of a 1.5 mol/L aqueous sodium hydroxide solution and 6.9 ml of concentrated sulfuric acid, and the resulting mixture was then cooled to 55° C., whereby a fatty acid sodium salt solution was prepared. While maintaining the temperature of said fatty acid sodium salt solution at 55° C. a photosensitive silver halide emulsion (the type and the added amount are described in Table 2) and 450 ml of pure water were added and stirred for 5 minutes. Subsequently, 468.4 ml of 1 mol/L silver nitrate solution were added over 2 minutes and the resulting mixture was stirred for 10 minutes, whereby an organic silver salt dispersion was prepared. Thereafter, the prepared organic silver salt dispersion was placed into a washing vessel. After adding deionized water while stirring, the resulting dispersion was allowed to stand so that the organic silver salt dispersion was separated as the supernatant and water-soluble salts below the supernatant were removed. The supernatant organic silver salt dispersion was repeatedly washed with deionized water and drained until the electric conductivity of the drainage reached 2 μS/cm, and then dehydrated by centrifuge. The obtained organic salt of a cake form was dried by use of an air-flow type dryer, Flush Jet Dryer (manufactured by Seishin Enterprise Co., Ltd.) under a nitrogen gas environment and an operation condition (inlet 65° C., outlet 40° C.) of a dryer warm-air temperature, until the water content reached 0.1%, resulting in preparation of dried powder organic silver salt A. From the analyzed result by use of an electromicroscope with respect to thermally developable photosensitive material sample 117 (described later) which was prepared employing this organic silver salt, said organic silver salt was tabular grains having a mean grain size (an equivalent circle diameter) of 0.08 μm, an aspect ratio of 5 and a monodispersibility of 10%.

Herein water content measurement of an organic silver salt composition was performed by use of an infrared water content analyzer.

<Preparation of Preliminary Dispersion A>

Dissolved in 1457 g of MEK were 14.57 g of polyvinylbutyral containing a $SO_3K$ group (having a Tg of 75° C. and containing 0.2 mmol/g of —SO3K group) (the added amounts are described in Table 5) as a photosensitive layer (an image forming layer) binder. Subsequently, preliminary dispersion A was prepared by gradually adding 500 g of above-described powdered organic silver salt A while stirring employing a dissolver, DISPERMAT CA-40M Type, produced by VMAGetzmann Co. to be mixed sufficiently.

<Preparation of Photosensitive Emulsion Dispersion A>

By employing a pump, preliminary dispersion A was supplied into a media type homogenizer, Dispermat Type SL-C12EX (produced by VMA-Getzmann Co.), filled with 0.5 mm diameter zirconia beads at an amount of 80% of the interior volume, so as to obtain a retention time in the mill of 1.5 minutes, and was dispersed at a circumferencial speed of the mill of 8 m/second, whereby photosensitive emulsion dispersion A was prepared.

<Preparation of Stabilizer Solution>

A stabilizer solution was prepared by dissolving 1.0 g of stabilizer 1 and 0.31 g of potassium acetate in 4.97 g of methanol.

<Preparation of Infrared Sensitizing Dye Solution A>

An infrared sensitizing dye solution A was prepared by dissolving in a dark place 9.6 mg of infrared sensitizing dye 1, 9.6 mg of infrared sensitizing dye 2, 1.488 g of 2-chlorobenzoic acid, 2.779 g of stabilizer 2 and 365 mg of 5-methyl-2-mercaptobenzimidazole in 31.3 ml of MEK.

<Preparation of Additive Solution "a">

Additive solution "a" was prepared by dissolving a reducing agent (the compound and amount described in Table 5), 0.159 g of compound (YA-1) of formula (YB), 0.159 g of cyan coloring leuco dye CA-12, 1.54 g of 4-methylphthalic acid and 0.48 g of foregoing infrared dye 1 in 110.0 g of MEK.

<Preparation of Additive Solution "b">

Additive solution "b" was prepared by dissolving 1.56 g of antifoggant 2, 0.5 g of antifoggant 3, 0.5 g of antifoggant 4, 0.5 g of antifoggant 5 and 3.43 g of phthalazine in 40.9 g of MEK.

<Preparation of Additive Solution "c">

Additive-solution "c" was prepared by dissolving 0.2 g of silver saving agent (SE2-2) in 39.8 g of MEK.

<Preparation of Additive Solution "d">

Additive solution "d" was prepared by dissolving 0.1 g of supersensitizer 1 in 9.9 g of MEK.

<Preparation of Additive Solution "e">

Additive solution "e" was prepared by dissolving 0.5 g of potassium p-toluenethiosulfonate and 0.5 g of antifoggant 6 in 9.0 g of MEK.

<Preparation of Additive Solution "f">

Additive solution "f" was prepared by dissolving 1.0 g of vinylsulfone $[(CH_2{=}CH{-}SO_2CH_2)_2CHOH]$ in 9.0 g of MEK.

<Preparation of Photosensitive Layer Coating Composition>

Under an inert gas atmosphere (comprising 97% nitrogen gas), 50 g of the foregoing photosensitive emulsion dispersion (described in Table 5) and 15.11 g of MEK were heated at 21° C. while stirring. Subsequently, 1000 μl of chemical sensitizer 5-5 (0.5% methanol solution) were added, and 390 μl of antifoggant 1 were added after 2 minutes followed by stirring for 1 hour. Further, 494 μl of calcium bromide (10% methanol solution) were added and stirred for 10 minutes, and then gold sensitizer Au-5 equivalent to 1/20 mol of the foregoing organic chemical sensitizer was added and further stirred for 20 minutes. Subsequently, 167 μl of the stabilizer solution were added and stirred for 10 minutes, and then 1.32 g of above-described infrared sensitizing dye solution A were added and stirred for 1 hour. Thereafter the resulting mixture was cooled to 13° C. and further stirred for 30 minutes. While maintaining at 13° C., 0.5 g of additive solution "d", 0.5 g of additive solution "e", 0.5 g of additive solution "f" and 13.31 g of the binder utilized in preliminary dispersion A were added and stirred for 30 minutes. Thereafter, 1.084 g of tetrachlorophthalic acid (being a 9.4 weight % MEK solution) were added and stirred for 15 minutes. Further, while stirring, 12.43 g of additive solution "a", 1.6 ml of Desmodur N3300/aliphatic isocyanate, manufactured by Mobay Co. (being a 10% MEK solution), and 4.27 g of additive solution "c" were successively added and stirred, whereby a photosensitive layer coating composition was prepared.

Chemical structures of additives which were utilized in each coating composition such as a stabilizer solution, and photosensitive layer coating composition, are shown below.

Stabilizer 1

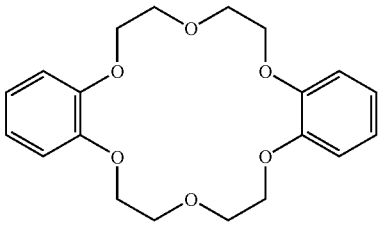

Stabilizer 2

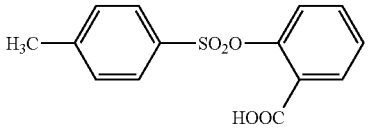

Antifoggant 2

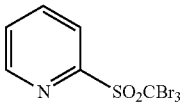

Antifoggant 3

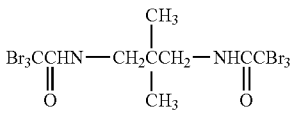

-continued
Antifoggant 4
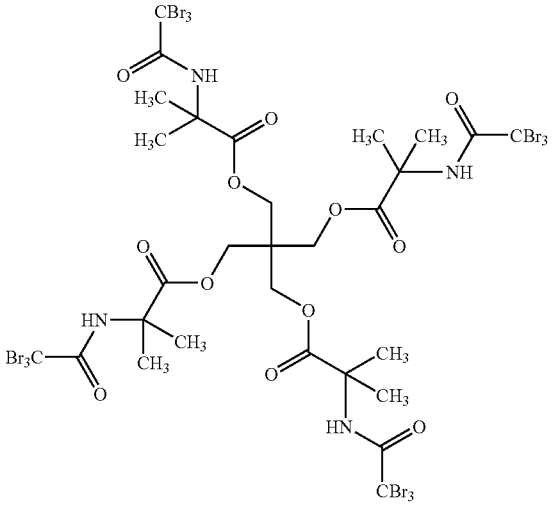
Antifoggant 5
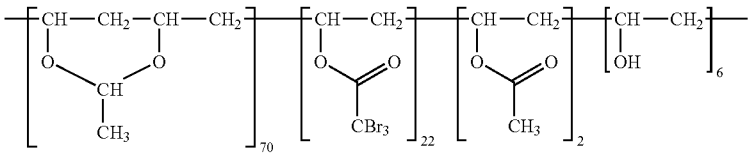
Number average molecular weight: 20,000
Infrared sensitizing dye 1
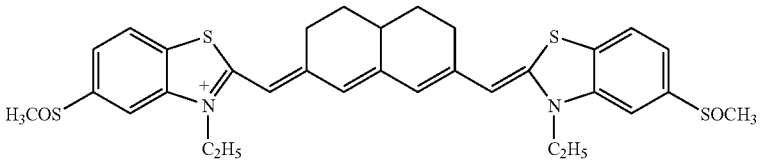
$BF_4^-$
Infrared sensitizing dye 2
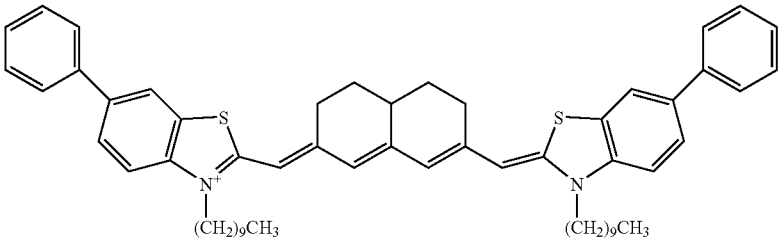
p-$TsO^-$
Supersensitizer 1
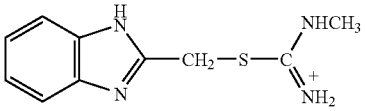
Antifoggant 6
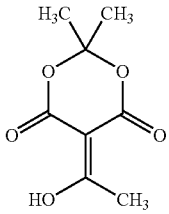

-continued

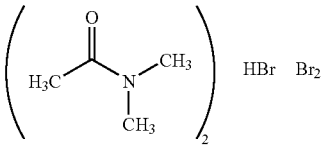

Antifoggant 1

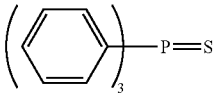

Chemical sensitizer S-5

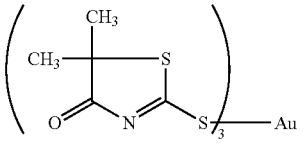

Au-5

| <Preparation of Photosensitive Layer Lower Protective Layer (Lower Surface Protective Layer)> | |
|---|---|
| Acetone | 5 g |
| MEK | 21 g |
| Cellulose acetate propionate (CAP-141-20 having a glass transition temperature, Tg, of 190° C., manufactured by Eastman Chemical Co.) | 2.3 g |
| Methanol | 7 g |
| Phthalazin | 0.25 g |
| $CH_2{=}CHSO_2CH_2CH_2OCH_2CH_2SO_2CH{=}CH_2$ | 0.035 g |
| $C_{12}F_{25}(CH_2CH_2O)_{10}C_{12}F_{25}$ | 0.01 g |
| Fluorine-type surfactant (SF-17: described above) | 0.01 g |
| Stearic acid | 0.1 g |
| Butyl Stearate | 0.1 g |
| α-alumina (Mohs' hardness of 9) | 0.1 g |

| <Preparation of Photosensitive Layer Upper Protective Layer (Upper Surface Protective Layer)> | |
|---|---|
| Acetone | 5 g |
| MEK | 21 g |
| Binder (described in Table 5) | 2.3 g |
| Palaroide A-21 (Rhom & Haas Corp.) | 0.08 g |
| Benzotriazole | 0.03 g |
| Methanol | 7 g |
| Phthalazin | 0.25 g |
| Mnodispersed Silica having a monodispersibility of 15% (mean particle size: 3 μm) (being surface treated with aluminum of 1 weight % against the total weight of silica) | 0.140 g |
| $CH_2{=}CHSO_2CH_2CH_2OCH_2CH_2SO_2CH{=}CH_2$ | 0.035 g |
| $C_{12}F_{25}(CH_2CH_2O)_{10}C_{12}F_{25}$ | 0.01 g |
| Fluorine-type surfactant (SF-17: described above) | 0.01 g |
| Fluorine-type polymer (SM-1: described above) | 0.01 g |
| Stearic acid | 0.1 g |
| Butyl Stearate | 0.1 g |
| α-alumina (Mohs' hardness of 9) | 0.1 g |

Herein, with respect to upper and lower photosensitive layer protective layers, the coating compositions were prepared in a similar manner to preparation of a back-coat layer protective layer coating composition, employing the composition ratio described above. Silica was dispersed by use of a dissolver type homogenizer at 1 weight % concentration in MEK, and being added at the end, resulting in preparation of upper and lower photosensitive layer protective layers.

<Preparation of Silver Salt Photothermographic Dry Imaging Material>

The back-coat layer coating composition and back-coat layer protective layer coating composition, prepared in the above manner, were coated on upper under-coat layer B-2 by use of an extrusion coater at a coating speed of 50 m/min, so as to make a dry layer thickness of 3.5 μm each. Herein, drying was performed for 5 minutes employing wind having a drying temperature of 100° C. and a dew point of 10° C.

Photosensitive material samples 101–120 shown in Table 5 were prepared by simultaneously coating the foregoing photosensitive layer coating composition and photosensitive layer protective layer coating composition on upper under-coat layer A-2 by use of an extrusion coater at a coating speed of 50 m/min. Coating was performed to make the dry layer thicknesses described in Table 5 for a photosensitive layer and a dry layer thickness of 3.0 μm for a photosensitive layer protecyive layer (upper surface protective layer of 1.5 μm, lower surface protective layer of 1.5 μm,), followed by drying for 10 minutes employing wind having a drying temperature of 75° C. and a dew point of 10° C.

Prepared phtothermographic materials (samples 101–120) were provided with a surface pH 5.3 and a Beck's smoothness of 6,000 sec., for the photosensitive layer side, and a surface pH 5.5 and a Beck's smoothness of 9,000 sec., for the back-coat layer side. Further, surface roughness was measured with respect to samples 101–120 to be Rz(E)/Rz(B)=0.40 and Rz(E)=1.4 μm. Further, Rz(B) was 3.5 μm, Ra(E) was 0.09 μm and Ra(B) was 0.12μm.

Further, with respect to prepared samples 101–120, a weight loss value at 100° C. when being heated from 25° C. to 100° C., and a weight loss value at 120° C. when being heated from 100° C. to 120° C., each were calculated against a weight value at 25° C., by use of a thermal dry weight analyzer, TGA Q-1000, produced by T. A. Instrument Co., and the results are shown in Table 5.

Herein, sample 108 was prepared in a similar manner to sample 104, except that 259.9 g of behenic acid were utilized instead of 130.8 g of behenic acid, 67.7 g of arachidic acid, 43.6 g of stearic acid and 2.3 g of palmitic acid, in preparation of powdered organic silver salt A.

Sample 109 was prepared in a similar manner to sample 104, except that 540.2 ml of 1.5 mol/L aqueous potassium hydroxide solution were utilized instead of 540.2 ml of 1.5 mol/L aqueous sodium hydroxide solution, in preparation of powdered organic silver salt A.

Sample 110 was prepared in a similar manner to sample 104, except that a fluorine-type surfactant in a back-coat layer protective layer and in a photosensitive layer protective layer (upper and lower layers) was changed from SF-17 to $C_8F_{17}SO_3Li$.

Sample 111 was prepared in a similar manner to sample 104, except that $SO_3K$ group containing polyvinylbutyral (Tg of 65° C., containing 0.2 mmol/g of $SO_3K$) was employed instead of $SO_3K$ group containing polyvinylbutyral (Tg of 75° C., containing 0.2 mmol/g of $SO_3K$)

The prepared phtothermographic light-sensitive material samples 101–120 prepared in the above manner were processed into a half-cut size (34.5 cm×43.0 cm), subsequently being packaged with the following packaging material under an environment of 25° C.·50% RH, and the following evaluations were performed after the samples have been kept at ordinary temperature for 2 weeks.

(Packaging Material)

A barrier bag comprising PET 10 μm/PE 12 μm/aluminum foil 9 μm/Ny 15 μm/polyethylene containing 3% of carbon 50 μm, having an oxygen permeability of 0.02 ml/atm·$m^2$·25° C.·day, and a water permeability of 0.001 g/$m^2$·40° C.·90% RH·day (based on a cup method of JIS Z208), and a papper tray were utilized.

(Evaluation of Samples)

Figure 4:
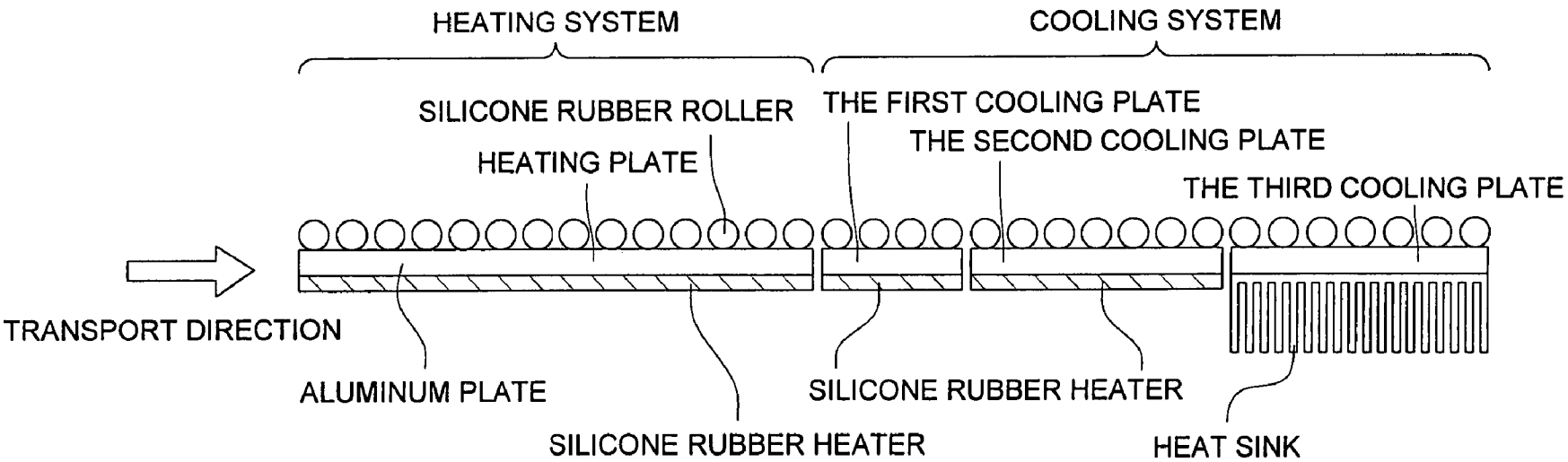
FIG. 4 is a side-view drawing to show a primary constitution of a thermal development apparatus having been utilized in example 1.

A thermal development apparatus as shown in FIG. 4 (equipped with a semiconductor laser of having a maximum output power of 50 mW) was employed in the experiment, and the constitution was as follows. A heating system was constituted of a heating plate of a plate form comprising an aluminum plate having a thickness of 10 mm the back surface of which was pasted up with a silicone rubber heater. A silicone rubber roller, on the surface layer of which was provided with a silicone rubber layer of 1 mm thick, having a diameter of 12 mm and an effective transport length of 380 mm was arranged at the guide surface of the heating plate so as to provide a line pressure of 8 gf/cm, and a film coated with a thermally developable photosensitive material was transported, while pressing and bringing the BC surface in contact with the heating plate. The transport length of the heating plate was 210 mm.

As a cooling system, an aluminum plate of 10 mm thick was employed as the first-third cooling plates, the first and second cooling plates each were provided with a silicone rubber heater to enable cooling temperature control, and on the rear surface of an aluminum plate of the third cooling plate was attached with a heat sink, having a thickness of 0.7 mm, a height of 35 mm and a depth of 390 mm, in which 21 sheets of fins were arranged at 4 mm pitches. A silicone rubber roller having a diameter of 12 mm and an effective transport length of 380 mm was arranged at the first-third cooling plates so as to provide a line pressure of 8 gf/cm, and a film was transported, while being pressed. The transport length of the first-third cooling plates each were 60 mm, 105 mm and 105 mm, respectively.

The transport speed was set to 15.1 mm/s at an ordinary processing and to 21.2 mm/s at a rapid processing. The temperature of heating plate was set to 123° C., of the first cooling plate to 110° C., of the second cooling plate to 90° C. and of the third plate to 30–60° C. A gap of 2 mm was provided between the heating plate and the cooling plate to depress heat transfer between the plates each other.

Samples were subjected to thermal development simultaneous with exposure by use of a thermal development apparatus shown in FIG. 4 followed by evaluations of obtained images with a densitometer. Herein, "thermal development simultaneous with exposure" means that, in one sheet of photosensitive material, the part of one sheet having been exposed already starts to be developed while a part is exposed. The distance between an exposure part and a development part was 26 cm.

Samples 101–115 was subjected to thermal development while the surface side on which a photosensitive layer had been coated (the EC surface) was left open and being transported by pressing the surface side opposite to the photosensitive layer coated side (the BC surface) to be brought in contact with a heating plate, for 10 seconds of heating time B of FIG. 3 (EC surface open, BC surface heated, rapid processing). At this time, the transport speed from the feeding apparatus portion to the image exposure apparatus portion, the transport speed at the image exposure section, the transport speed at the thermal development section and the transport speed at the cooling section, each were 21.2 mm/sec, respectively.

Sample 116 was thermally developed under similar conditions to sample 112 except that the film was reversed upside down to make a state of the BC surface side open and the EC side heated (BC surface open, EC surface heated, rapid processing).

Sample 117 was thermally developed, while leaving the BC surface open and heating the EC surface, under similar conditions to sample 116 except that an ordinary processing at a transport speed of 15.1 mm/sec and heating time B of 14 seconds was applied (BC surface open, EC surface heated, ordinary processing).

Sample 118 was thermally developed, while leaving the EC surface open and heating the BC surface, under similar conditions to sample 116 except that an ordinary processing at a transport speed of 15.1 mm/sec and heating time B of 14 seconds was applied (EC surface open, BC surface heated, ordinary processing).

Sample 119 was thermally developed, while leaving the EC surface open and heating the BC surface, under similar conditions to sample 114 except that an ordinary processing at a transport speed of 15.1 mm/sec and heating time B of 14 seconds was applied (EC surface open, BC surface heated, ordinary processing).

Sample 120 was thermally developed, while leaving the EC surface open and heating the BC surface, under similar conditions to sample 115 except that an ordinary processing at a transport speed of 15.1 mm/sec and heating time B of 14 seconds was applied (EC surface open, BC surface heated, ordinary processing).

Herein, exposure and development were performed in a room rehumidified at 23° C.·50% RH. Exposure was stepwise performed by decreasing the exposure energy by logE 0.05 per one step from the maximum output power.

<Contamination Evaluation in Running Experiment>

The prepared samples of 3,000 sheets were continuously developed according to the above exposure and development, and contamination of a heat development drum and the neighborhood in the processor were visually evaluated. The evaluation was performed in a 5-ranking based on the following criteria:

A: No contamination is observed.
B: Very slight contamination is observed.
C: Slight contamination is observed.
D: Contamination is observed.
E: Considerably strong contamination is observed.

(Measurement of Equivalent Value of Odor Index)

Black color image sample having a density of 3.0 was prepared by a method similar to the foregoing exposure and development. A sample of 10 g were put in a sample bag and an odor gas in the interior of the sample bag at 120° C. was gathered by use of an odor detector FF-2A (manufactured by Shimazu Seisakusho Co., Ltd., a temperature-raising thermal eliminating concentration method, oxide semiconductor sensor 9) and an equivalent value of odor index was measured. Herein, an equivalent value of odor index is a value to express odor strength and is the dilution ratio, at which the odor cannot be smelled, expressed in common logarithm multiplied by 10.

<Abrasion Evaluation>

Abrasion on the surface (the protective layer surface, the back-coat layer surface) of prepared samples was evaluated by visual observation. The evaluation was performed in 5-steps based on the following criteria.

A: No abrasion is observed.
B: Very slight abrasion is observed.
C: Slight abrasion is observed.
D: Abrasion is observed.
E: Considerably strong abrasion is observed.

TABLE 5

| Sample No. | Type and amount (g) of photosensitive silver halide emulsion | Type and amount (g) of reducing agent represented by general formula (1) | Type and amount (g) of reducing agent represented by general formula (2) | Binder amount (g) in photosensitive layer | Dry layer thickness (μm) of photosensitive layer | Total* dry layer thickness (μm) | Binder in Protective layer |
|---|---|---|---|---|---|---|---|
| 101 | A2/B2 = 36.2/9.1 | (1-1) = 4.20 | (2-6) = 23.78 | 14.57 | 15.0 | 18.0 | L-30 |
| 102 | A3/B2 = 36.2/9.1 | (1-1) = 4.20 | (2-6) = 23.78 | 14.57 | 15.0 | 18.0 | L-30 |
| 103 | A3/B2 = 36.2/9.1 | (1-7) = 4.20 | (2-6) = 23.78 | 14.57 | 15.0 | 18.0 | L-30 |
| 104 | A3/B2 = 36.2/9.1 | (1-10) = 4.20 | (2-6) = 23.78 | 14.57 | 15.0 | 18.0 | L-30 |
| 105 | A3/B2 = 36.2/9.1 | (1-10) = 4.20 | (2-6) = 23.78 | 14.57 | 15.0 | 18.0 | L-70 |
| 106 | A3/B2 = 36.2/9.1 | (1-10) = 4.20 | (2-6) = 23.78 | 14.57 | 17.0 | 20.0 | L-50 |
| 107 | A3/B2 = 36.2/9.1 | (1-10) = 4.20 | (2-6) = 23.78 | 16.03 | 17.0 | 20.0 | L-30 |
| 118 | A3/B2 = 36.2/9.1 | (1-10) = 4.20 | (2-6) = 23.78 | 14.57 | 15.0 | 18.0 | PVA-505 |
| 109 | A3/B2 = 36.2/9.1 | (1-10) = 4.20 | (2-6) = 23.78 | 14.57 | 15.0 | 18.0 | IL-30 |
| 110 | A3/B2 = 36.2/9.1 | (1-10) = 4.20 | (2-6) = 23.78 | 14.57 | 15.0 | 18.0 | L-30 |
| 111 | A3/B2 = 36.2/9.1 | (1-10) = 4.20 | (2-6) = 23.78 | 14.57 | 15.0 | 18.0 | L-30 |
| 112 | A1/B1 = 36.2/9.1 | (1-1) = 4.20 | (2-6) = 23.78 | 14.57 | 15.0 | 18.0 | L-30 |
| 113 | A1/B1 = 36.2/9.1 | (1-1) = 4.20 | (2-6) = 23.78 | 16.03 | 19.0 | 22.0 | CAP |
| 114 | A1/B1 = 36.2/9.1 | (1-1) = 4.20 | (2-6) = 23.78 | 20.40 | 17.0 | 20.0 | L-30 |
| 115 | A1/B1 = 36.2/9.1 | (1-1) = 4.20 | (2-6) = 23.78 | 9.00 | 17.0 | 20.0 | CAP |
| 116 | A1/B1 = 36.2/9.1 | (1-1) = 4.20 | (2-6) = 23.78 | 14.57 | 15.0 | 18.0 | CAB |
| 117 | A1/B1 = 36.2/9.1 | (1-1) = 4.20 | (2-6) = 23.78 | 14.57 | 15.0 | 18.0 | L-30 |
| 118 | A1/B1 = 36.2/9.1 | (1-1) = 4.20 | (2-6) = 23.78 | 14.57 | 15.0 | 18.0 | L-30 |
| 119 | A1/B1 = 36.2/9.1 | (1-1) = 4.20 | (2-6) = 23.78 | 20.40 | 17.0 | 20.0 | L-30 |
| 120 | A1/B1 = 36.2/9.1 | (1-1) = 4.20 | (2-6) = 23.78 | 9.00 | 17.0 | 20.0 | L-30 |

| Sample No. | EC surface | BC surface | Processing speed | Heating Time (sec.) | *1 | *2 | Heating Time (sec.) | Running test result | Equivalent value of odor index | Abrasion | Remarks |
|---|---|---|---|---|---|---|---|---|---|---|---|
| 101 | Open | Heated | Rapid processing | 10 | 0.35 | 0.035 | 10 | B | 36.7 | B | Invention |
| 102 | Open | Heated | Rapid processing | 10 | 0.32 | 0.028 | 10 | A | 35.5 | A | Invention |
| 103 | Open | Heated | Rapid processing | 10 | 0.32 | 0.024 | 10 | A | 33.7 | A | Invention |
| 104 | Open | Heated | Rapid processing | 10 | 0.22 | 0.021 | 10 | A | 35.9 | A | Invention |
| 105 | Open | Heated | Rapid processing | 10 | 0.31 | 0.031 | 10 | B | 38.9 | A | Invention |
| 106 | Open | Heated | Rapid processing | 10 | 0.27 | 0.031 | 10 | A | 35.8 | B | Invention |
| 107 | Open | Heated | Rapid processing | 10 | 0.38 | 0.035 | 10 | B | 39.1 | B | Invention |
| 108 | Open | Heated | Rapid processing | 10 | 0.32 | 0.034 | 10 | B | 37.9 | B | Invention |
| 109 | Open | Heated | Rapid processing | 10 | 0.29 | 0.035 | 10 | B | 38.5 | C | Invention |
| 110 | Open | Heated | Rapid processing | 10 | 0.32 | 0.038 | 10 | B | 38.4 | C | Invention |
| 111 | Open | Heated | Rapid processing | 10 | 0.31 | 0.031 | 10 | B | 37.9 | B | Invention |
| 112 | Open | Heated | Rapid processing | 10 | 0.33 | 0.031 | 10 | B | 38.4 | A | Invention |
| 113 | Open | Heated | Rapid processing | 10 | 0.36 | 0.057 | 10 | C | 39.4 | C | Invention |

TABLE 5-continued

| | | | | | | | | | | | |
|---|---|---|---|---|---|---|---|---|---|---|---|
| 114 | Open | Heated | Rapid processing | 10 | 0.42 | 0.037 | 10 | C | 39.7 | C | Invention |
| 115 | Open | Heated | Rapid processing | 10 | 0.52 | 0.048 | 10 | D | 45.2 | D | Comparison |
| 116 | Heated | Open | Rapid processing | 10 | 0.55 | 0.061 | 10 | D | 47.1 | D | Comparison |
| 117 | Heated | Open | Ordinary processing | 14 | 0.33 | 0.031 | 14 | E | 47.3 | E | Reference |
| 118 | Open | Heated | Ordinary processing | 14 | 0.33 | 0.031 | 14 | D | 42.1 | D | Reference |
| 119 | Open | Heated | Ordinary processing | 14 | 0.42 | 0.037 | 14 | D | 43.1 | D | Reference |
| 120 | Open | Heated | Ordinary processing | 14 | 0.52 | 0.048 | 14 | E | 47.2 | E | Reference |

Total*: Total of a photosensitive layer and a photosensitive layer protective layer (upper layer/lower layer)
*1: A weight loss value from 25° C. to 100° C. of an undeveloped film/weight value at 25° C. (%)
*2: A weight loss value from 100° C. to 125° C. of an undeveloped film/weight value at 25° C. (%)

CAP (CAP 141-20, cellulose acetate propionate, having a glass transition temperature Tg of 190° C., manufactured by Eastman Chemical Co.)

CAB (CAB 171-15, cellulose acetate butyrate, having a glass transition temperature Tg of 161° C., manufactured by Eastman Chemical Co.)

L-30, 50, 70 (cellulose acetate, manufactured by Daicel Chemical Industries Ltd.)

PVA-505 (polyvinyl alcohol, manufactured by Kuraray Corp.)

It is clear from Table 5 that samples of this invention, compared to the comparative samples, exhibit less contamination in the interior of an imager, a lower level in odor, as well as higher abrasion resistance. Further, comparing the case of EC surface open and BC surface heated with the case of BC surface open and EC surface heated, it is clear from the results of samples 112 and 116, and of samples 117 and 118, the improvement effect by setting EC surface open and BC surface heated is larger when a heating time is set to 10 seconds compared to when a heating time is set to 14 seconds.

What is claimed is:

1. A photothermographic imaging material comprising a support having thereon:

(a) a photosensitive layer containing an organic silver salt, photosensitive silver halide grains, a reducing agent and a binder, (b) a light-insensitive layer, and (c) a protective layer, wherein a weight reducing value from 25° C. to 100° C. by a heat drying weight measurement of the photographic imaging material is not more than 0.4% based on a weight value at 25° C.

2. The photothermographic imaging material of claim 1, wherein the weight reducing value from 100° C. to 120° C. by the heat drying weight measurement of the photographic imaging material is not more than 0.04% based on the weight value at 25° C.

3. The photothermographic imaging material of claim 1, wherein the light-insensitive layer comprises a cross-linking agent.

4. The photothermographic imaging material of claim 1, wherein the protective layer comprises tabular grains.

5. The photothermographic imaging material of claim 1, wherein the photosensitive silver halide grains are silver halide grains convertible from internal latent-image type grains to surface latent-image type grains after the thermal development process.

6. The photothermographic imaging material of claim 1, exhibiting a total dry thickness of the photosensitive layer and the light-insensitive layer of not less than 10 μm and not more than 20 μm.

7. The photothermographic imaging material of claim 1 exhibiting the total dry thickness of the photosensitive layer of not less than 9 μm and not more than 16 μm.

8. The photothermographic imaging material of claim 1, wherein as silver halide grains, the photosensitive layer contains thermally convertible interior latent-image type silver halide grains surface sensitivity of which is reduced from that of before thermal development by conversion from the surface latent-image type to the interior latent-image type after the thermal development process.

9. The photothermographic imaging material of claim 1, exhibits a relative ratio ($S_2/S_1$) of not more than 1/10, wherein sensitivity $S_1$ is determined from characteristic curves which are obtained by thermal development with common thermal development conditions after exposure of the photothermographic material, exposure being conducted by white light or light of a specific spectral sensitized region through an optical wedge, or by laser light changing illumination intensity on the surface of the photosensitive layer in incremental steps; and sensitivity $S_2$ is determined from characteristic curves which are obtained by thermal development under the same conditions as above thermal development after exposure under the same exposure conditions as above exposure, except that exposure is conducted after heating of the photothermographic material under the same conditions as above thermal development.

10. The photothermographic imaging material of claim 1, wherein in the interior of the silver halide grains, contained are dopants which function as electron traps after thermal development.

11. The photothermographic imaging material of claim 1, wherein a compound represented by Formula (SE1) or Formula (SE2) is incorporated as a silver saving agent:

$$Q_1\text{-NHNH-}Q_2 \qquad \text{Formula (SE1)}$$

wherein $Q_1$ is an aromatic group bonding with —NHNH-$Q_2$ at a carbon atom site or a heterocycle group; $Q_2$ is a carbamoyl group, an acyl group, an alkoxycarbonyl group, an aryloxycarbonyl group, a sulfonyl group or a sulfamoyl group;

Formula (SE2)

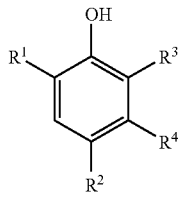

wherein $R^1$ is an alkyl group, an acyl group, an acylamino group, a sufonamide group, an alkoxycarbonyl group, or a carbamoyl group; $R^2$ is a hydrogen atom, a halogen atom, an alkyl group, an alkoxy group, an aryloxy group, an alkylthio group, an arylthio group, an acyloxy group, or ester carbonate; and $R^3$ and $R^4$ are each a substituent group capable of substituting to a benzene ring and may form a condensed ring combining each other.

12. The photothermographic imaging material of claim 1, wherein the photosensitive layer contains a binder exhibiting a glass-transition temperature (Tg) of 70 to 150° C.

13. The photothermographic imaging material of claim 1, wherein a compound represented by Formula (SF) is incorporated:

$$(R_f\text{-}(L_1)n_1\text{-})_p\text{-}(Y)m_1\text{-}(A)_q \qquad \text{Formula (SF)}$$

wherein $R_f$ is a substituent group containing a fluorine atom, $L_1$ is a divalent linking group not containing a fluorine atom, Y is a (p+Q) valent linking group containing no fluorine atom, A is an anion group or its salt, $n_1$ and $m_1$ are each an integer of 0 or 1, p and q are each an integer of 1 to 3, but when q is 1, $n_1$ and $m_1$ are not zero at the same time.

14. The photothermographic imaging material of claim 1, wherein an average grain diameter of the silver halide grains contained in the photosensitive layer is 10 to 50 nm.

15. The photothermographic imaging material of claim 14, wherein the photosensitive layer further contains silver halide grains exhibiting an average grain diameter of 55 to 100 nm.

16. The photothermographic imaging material of claim 1, wherein a portion of the silver halide grains contained in the photosensitive layer is provided with chemical sensitization employing a chalcogen compound.

17. A method of development of the photothermographic imaging material of claim 1 comprising the steps of:

(a) exposing the photothermographic imaging material, and (b) developing the exposed photothermographic material using a thermal development apparatus having a distance from an exposure section to a development section of 0 to 20 cm.

18. A method of thermal development of a photothermographic imaging material of claim 1, further exhibiting a weight reducing value from 25° C. to 100° C. by a heat drying weight measurement of not more than 0.4% based on a weight value at 25° C., comprising the steps of:

(a) exposing the photothermographic material, (b) heating the exposed photothermographic material within a heating time of 0.5 to 10 seconds, and (c) cooling the heated material, wherein a side of the photothermographic material coated with the photosensitive layer is open to the air, and heating is conducted from the opposite side of the photosensitive layer.

19. The method of thermal development of the photothermographic imaging material of claim 1, further exhibiting a weight reducing value from 100 to 120° C. by the heat drying weight measurement of not more than 0.04% based on a weight value at 25° C., comprising the steps of:

(a) exposing the photothermographic material, (b) heating the exposed photothermographic material within a heating time of 0.5 to 10 seconds, and (c) cooling the heated material, wherein a side of the photothermographic material coated with the photosensitive layer is open to the air, and heating is conducted from the side opposite the photosensitive layer.

20. The method of thermal development of the photothermographic imaging material of claim 19, wherein the heated photothermographic material is transferred to a cooling process while the photosensitive layer coated side of the photothermographic material is open to the air.

21. The method of thermal development of the photothermographic imaging material of claim 19, wherein the side opposite the photosensitive layer of the photothermographic material is cooled while the photosensitive layer coated side of the photothermographic material is open to the air.

22. The method of thermal development of the photothermographic imaging material of claim 19, wherein at least an entering portion of a thermal development apparatus, the photosensitive later coated side of the material is open to the air.

23. A thermal development apparatus for the method of thermal development of claim 18 comprising a temperature raising section which heats the photothermographic material to a thermal development temperature and a temperature maintaining section to prevent heat loss of the material, wherein different heating methods are employed in each of the temperature raising section and the temperature maintaining section.

24. The thermal development apparatus of claim 23, wherein the temperature raising section heats the photothermographic material while in contact with a plate heater while pressed by opposed rollers, and the temperature maintaining section keeps the material warm in a slit formed by guides, at least one of which guides has a heater.

25. The thermal development apparatus of claim 23, wherein a slit distance in the temperature maintaining section is 0.5 to 3.0 mm.

26. The thermal development apparatus of claim 23, wherein a slit distance in the temperature maintaining section is 1 to 3 mm.

27. The method of thermal development of the photothermographic imaging material of claim 18, wherein the heated photothermographic material is transferred to a cooling process while the photosensitive layer coated side of the photothermographic material is open to the air.

28. The method of thermal development of the photothermographic imaging material of claim 18, wherein the side opposite the photosensitive layer of the photothermographic material is cooled while the photosensitive layer coated side of the photothermographic material is open to the air.

29. The method of thermal development of the photothermographic imaging material of claim 18, wherein at least an entering portion of a thermal development apparatus, the photosensitive later coated side of the material is open to the air.

* * * * *